US011705294B2

(12) United States Patent
Hsieh et al.

(10) Patent No.: US 11,705,294 B2
(45) Date of Patent: Jul. 18, 2023

(54) INPUT DEVICE AND KEY STRUCTURE THEREOF

(71) Applicant: Darfon Electronics Corp., Taoyuan (TW)

(72) Inventors: Yu-Chun Hsieh, Taoyuan (TW); Ling-Hsi Chao, Taoyuan (TW); Shao-Lun Hsiao, Taoyuan (TW); Chen Yang, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/841,795

(22) Filed: Jun. 16, 2022

(65) Prior Publication Data

US 2022/0406539 A1 Dec. 22, 2022

(51) Int. Cl.

| | |
|---|---|
| ***H01H 13/20*** | (2006.01) |
| ***H01H 13/14*** | (2006.01) |
| ***H01H 13/10*** | (2006.01) |
| ***H01H 13/70*** | (2006.01) |

(52) U.S. Cl.

CPC ..... *H01H 13/20* (2013.01); *H01H 13/10* (2013.01); *H01H 13/14* (2013.01); *H01H 13/70* (2013.01); *H01H 2215/03* (2013.01)

(58) Field of Classification Search

CPC ..... H01H 3/125; H01H 13/705; H01H 13/04; H01H 13/20; H01H 13/70; H01H 13/14; H01H 13/704; H01H 13/7065; H01H 13/7006; H01H 13/7057; H01H 13/78; H01H 13/79; H01H 13/52; H01H 13/703; H01H 13/507

See application file for complete search history.

(56) References Cited

U.S. PATENT DOCUMENTS

| | | | | |
|---|---|---|---|---|
| 4,642,433 | A * | 2/1987 | Murata | H01H 13/50 200/521 |
| 7,442,894 | B2 | 10/2008 | Villain et al. | |
| 10,259,384 | B2 | 4/2019 | Teng et al. | |
| 10,515,508 | B2 | 12/2019 | Brandau | |
| 2016/0351349 | A1 | 12/2016 | Chen et al. | |

(Continued)

FOREIGN PATENT DOCUMENTS

| | | | |
|---|---|---|---|
| CN | 101320646 | A | 12/2008 |
| CN | 100530061 | C | 8/2009 |

(Continued)

*Primary Examiner* — Ahmed M Saeed

(74) *Attorney, Agent, or Firm* — McClure, Qualey & Rodack, LLP

(57) ABSTRACT

A key structure includes a base, a movable mechanism movably positioned on the base, a sound generating member positioned on the base, and an adjusting unit movable relative to the base to be at a first position or a second position. The sound generating member has a hitting portion, which extends corresponding to an impact surface. When the adjusting unit is at the first position, and a pressing force is applied to the movable mechanism, the movable mechanism moves relative to the base and drives the sound generating member to move, so the hitting portion moves to hit the impact surface to generate a hitting sound. When the adjusting unit is at the second position, the adjusting unit restricts movement of the hitting portion, so the hitting portion cannot move to hit the impact surface.

20 Claims, 78 Drawing Sheets

(56) References Cited

U.S. PATENT DOCUMENTS

| | | | | |
|---|---|---|---|---|
| 2017/0213663 | A1* | 7/2017 | Jhuang | H01H 3/125 |
| 2017/0330704 | A1* | 11/2017 | Chen | H03K 17/967 |
| 2018/0190446 | A1* | 7/2018 | Chen | H01C 10/10 |

FOREIGN PATENT DOCUMENTS

| | | | |
|---|---|---|---|
| CN | 101025668 | B | 8/2010 |
| CN | 104576141 | A | 4/2015 |
| CN | 104681337 | A | 6/2015 |
| CN | 104599884 | B | 11/2016 |
| CN | 106648177 | A | 5/2017 |
| CN | 209015959 | U | 6/2019 |
| CN | 209282108 | U | 8/2019 |
| CN | 113053686 | A | 6/2021 |
| EP | 0693761 | A1 | 1/1996 |
| TW | 201624203 | A | 7/2016 |
| TW | 201801115 | A | 1/2018 |
| TW | 201802643 | A | 1/2018 |
| TW | 201905650 | A | 2/2019 |
| TW | 202004804 | A | 1/2020 |
| TW | 202009961 | A | 3/2020 |
| TW | I687849 | B | 3/2020 |
| TW | I699799 | B | 7/2020 |
| WO | 2020261664 | A1 | 12/2020 |

* cited by examiner

1B"

INPUT DEVICE AND KEY STRUCTURE THEREOF

BACKGROUND OF THE INVENTION

1. Field of the Invention

The invention generally relates to an input device and a key structure thereof. Particularly, the invention relates to an input device and a key structure capable of switching between an audible operation and a silent operation.

2. Description of the Prior Art

The tactile feedbacks of a keyswitch generally include a tactile feedback or a linear feedback. In addition to the tactile feedback, the sound of the keyswitch is also an important factor affecting the user's operating experience. Current silencing designs of the keyswitch mostly utilize cushion materials (e.g. soft materials) as a contact stopper to achieve the silencing effect. However, even if the cushion materials are used, sound is still generated due to contact or collision, so the silencing effect cannot be satisfied.

Moreover, the silencing design of using the cushion materials generally does not provide a function of switching between the silent operation and the audible operation. Therefore, users cannot select the silent operation or the audible operation according to preference.

SUMMARY OF THE INVENTION

It is an object of the invention to provide an input device and a key structure thereof, which provide silent and audible operation feedbacks for the users to choose to meet the users' operation requirements.

It is another object of the invention to provide an input device and a key structure, which utilize the displacement limitation of the linkage mechanism to achieve the pressing stop point, enhancing the silencing effect by reducing the sound caused by collision.

In an embodiment, the invention provides a key structure including a base, a movable mechanism movably positioned on the base, a sound generating member positioned on the base, and an adjusting unit movable relative to the base to be at a first position or a second position. The sound generating member has a hitting portion extending corresponding to an impact surface. When the adjusting unit is at the first position, and a pressing force is applied to the movable mechanism, the movable mechanism moves relative to the base and drives the sound generating member to move, so the hitting portion moves to hit the impact surface to generate a hitting sound. When the adjusting unit is at the second position, the adjusting unit restricts movement of the hitting portion, so the hitting portion cannot move to hit the impact surface.

In an embodiment, the movable mechanism includes a linkage mechanism including a plurality of linking members coupled with each other. At least one of the plurality of linking members is rotatably positioned on the base. When the pressing force is applied to the movable mechanism, the plurality of linking members move associated with each other to restrict a moving range of the plurality of linking members relative to the base.

In an embodiment, the plurality of linking members include a first linking member and a second linking member. The first linking member has a first pivoting portion, and the first linking member couples with the base through the first pivoting portion to form a first rotation axis. The second linking member has a second pivoting portion, and the second linking member couples with the base through the second pivoting portion to form a second rotation axis. The first linking member couples with the second linking member to form a coupling axis. When the pressing force is applied to the first linking member, the first linking member rotates about the first rotation axis along a first direction to drive the coupling axis to move relative to the base, so the second linking member is driven to rotate about the second rotation axis along a second direction. The first direction and the second direction are a same direction or different directions.

In an embodiment, the first linking member has a first connecting portion connected to the first pivoting portion and located at one end of the first linking member. The second linking member has a second connecting portion connected to the second pivoting portion and located at one end of the second linking member. The first connecting portion and the second connecting portion couple with each other to form the coupling axis.

In an embodiment, the sound generating member includes a torsion spring having a spring body, a contacting portion, and the hitting portion. The spring portion is positioned on the base. The contacting portion and the hitting portion extend from two opposite ends of the spring body, and the contacting portion is adapted to touch against the movable mechanism.

In an embodiment, when the adjusting unit is at the first position, and the movable mechanism moves relative to the base, the movable mechanism drives the contacting portion to move to rotate the spring body, so the hitting portion is driven to hit the impact surface.

In an embodiment, when the adjusting unit is at the second position, and the movable mechanism moves relative to the base, the movable mechanism drives the contacting portion to move, and the spring body and the hitting portion are substantially immovable.

In an embodiment, the key structure further includes a magnet disposed corresponding to the hitting portion. When the adjusting unit is at the first position, and the pressing force is not applied to the movable mechanism, a magnetic attraction force is generated between the magnet and the hitting portion to maintain a moving space between the hitting portion and the impact surface.

In an embodiment, the impact surface is an extension surface of the base. The magnet is disposed on the base. The base has a channel located between the magnet and the extension surface to serve as the moving space. The hitting portion is allowed to move along the channel to hit the impact surface.

In an embodiment, the key structure further includes a magnetic unit. The magnetic unit includes a first magnetic member disposed on the movable mechanism and a second magnetic member disposed corresponding to the first magnetic member to generate a magnetic attraction force. When the pressing force is applied to the movable mechanism, the movable mechanism drives the first magnetic member away from the second magnetic member. When the pressing force is released, the magnetic attraction force enables the movable mechanism to move with the first magnetic member toward the second magnetic member to a position before the pressing force is applied.

In an embodiment, the adjusting unit includes a blocking portion. When the adjusting unit is at the first position, the blocking portion does not interfere with the sound generating member. When the adjusting unit is at the second position, the blocking portion interferes with the sound generating member to restrict the hitting portion to move relative to the impact surface.

In an embodiment, when the adjusting unit is at the second position, the blocking portion abuts below the hitting portion to restrict the hitting portion to move relative to the impact surface.

In an embodiment, when the adjusting unit is at the second position, the blocking portion presses the hitting portion against the impact surface, so the hitting portion contacts the impact surface.

In an embodiment, the adjusting unit is movably positioned on the base to be at the first position or the second position relative to the hitting portion.

In an embodiment, the adjusting unit includes a support plate disposed below the base, a movable portion supported by the support plate to be movable relative to the base, and a blocking portion rotatably positioned on the support plate and coupling the movable portion. When the movable portion moves relative to the base, the movable portion drives the blocking portion to rotate, so the blocking portion interferes or does not interfere with the hitting portion.

In an embodiment, when the movable portion moves relative to the base to be at the first position, the blocking portion does not interfere with the hitting portion. when the movable portion moves relative to the base to be at the second position, the movable portion drives the blocking portion to rotate and interfere with the hitting portion to restrict the hitting portion to move relative to the impact surface.

In an embodiment, when the movable portion moves relative to the base to be at the second position, the blocking portion abuts below the hitting portion to restrict the hitting portion to move relative to the impact surface.

In an embodiment, when the movable portion moves relative to the base to be at the second position, the blocking portion presses the hitting portion against the impact surface, so the hitting portion contacts the impact surface.

In an embodiment, the adjusting unit further includes a positioning unit. The movable portion is positioned at the first position or the second position by the positioning unit.

In an embodiment, the positioning unit includes a movable portion magnetic member disposed on the movable portion and a support plate magnetic member disposed on the support plate. A magnetic attraction force is generated between the movable portion magnetic member and the support plate magnetic member.

In another embodiment, the invention provides an input device including a housing, a plurality of key structures described above disposed in the housing, and a movable frame movably disposed in the housing. The movable frame has a plurality of engaging portions corresponding to the plurality of key structures, so the adjusting unit of each of the plurality of key structures engages with a corresponding one of the plurality of engaging portions. When the movable frame moves relative to the housing, the movable frame drives the adjusting unit of each of the plurality of key structures to move, so the plurality of key structures provide an audible operation feedback or a silent operation feedback.

In an embodiment, the housing has a hole, and the movable frame has an operating part. The operating part is exposed from the hole for a user to operate to move the movable frame.

In an embodiment, the input device further includes a first positioning unit and a second positioning unit. The movable frame is positioned by the first positioning unit or the second positioning unit to position each of the adjusting units at the first position or the second position.

In an embodiment, each of the first positioning unit and the second positioning unit includes a movable frame magnetic member disposed on the movable frame and a housing magnetic member disposed on the housing. A magnetic attraction force is generated between the movable frame magnetic member and the housing magnetic member.

Compared with the prior art, the input device and the key structure of the invention provide silent and audible operation feedbacks for the users to choose, so as to meet the users' operation expectation in different situations. Moreover, the input device and the key structure can utilize the displacement limitation of the linkage mechanism to reduce the sound caused by collision during movement of components of the key structure.

BRIEF DESCRIPTION OF THE DRAWINGS

FIG. 2A to FIG. 2C are operation views of the key structure of FIG. 1C, wherein FIG. 2A to FIG. 2C show that the key structure are in the non-pressed state, the transition state, and the pressing stop state, respectively.

FIG. 5A to FIG. 5C are operation views of the key structure of FIG. 4C, wherein FIG. 5A to FIG. 5C show that the key structure are in the non-pressed state, the transition state, and the pressing stop state, respectively.

FIG. 7A and FIG. 7B are operation views of the key structure of FIG. 6B, wherein FIG. 7A and FIG. 7B show that the key structure are in the non-pressed state and the pressing stop state, respectively.

FIG. 9A to FIG. 9C are operation views of the key structure of FIG. 8B, wherein FIG. 9A to FIG. 9C show that the key structure are in the non-pressed state, the transition state, and the pressing stop state, respectively.

FIG. 11A and FIG. 11B are variant operation views of the key structure of FIG. 8B, wherein FIG. 11A and FIG. 11B show that the key structure are in the non-pressed state and the pressing stop state, respectively.

FIG. 13A and FIG. 13B are operation views of the key structure of FIG. 12B, wherein FIG. 13A and FIG. 13B show that the key structure are in the non-pressed state and the pressing stop state, respectively.

FIG. 15A and FIG. 15B are operation views of the key structure of FIG. 14, wherein FIG. 15A and FIG. 15B show that the key structure are in the non-pressed state and the pressing stop state, respectively.

FIG. 17A and FIG. 17B are operation views of the key structure of FIG. 16B, wherein FIG. 17A and FIG. 17B show that the key structure are in the non-pressed state and the pressing stop state, respectively.

DETAILED DESCRIPTION OF THE PREFERRED EMBODIMENT

The invention provides a key structure, which can be applied to any pressing type input device (e.g. mouse, keyboard) or integrated to any suitable electronic devices (e.g. keybuttons or keyboard equipped in portable devices), to reduce the abnormal sound generated during the pressing operation and to provide the click feedback of the pressing operation. Hereinafter, the structure and operation of the key structure of the invention will be described in detail with reference to the drawings.

Figure 1A:
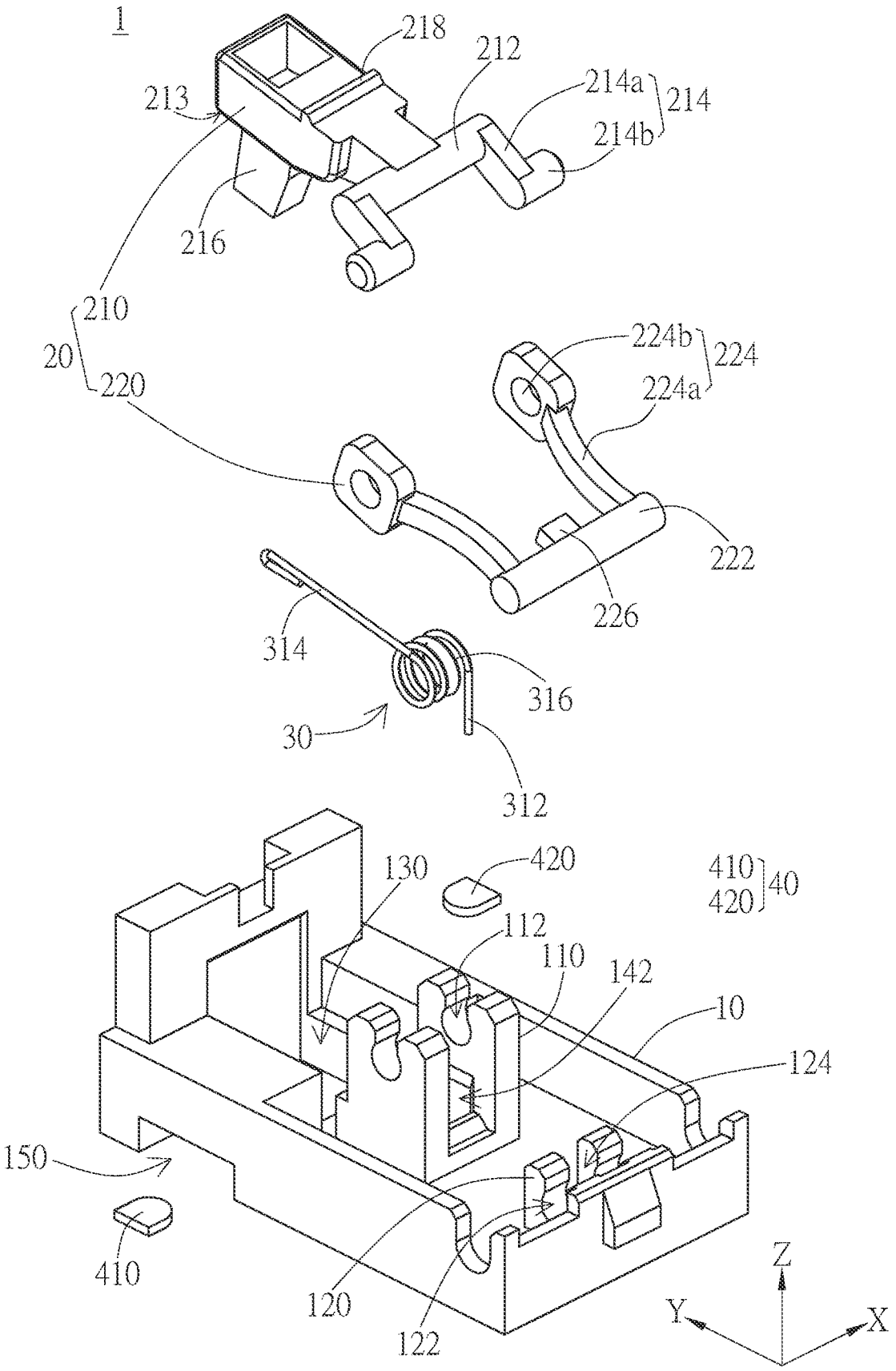
FIG. 1A to FIG. 1C are an exploded view, a partially exploded view, and an assembled view of the key structure in a first embodiment of the invention, respectively.
Figure 1B:
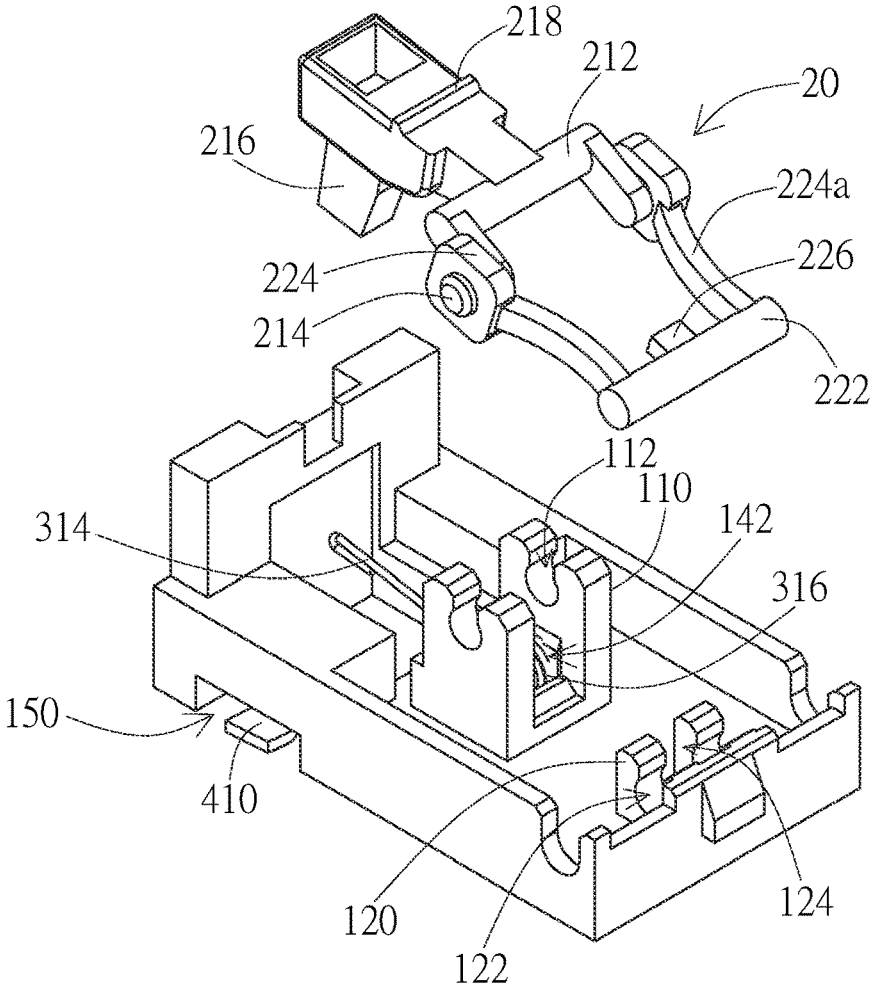
Figure 1C:
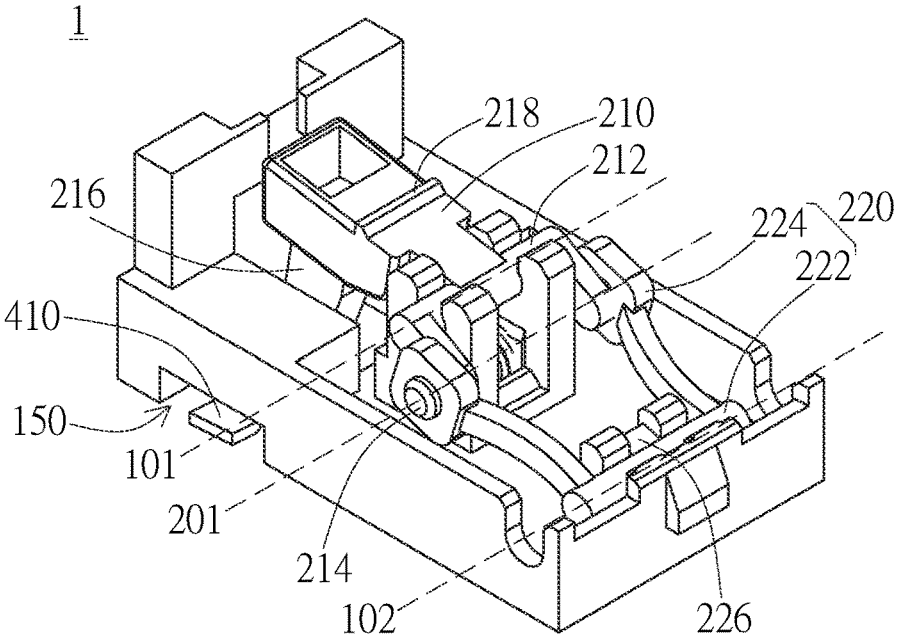

FIG. 1A to FIG. 1C are an exploded view, a partially exploded view, and an assembled view of the key structure 1 in a first embodiment of the invention, respectively. As shown in FIG. 1A to FIG. 1C, in this embodiment, the key structure 1 includes a base 10 and a linkage mechanism 20. The linkage mechanism 20 includes a plurality of linking members, and the plurality of linking members are movably coupled with each other. The plurality of linking members includes at least two linking members (e.g. a first linking member 210 and a second linking member 220), which are rotatably positioned on the base 10, respectively. When a pressing force is applied to the linkage mechanism 20 (e.g. to the first linking member 210), the plurality of linking members move associated with each other to restrict a moving range of the plurality of linking members relative to the base 10.

Specifically, the base 10 is a component adapted to position the linkage mechanism 20 and has a structure for coupling the plurality of linking members, so at least two linking members of the plurality of linking members can be rotatably positioned on the base 10. As shown in the drawings, the base 10 has a first coupling portion 110 and a second coupling portion 120. The first linking member 210 and the second linking member 220 rotatably couple with the first coupling portion 110 and the second coupling portion 120, respectively. For example, the base 10 and the linking member (e.g. first linking member 210, second linking member 220) can rotatably couple with each other through the coupling mechanism of a pivot and a pivotal hole. In other words, one of the base 10 and the linking member (e.g. 210, 220) has a pivot structure, and the other of the base 10 and the linking member (e.g. 210, 220) has a corresponding pivotal hole, so the base 10 and the linking member can rotatably couple with each other. In this embodiment, each of the first coupling portion 120 and the second coupling portion 120 has a coupling hole structure, such as holes 112, 122, and the linking member (e.g. each of the first linking member 210 and the second linking member 220) has a corresponding pivot structure, but not limited thereto. In other embodiments, according to practical applications, the locations of the pivotal hole and the pivot can be interchanged. For example, each of the first coupling portion 120 and the second coupling portion 120 can have a pivot structure, and the linking member (e.g. each of the first linking member 210 and the second linking member 220) has a corresponding pivotal hole structure. In this embodiment, the first coupling portion 110 and the second coupling portion 120 are arranged along the Y-axis direction and apart from each other. The first coupling portion 110 includes two pivotal holes 112, which are arranged along the X-axis direction and apart from each other, so an accommodation space 142 is defined between the two pivotal holes 112 of the first coupling portion 110. The second coupling portion 120 includes two pivotal holes 122, which are arranged along the X-axis direction and apart from each other, so a positioning space 124 is defined between the two pivotal holes 122 of the second coupling portion 120. The height of the first coupling portion 110 extending upward from the bottom of the base 10 (i.e., the distance between the pivotal hole 112 and the bottom of the base 10) is larger than the height of the second coupling portion 120 extending upward from the bottom of the base 10 (i.e., the distance between the pivotal hole 122 and the bottom of the base 10). In other words, in the Z-axis direction, the height of the first coupling portion 110 is larger than the height of the second coupling portion 120. Moreover, the bottom of the base 10 can be formed with an opening 130, which is adapted to allow a portion of the linkage mechanism 20 (e.g. the first linking member 210) to extend thereinto. The base 10 can further include a positioning mechanism, which is disposed corresponding to a restoring member 30 (described later). The positioning mechanism can be the accommodation space 142, a positioning hole 144 (shown in FIG. 2A), which is adapted to accommodate or position the restoring member 30.

Figure 12A:
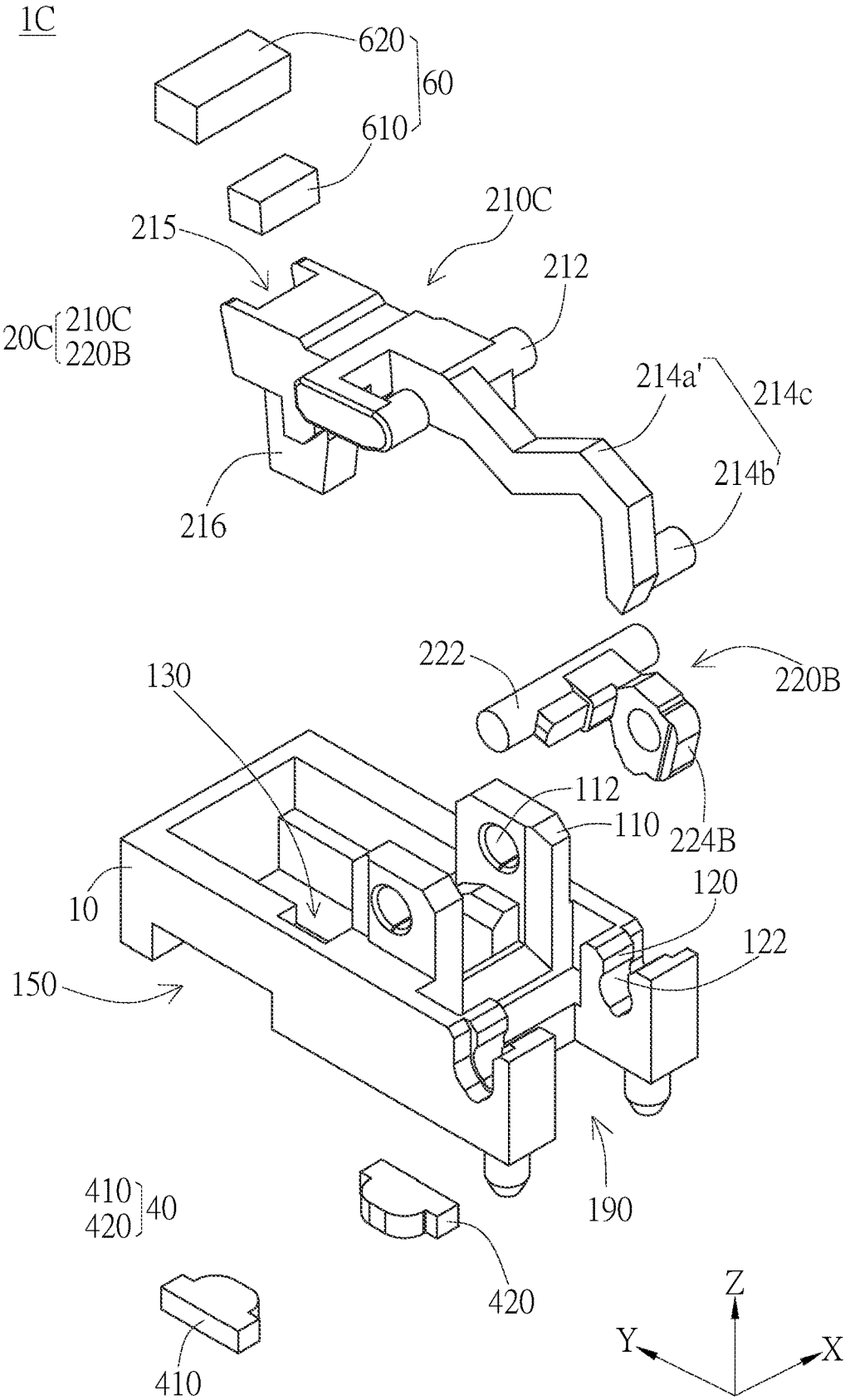
FIG. 12A and FIG. 12B are an exploded view and an assembled view of the key structure in a sixth embodiment of the invention.

In this embodiment, the plurality of linking members of the linkage mechanism 20 can include the first linking member 210 and the second linking member 220. The first linking member 210 and the second linking member 220 are rotatably positioned on the base 10, respectively, but not limited thereto. In other embodiments, the linkage mechanism 20 can include two or more linking members, and at least two linking members of the plurality of linking members are rotatably positioned on the base 10. As such, in response to the pressing force, the plurality of linking members can move associated with each other to restrict the moving range or the rotation range of the plurality of linking members relative to the base 10. For example, corresponding to the first coupling portion 110 and the second coupling portion 120 of the base 10, the first linking member 210 can have a first pivoting portion 212, and the second linking member 220 can have a second pivoting portion 222. The first linking member 210 couples with the base 10 (e.g. the first coupling portion 110) through the first pivoting portion 212 to form a first rotation axis 101, and the second linking member 220 couples with the base 10 (e.g. the second coupling portion 120) through the second pivoting portion 212 to form a second rotation axis 102. As such, the first linking member 210 and the second linking member 220 are rotatably positioned on or engage with the base 10 and can rotate about the first rotation axis 101 and the second rotation axis 102, respectively. As described above, in the Z-axis direction, the height of the first coupling portion 110 is larger than the height of the second coupling portion 120, so the first rotation axis 101 is higher than the second rotation axis 102 in Z-axis direction. Moreover, in this embodiment, adjacent ends of the first linking member 210 and the second linking member 220 couple with each other to form a coupling axis 201, so the first linking member 210 can drive the second linking member 220 to move. In the connection direction of the first linking member 210 and the second linking member 220 (e.g. the Y-axis direction), the coupling axis 201 is located between the first rotation axis 101 and the second rotation axis 102. When the first linking member 210 moves (or rotates) with respect to the base 10, the first linking member 210 can drive the second linking member 220 to move (or rotate) in an opposite direction with respect to the base 10, and in response to the rotations of the first linking member 210 and the second linking member 220, the coupling axis 201 can move relative to the base 10 (in the up-down direction), but not limited thereto. According to practical applications, the coupling position of the two linking members can be modified, so the two linking members can move (or rotate) in the same direction with respect to the base 10 (as shown in the embodiment of FIG. 12A). In addition, the coupling position (e.g. the coupling axis 201) of the linking members are not limited to be between the two rotation axes (e.g. the first rotation axis 101 and the second rotation axis 102) (as shown in the embodiment of FIG. 12A). Moreover, according to the pressing position (i.e., where the pressing force is applied), the coupling axis 201 can move toward the base 10 or away from the base 10 after the linkage mechanism is pressed.

Specifically, the first linking member 210 includes a first connecting portion 214, and the second linking member 220 includes a second connecting portion 224. The first linking member 210 and the second linking member 220 movably couple with each other through the first connecting portion 214 and the second connecting portion 224 to form the linkage mechanism 20. For example, the first connecting portion 214 and the second connecting portion 224 are adjacent ends of the first linking member 210 and the second linking member 220. The first linking member 210 and the second linking member 220 can movably couple with each other through the coupling mechanism of pivot and pivotal hole. In other words, one of the first linking member 210 and the second linking member 220 has a pivot structure, and the other of the first linking member 210 and the second linking member 220 has a corresponding pivotal hole structure, so two adjacent ends of the first linking member 210 and the second linking member 220 can movably couple with each other. In this embodiment, the first connecting portion 214 has a pivot, and the second connecting portion 224 has a corresponding pivotal hole, so the first connecting portion 214 and the second connecting portion 224 couple with each other to form the coupling axis 201, but not limited thereto. In other embodiments, according to practical applications, the locations of the pivot and the pivotal hole can be interchanged. For example, the first connecting portion 214 can have a pivotal hole, and the second connecting portion 224 has a corresponding pivot.

As shown in FIG. 1A to FIG. 1C, the first connecting portion 214 of the first linking member 210 is connected to the first pivoting portion 212 and located at one side of the first linking member 210 (e.g. righthand side). The second connecting portion 224 of the second linking member 220 is connected to the second pivoting portion 222 and located at one side of the second linking member 220 (e.g. lefthand side), so the second connecting portion 224 is adjacent to the first connecting portion 214 of the first linking member 210. In other words, the first linking member 210 and the second linking member 220 couple with each other through the first connecting portion 214 and the second connecting portion 224, which are adjacent to each other and movably couple with each other. Specifically, the first pivoting portion 212 of the first linking member 210 is a pivot shaft disposed along the X-axis direction, and the first connecting portion 214 includes a first connection section 214*a* and a pivot 214*b*. For example, two first connection sections 214*a* are preferably disposed along the X-axis direction at two opposite ends of the first pivoting portion 212, i.e., the two first connection sections 214*a* are disposed along the first rotation axis 101 and apart from each other. The two first connection sections 214*a* extend from the first pivoting portion 212 along the Y-axis direction by a predetermined distance. The pivot 214*b* is disposed on the distal end of each first connection section 214*a* and away from the first pivoting portion 212. In this embodiment, the two pivots 214*b* extend toward the outer side of the first connection sections 214*a* along the X-axis direction, so the two pivot 214*b* extend away from each other, but not limited thereto. According to practical applications, the two pivots 214*a* can extend toward the inner side of the first connection sections 214*a* along the X-axis direction, so the two pivots 214*b* extend toward each other. In another embodiment, the two pivots 214*b* can extend toward the inner side and the outer side along the X-axis direction, respectively, so the two pivots 214*b* extend toward the same direction. In an embodiment, the first connecting portion 214 preferably extends inclinedly outward with respect to the first pivoting portion 212. For example, the two first connection sections 214*a* of the first connecting portion 214 extend downward from the first pivoting portion 212 and are inclined outward with respect to the Y-axis direction, so the extending directions of the first connecting portion 214 and the first pivoting portion 212 are not coplanar.

The first linking member 210 can be an actuating linking member, which receives the pressing force to trigger the switch unit (e.g. 40). Specifically, the first linking member 210 can include an actuating portion 216. When the first linking member 210 rotates with respect to the base 10, the actuating portion 216 moves to trigger the switch unit. For example, the actuating portion 216 can be disposed on another side of the first pivoting portion 212 opposite to the first connecting portion 214. The actuating portion 216 preferably extends downward with respect to the first pivoting portion 212. In other words, the actuating portion 216 and the first connecting portion 214 are located at two opposite sides of the first pivoting portion 212 in the Y-axis direction. The actuating portion 216, the first pivoting portion 212, and the first connecting portion 214 are sequentially disposed along the Y-axis direction. When the first linking member 210 rotates about the first rotation axis 101 formed by the first pivoting portion 212, the actuating portion 216 and the first connecting portion 214 move in opposite directions with respect to the base 10. For example, with respect to the first pivoting portion 212, when the pressing force is applied to the side of the first linking member 210 having the actuating portion 216 disposed thereon, the actuating portion 216 moves downward toward the base 10, and the first connecting portion 214 moves upward away from the base 10. The first linking member 210 can optionally include a positioning portion 218 to define the position to which the pressing force is applied. In this embodiment, the positioning portion 218 can be a rib or bump, which protrudes from the upper surface of the first linking member 210. A predetermined distance is defined between the positioning portion 218 and the first pivoting portion 212 to define the position of the force-applying operation member 50 (shown in FIG. 2A), but not limited thereto. In other embodiments (not shown), the positioning portion 218 can be implemented as a groove on the first linking member 210, so the operation member 50 can be positioned in the groove.

Corresponding to the shape of the first connecting portion 214 of the first linking member 210, the second linking member 220 can include two second connection sections 224*a* and two pivotal holes 224*b*. For example, the two second connection sections 224*a* disposed along the X-axis direction at two opposite ends of the second pivoting portion 222, i.e., the two second connection sections 224*a* are disposed along the second rotation axis 102 and apart from each other. The two second connection sections 224*a* extend from the second pivoting portion 222 along the Y-axis direction by a predetermined distance. The pivotal holes 224*b* is disposed on the distal end of each second connection section 224*a* and away from the second pivoting portion 222. The two pivotal holes 224*b* are preferably aligned with each other along the X-axis direction. By inserting the pivots 214*b* into the corresponding pivotal holes 224*b*, the two second connection sections 224*a* respectively couple the two first connection sections 214*a*, so the first connecting portion 214 is movably connected to the second connecting portion 224. In this embodiment, the second connection sections 224*a* preferably have a curved shape. When the first linking member 210 drives the second linking member 220 to move, the second connection sections 224*a* can elastically deform. Moreover, the second linking member 220 can optionally have a restricting portion 226, and the restricting portion 226 can be a protrusion or a bump protruding from the second pivoting portion 222. For example, the restricting portion 226 can be located between the two second connection sections 224*a* and protrudes from the second pivoting portion 222 corresponding to the positioning space 124 of the base 10.

The key structure 1 can further include a restoring member 30 and a switch unit 40. The restoring member 30 is adapted to provide a restoring force to enable the linkage mechanism 20 to return to the non-pressed position, and the switch unit 40 is adapted to be triggered to generate the triggering signal. The restoring member 30 is disposed on the base 10. When the pressing force is released, the restoring member 30 provides the restoring force, so the plurality of linking members (e.g. the first linking member 210 and the second linking member 220) are moved associated with each other back to the position before the pressing force is applied (i.e., the non-pressed position). In an embodiment, the restoring member 30 can be implemented as a resilient member having a positioning portion 312 and an acting portion 314. The positioning portion 312 is positioned on the base 10, and the acting portion 314 extends corresponding to one of the plurality of linking members (e.g. the first linking member 210). For example, the restoring member 30 can be implemented as a torsion spring. One end of the torsion spring functions as the positioning portion 312, and the other end of the torsion spring functions as the acting portion 314. In other words, the positioning portion 312 and the acting portion 314 are two rods extending out from two opposite ends of the spring body 316. The acting portion 314 preferably extends toward a direction away from the first connecting portion 214, so the acting portion 314 can come into contact to the side of the first linking member 210 having the actuating portion 216 disposed thereon. For example, the acting portion 314 touches against the lower surface 213 of the first linking member 210, and the actuating portion 216 extends downward from the lower surface 213. When the pressing force is applied to the first linking member 210, the first linking member 210 (e.g. by the lower surface 213) pushes the acting portion 314 to drive the acting portion 314 to move relative to the positioning portion 312.

In an embodiment, the switch unit 40 can be implemented as an optical switch, and the switch unit 40 is disposed corresponding to the linkage mechanism 20 (e.g. the first linking member 210). When the pressing force is applied to the linkage mechanism 20 (e.g. the first linking member 210), the first linking member 210 moves relative to the base 10 to trigger the switch unit 40. Specifically, the switch unit 40 includes an emitter 410 and a receiver 420. The emitter 410 and the receiver 420 are electrically connected to a circuit board (not shown). When the first linking member 210 moves relative to the base 10, the intensity of the optical signal received by the receiver 420 from the emitter 410 is changed to generate the triggering signal. Corresponding to the optical type switch unit 40, the base 10 preferably has a light channel 150, so the emitter 410 and the receiver 420 can be disposed at two opposite sides of the light channel 150. The extending direction of the light channel 150 (e.g. the X-axis direction) preferably intersects with the connecting direction of the first pivoting portion 212 and the first connecting portion 214 (e.g. the Y-axis direction), so when the actuating portion 216 moves in response to the movement of the first linking member 210, the actuating portion 216 selectively shields the light channel 150 to change the intensity of the optical signal received by the receiver 420 from the emitter 410 to trigger the switch unit 40. It is noted that the key structure 1 is illustrated with the optical type switch unit 40, but not limited thereto. In other embodiments, the key structure 1 can have other types of switch unit, which generates the triggering signal in response to the movement of the first linking member 210 (e.g. the actuating portion 216). For example, according to practical applications, the switch unit can include an electrode module, a switch membrane, a microswitch, a magnetic type switch (Hall effect switch), or the like, which is triggered in response to the movement of the first linking member 210 (e.g. actuating portion 216). In this embodiment, the switch unit 40 is triggered by the actuating portion 216 of the first linking member 210, but not limited thereto. In other embodiments, according to practical applications, the switch unit 40 can be triggered by other components, such as a component which is affected by the movement of the first linking member 210 to change the status of the switch unit 40 (e.g. as the embodiment shown in FIG. 14).

As shown in FIG. 1A to FIG. 1C and FIG. 2A, when the key structure 1 is assembled, the positioning portion 312 of the restoring member 30 is inserted into the positioning hole 144 of the base 10. The spring body 316 is disposed in the accommodation space 142, which is located between the two pivotal holes 112 of the first coupling portion 110 of the base 10, so the spring body 316 is located under the first pivoting portion 212 of the first linking member 210, and the acting portion 314 extends toward a direction away from the first connecting portion 214 to be in contact with the lower surface 213 of the first linking member 210. The first connecting portion 214 of the first linking member 210 and the second connecting portion 224 of the second linking member 220 are rotatably connected (i.e., the pivot 214*b* and the pivotal hole 224*b* are pivotally connected) to form the coupling axis 201. The first pivoting portion 212 of the first linking member 210 is rotatably connected to the pivotal holes 112 of the first coupling portion 110 of the base 10 to form the first rotation axis 101, so the actuating portion 216 of the first linking member 210 is disposed corresponding to the opening 130. The second pivoting portion 222 of the second linking member 220 is rotatably connected to the pivotal holes 122 of the second coupling portion 120 of the base 10 to form the second rotation axis 102, and the restricting portion 226 of the second linking member 220 is located in the positioning space 124 between the two pivotal holes 122 of the second coupling portion 120 of the base 10 to limit the lateral movement of the second linking member 220 (e.g. the movement in the X-axis direction).

Figure 2A:
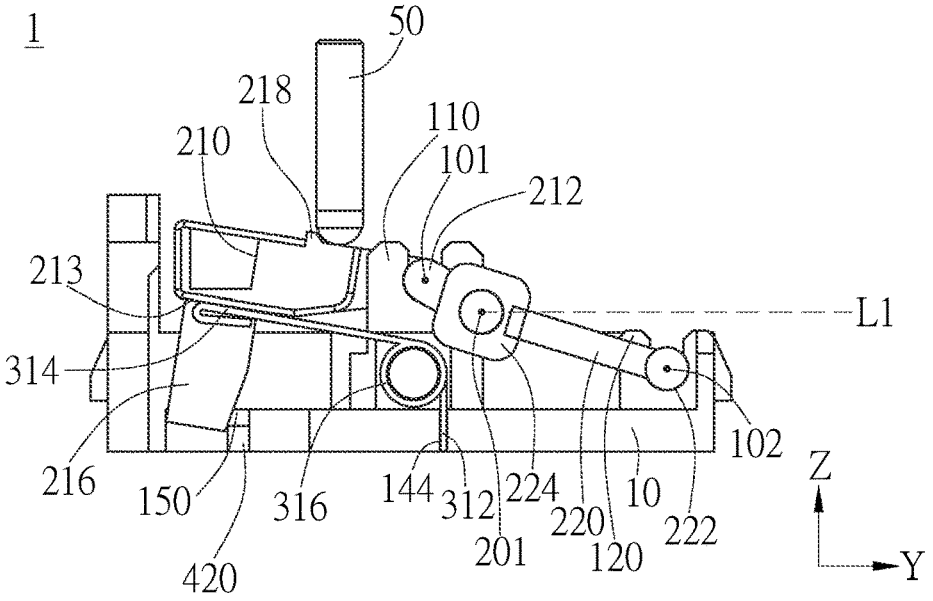
Figure 2B:
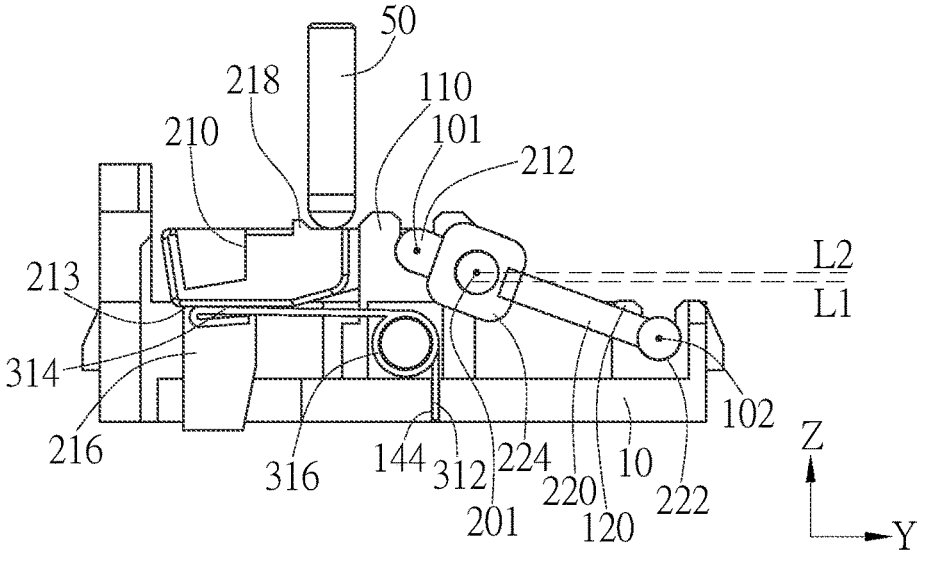
Figure 2C:
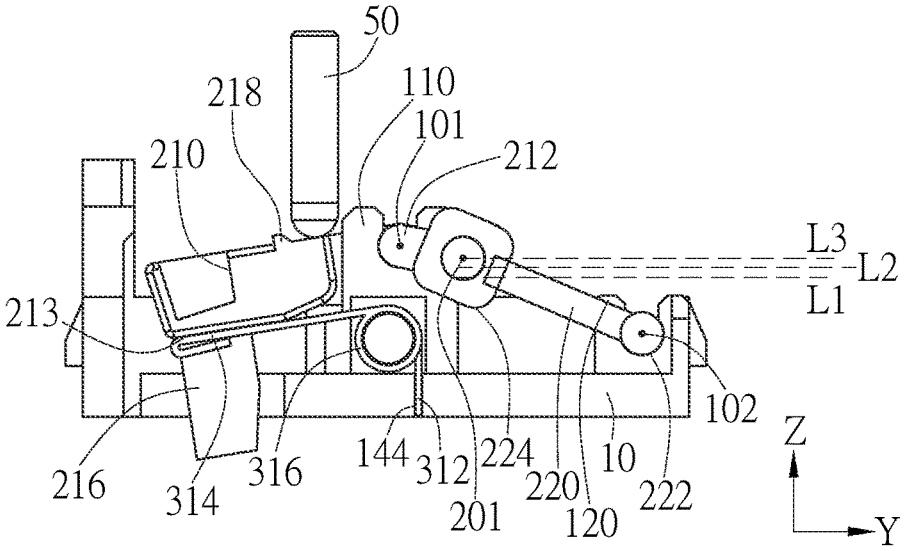

Referring to FIG. 2A to FIG. 2C, the operation of the key structure 1 is illustrated. FIG. 2A to FIG. 2C show that the key structure 1 is in the non-pressed state, the transition state, and the pressing stop state, respectively. As shown in FIG. 2A, when the pressing force is not applied to the linkage mechanism 20 (e.g. the first linking member 210), the linkage mechanism 20 supports the key structure 1 in the non-pressed state by the restoring force provided by the restoring member 30. When the key structure 1 is in the non-pressed state, the coupling axis 201 of the first linking member 210 and the second linking member 220 formed by coupling the first connecting portion 214 and the second connecting portion 224 is located at the non-pressed position L1. The operation member 50 is positioned by the positioning portion 218 of the first linking member 210, and the actuating portion 216 of the first linking member 210 does not shield or partially shields the light channel 150, so the intensity of the optical signal received by the receiver 420 from the emitter 410 is stronger (i.e., the amount of light received is larger).

As shown in FIG. 2B, when the pressing force is applied to the first linking member 210 of the linkage mechanism 20 by the operation member 50, the first linking member 210 rotates about the first rotation axis 101 along a first direction (e.g. counterclockwise) to drive the coupling axis 201 to move relative to the base 10, so the second linking member 220 is driven to rotate about the second rotation axis 102 along a second direction (e.g. clockwise). Specifically, when the first linking member 210 rotates about the first rotation axis 101 to drive the actuating portion 216 to rotate counterclockwise toward the base 10, the lower surface 213 of the first linking member 210 pushes the acting portion 314 of the restoring member 30, so the acting portion 314 moves downward relative to the positioning portion 312, and the acting portion 314 is elastically deformed with respect to the positioning portion 312. The actuating portion 216 rotates with the first linking member 210 to a position that the light channel 150 can be shielded. As such, the intensity of the optical signal received by the receiver 420 from the emitter 410 is smaller (e.g. the amount of light received is less) or substantially equal to zero (i.e., the receiver 420 does not receive the optical signal), and the switch unit 40 is triggered to generate the triggering signal. Meanwhile, the first connecting portion 214 of the first linking member 210 rotates counterclockwise away from the base 10 (i.e., the coupling axis 201 moves upward to the transition position L2) and drives the second connecting portion 224 of the second linking member 220 moves upward, so the second linking member 220 is driven to rotate about the second rotation axis 102 clockwise. In other words, when the pressing force is applied to the first linking member 210, the first linking member 210 drives the second linking member 220 to move, so the first linking member 210 and the second linking member 220 rotate in opposite directions with respect to the base 10. For example, the first linking member 210 rotates counterclockwise to move the actuating portion 216 close to the base 10 and drive the second linking member 220 to rotate clockwise to move the second connecting portion 224 away from the base 10.

As shown in FIG. 2C, when the first linking member 210 drives the second linking member 220 to rotate in the opposite direction with respect to the base 10 until the coupling axis 201 can no longer move upward relative to the base 10, the coupling axis 201 reaches the pressing stop position L3. Specifically, in the key structure 1, through the linkage of the first linking member 210 and the second linking member 220, the movements of the first linking member 210 and the second linking member 220 are associated with each other to limit the rotation range of the first linking member 210 and the second linking member 220 relative to the base 10, thereby achieving a non-collision pressing stop point. In other words, the key structure 1 can achieve the limiting effect without collision between components to effectively reduce the abnormal sound. It is noted that the pressing stop position L3 of the coupling axis 201 can be determined according to the inclined angle of the first connecting portion 214 with respect to the first pivoting portion 212, the length of the first connection section 214*a*, the length of the second connection section 224*a*, etc. In other words, the pressing stop position L3 of the coupling axis 201 can be determined according to the relative positions among the first rotation axis 101, the coupling axis 201, and the second rotation axis 102.

When the pressing force is released, the restoring member 30 provides the restoring force to enable the acting portion 314 to push the lower surface 213 of the first linking member 210 upward, so as to drive the first linking member 210 to rotate clockwise, and the first connecting portion 214 drives the second linking member 220 to rotate counterclockwise. As such, the key structure 1 returns from the pressing stop state of FIG. 2C through the transition state of FIG. 2B to the non-pressed state of FIG. 2A (i.e., the position before the pressing force is applied).

Figure 3:
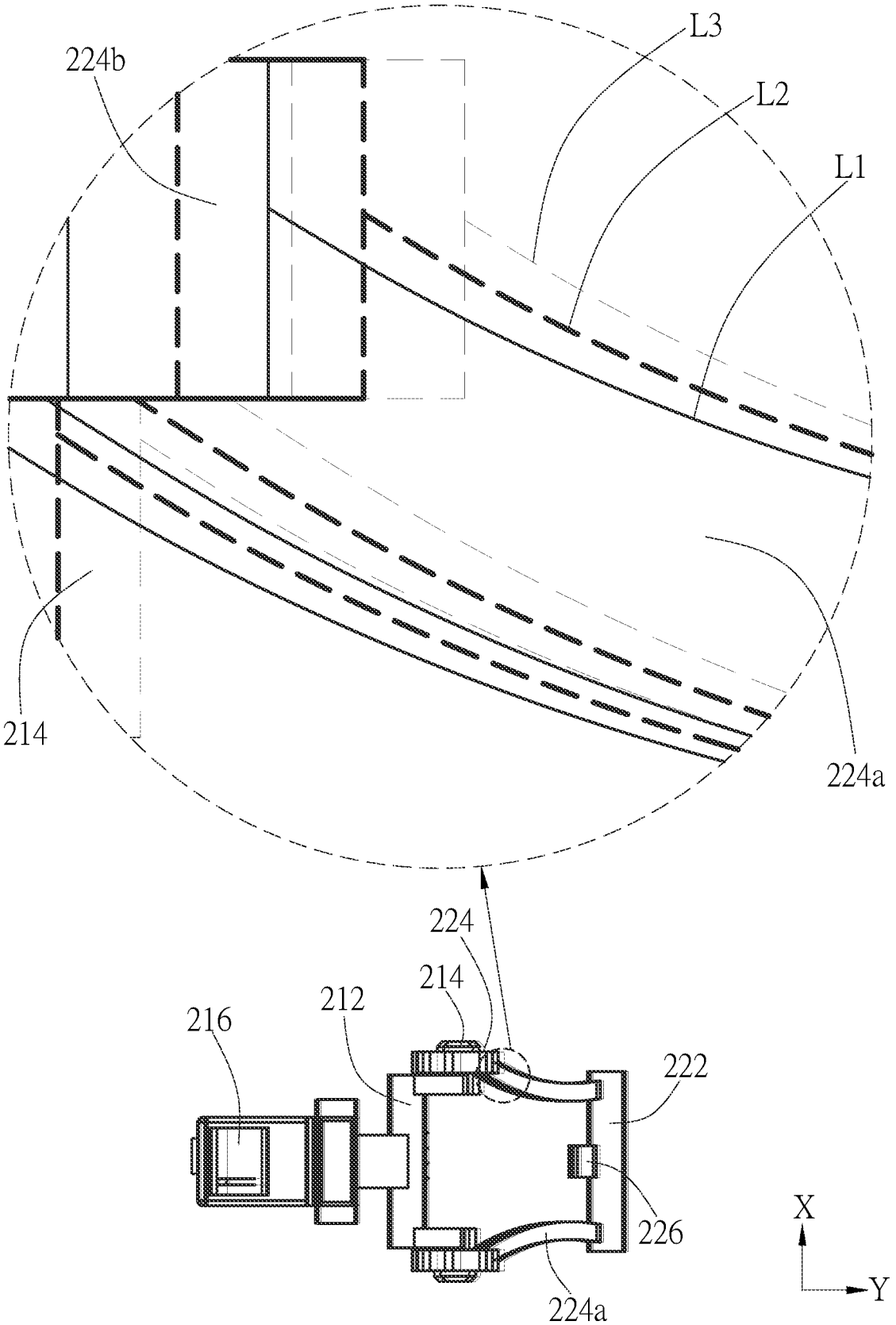
FIG. 3 is a schematic view showing the deformation of the key structure of FIG. 1C from the non-pressed state through the transition state to the pressing stop state.

Referring to FIG. 3, FIG. 3 is a schematic view showing the deformation of the linkage mechanism 20 when the coupling axis 201 of the key structure 1 of FIG. 1C is at the non-pressed position L1, the transition position L2, and the pressing stop position L3. As shown in the enlarged view of FIG. 3, when the pressing force is applied to the first linking member 210, the first linking member 210 and the second linking member 220 are substantially immovable relative to each other in the Y-axis direction (i.e., the positions of the first pivoting portion 212 and the second pivoting portion 222 are substantially fixed, or the positions of the first rotation axis 101 and the second rotation axis 102 are substantially fixed). The first linking member 210 and the second linking member 220 are squeezed relative to each other, and the second connection section 224*a* can be elastically deformed, so the user can experience the click feedback during the deformation of the linkage mechanism 20 from the non-pressed position L1 to the pressing stop position L3, enhancing the tactile feedback of the key structure 1. In other words, the key structure 1 can not only use the displacement limitation of the linkage mechanism 20 to reduce the abnormal sound caused by collision of components of the keyswitch, but also use the deformation of the linkage mechanism 20 to provide the click feedback, so the user can experience the soundless click feedback. It is noted that in this embodiment, the second connection sections 224*a* of the second linking member 220 are elastically deformed, but not limited thereto. In other embodiments, by modifying the design of the first linking member and the second linking member according to practical applications, when the first linking member 210 drives the second linking member 220 to move, at least one of the first connection section 214*a* and the second connection section 224*a* can be elastically deformed to provide the click feedback.

Figure 4A:
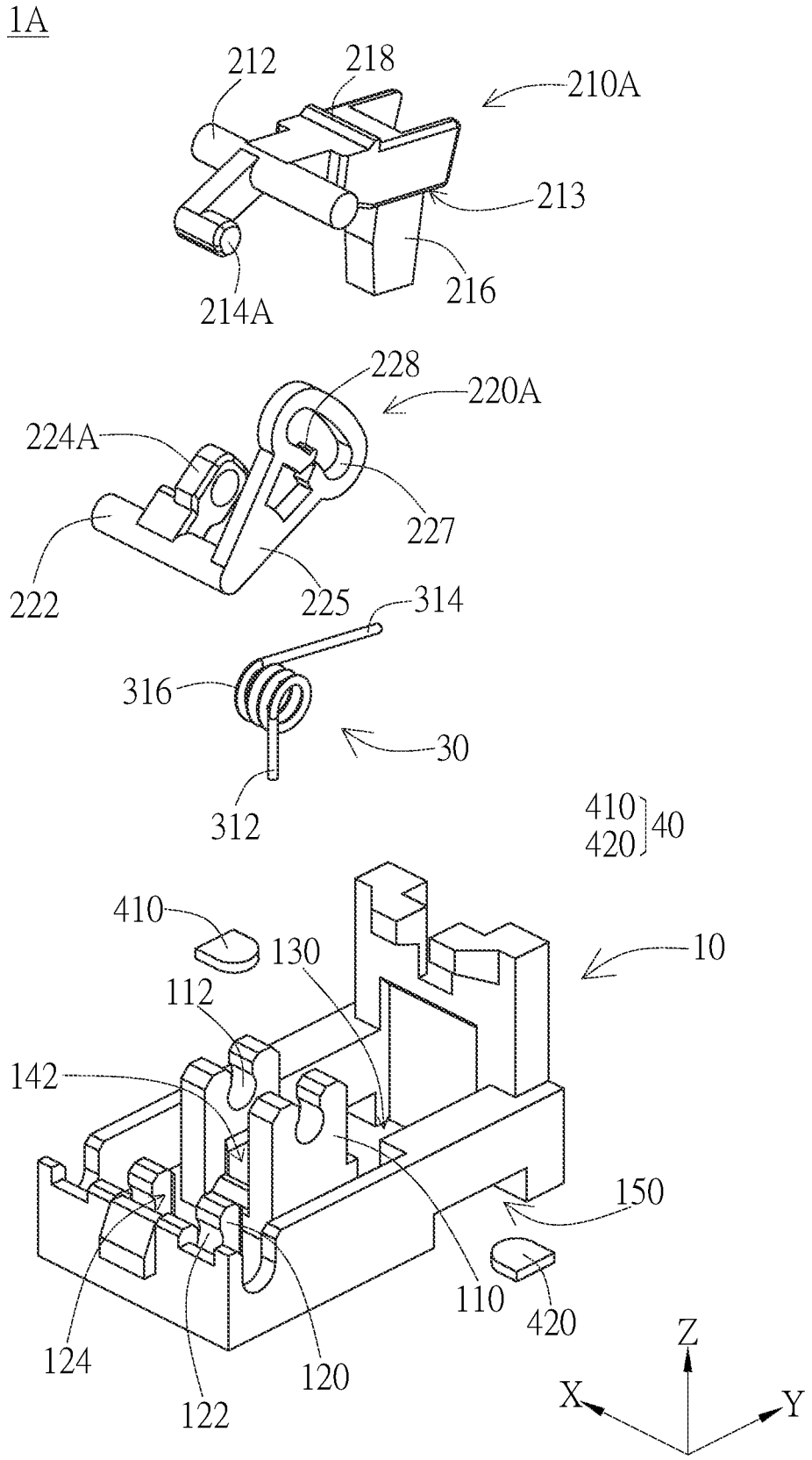
FIG. 4A to FIG. 4C are an exploded view, a partially exploded view, and an assembled view of the key structure in a second embodiment of the invention, respectively.
Figure 4B:
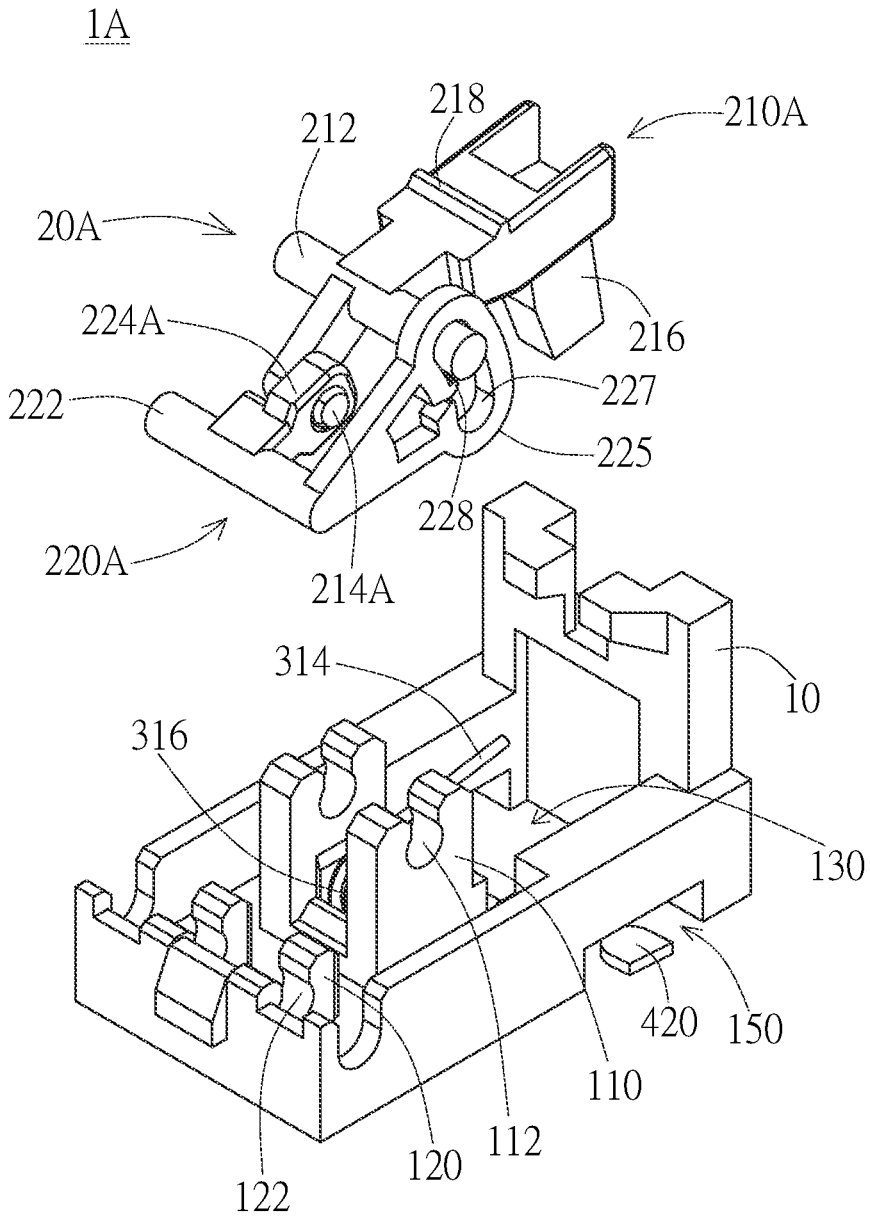
Figure 4C:
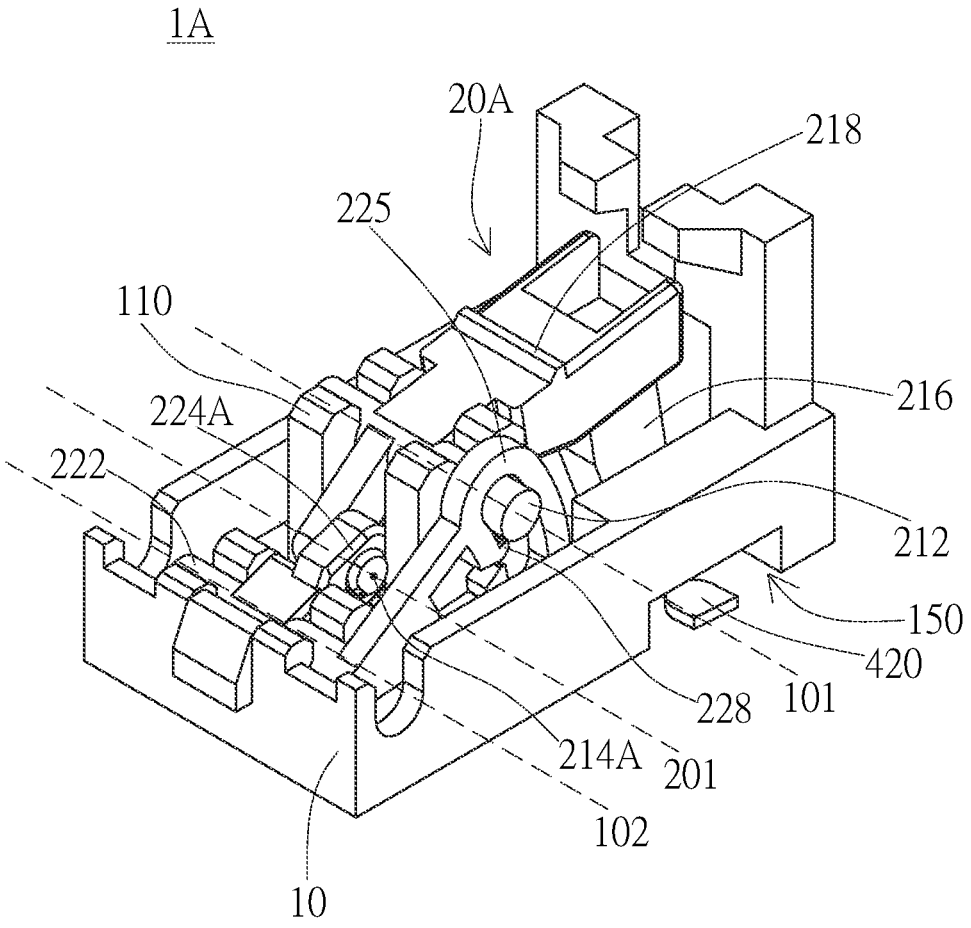

FIG. 4A to FIG. 4C are an exploded view, a partially exploded view, and an assembled view of the key structure 1A in a second embodiment of the invention, respectively. The key structure 1A includes a base 10 and a linkage mechanism 20A. The linkage mechanism 20A includes a first linking member 210A and a second linking member 220A. In this embodiment, the base 10 has a structure similar to FIG. 1A, and the linkage mechanism 20A can have a linking limitation similar to the linkage mechanism 20 of FIG. 1A. For example, the respective rotatable coupling mechanism of the first linking member 210A and the second linking member 220A of the linkage mechanism 20A to the base 10, the structure and function of the restoring member 30 and the switch unit 40 can be referred to the related descriptions of the first embodiment and will not elaborate again. Moreover, the first linking member 210A of the linkage mechanism 20A has the first pivoting portion 212, the actuating portion 216, the positioning portion 218, the lower surface 213, etc. similar to the first embodiment, and the second linking member 220A has the second pivoting portion 222 similar to the first embodiment. Hereinafter, the difference between the linkage mechanism 20A and the linkage mechanism 20 will be described.

As shown in FIG. 4A to FIG. 4C, the first connecting portion 214A of the first linking member 210A and the second connecting portion 224A of the second linking member 220A couple with each other to form the coupling axis 201 through the coupling mechanism of a pivot and a pivotal hole. Specifically, the first connecting portion 214A extends inclinedly downward from the middle section of the first pivoting portion 212 to form a pivot extending along the X-axis direction at the distal end. The second connecting portion 224A extends from the middle section of the second pivoting portion 222 toward the first linking member 210A to form a corresponding pivotal hole at the distal end.

In this embodiment, the second linking member 220A further includes a tactile feedback portion 225. The tactile feedback portion 225 is connected to the second pivoting portion 222 and adapted to movably couple with the first pivoting portion 212. When the first linking member 210A drives the second linking member 220A to move, the tactile feedback portion 225 moves relative to the first pivoting portion 212 to interfere with the first pivoting portion 212. Specifically, the tactile feedback portion 225 has a protrusion 228, and the protrusion 228 is disposed corresponding to the first pivoting portion 212. When the tactile feedback portion 225 moves relative to the first pivoting portion 212, the protrusion 228 interferes with the first pivoting portion 212. For example, the tactile feedback portion 225 is connected to one end of the second pivoting portion 222 and extends toward the first pivoting portion 212. In this embodiment, the tactile feedback portion 225 can be implemented as a sector-shaped or angular-shaped tactile feedback portion 225. The apex portion of the sector-shaped or angular-shaped tactile feedback portion 225 is connected to the second pivoting portion 222, and the arch portion or the bottom side of the sector-shaped or angular-shaped tactile feedback portion 225 corresponds to the first pivoting portion 212 and is formed with a groove 227. The protrusion 228 is disposed at one side of the groove 227 corresponding to the first pivoting portion 212. The protrusion 228 is preferably located at the middle section of the groove 227 and protrudes toward the groove 227. When the tactile feedback portion 225 moves relative to the first pivoting portion 212, the first pivoting portion 212 preferably moves from one end of the groove 227 to the other end of the groove 227 and interacts with the protrusion 228 during the movement.

As shown in FIG. 4A to FIG. 4C and FIG. 5A, when the key structure 1A is assembled, the positioning portion 312 of the restoring member 30 is inserted into the positioning hole 144 of the base 10, the spring body 316 is disposed in the accommodation space 142, which is located between the two pivotal holes 112 of the first coupling portion 110 of the base 10, so the spring body 316 is located under the first pivoting portion 212 of the first linking member 210A, and the acting portion 314 extends toward a direction away from the first connecting portion 214A to be in contact with the lower surface 213 of the first linking member 210A. The first connecting portion 214A of the first linking member 210A and the second connecting portion 224A of the second linking member 220A are rotatably connected (i.e., the pivot and the pivotal hole are pivotally connected) to form the coupling axis 201. The first pivoting portion 212 of the first linking member 210A is rotatably connected to the pivotal holes 112 of the first coupling portion 110 of the base 10 to form the first rotation axis 101, so the actuating portion 216 of the first linking member 210A is disposed corresponding to the opening 130 of the base 10. The second pivoting portion 222 of the second linking member 220A is rotatably connected to the pivotal holes 122 of the second coupling portion 120 of the base 10 to form the second rotation axis 102, and the second connecting portion 224A of the second linking member 220A is located between the two pivotal hoes 122 of the second coupling portion 120 (e.g. in the positioning space 124 as described in the previous embodiment) to limit the lateral movement of the second linking member 220A (e.g. the movement in the X-axis direction). The tactile feedback portion 225 couples with the first pivoting portion 212. For example, one end of the first pivoting portion 212 is inserted into the groove 227, so the first pivoting portion 212 is located at the upper end of the groove 227, and the tactile feedback portion 225 is located at the outer side of the pivotal hole 112 of the first coupling portion 110.

Figure 5A:
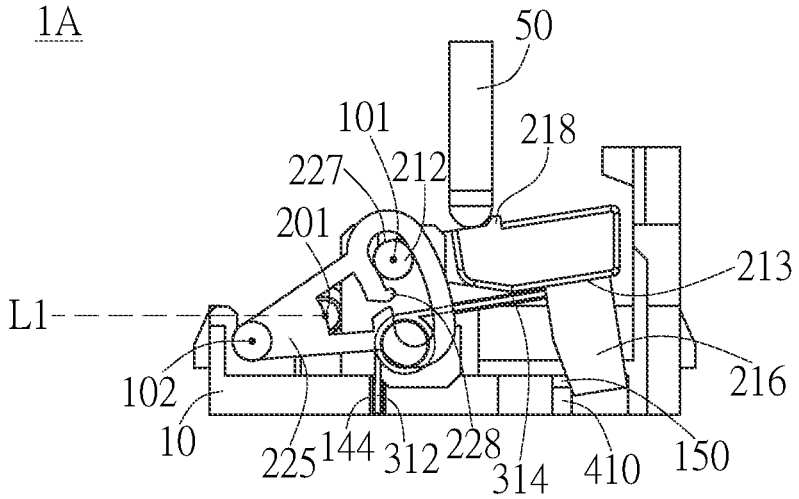
Figure 5B:
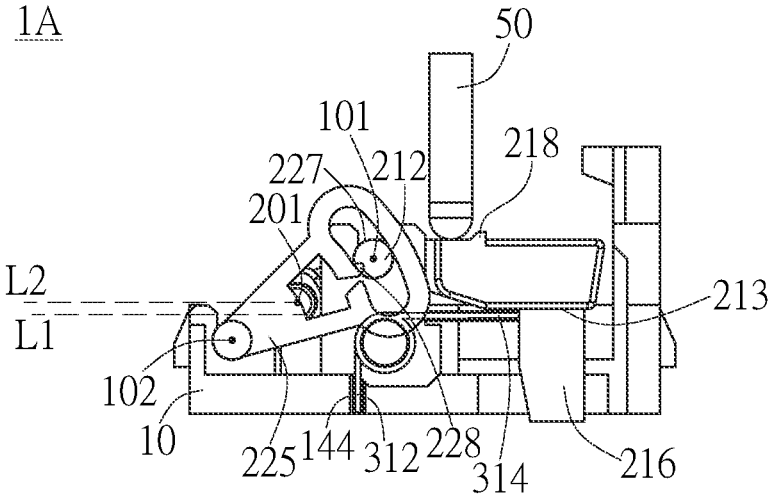
Figure 5C:
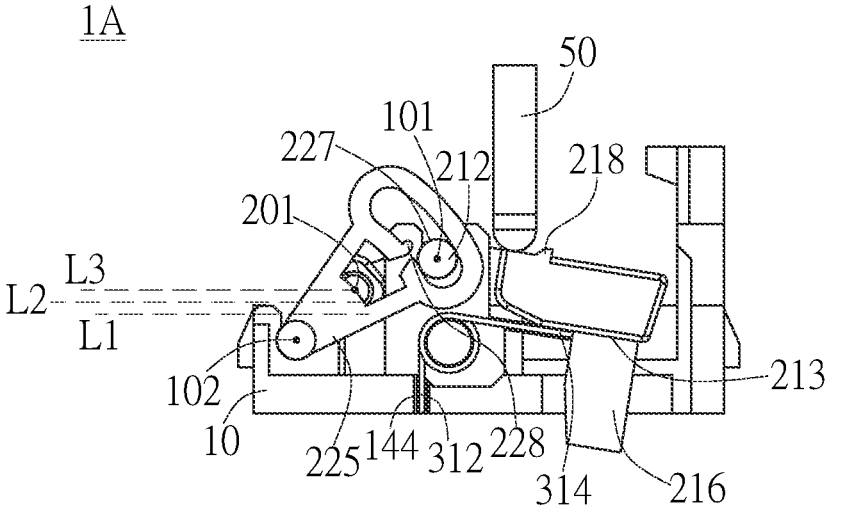

Referring to FIG. 5A to FIG. 5C, the operation of the key structure 1A is illustrated. FIG. 5A to FIG. 5C show that the key structure 1A are in the non-pressed state, the transition state, and the pressing stop state, respectively. As shown in FIG. 5A, when the pressing force is not applied to the linkage mechanism 20A, the linkage mechanism 20A supports the key structure 1A in the non-pressed state by the restoring force provided by the restoring member 30. When the key structure 1A is in the non-pressed state, the coupling axis 201 of the first linking member 210A and the second linking member 220A formed by coupling the first connecting portion 214A and the second connecting portion 224A is located at the non-pressed position L1, and the first pivoting portion 212 is located at the upper end of the groove 227 of the tactile feedback portion 225. The operation member 50 is positioned by the positioning portion 218 of the first linking member 210A, and the actuating portion 216 of the first linking member 210A does not shield or partially shields the light channel 150, so the intensity of the optical signal received by the receiver 420 from the emitter 410 is stronger (i.e., the amount of light received is larger).

As shown in FIG. 5B, when the pressing force is applied to the linkage mechanism 20A (e.g. to the first linking member 210A) by the operation member 50, the positions of the first rotation axis 101 and the second rotation axis 102 relative to the base 10 substantially remain unchanged, and the first linking member 210A and the second linking member 220A move associated with each other to restrict the rotation range of the first linking member 210A and the second linking member 220A with respect to the base 10. For example, the first linking member 210A rotates about the first rotation axis 101 clockwise (i.e., along the first direction) to drive the coupling axis 201 to move away from the base 10, so the second linking member 220A is driven to rotate about the second rotation axis 102 counterclockwise (i.e., along the second direction), and the tactile feedback portion 225 moves upward relative to the first pivoting portion 212. Specifically, when the first linking member 210A rotates about the first rotation axis 101 to drive the actuating portion 216 to rotate clockwise toward the base 10, the lower surface 213 of the first linking member 210A pushes the acting portion 314 of the restoring member 30, so the acting portion 314 moves downward relative to the positioning portion 312, and the acting portion 314 is elastically deformed with respect to the positioning portion 312. The actuating portion 216 rotates with the first linking member 210A to a position that the light channel 150 can be shielded. As such, the intensity of the optical signal received by the receiver 420 from the emitter 410 is smaller (e.g. the amount of light is less) or substantially equal to zero (i.e., the receiver 420 does not receive the optical signal), and the switch unit 40 is triggered to generate the triggering signal. Meanwhile, the first connecting portion 214A of the first linking member 210A rotates clockwise away from the base 10 (i.e., the coupling axis 201 moves upward to the transition position L2) and drives the second connecting portion 224A of the second linking member 220A and the tactile feedback portion 225 to move upward, so the second linking member 220A is driven to rotate about the second rotation axis 102 counterclockwise. In other words, when the pressing force is applied to the first linking member 210A, the first linking member 210A drives the second linking member 220A to move, so the first linking member 210A and the second linking member 220A rotate in opposite directions with respect to the base 10. For example, the first linking member 210A rotates clockwise to drive the actuating portion 216 to rotate toward the base 10, and the second linking member 220A is driven to rotate counterclockwise to drive the second connecting portion 224A and the tactile feedback portion 225 to rotate away from the base 10. When the tactile feedback portion 225 moves upward to enable the protrusion 228 to pass the first pivoting portion 212, the protrusion 228 interacts with the first pivoting portion 212, and the protrusion 228 is pushed by the first pivoting portion 212 to elastically deform so as to pass the first pivoting portion 212. In other words, when the first pivoting portion 212 moves relative to the tactile feedback portion 225 from the upper end of the groove 227 to the lower end of the groove 227, the first pivoting portion 212 encounters the protrusion 228 and pushes the protrusion 228 away from the groove 227, so the first pivoting portion 212 can pass the protrusion 228 and continue to move to the lower end of the groove 227.

As shown in FIG. 5C, when the first linking member 210A drives the second linking member 220A to rotate with respect to the base 10 until the coupling axis 201 can no longer move upward relative to the base 10 (i.e., the rotation range of the first linking member 210A and the second linking member 220A with respect to the base 10 is restricted by the associated movement of the first linking member 210A and the second linking member 220A), the coupling axis 201 reaches the pressing stop position L3. Specifically, in the key structure 1A, through the linkage of the first linking member 210A and the second linking member 220A, the non-collision pressing stop point can be achieved. In other words, the key structure 1A can achieve the limiting effect without collision between components to effectively reduce the abnormal sound. It is noted that the pressing stop position L3 of the coupling axis 201 can be determined according to the inclined angle of the first connecting portion 214A with respect to the first pivoting portion 212, the length of the first connecting portion 214A, the length of the second connecting portion 224A, the length of the groove 227, etc. In other words, the pressing stop position L3 of the coupling axis 201 can be determined according to the relative positions among the first rotation axis 101, the coupling axis 201, and the second rotation axis 102, and the apex angle of the sector-shaped or angular-shaped tactile feedback portion 225 (or the length of the groove 227).

When the pressing force is released, the restoring member 30 provides the restoring force to enable the acting portion 314 to push the lower surface 213 of the first linking member 210A upward, so as to drive the first linking member 210A to rotate counterclockwise, and the first connecting portion 214A drives the second linking member 220A to rotate clockwise. As such, the key structure 1A returns from the pressing stop state of FIG. 5C through the transition state of FIG. 5B to the non-pressed state of FIG. 5A (i.e., the position before the pressing force is applied).

In the second embodiment, for the key structure 1A, during the movement of the linkage mechanism 20A, the first pivoting portion 212 of the first linking member 210A moves in the groove 227 relative to the tactile feedback portion 225 to interact with the protrusion 228, and the protrusion 228 is pushed to elastically move away from the groove 227 to provide the click feedback, so the key structure 1A can provide a soundless click tactile feedback. It is noted that in this embodiment, the tactile feedback portion 225 is illustrated to have a sector shape or an angular shape for coupling with the first pivoting portion 212, but not limited thereto. In other embodiments, the shape of the tactile feedback portion 225 can be modified according to practical applications.

Figure 6A:
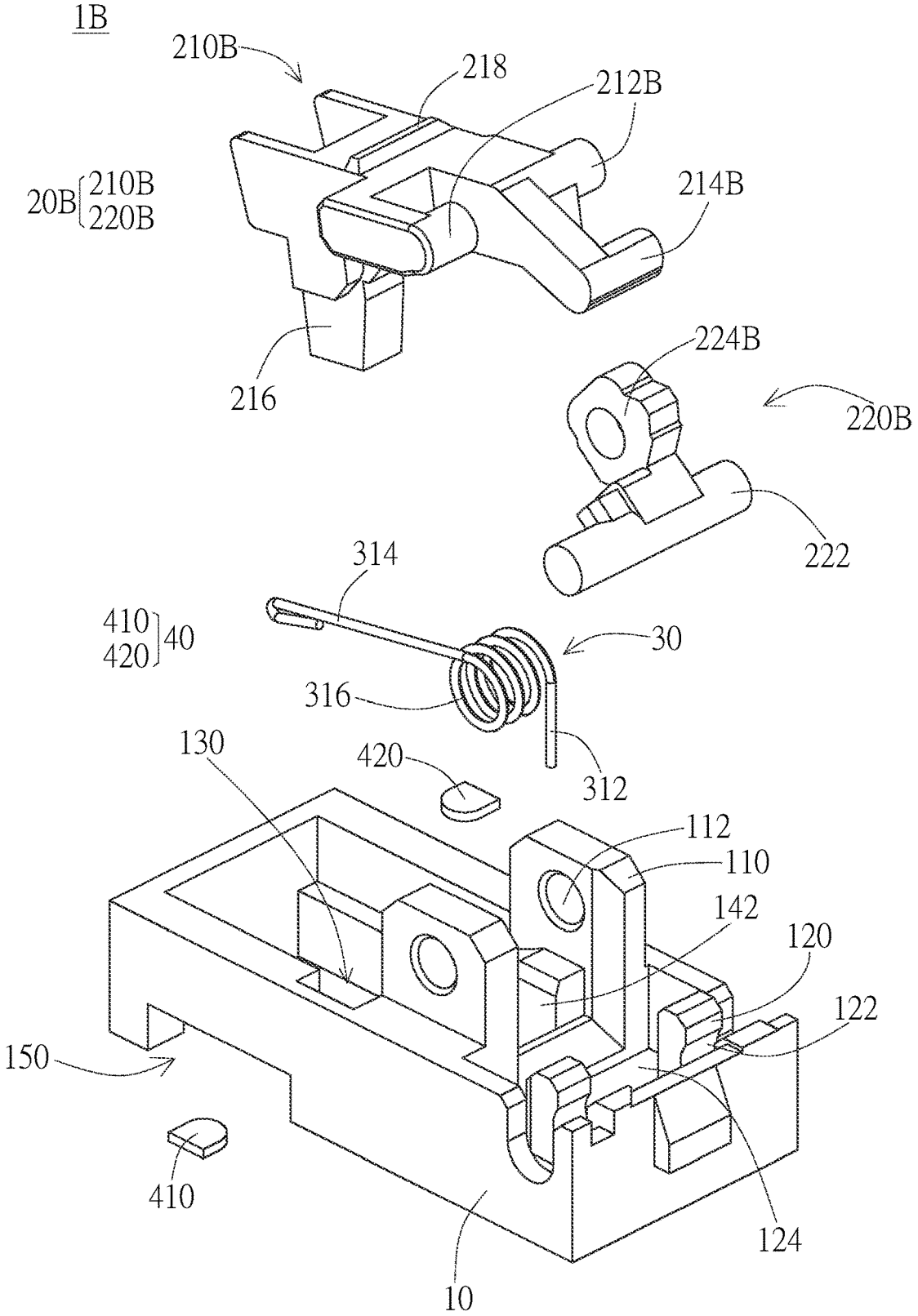
FIG. 6A and FIG. 6B are an exploded view and an assembled view of the key structure in a third embodiment of the invention, respectively.
Figure 6B:
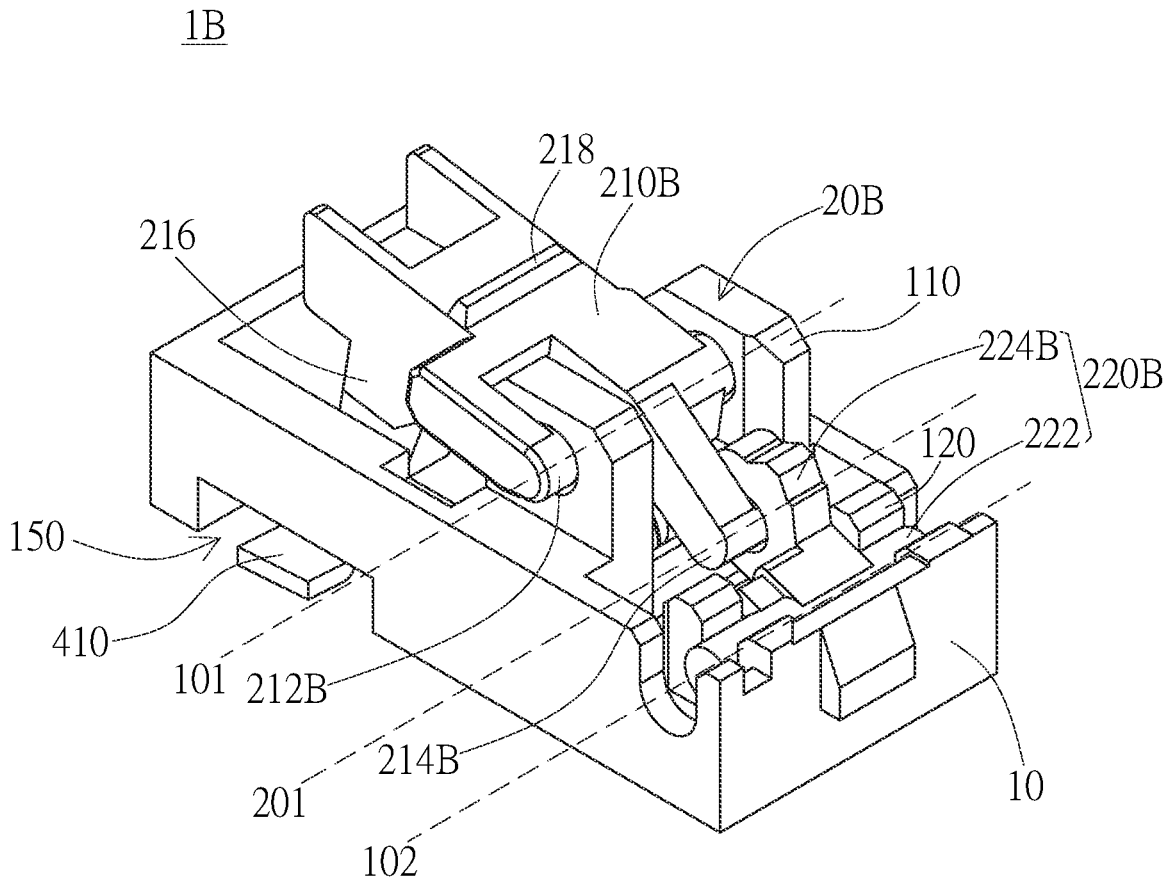

FIG. 6A and FIG. 6B are an exploded view and an assembled view of the key structure 1B in a third embodiment of the invention, respectively. The key structure 1B includes a base 10 and a linkage mechanism 20B. The linkage mechanism 20B includes a first linking member 210B and a second linking member 220B. In this embodiment, the base 10 has a structure similar to FIG. 1A, and the linkage mechanism 20B can have a linking limitation similar to the linkage mechanism 20 or 20A. For example, the respective rotatable coupling mechanism of the first linking member 210B and the second linking member 220B of the linkage mechanism 20B to the base 10, the structure and function of the restoring member 30 and the switch unit 40 can be referred to the related descriptions of the first embodiment and will not elaborate again. Moreover, the first linking member 210B of the linkage mechanism 20B has the actuating portion 216, the positioning portion 218, the lower surface 213, etc. similar to the first embodiment, and the first linking member 210B of the linkage mechanism 20B has the first connecting portion 214B similar to the second embodiment. The second linking member 220A has the second pivoting portion 222 and a second connecting portion 224B similar to the second embodiment. Hereinafter, the difference between the linkage mechanism 20B and the linkage mechanism 20 or 20A will be described.

As shown in FIG. 6A and FIG. 6B, the first pivoting portion 212B of the first linking member 210B can be implemented as two pivots, which extend along the X-axis direction and are spaced apart from each other. In this embodiment, the two pivots of the first pivoting portion 212B preferably extend toward the same direction, so one of the two pivots couples with one pivot hole 112 of the first coupling portion 110 from the outer side to the inner side, and the other of the two pivots couples with the other pivotal hole 112 of the first coupling portion 110 from the inner side to the outer side, but not limited thereto. The first connecting portion 214B extends inclinedly downward from one of the pivots of the first pivoting portion 212, and the first connecting portion 214B is preferably located between the two pivots to couple with the second connecting portion 224B of the second linking member 220B. In other words, the first connecting portion 214B and the second connecting portion 224B couple with each other to form the coupling axis 201 through the coupling mechanism of a pivot and a pivotal hole.

Figure 7A:
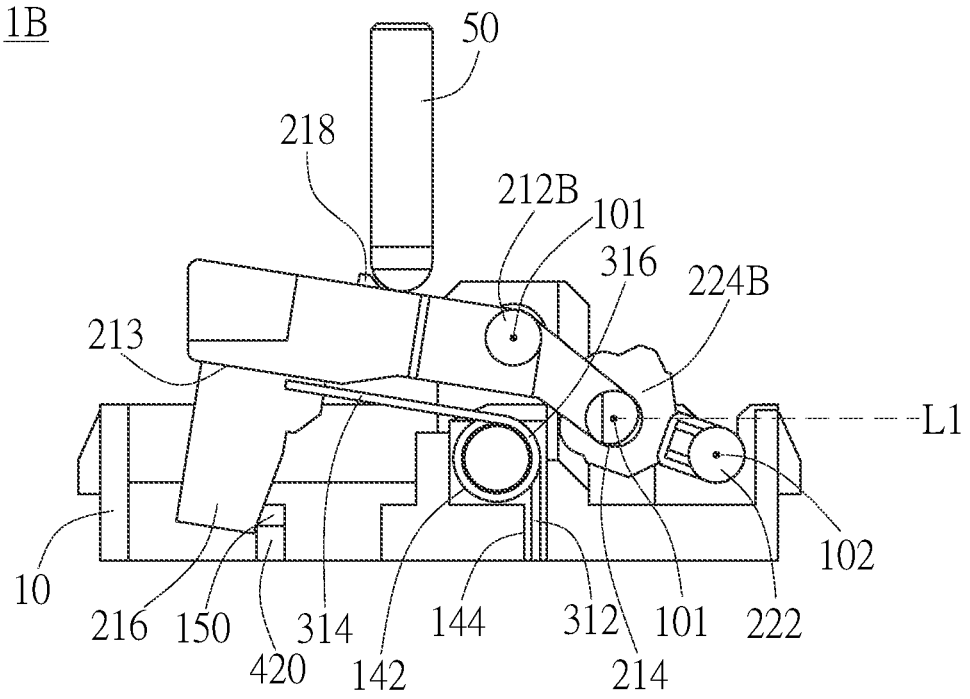
Figure 7B:
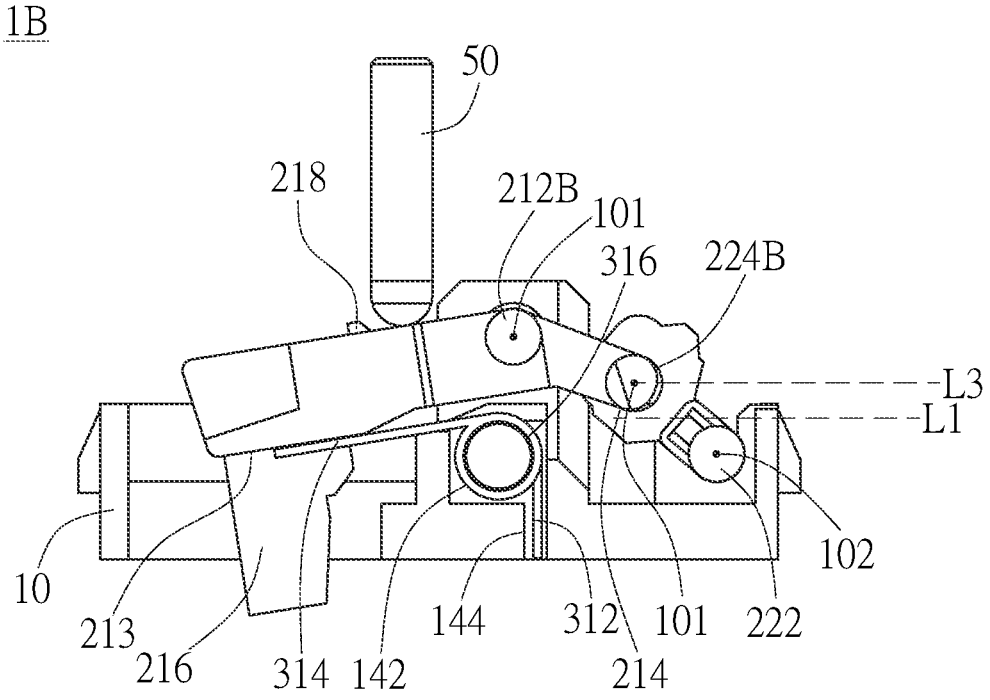

Referring to FIG. 7A and FIG. 7B, the operation of the key structure 1B is illustrated. FIG. 7A and FIG. 7B show that the key structure 1B are in the non-pressed state and the pressing stop state, respectively. As shown in FIG. 7A, when the pressing force is not applied to the linkage mechanism 20B (e.g. the first linking member 210B), the linkage mechanism 20B supports the key structure 1B in the non-pressed state by the restoring force provided by the restoring member 30. When the key structure 1B is in the non-pressed state, the coupling axis 201 of the first linking member 210B and the second linking member 220B formed by coupling the first connecting portion 214B and the second connecting portion 224B is located at the non-pressed position L1. The operation member 50 is positioned by the positioning portion 218 of the first linking member 210B, and the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 7B, when the pressing force is applied to the first linking member 210B of the linkage mechanism 20B by the operation member 50, the first linking member 210B rotates about the first rotation axis 101 along a first direction (e.g. counterclockwise) to drive the coupling axis 201 to move relative to the base 10, so the second linking member 220B is driven to rotate about the second rotation axis 102 along a second direction (e.g. clockwise). As such, the first linking member 210B and the second linking member 220B move associated with each other to restrict the rotation range of the first linking member 210B and the second linking member 220B with respect to the base 10, and the coupling axis 201 moves to the pressing stop position L3. Specifically, when the first linking member 210B rotates about the first rotation axis 101 to enable the actuating portion 216 to rotate counterclockwise toward the base 10, the lower surface 213 of the first linking member 210B pushes the acting portion 314 of the restoring member 30, so the acting portion 314 moves downward relative to the positioning portion 312, and the acting portion 314 is elastically deformed with respect to the positioning portion 312. The actuating portion 216 rotates with the first linking member 210B to a position that the light channel 150 can be shielded. As such, the intensity of the optical signal received by the receiver 420 from the emitter 410 is smaller (e.g. the amount of light received is less) or substantially equal to zero (i.e., the receiver 420 does not receive the optical signal), and the switch unit 40 is triggered to generate the triggering signal. Meanwhile, the first connecting portion 214B of the first linking member 210B rotates counterclockwise away from the base 10 (i.e., the coupling axis 201 moves upward to the pressing stop position L3) and drives the second connecting portion 224B of the second linking member 220B to move upward, so the second linking member 220B is driven to rotate about the second rotation axis 102 clockwise. In other words, when the pressing force is applied to the first linking member 210B, the first linking member 210B drives the second linking member 220B to move, so the first linking member 210B and the second linking member 220B rotate in opposite directions with respect to the base 10. For example, the first linking member 210B rotates counterclockwise to enable the actuating portion 216 to move toward the base 10, and the second linking member 220B is driven to rotate clockwise to enable the second connecting portion 224B to move away from the base 10.

When the pressing force is released, the restoring member 30 provides the restoring force to enable the acting portion 314 to push the lower surface 213 of the first linking member 210B upward, so as to drive the first linking member 210B to rotate clockwise. As such, the first connecting portion 214B drives the second linking member 220B to rotate counterclockwise, and the key structure 1B returns from the pressed state of FIG. 7B to the non-pressed state of FIG. 7A. Specifically, in the key structure 1B, through the linkage of the first linking member 210B and the second linking member 220B, the movements of the first linking member 210B and the second linking member 220B are associated with other to limit the rotation range of the first linking member 210B and the second linking member 220B relative to the base 10, thereby achieving a non-collision pressing stop point. In other words, the key structure 1B can achieve the limiting effect without collision between components to effectively reduce the abnormal sound.

Figure 8A:
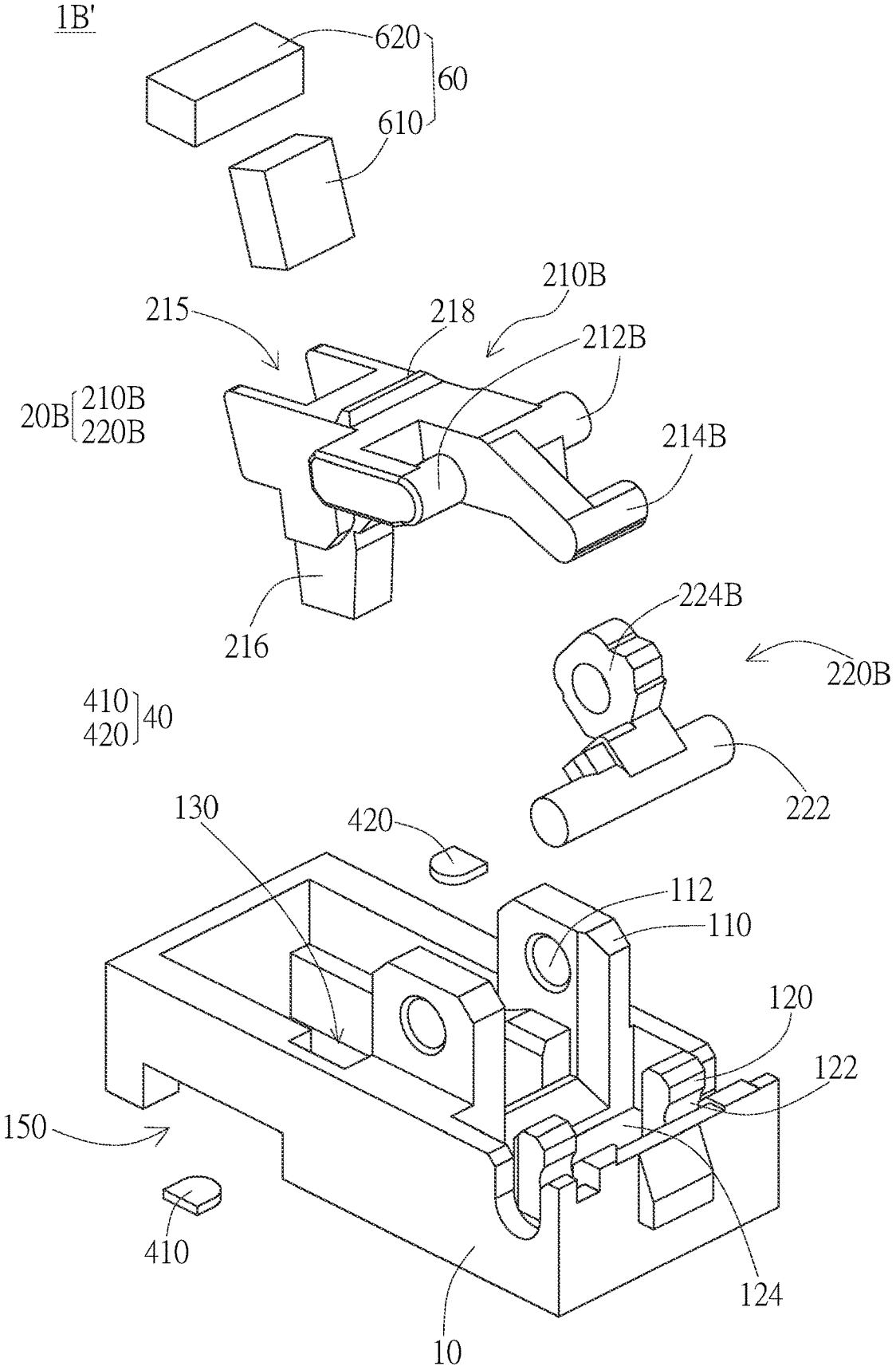
FIG. 8A and FIG. 8B are an exploded view and an assembled view of the key structure in a fourth embodiment of the invention, respectively.
Figure 8B:
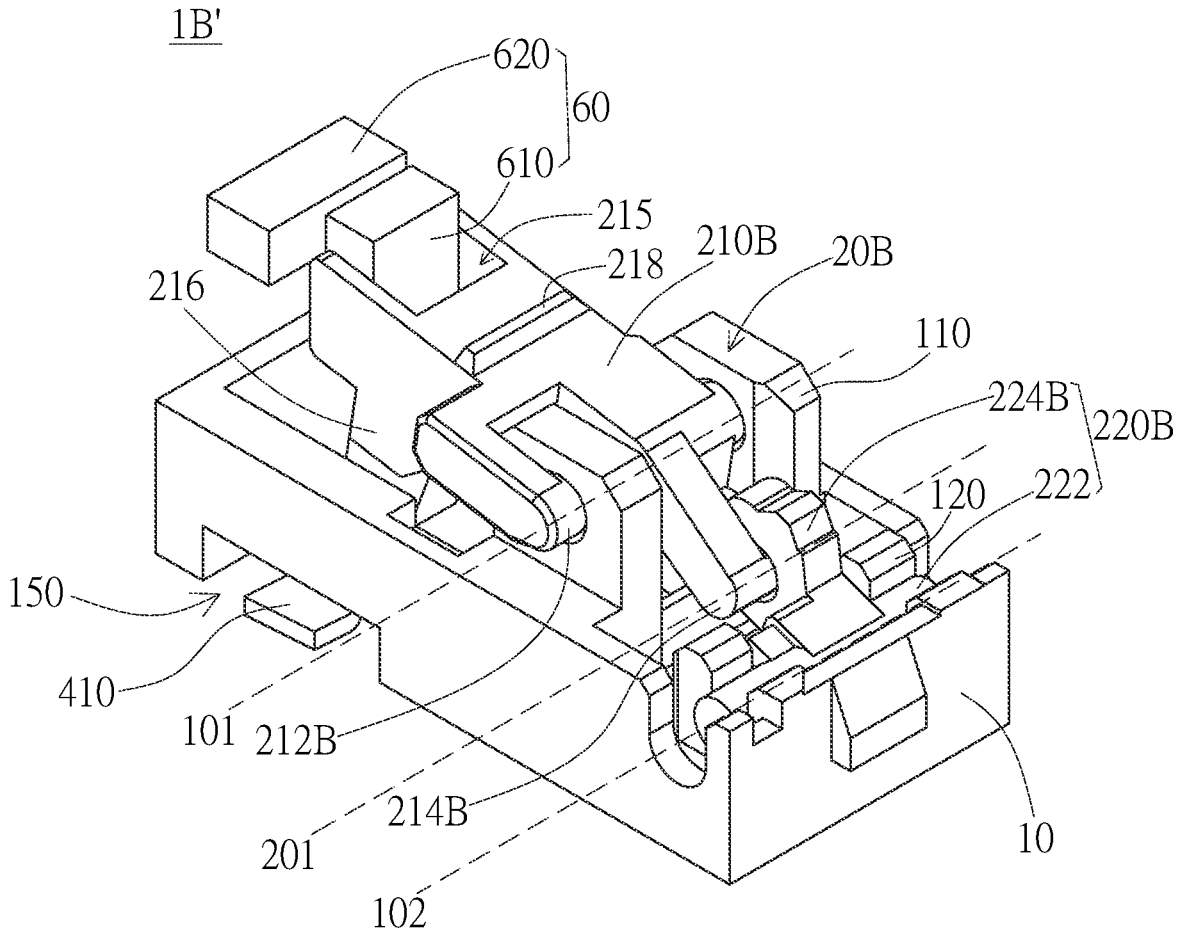

FIG. 8A and FIG. 8B are an exploded view and an assembled view of the key structure 1B' in a fourth embodiment of the invention, respectively. The key structure 1B' of FIG. 8A is a variant embodiment of the key structure 1B of FIG. 6A. Thus, the detailed structure and function of components of the key structure 1B' can be referred to the related descriptions of the previous embodiments and will not elaborate again. As shown in FIG. 8A and FIG. 8B, the key structure 1B' may include a magnetic unit 60 as the restoring member, instead of the spring type restoring member 30 of FIG. 6A. The magnetic unit 60 includes a first magnetic member 610 and a second magnetic member 620. The first magnetic member 610 and the second magnetic member 620 can be implemented as both magnets or a combination of a magnet and a ferromagnetic material. The first magnetic member 610 is disposed on the linkage mechanism 20B, and the second magnetic member 620 is disposed corresponding to the first magnetic member 610 to produce a magnetic attraction force. Specifically, the first magnetic member 610 can be disposed on any suitable position of the first linking member 210B (or so-called movable member) of the linkage mechanism 20B, and the first magnetic member 610 is preferably located at the same side as the actuating portion 216 with respect to the first pivoting portion 212. Corresponding to the disposition of the first magnetic member 610, the first linking member 210B has a receiving portion 215 adapted to receive the first magnetic member 610. In this embodiment, the receiving portion 215 can be a cavity formed on the first linking member 210B, and the first magnetic member 610 can be at least partially received in the cavity, but not limited thereto. In other embodiments, the receiving portion 215 can be a surface space of the first linking member 210B, and the first magnetic member 610 can be attached to the first linking member 210B by engaging or adhering. As such, when the first linking member 210B moves relative to the base 10, the first magnetic member 610 can move with the first linking member 210B. The second magnetic member 620 is preferably disposed corresponding to the first magnetic member 610, so the magnetic attraction force can be generated between the first magnetic member 610 and the second magnetic member 620 to support the key structure 1B' in the non-pressed state. For example, the second magnetic member 620 can be disposed on the base 10 or other components of the key structure 1B' (e.g. the cover 70 of FIG. 18A, but not limited thereto).

Figure 9A:
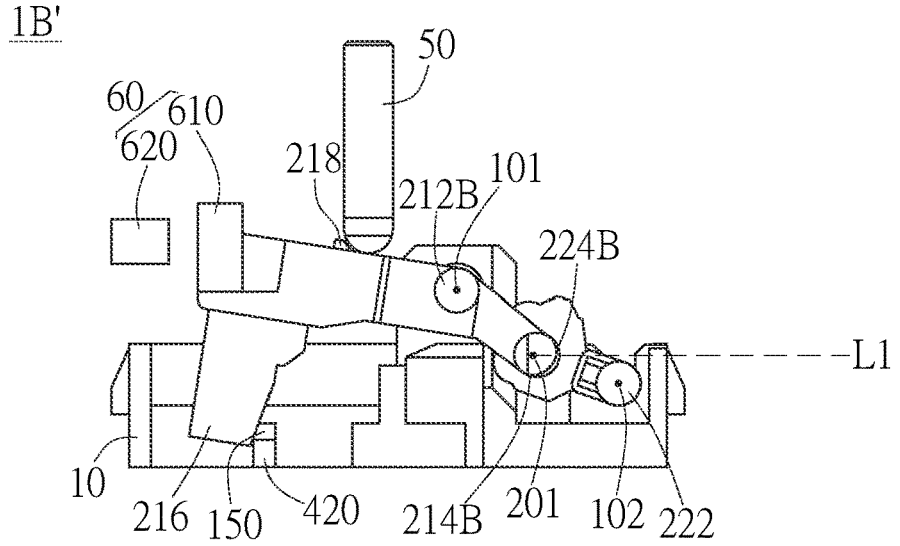
Figure 9B:
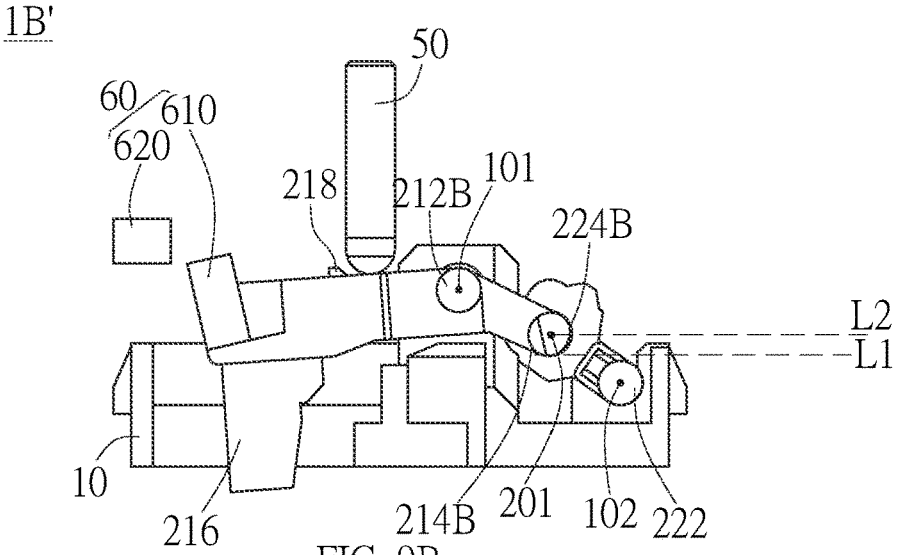
Figure 9C:
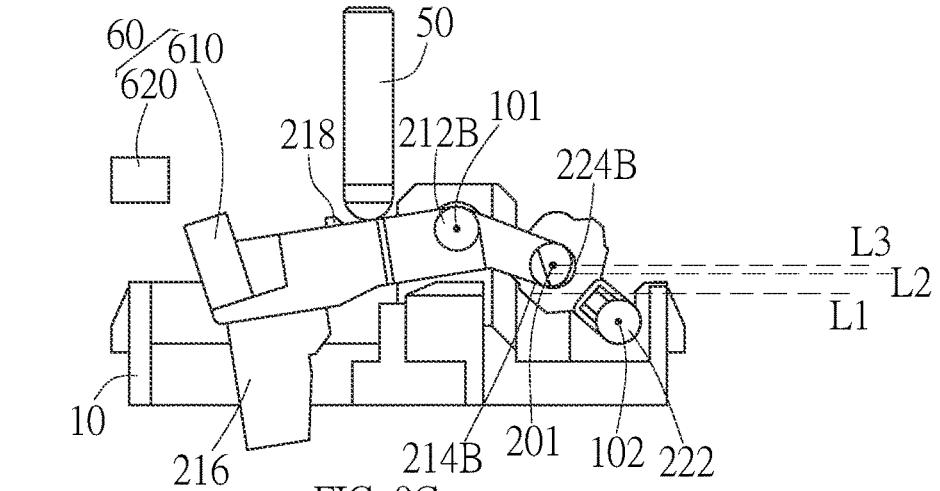

Referring to FIG. 9A to FIG. 9C, the operation of the key structure 1B' will be illustrated. FIG. 9A to FIG. 9C show that the key structure 1B' are in the non-pressed state, the transition state, and the pressing stop state, respectively. As shown in FIG. 9A, when the pressing force is not applied to the linkage mechanism 20B (e.g. the first linking member 210B), the linkage mechanism 20B supports the key structure 1B' in the non-pressed state by the force provided by the restoring member (e.g. the magnetic attraction force between the first magnetic member 610 and the second magnetic member 620). In other words, when the key structure 1B' is in the non-pressed state, the coupling axis 201 of the first linking member 210B and the second linking member 220B formed by coupling the first connecting portion 214B and the second connecting portion 224B is located at the non-pressed position L1. The operation member 50 is positioned by the positioning portion 218 of the first linking member 210B, and the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 9B and FIG. 9C, when the pressing force is applied to the first linking member 210B of the linkage mechanism 20B, the first linking member 210B drives the first magnetic member 610 to move away from the second magnetic member 620. Specifically, when the pressing force is applied to the first linking member 210B by the operation member 50, the first linking member 210B rotates about the first rotation axis 101 to enable the actuating portion 216 to rotate counterclockwise (i.e., along the first direction) toward the base 10, and the first magnetic member 610 moves downward with the first linking member 210B to be away from the second magnetic member 620. Meanwhile, the first connecting portion 214B of the first linking member 210B rotates counterclockwise away from the base 10 (i.e., the coupling axis 201 moves upward through the transition position L2 to the pressing stop position L3) and drives the second connecting portion 224B of the second linking member 220B to move upward, so the second linking member 220B is driven to rotate clockwise (i.e., along the second direction) about the second rotation axis 102. Moreover, the actuating portion 216 rotates with the first linking member 210B and moves to a position that the light channel 150 can be shielded, so the intensity of the optical signal received by the receiver 420 from the emitter 410 is smaller (i.e., the amount of light received is less) or substantially equal to zero (i.e., the receiver 420 does not receive the optical signal), and the switch unit 40 is triggered to generate the triggering signal.

When the pressing force is released, the magnetic attraction force between the first magnetic member 610 and the second magnetic member 620 enables the first linking member 210B and the first magnetic member 610 to move close to the second magnetic member 620 back to the position before being pressed (i.e., back to the non-pressed position). Specifically, when the pressing force is released, the magnetic attraction force between the first magnetic member 610 and the second magnetic member 620 enables the first magnetic member 610 to move (e.g. upward) toward the second magnetic member 620 and drives the first linking member 210B to rotate clockwise, and the first connecting portion 214B drives the second linking member 220B to rotate counterclockwise. As such, the key structure 1B' returns from the pressing stop state of FIG. 9C through the transition state of FIG. 9B to the non-pressed state of FIG. 9A.

The key structure 1B' utilizes the associated movements of the first linking member 210B and the second linking member 220B to restrict the rotation range of the first linking member 210B and the second linking member 220B relative to the base 10, thereby achieving a non-collision pressing stop point. In other words, the key structure 1B' can achieve the limiting effect without collision between components to effectively reduce the abnormal sound. Moreover, the key structure 1B' utilizes the magnetic attraction force between the first magnetic member 610 and the second magnetic member 620 to provide a click feedback. In other words, the key structure 1B' can use the magnetic unit 60 as the restoring member not only to replace the torsion spring of FIG. 6A to drive the first linking member 210B with the second linking member 220B to return the non-pressed position, but also utilizes the magnetic attraction force provided by the magnetic unit 60 to enable the key structure 1B' to provide the click feedback, but not limited thereto. In other embodiments (e.g. the embodiment of FIG. 10A), the key structure can use the torsion spring as the restoring member 30 and also uses the magnetic unit 60 to provide the click feedback. As such, the key structure can provide a non-collision silencing effect and a non-contact (e.g. magnetic attraction) click feedback.

Figure 10A:
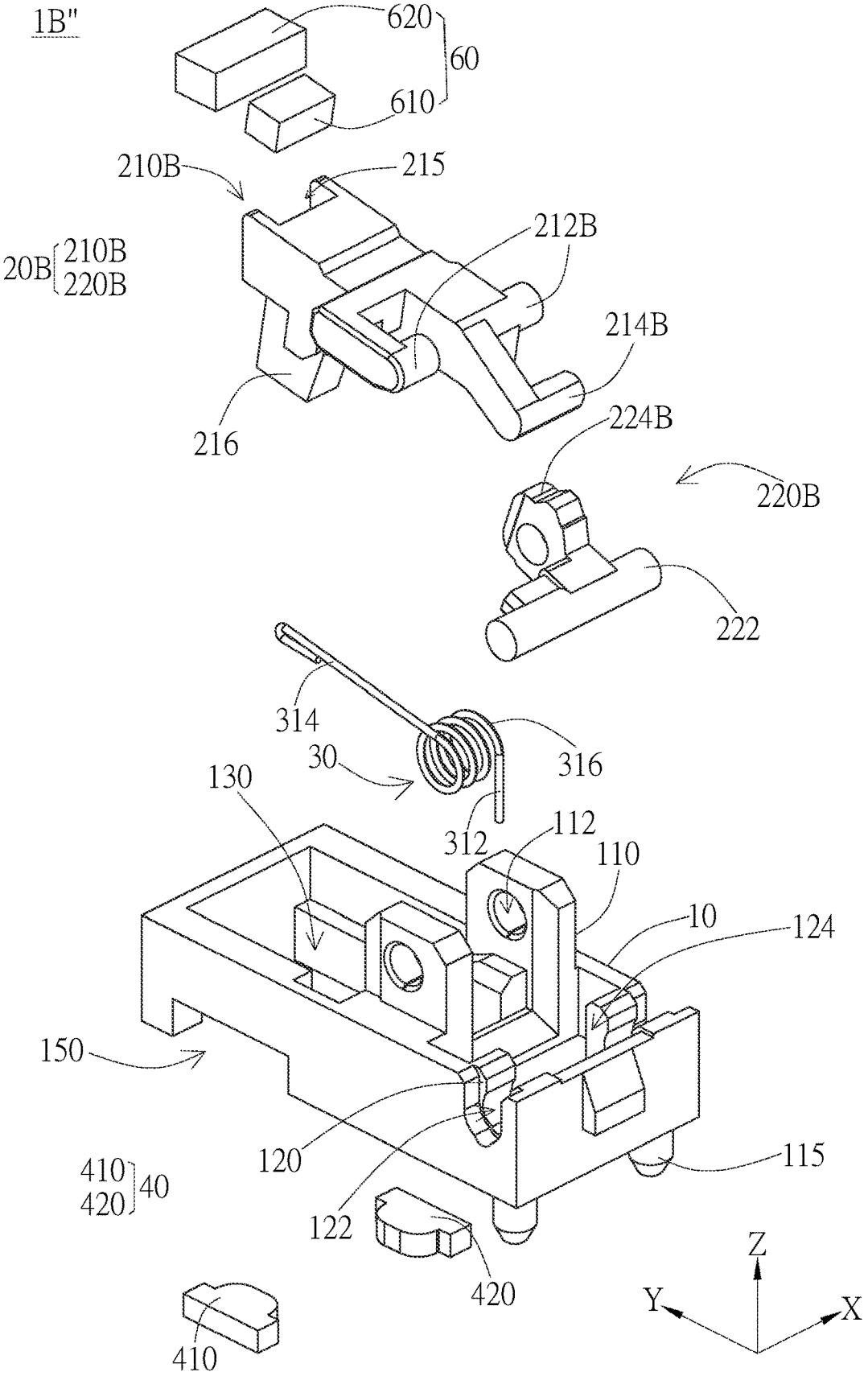
FIG. 10A to FIG. 10D are an exploded view, an assembled view, a bottom view, and a cross-sectional view of the key structure in a fifth embodiment of the invention, respectively.
Figure 10B:
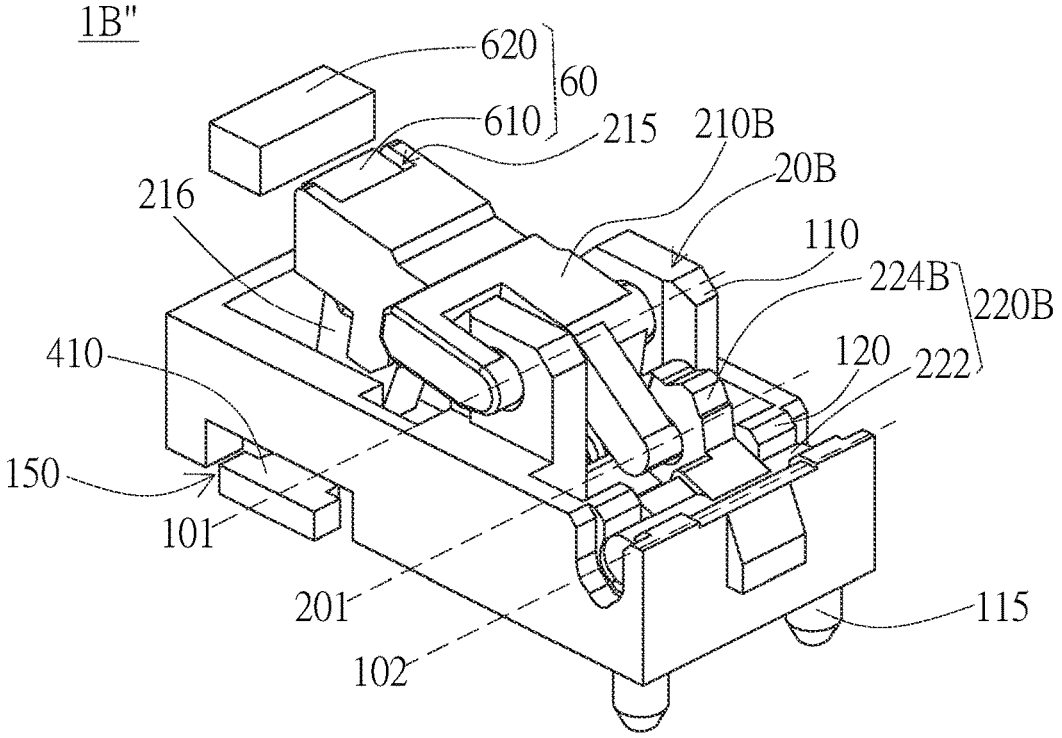
Figure 10C:
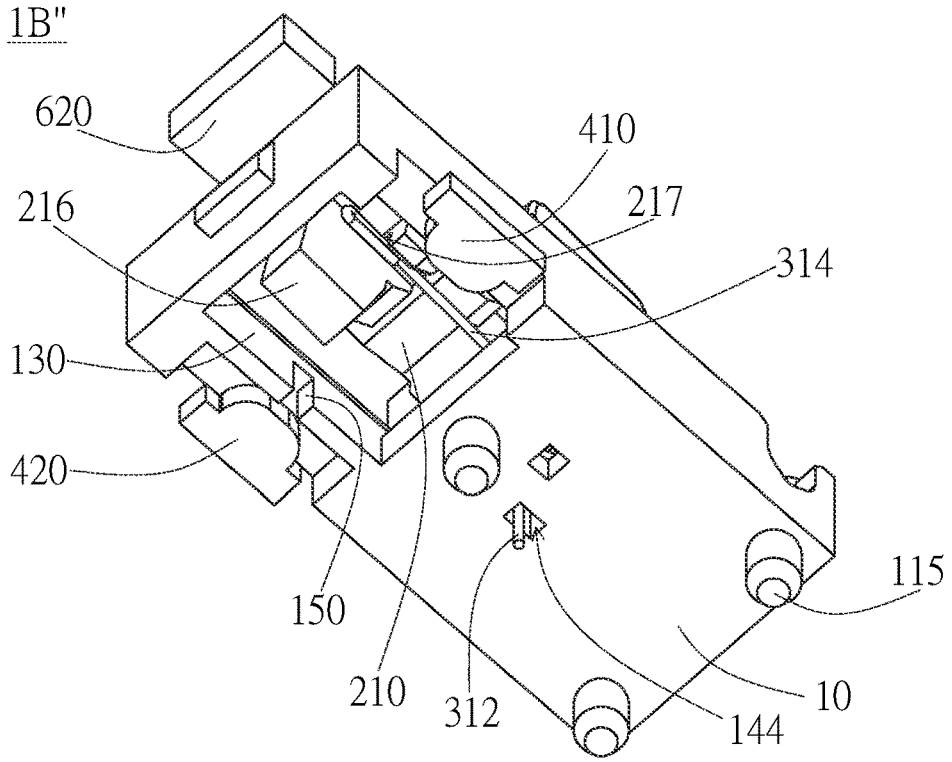
Figure 10D:
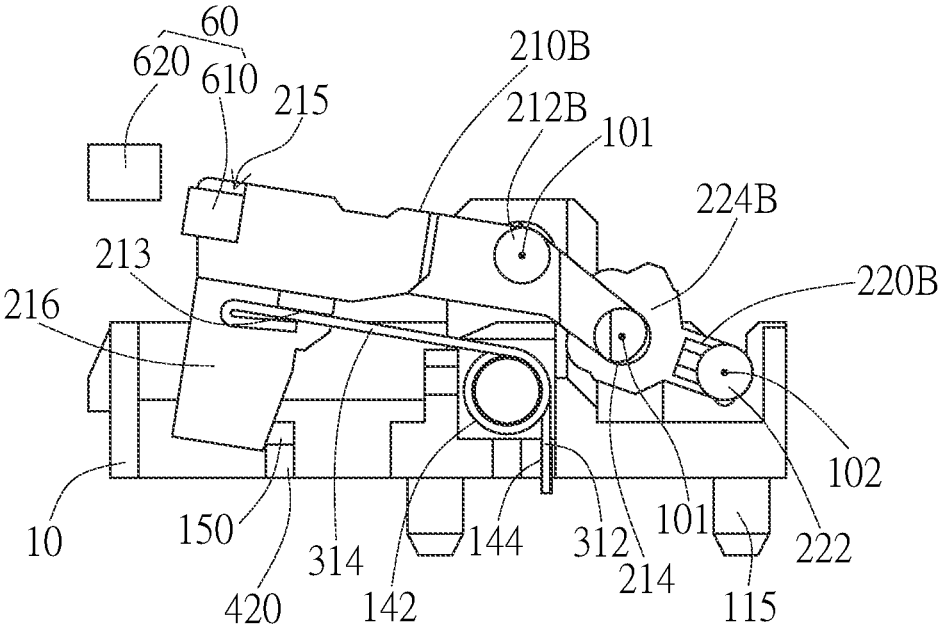

FIG. 10A to FIG. 10D are an exploded view, an assembled view, a bottom view, and a cross-sectional view of the key structure 1B" in a fifth embodiment of the invention, respectively. The key structure 1B" of FIG. 10A is a variant embodiment of the key structures 1B, 1B' of FIG. 6A and FIG. 8A, and the detailed structure and function of components of the key structure 1B" can be referred to the related descriptions of the previous embodiments and will not elaborate again. In this embodiment, the key structure 1B" includes not only the torsion spring type restoring member 30 similar to FIG. 6A, but also the magnetic unit 60 similar to FIG. 8A. Moreover, as shown in FIG. 10C and FIG. 10D, the first linking member 210B of the linkage mechanism 20B preferably has a positioning groove 217, which is adapted to position the acting portion 314 of the restoring member 30. In this embodiment, the positioning groove 217 can be disposed at the bottom of the first linking member 210B near the actuating portion 216. As such, the bottom of the positioning groove 217 can function as the lower surface 213 of the first linking member 210B, which is in contact with the acting portion 314. When the restoring member 30 is disposed on the base 10, the spring body 316 is accommodated in the accommodation space 142, and the positioning portion 312 is inserted into the positioning hole 144 of the base 10, so the acting portion 314 is at least partially inserted into the positioning groove 217 and against the lower surface 213 to enhance the coupling effect of the acting portion 314 of the restoring member 30 and the first linking member 210B, but not limited thereto. In this embodiment, the base 10 may further include a positioning mechanism 115 to facilitate the positioning of the key structure 1B" on other component (e.g. the circuit board or the support component). For example, the positioning mechanism 115 can be implemented as a post protruding from the bottom of the base 10, but not limited thereto. In other embodiments, the positioning mechanism 115 can be implemented as a hole or a groove on the bottom of the base 10.

In this embodiment, the operation of the key structure 1B" is similar to those of FIGS. 7A and 7B or those of FIG. 9A to FIG. 9C. As shown in FIG. 10D, when the pressing force is not applied to the linkage mechanism 20B (e.g. the first linking member 210B), the linkage mechanism 20B supports the key structure 1B" in the non-pressed state by the restoring force provided by the restoring member 30 and the magnetic attraction force between the first magnetic member 610 and the second magnetic member 620. When the key structure 1B" is in the non-pressed state, the actuating portion 216 of the first linking member 210B does not shield or partially shields the light channel 150, so the intensity of the optical signal received by the receiver 420 from the emitter 410 is stronger (i.e., the amount of light received is larger). When the pressing force is applied to the first linking member 210B of the linkage mechanism 20B, the first linking member 210B rotates about the first rotation axis 101 along the first direction (e.g. counterclockwise). The first linking member 210B drives the first magnetic member 610 to move away from the second magnetic member 620, and the first linking member 210B pushes the acting portion 314 of the restoring member 30 by the lower surface 213, so the acting portion 314 is elastically deformed with respect to the positioning portion 312. Meanwhile, the first connecting portion 214B of the first linking member 210B also rotates counterclockwise away from the base 10 (i.e., the coupling axis 201 moves upward to the pressing stop position) and drives the second connecting portion 224B of the second linking member 220B to move upward, so the second linking member 220B is driven to rotate about the second rotation axis 102 along the second direction (e.g. clockwise). Through the linkage of the first linking member 210B and the second linking member 220B, the rotation range of the first linking member 210B and the second linking member 220B relative to the base 10 can be restrained. In other words, once the coupling axis 201 reaches the pressing stop position, the coupling axis 201 can no longer move upward. Moreover, the actuating portion 216 rotates with the first linking member 210B to a position that the light channel 150 can be shielded. As such, the intensity of the optical signal received by the receiver 420 from the emitter 410 is smaller (e.g. the amount of light received is less) or substantially equal to zero (i.e., the receiver 420 does not receive the optical signal), and the switch unit 40 is triggered to generate the triggering signal.

When the pressing force is released, the restoring force provided by the restoring member 30 and the magnetic attraction force between the first magnetic member 610 and the second magnetic member 620 enable the acting portion 314 to push the lower surface 213 of the first linking member 210B upward and drive the first linking member 210B to rotate clockwise. As such, the first connecting portion 214B drives the second linking member 220B to rotate counterclockwise, and the first linking member 210B drives the first magnetic member 610 to move close to the second magnetic member 620, making the key structure 1B" return to the non-pressed state. Specifically, the key structure 1B" not only utilizes the displacement limitation of the first linking member 210B and the second linking member 220B to achieve the pressing stop point without collision of components, but also utilizes the magnetic attraction force provided by the magnetic unit 60 to make the key structure 1B" have the silent click feedback, so that the abnormal sound caused by collision of components can be reduced.

Figure 11A:
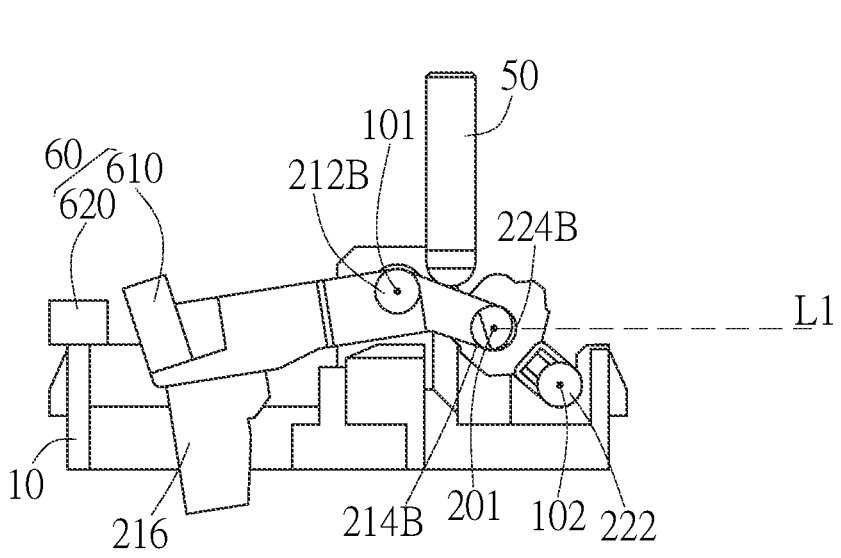
Figure 11B:
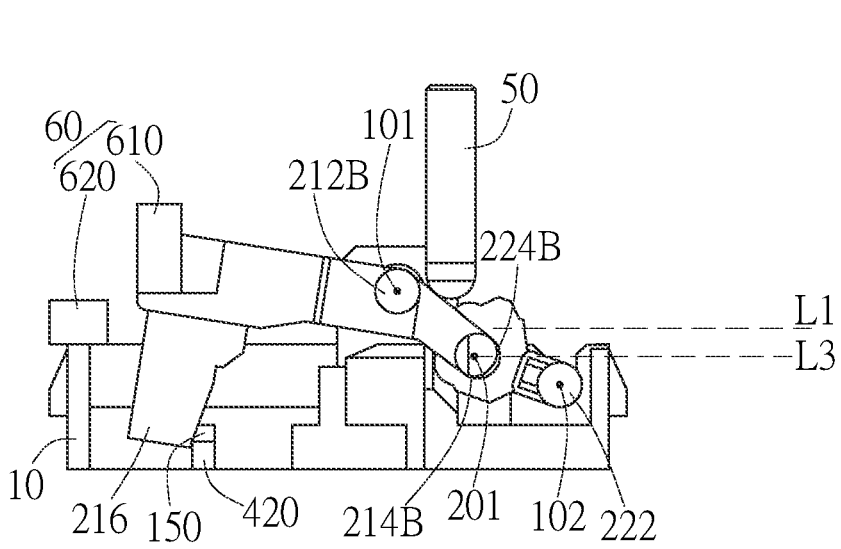

In the previous embodiments, the operations of the key structure 1, 1A, 1B, 1B', or 1B" is illustrated by using the operation member 50 to apply the pressing force on the side of the first linking member 210, 210A, or 210B opposite to the first connecting portion 214, 214A, or 214B with respect to the first rotation axis 101, so the coupling axis 201 moves away from the base 10 after the pressing force is applied, but not limited thereto. As shown in FIG. 11A and FIG. 11B, FIG. 11A and FIG. 11B are schematic views of a variant embodiment of the operation of the key structure 1B' of FIG. 8A. In this embodiment, the pressing force is applied to the same side of the first linking member 210B as the first connecting portion 214B with respect to the first rotation axis 101, so the coupling axis 201 moves toward the base 10 when the pressing force is applied. Specifically, as shown in FIG. 11A, when the pressing force is not applied to the first linking member 210B, the linkage mechanism supports the key structure 1B' in the non-pressed state by the magnetic attraction force between the first magnetic member 610 and the second magnetic member 620. In other words, the coupling axis 201 is located at the non-pressed position L1, and the actuating portion 216 of the first linking member 210B at least partially shields the light channel 150, so the intensity of the optical signal received by the receiver 420 from the emitter 410 is smaller (i.e., the amount of light received is less) or substantially equal to zero (i.e., the receiver 420 does not receive the optical signal). As shown in FIG. 11B, when the pressing force is applied to the righthand side of the first linking member 210B (i.e., the same side as the first connecting portion 214B with respect to the first rotation axis 101) by the operation member 50, the first linking member 210B rotates about the first rotation axis 101 along the first direction (e.g. clockwise) to drive the actuating portion 216 to rotate clockwise (also along the first direction) away from the base 10, and the first magnetic member 610 moves upward with the first linking member 210B away from the second magnetic member 620. Meanwhile, the first connecting portion 214B of the first linking member 210B rotates clockwise toward the base 10 (i.e., the coupling axis 201 moves downward to the pressing stop position L3) and drives the second connecting portion 224B of the second linking member 220B to move downward, so the second linking member 220B is driven to rotate about the second rotation axis 102 along the second direction (e.g. counterclockwise). Moreover, the actuating portion 216 rotates with the first linking member 210B and moves to a position to open the light channel 150, so the intensity of the optical signal received by the receiver 420 from the emitter 410 is stronger (e.g. the amount of light received is larger), and the switch unit is triggered to generate the triggering signal.

Figure 12B:
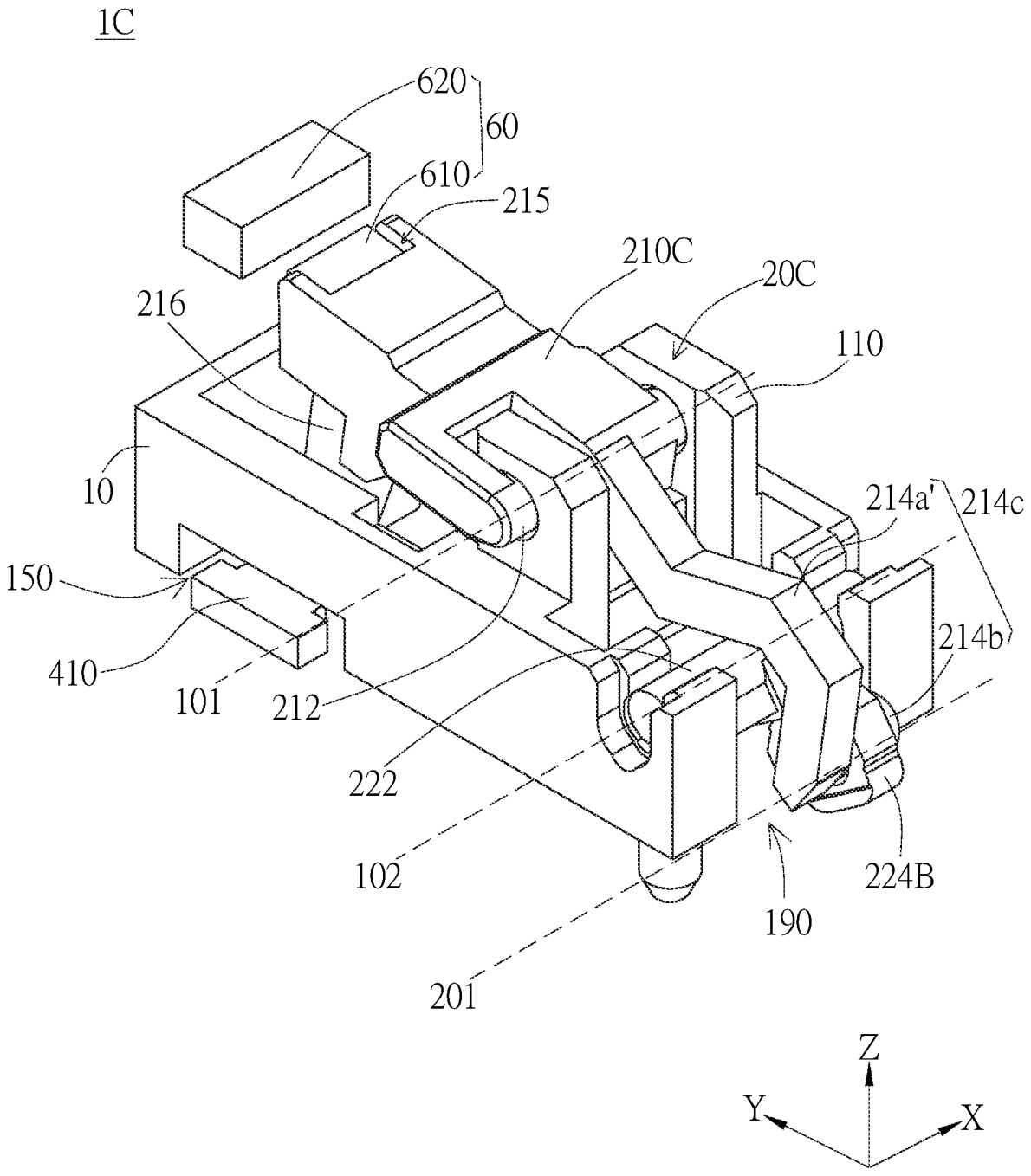

FIG. 12A and FIG. 12B are an exploded view and an assembled view of the key structure 1C of a sixth embodiment of the invention. In this embodiment, by modifying the design of the linkage mechanism, the coupling axis can be located not between the two rotation axes. For example, as shown in FIG. 12A and FIG. 12B, the key structure 1C includes a linkage mechanism 20C and the base 10. The key structure 1C and the key structure 1B' are different in that the first linking member 210C of the linkage mechanism 20C has a first connecting portion 214C, so the coupling position of the first linking member 210C and the second linking member 220B are changed. The structure and function of other components of the key structure 1C can be referred to the related descriptions of the previous embodiments and will not elaborate again. Specifically, the first connecting portion 214C of the first linking member 210C includes a first connection section 214*a*', which extends from the first pivoting portion 212. The first connection section 214*a*' preferably extends by a length beyond the second coupling portion 120 of the base 10, and a pivot 214*b* is formed at the end of the first connection section 214*a* and extends along the X-axis direction. When the linkage mechanism 20C is disposed on the base 10, the first pivoting portion 212 of the first linking member 210C couples with the first coupling portion 110 of the base 10 to form the first rotation axis 101. The second pivoting portion 222 of the second linking member 220B couples with the second coupling portion 120 of the base 10 to form the second rotation axis 102. The first connecting portion 214C of the first linking member 210C extends across the second rotation axis 102 to couple with the second connecting portion 224B of the second linking member 220B to form the coupling axis 201. As such, the coupling axis 201 is located at the outer side of the first rotation axis 101 and the second rotation axis 102. In other words, the first rotation axis 101, the second rotation axis 102, and the coupling axis 201 are disposed sequentially along the Y-axis direction. In response to the modification of the first linking member 210C, the base 10 further has an action space 190, which allows the linkage mechanism 20C (e.g. the second linking member 220B) to move therein. For example, the action space 190 can be formed as an opening of the base 10, which corresponds to the coupling axis 201, so an open space communicating with the outside is formed between the two pivotal holes 122 of the second coupling portion 120, but not limited thereto.

Figure 13A:
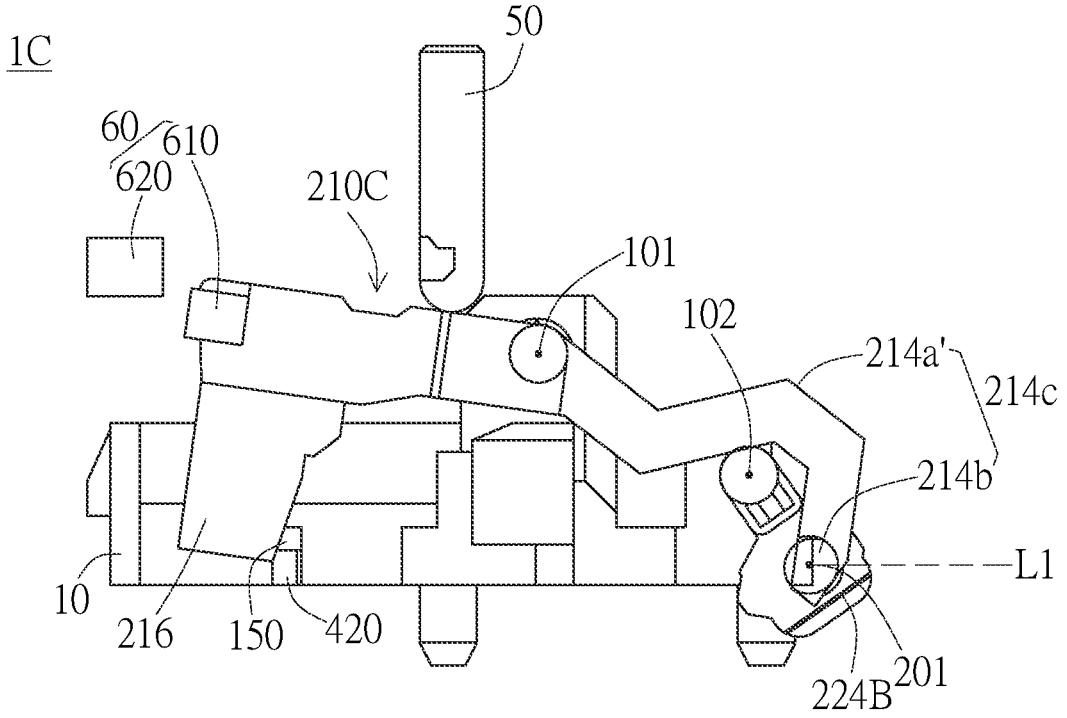
Figure 13B:
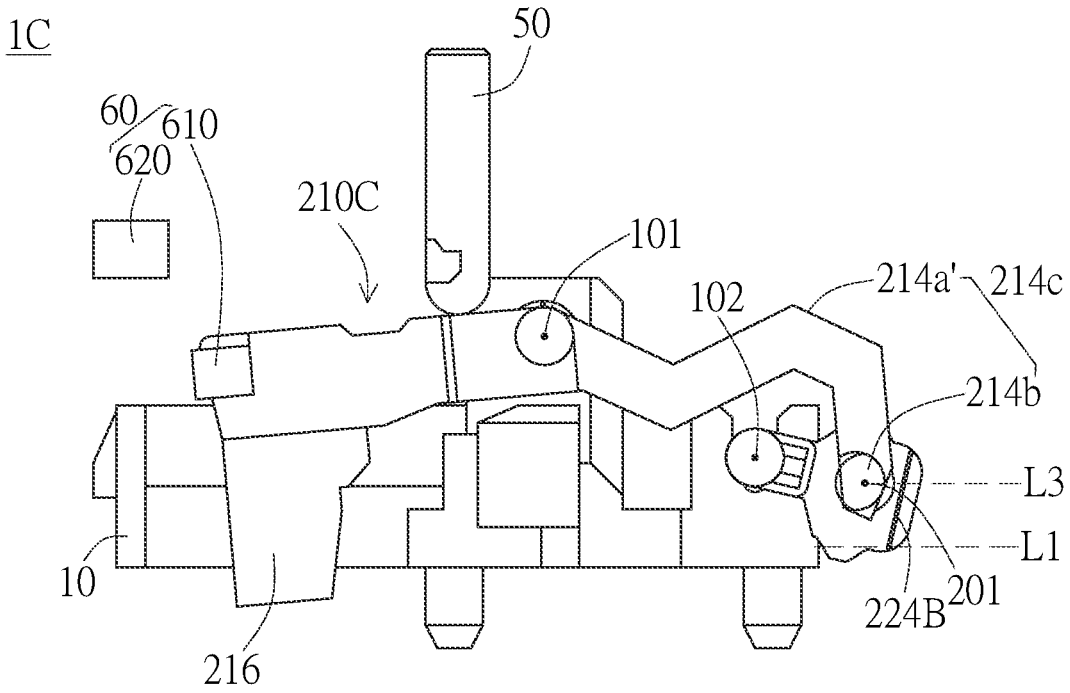

Referring to FIG. 13A and FIG. 13B, the operation of the key structure 1C is illustrated. FIG. 13A and FIG. 13B show that the key structure 1C is in the non-pressed state and the pressing stop state, respectively. As shown in FIG. 13A, when the pressing force is not applied to the linkage mechanism 20C (e.g. the first linking member 210C), the linkage mechanism 20C supports the key structure 1C in the non-pressed state by the magnetic attraction force between the first magnetic member 610 and the second magnetic member 620. When the key structure 1C is in the non-pressed state, the coupling axis 201 of the first linking member 210C and the second linking member 220B formed by coupling the first connecting portion 214C and the second connecting portion 224B is located at the non-pressed position L1, and the actuating portion 216 of the first linking member 210C does not shield or partially shields the light channel 150, so the intensity of the optical signal received by the receiver 420 from the emitter 410 is stronger (i.e., the amount of light received is larger).

As shown in FIG. 13B, when the pressing force is applied to the first linking member 210C by the operation member 50, the first linking member 210C rotates about the first rotation axis 101 to enable the actuating portion 216 to rotate counterclockwise (i.e., along the first direction) toward the base 10, and the first magnetic member 610 moves downward with the first linking member 210C away from the second magnetic member 620. Meanwhile, the first connecting portion 214C of the first linking member 210C also rotates counterclockwise away from the base 10 (i.e., the coupling axis 201 moves upward to the pressing stop position L3) and drives the second connecting portion 224B of the second linking member 220B to move upward, so the second linking member 220B is driven to rotate about the second rotation axis 102 along the second direction (e.g. counterclockwise) in the action space 190. In other words, by modifying the coupling design of the plurality of linking members, the first linking member 210C can drive the second linking member 220B to rotate along the same direction (i.e., the first direction and the second direction are the same direction). Moreover, the actuating portion 216 rotates with the first linking member 210C and moves to a position that the light channel 150 can be shielded, so the intensity of the optical signal received by the receiver 420 from the emitter 410 is smaller (e.g. the amount of light received is less) or substantially equal to zero (i.e., the receiver 420 does not receive the optical signal), and the switch unit 40 is triggered to generate the triggering signal.

Figure 14:
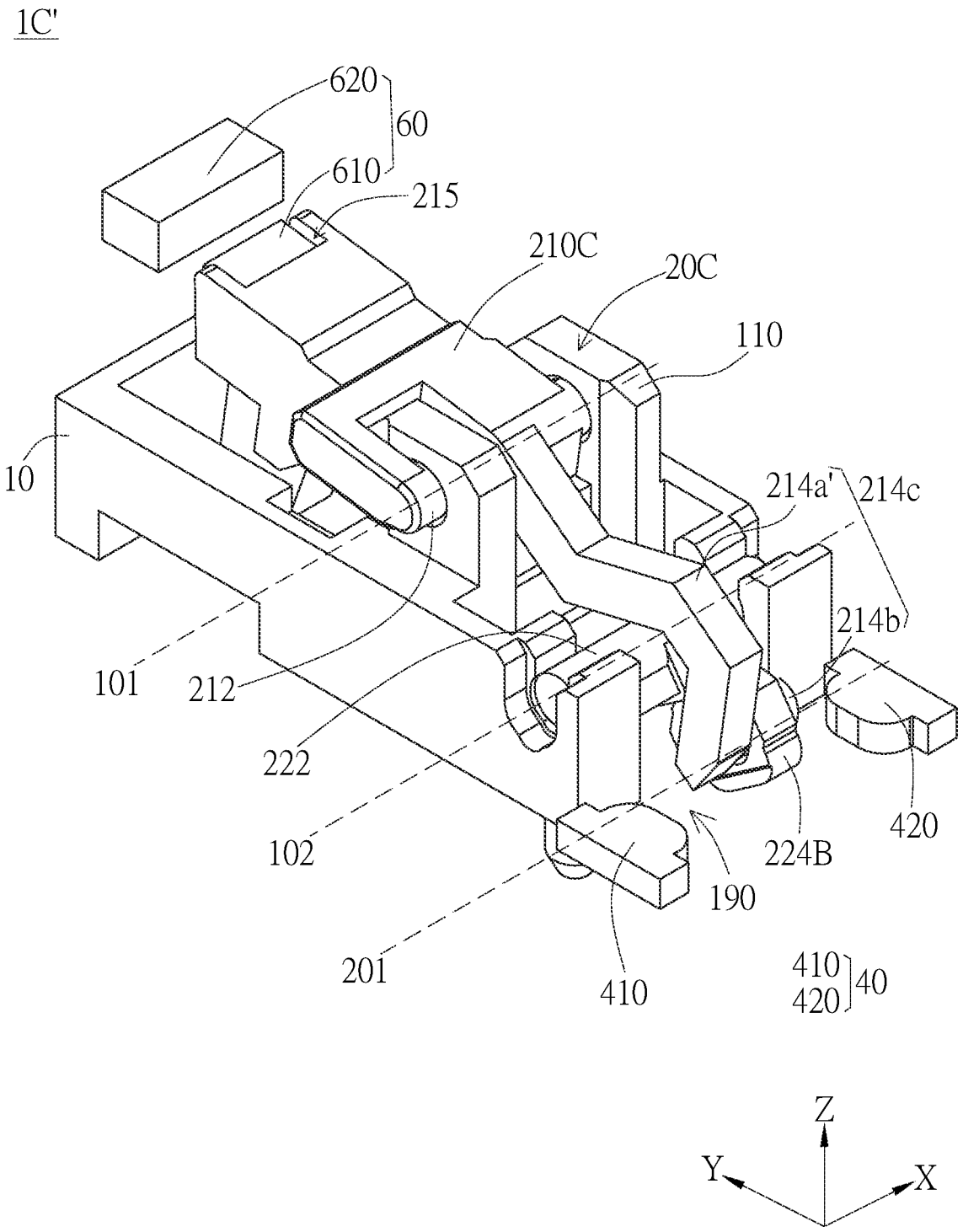
FIG. 14 is a schematic view of a variant embodiment of the key structure of FIG. 12B.
Figure 15A:
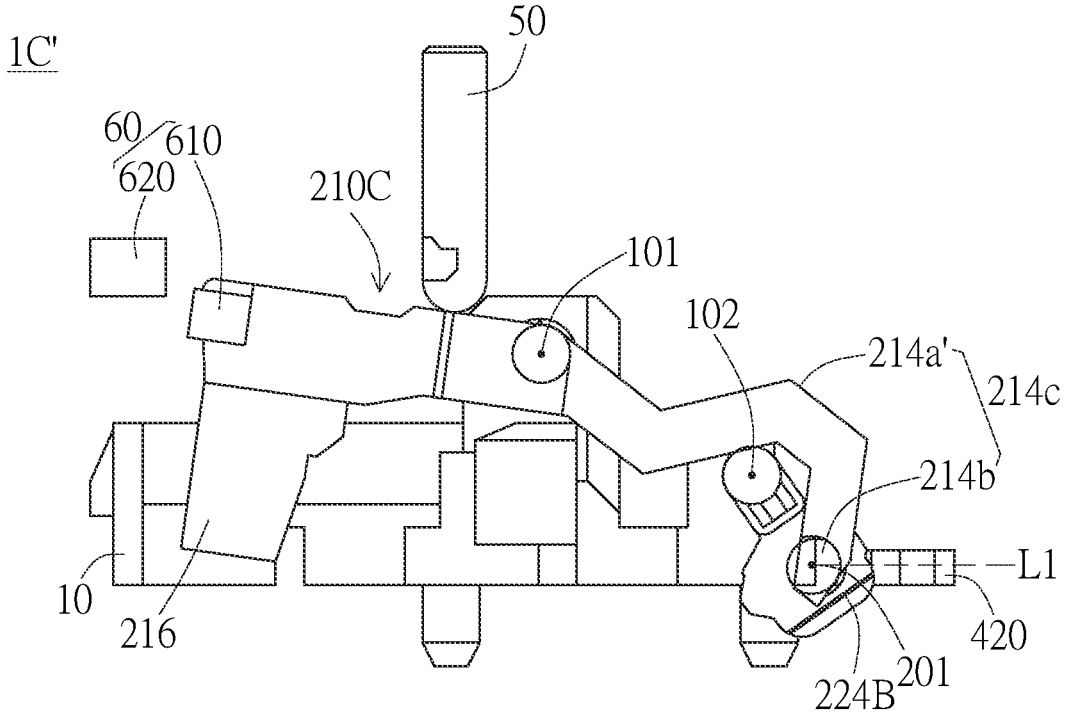
Figure 15B:
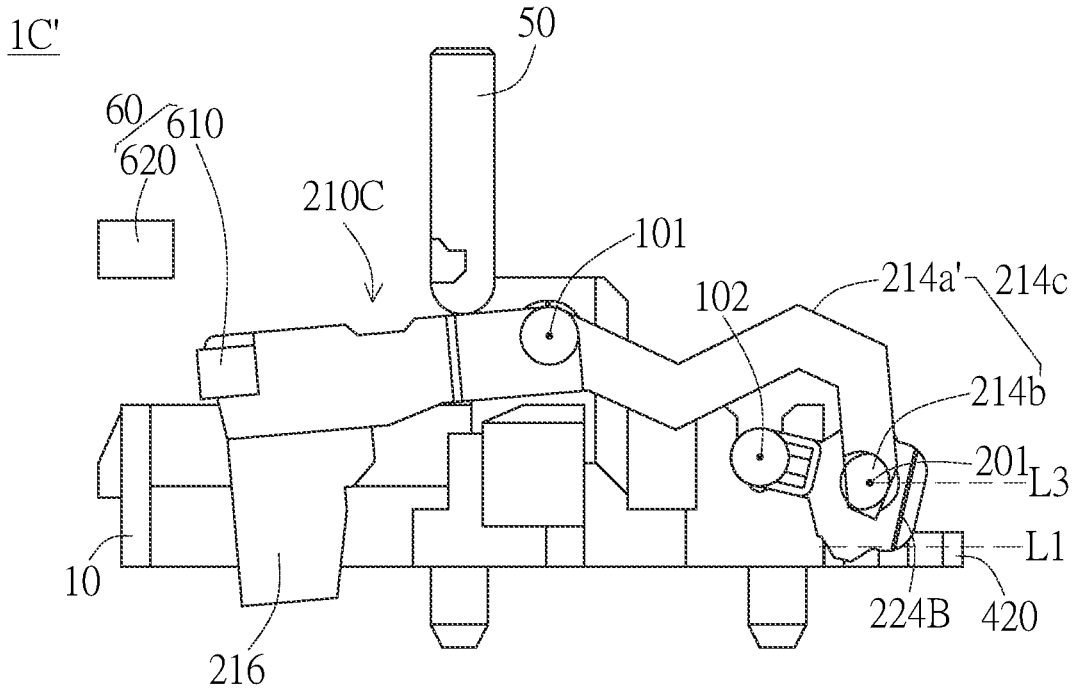

FIG. 14 is a schematic view of a variant embodiment of the key structure 1C of FIG. 12B. In this embodiment, the position of the switch unit 40 of the key structure 1C' is different from that of the key structure 1C, so the switch unit 40 can be triggered by the second linking member 220B. Specifically, in this embodiment, the emitter 410 and the receiver 420 of the switch unit 40 are disposed corresponding to the second linking member 220B at one side of the base 10, such as a position corresponding to the coupling axis 201, so that the switch unit 40 can be triggered by the second linking member 220B. Referring to FIG. 15A and FIG. 15B, the operation of the key structure 1C' is illustrated. FIG. 15A and FIG. 15B show that the key structure 1C' is in the non-pressed state and the pressing stop state, respectively. As shown in FIG. 15A, when the pressing force is not applied to the linkage mechanism 20C (e.g. the first linking member 210C), the linkage mechanism 20C supports the key structure 1C' in the non-pressed state by the magnetic attraction force between the first magnetic member 610 and the second magnetic member 620. When the key structure 1C' is in the non-pressed state, the coupling axis 201 of the first linking member 210C and the second linking member 220B formed by coupling the first connecting portion 214C and second connecting portion 224B is located at the non-pressed position L1. The second linking member 220B (e.g., the second connecting portion 224B) is located at a position that the optical signal is not shielded or partially shielded, so the intensity of the optical signal received by the receiver 420 from the emitter 410 is stronger (e.g. the amount of light received is larger).

As shown in FIG. 15B, when the pressing force is applied to the first linking member 210C by the operation member 50, the first linking member 210C rotates about the first rotation axis 101 to enable the actuating portion 216 (which can be omitted in this embodiment) to rotate counterclockwise toward the base 10, and the first magnetic member 610 moves downward with the first linking member 210C away from the second magnetic member 620. Meanwhile, the first connecting portion 214C of the first linking member 210C also rotates counterclockwise away from the base 10 (i.e., the coupling axis 201 moves upward to the pressing stop position L3) and drives the second connecting portion 224B of the second linking member 220B to move upward, so the second linking member 220B is driven to rotate about the second rotation axis 102 counterclockwise in the action space 190 to a position that the optical signal can be shielded. As such, the intensity of the optical signal received by the receiver 420 from the emitter 410 is smaller (e.g. the amount of light received is less) or substantially equal to zero (i.e., the receiver 420 does not receive the optical signal), and the switch unit 40 is triggered to generate the triggering signal.

Figure 16A:
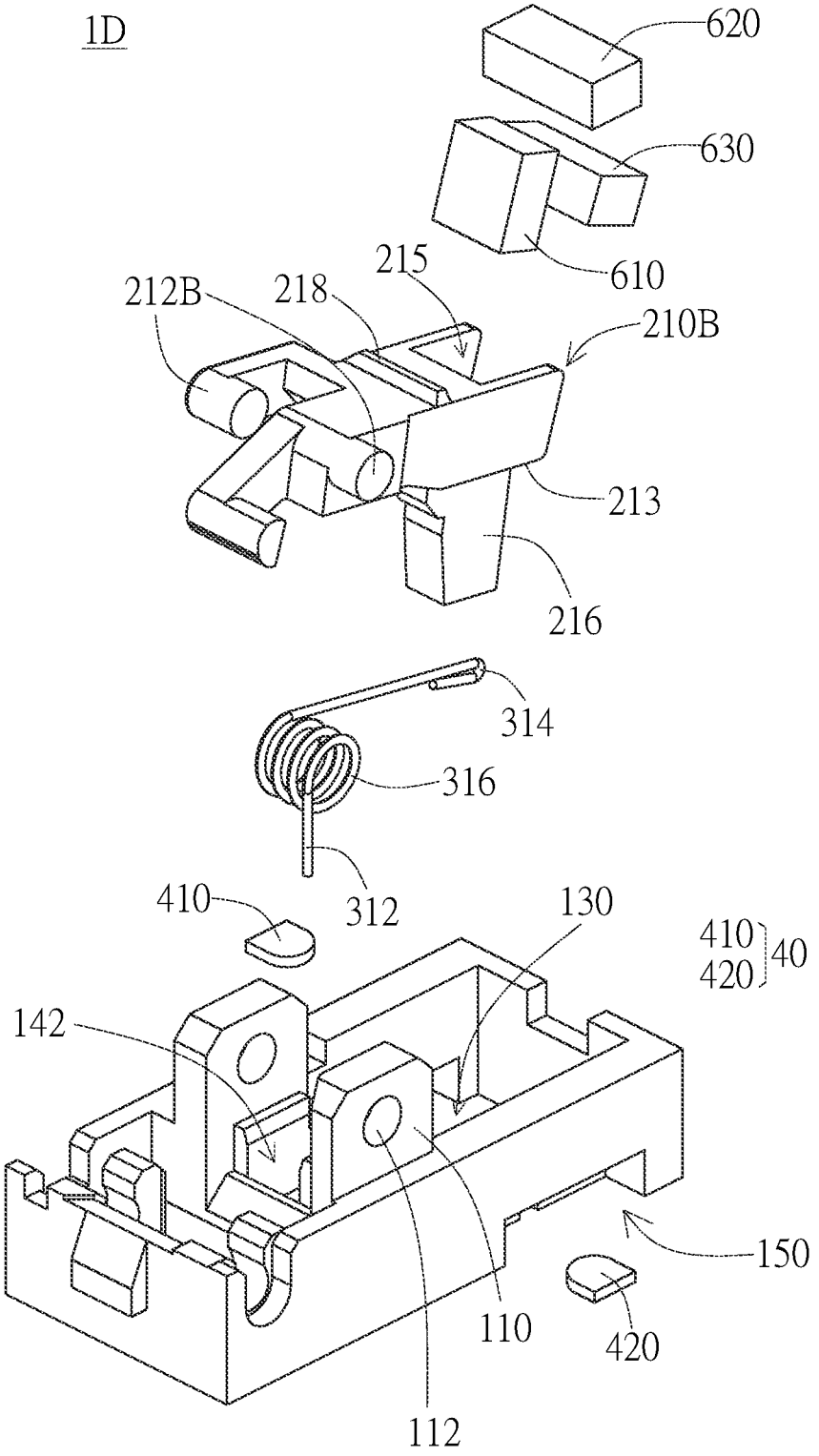
FIG. 16A and FIG. 16B are an exploded view and an assembled view of the key structure in a seventh embodiment of the invention.
Figure 16B:
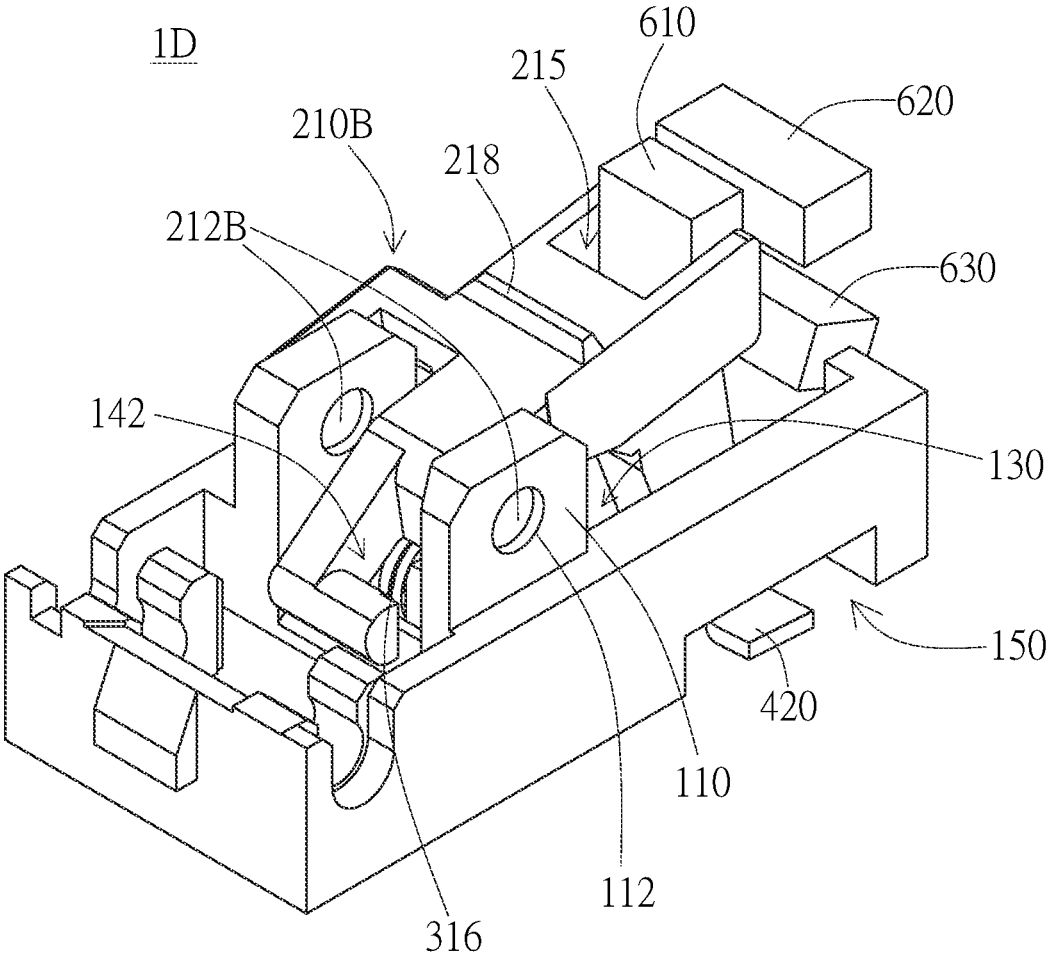

FIG. 16A and FIG. 16B are an exploded view and an assembled view of the key structure 1D in a seventh embodiment of the invention. In this embodiment, the key structure 1D includes the base 10, a movable member (such as the first linking member 210B), and the magnetic unit 60. The movable member is rotatably disposed on the base 10. The magnetic unit 60 includes the first magnetic member 610 and the second magnetic member 620. The first magnetic member 610 is disposed on the movable member, and the second magnetic member 620 is disposed corresponding to the first magnetic member 610 to generate a magnetic attraction force. When a pressing force is applied to the movable member, the movable member drives the first magnetic member 610 to move away from the second magnetic member 620. When the pressing force is released, the magnetic attraction force between the first magnetic member 610 and the second magnetic member 620 enables the movable member to move with the first magnetic member 610 toward the second magnetic member 620 to a position before the pressing force is applied.

Specifically, the key structure 1D of FIG. 16A is a variant embodiment of the key structures 1B, 1B', 1B" of FIG. 6A, FIG. 8A and FIG. 10A. The key structure 1D includes a torsion spring type restoring member 30 similar to those of FIG. 6A and FIG. 10A and the magnetic unit 60 similar to those of FIG. 8A and FIG. 10A. In this embodiment, the key structure 1D can include only the first linking member 2106 as the movable member, and the second linking member 2206 of FIG. 6A, FIG. 8A, or FIG. 10A can be omitted. The magnetic unit 60 can further include a third magnetic member 630. In this embodiment, the first magnetic member 610, the second magnetic member 620, and the third magnetic member 630 of the magnetic unit 60 can be implemented as all magnets or a combination of the magnet and the ferromagnetic material, so the first magnetic member 610 can produce the magnetic attraction force respectively with the second magnetic member 620 and the third magnetic member 630. The third magnetic member 630 and the second magnetic member 620 are disposed along the moving path of the movable member (i.e., the first linking member 210B). When the pressing force is applied to the movable member, the movable member drives the first magnetic member 610 to move away from the second magnetic member 620 and close to the third magnetic member 630. Specifically, the second magnetic member 620 and the third magnetic member 630 can be disposed along the Z-axis direction, and the magnetic attraction force can be generated between the third magnetic member 630 and the first magnetic member 610.

Figure 17A:
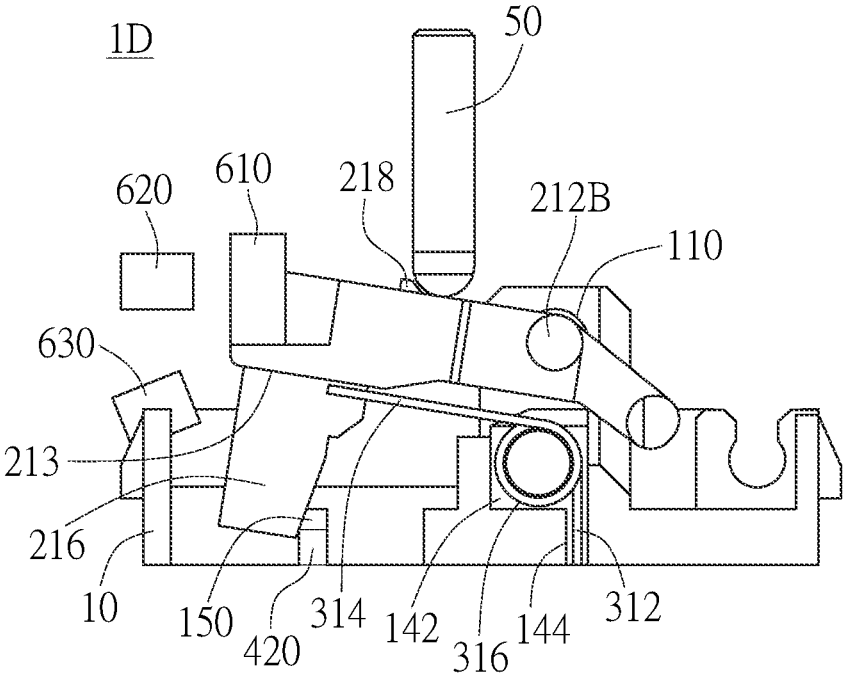
Figure 17B:
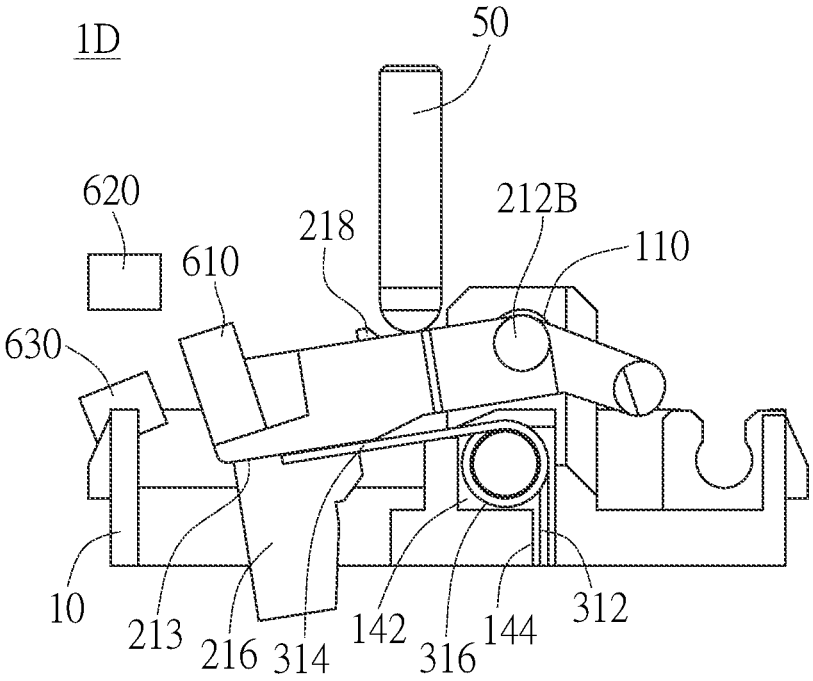

Referring to FIG. 17A and FIG. 17B, the operation of the key structure 1D is illustrated. FIG. 17A and FIG. 17B show that the key structure 1D is in the non-pressed state and the pressing stop state, respectively. As shown in FIG. 17A, when the pressing force is not applied to the movable member (e.g. the first linking member 210B), the linkage mechanism 20B supports the key structure 1D in the non-pressed by the restoring force provided by the restoring member 30 and the magnetic attraction force between the first magnetic member 610 and the second magnetic member 620. When the key structure 1D is in the non-pressed state, the operation member 50 is positioned by the positioning portion 218 of the first linking member 210B, and the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 17B, when the pressing force is applied to the first linking member 210B, the first linking member 210B drives the first magnetic member 610 to move away from the second magnetic member 620 and close to the third magnetic member 630. Specifically, when the pressing force is applied to the first linking member 210B by the operation member 50, the first linking member 210B rotates about the first rotation axis 101 along the first direction (e.g. counter-clockwise), and the lower surface 213 of the first linking member 210 pushes the acting portion 314 of the restoring member 30 downward, so the acting portion 314 moves relative to the positioning portion 312, and the acting portion 314 is elastically deformed with respect to the positioning portion 312. Meanwhile, the first magnetic member 610 moves downward with the first linking member 210B away from the second magnetic member 620 and close to the third magnetic member 630, so the pressing stop point of the key structure 1D can be defined by the magnetic attraction force between the third magnetic member 630 and the first magnetic member 610. Moreover, the actuating portion 216 rotates with the first linking member 210B to a position that the light channel 150 can be partially or fully shielded, so the intensity of the optical signal received by the receiver 420 from the emitter 410 is smaller (i.e., the amount of light received is less) or substantially equal to zero (i.e., the receiver 420 does not receive the optical signal), and the switch unit 40 is triggered to generate the triggering signal.

When the pressing force is released, the restoring force provided by the restoring member 30 enables the acting portion 314 to push the lower surface 213 of the first linking member 210 to drive the first linking member 210 to rotate clockwise, so the first magnetic member 610 moves upward away from the third magnetic member 630 and close to the second magnetic member 620, and the key structure 1D returns from the pressing stop point (or the pressed state) of FIG. 17B to the non-pressed state of FIG. 17A (i.e., the position before the pressing force is applied). Specifically, the key structure 1D utilizes the magnetic attraction force between the first magnetic member 610 and the second magnetic member 620 to position the first linking member 210B in the non-pressed position.

The key structure 1D utilizes the first magnetic member 610 of the magnetic unit 60 to selectively generate the magnetic attraction force with the second magnetic member 620 or with the third magnetic member 630 to be positioned in the non-pressed state or in the pressed state, so the key structure 1D can achieve the limiting effect without collision between components to effectively reduce the abnormal sound. Moreover, the key structure 1D can provide the click feedback by the magnetic attraction force generated between the first magnetic member 610 and the second magnetic member 620 or the magnetic attraction force generated between the first magnetic member 610 and the third magnetic member 630. In other words, the key structure 1D can not only use the magnetic unit 60 as the displacement limiting mechanism, but also use the magnetic attraction forces provided by the magnetic unit 60 to provide the silent click feedback, so the key structure 1D can provide a non-collision silencing effect and a non-contact (magnetic) click feedback.

As shown in FIG. 18A to FIG. 19B, in the above embodiments, the key structure 1, 1A, 1B, 1B', 1B", 1C, or 1D can further include a cover 70, which is combined with the base 10 to form a housing. Specifically, the cover 70 preferably has a shape corresponding to the base 10, such as a rectangular cap. The cover 70 and the base 10 can be combined with each other by any suitable engaging mechanism. For example, the base 10 has hook-like portions 160 on two opposite sides in the Y-axis direction, and the cover 70 has corresponding holes 710. By engaging the hook-like portions 160 with the holes 710, the cover 70 and the base 10 can be combined to form the housing, which is adapted to protect components disposed therein. Moreover, the cover 70 and the base 10 may have an alignment mechanism, so the cover 70 can be easily and accurately combined with the base 10. For example, the cover 70 can have a protrusion 740, and the base 10 has a corresponding recess 170, so the cover 70 and the base 10 can be easily aligned by aligning the protrusion 740 with the recess 170. It is noted that the locations of the engaging mechanism (e.g. the hook-like portion and the hole) and the alignment mechanism (e.g. the protrusion and the recess) of the cover 70 and the base 10 can be interchanged, not limited to the embodiment.

The cover 70 further has an operation hole 730, and the operation member 50 is allowed to move relative to the cover 70 in the operation hole 730. The operation member 50 preferably has a restricting portion 52, which is configured to prevent the operation member 50 from escaping from the cover 70 when the operation member 50 moves in the operation hole 730. For example, the restricting portion 52 can be two wings disposed at two sides of the lower end of the operation member 50, and the distance between the two wings is preferably larger than the corresponding width of the operation hole 730. As such, when the operation member 50 inserted into the operation hole 730 from the bottom of the cover 70 moves upward, the restricting portion 52 can interfere with the cover 70 to prevent the operation member 50 from escaping the cover 70 from the upper side. Corresponding to the magnetic unit 60, the cover 70 can have an opening 720, so the second magnetic member 620 (and the third magnetic member 630) can correspond to the first magnetic member 610 through the opening 720. For example, the second magnetic member 620 (and the third magnetic member 630) can correspond to the opening 720 of the cover 70 (in which the first magnetic member 610 is disposed) or the neighborhood of the opening 720.

In the above embodiments, the key structure of the invention can utilize the linkage mechanism or the magnetic unit to provide the non-collision displacement limitation so as to reduce the abnormal sound caused by collision of the components. Moreover, the key structure of the invention can use the linkage mechanism or the magnetic unit to generate the click feedback so as to provide a silent tactile feedback and a satisfied operation experience.

In another embodiment, as shown in FIG. 20 to FIG. 24B, the eighth embodiment of the invention provide a key structure 1', which can provide silent/audible operation feedbacks for the user to choose. FIG. 20A and FIG. 20B are an exploded view and an assembled view of the key structure 1', respectively. FIG. 21A and FIG. 21B are assembled views of the key structure 1' of FIG. 20A (without the cover 70) from different viewing angles. As shown in FIG. 20A to FIG. 21B, in this embodiment, the key structure 1' includes a base 10, a movable mechanism 20', a sound generating member 80, and an adjusting unit 90. The movable mechanism 20' is movably positioned on the base 10. The sound generating member 80 is positioned on the base 10, and the sound generating member 80 has a hitting portion 814. The hitting portion 814 extends corresponding to an impact surface 155. The adjusting unit 90 is movable relative to the base 10 to be at a first position (ash shown in FIG. 23A) or a second position (as shown in FIG. 24A). When the adjusting unit 90 is at the first position, and a pressing force is applied to the movable mechanism 20', the movable mechanism 20' moves relative to the base 10 and drives the sound generating member 80 to move, so the hitting portion 814 moves toward the impact surface 155 to hit the impact surface 155 to generate a hitting sound. When the adjusting unit 90 is at the second position, and the pressing force is applied to the movable mechanism 20', the movable mechanism 20' moves relative to the base 10, and the adjusting unit 90 restricts the hitting portion 814 to move, so the hitting portion 814 cannot move to hit the impact surface 155 to generate the hitting sound.

Specifically, the movable mechanism 20' can be implemented as a linkage mechanism including a plurality of linking members. The plurality of linking members are movably coupled with each other, and at least one of the plurality of linking members is rotatably positioned on the base 10. When the pressing force is applied to the movable mechanism 20', the plurality of linking members move associated with each other to restrict a moving range of the plurality of linking members relative to the base 10. In this embodiment, the movable mechanism 20' embodied as the linkage mechanism may include a first linking member 210' and a second linking member 220'. The first linking member 210' may have a structure similar to the first linking member 210A of FIG. 4A, including the first pivoting portion 212, the first connecting portion 214A, etc. The second linking member 220' has a structure similar to the second linking member 220B of FIG. 6A, including the second pivoting portion 222 and the second connecting portion 224B, but not limited thereto. In another embodiment, the movable mechanism 20' can be implemented as any suitable linkage mechanism including a plurality of linking members, such as any one of the linkage mechanisms 20, 20A, 20B, 20C in the previous embodiments, but not limited thereto. In other embodiments, the movable mechanism 20' can be implemented as a movable member; for example, the first linking member 210B of FIG. 16A can function as the movable mechanism 20' to drive the sound generating member 80 to move.

Similar to the previous embodiments, the first linking member 210' and the second linking member 220' can be respectively rotatably positioned on the base 10, and the first linking member 210' and the second linking member 220' movably couple with each other. For example, the base 10 can have the first coupling portion 110 and the second coupling portion 120, which are adapted to respectively couple the first linking member 210' and the second linking member 220', so the base 10 and the first linking member 210' (or the second linking member 220') can be rotatably coupled by the coupling structure of a pivot and a pivotal hole. In this embodiment, the first coupling portion 110 and the second coupling portion 120 are exemplarily implemented as pivotal holes (e.g. 112, 122), and the first pivoting portion 212 of the first linking member 210' and the second pivoting portion 222 of the second linking member 220' can have corresponding pivots, but not limited thereto. In other embodiments, according to practical applications, the locations of the pivotal hole and the pivot can be interchanged. For example, each of the first coupling portion 110 and the second coupling portion 120 can have a pivot structure, and each of the first linking member 210' and the second linking member 220' has a corresponding pivotal hole structure. It is noted that the respective rotatable coupling mechanism of the first linking member 210' and the second linking member 220' of the movable mechanism 20' to the base 10, the displacement limitation of the first linking member 210' and the second linking member 220' by coupling the first connecting portion 214A and the second connecting portion 2246 can be referred to the related descriptions of the first embodiment and will not elaborate again. In addition, similar to the previous embodiments, the base 10 can have the accommodation space 142 between the two pivotal holes 112 of the first coupling portion 110, the opening 130 formed on the bottom of the base 10, the hook-like portion 160, the alignment mechanism (e.g. the recess 170), etc.

Figure 18A:
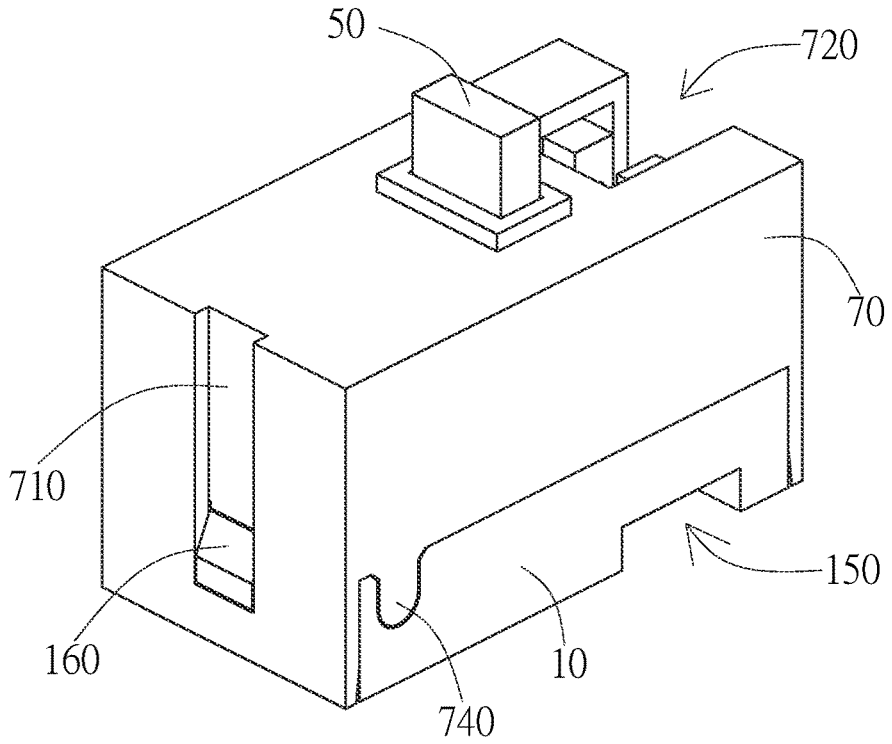
FIG. 18A and FIG. 18B are schematic views of the housing of the key structure in an embodiment of the invention from different viewing angles.
Figure 18B:
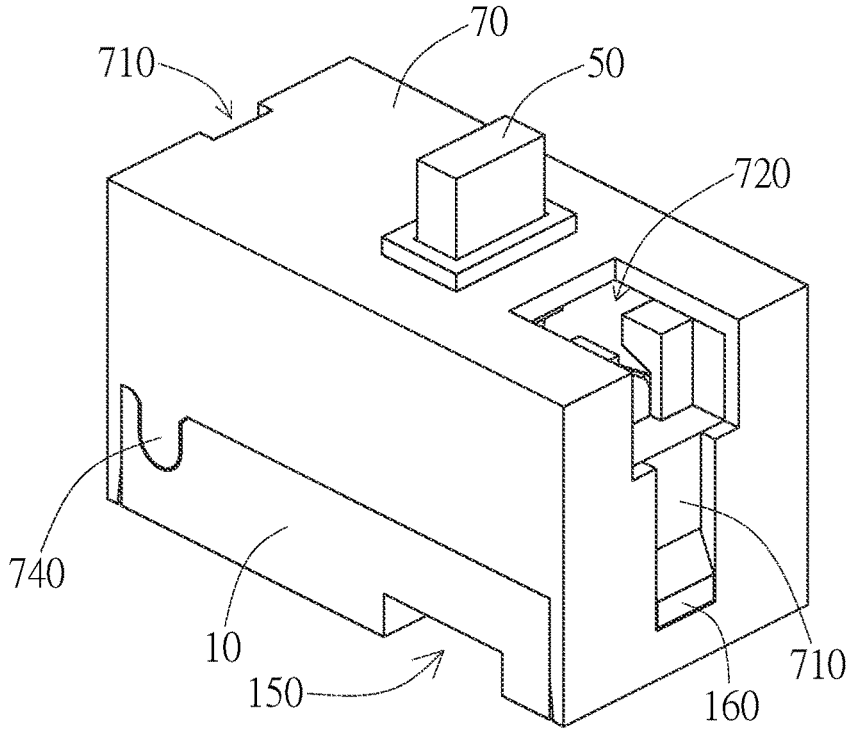
Figure 19A:
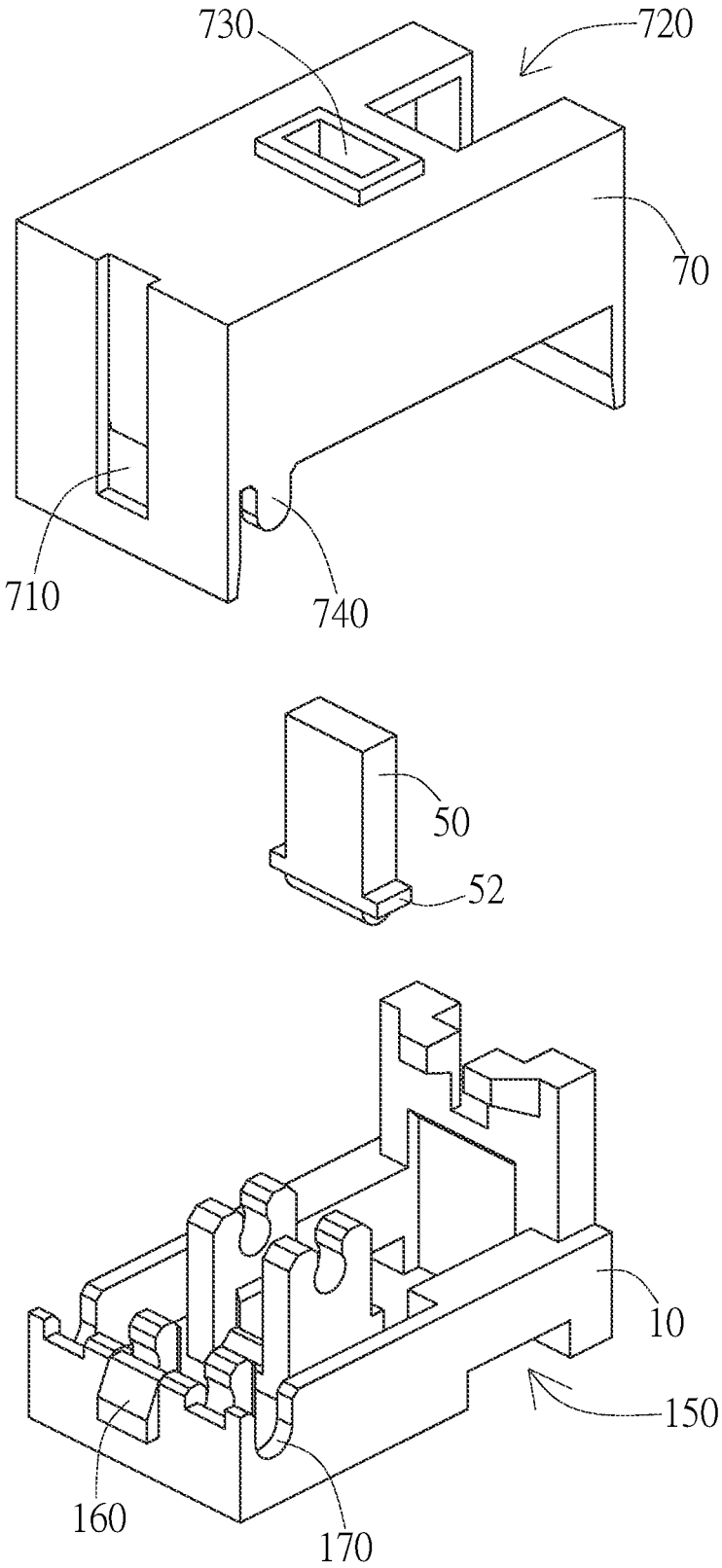
FIG. 19A and FIG. 19B are exploded views of the housing of the key structure of FIG. 18A and FIG. 18B, respectively.
Figure 19B:
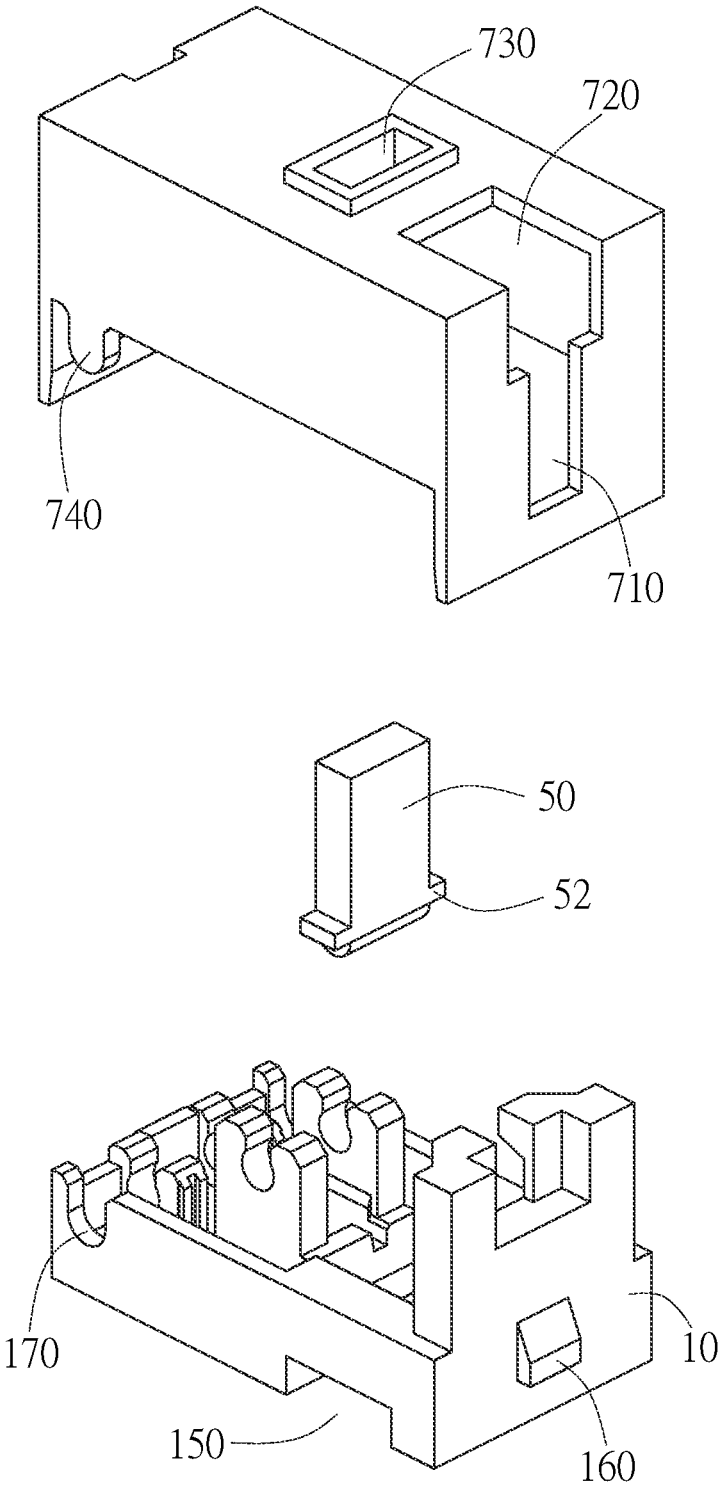

Moreover, the key structure 1' may have the cover 70 similar to that of FIG. 18A, which is combined with the base 10 to form the housing. The detailed structure and function of the cover 70, such as the hole 710, the alignment mechanism (e.g. the protrusion 740), the operation hole 730, can be referred to the related descriptions of the previous embodiments and will not elaborate hereinafter. The key structure 1' may further include the magnetic unit 60 similar to those of the previous embodiments, wherein the first magnetic member 610 is disposed on the movable mechanism 20' (e.g. the receiving portion 215 of the first linking member 210'), and the second magnetic member 620 is disposed corresponding to the first magnetic member 610 on the accommodation portion 720' of the cover 70 to generate the magnetic attraction force with the first magnetic member 610. For example, the accommodation portion 720' can be a recessed portion or an opening. Hereinafter, the difference of the key structure 1' and the key structure (e.g. 1, 1A, 1B, 1B', 1B", 1C, 1C', or 1D) in previous embodiments will be described.

Specifically, the sound generating member 80 can be implemented as a torsion spring including a spring body 816, a contacting portion 812, and the hitting portion 814. The spring body 816 is positioned on the base 10. The contacting portion 812 and the hitting portion 814 extend from two opposite ends of the spring body 816, and the contacting portion 812 is adapted to touch against the movable mechanism 20'. For example, the spring body 816 can be a coil spring. The contacting portion 812 and the hitting portion 814 are two rods extend from two opposite ends of the spring body 816. In this embodiment, with respect to the spring body 816, the contacting portion 812 and the hitting portion 814 preferably extend toward the same direction, such as toward the lefthand side of the spring body 816 corresponding to the first linking member 210'. The extending directions of the contacting portion 812 and the hitting portion 814 may include an angle, which can be any angle as appropriate according to practical applications, not limited to the embodiment.

Figure 22:
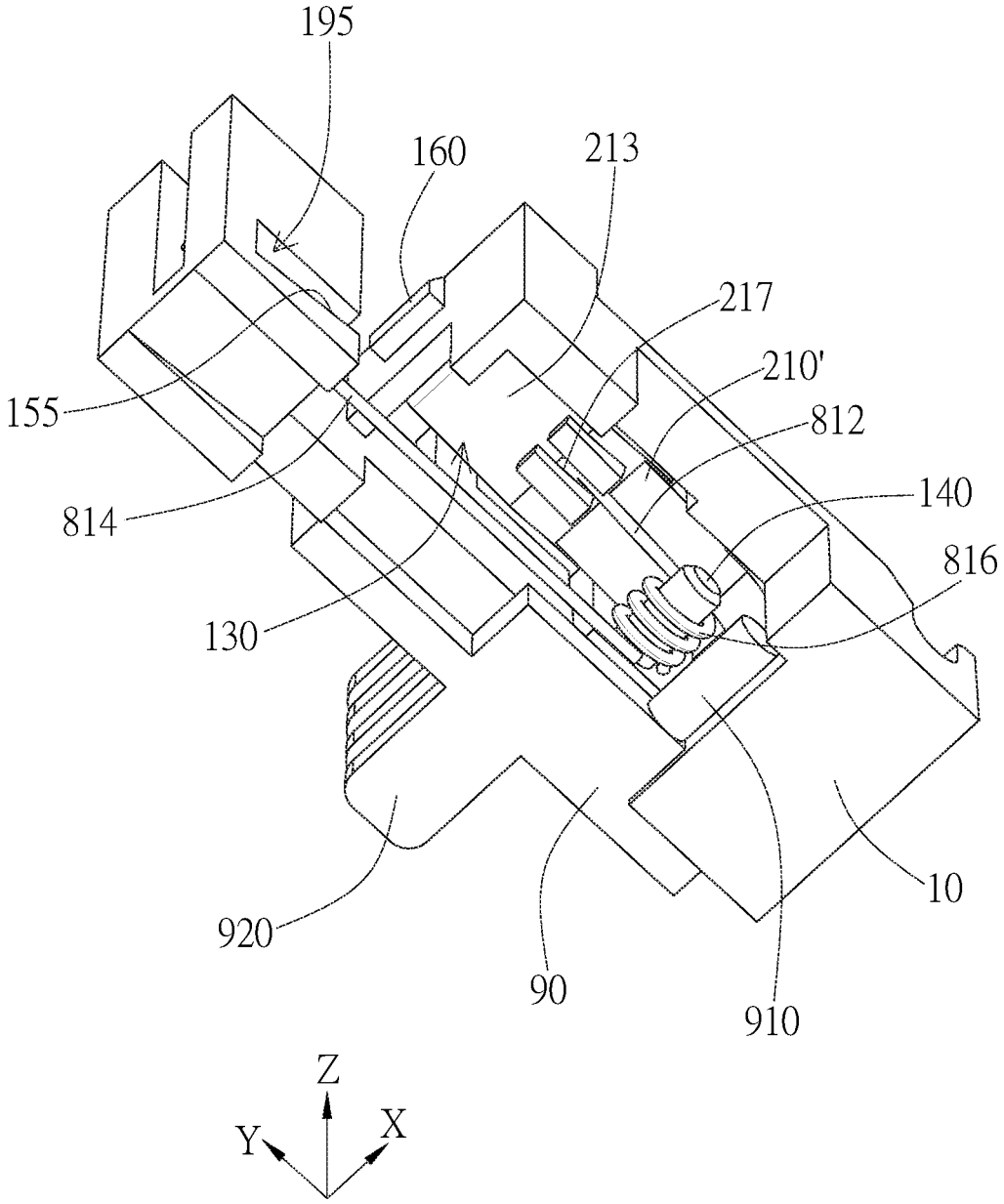
FIG. 22 is a schematic view of the sound generating member positioned on the base of the key structure of FIG. 21A.

Referring to FIG. 22, FIG. 22 is a schematic view showing that the sound generating member 80 is positioned on the base 10. As shown in FIG. 22, corresponding to the spring body 816, the base 10 has a positioning post 140, which is adapted to position the sound generating member 80. For example, the positioning post 140 can be a protrusion extending from the first coupling portion 110 toward the accommodation space 142 along the X-axis direction. The size of the positioning post 140 preferably corresponds to the inner diameter of the spring body 816, so the sound generating member 80 can be rotatably positioned on the base 10 by sleeving the spring body 816 on the positioning post 140. Moreover, when the spring body 816 is sleeved on the positioning post 140, the contacting portion 812 preferably touches against the movable mechanism 20', such as against the lower surface 213 of the first linking member 210'. In this embodiment, the first linking member 210' preferably has the positioning groove 217, and the positioning groove 217 is formed on the lower surface 213 of the first linking member 210' and extends along the Y-axis direction. When the spring body 816 is sleeved on the positioning post 140, the hitting portion 814 extends corresponding to the impact surface 155, and the contacting portion 812 is preferably inserted into the positioning groove 217 to enhance the coupling linkage of the contacting portion 812 and the first linking member 210', but not limited thereto. In this embodiment, the hitting portion 814 preferably extends corresponding to the impact surface 155, so the hitting portion 814 at least partially overlaps the impact surface 155 in the Z-axis direction. In other words, the projection of the hitting portion 814 in the Z-axis direction at least partially falls within the area of the impact surface 155.

The impact surface 155 can be a surface or an extension surface of any suitable components of the key structure 1' and is preferably located on one side of the hitting portion 814 away from the spring body 816. As shown in the drawings, in this embodiment, the impact surface 155 can be implemented as an extension surface of the base 10, and the extension surface can be an inclined surface, but not limited thereto. For example, the impact surface 155 preferably inclinedly extends downward with respect to the extending direction of the hitting portion 814. The inclined angle of the impact surface 155 is preferably designed in a manner that when the hitting portion 814 hits the impact surface 155, the extending direction of the hitting portion 814 is substantially parallel to the inclined surface to increase the hitting area of the hitting portion 814 on the impact surface 155. In another embodiment (not shown), by modifying the designs of the base 10 and the cover 70, the impact surface 155 can be implemented as the surface or the extension surface of the cover 70. In other embodiments, according to practical applications, the impact surface 155 can be the surface of any suitable component, which is independent from the base 10 or the cover 70 and is disposed corresponding to the hitting portion 814.

In this embodiment, the key structure 1' can further include a magnet 650, and the magnet 650 is disposed corresponding to the hitting portion 814. For example, the base 10 can further have a receiving portion 180, which is adapted to accommodate the magnet 650. In this embodiment, the receiving portion 180 can be a recess formed on the base 10, so the magnet 650 can be at least partially received in the recess, but not limited thereto. In other embodiments, the receiving portion 180 can be a surface space of the base 10, so the magnet 650 can be attached to the base 10 by engaging or adhering. Moreover, the base 10 can further have a channel 195, and the channel 195 is located between the magnet 650 and the impact surface 155 to serve as the moving space, so the hitting portion 814 is allowed to move along the channel 195 to hit the impact surface 155. When the adjusting unit 90 is at the first position, and the pressing force is not applied to the movable mechanism 20', the magnetic attraction force can be generated between the magnet 650 and the hitting portion 814, so the moving space is maintained between the hitting portion 814 and the impact surface 155. In other words, the hitting portion 814 and the impact surface 155 are respectively located at two opposite ends of the channel 195. For example, the hitting portion 814 is located at the upper end of the channel 195, and the impact surface 155 is located at the lower end of the channel 195. In another embodiment (not shown), by modifying the designs of the base 10 and the cover 70, the magnet 650 can be disposed on the cover 70 or a separate component independent from the base 10 or the cover 70 corresponding to the hitting portion 814.

In this embodiment, the adjusting unit 90 can be disposed corresponding to the sound generating member 80 on one side of the base 10, so the adjusting unit 90 is preferably movable relative to the base 10 along the extending direction of the hitting portion 814. The adjusting unit 90 includes a blocking portion 910, and the blocking portion 910 is adapted to interfere with or contact the sound generating member 80. As shown in the drawings, the blocking portion 910 is a rod-shaped protrusion and extends along the X-axis direction beyond the hitting portion 814. In other words, the extending length of the blocking portion 910 is larger than the corresponding distance between the hitting portion 814 and the base 10 in the X-axis direction. When the adjusting unit 90 moves relative to the base 10, the blocking portion 910 can selectively interfere or not interfere with the hitting portion 814. For example, when the adjusting unit 90 is at the first position, the blocking portion 910 of the adjusting unit 90 does not interfere with the sound generating member 80. When the adjusting unit 90 is at the second position, the blocking portion 910 interferes with the hitting portion 814 to restrict movement of the hitting portion 814 relative to the impact surface 155. The adjusting unit 90 can further have an operating portion 920, which is adapted to facilitate the moving operation of the adjusting unit 90. For example, the operating portion 920 can be a bump or a rib, which protrudes from the other side of the adjusting unit 90 opposite to the blocking portion 910, and the adjusting unit 90 can be moved by applying force on the operating portion 920.

Figure 23A:
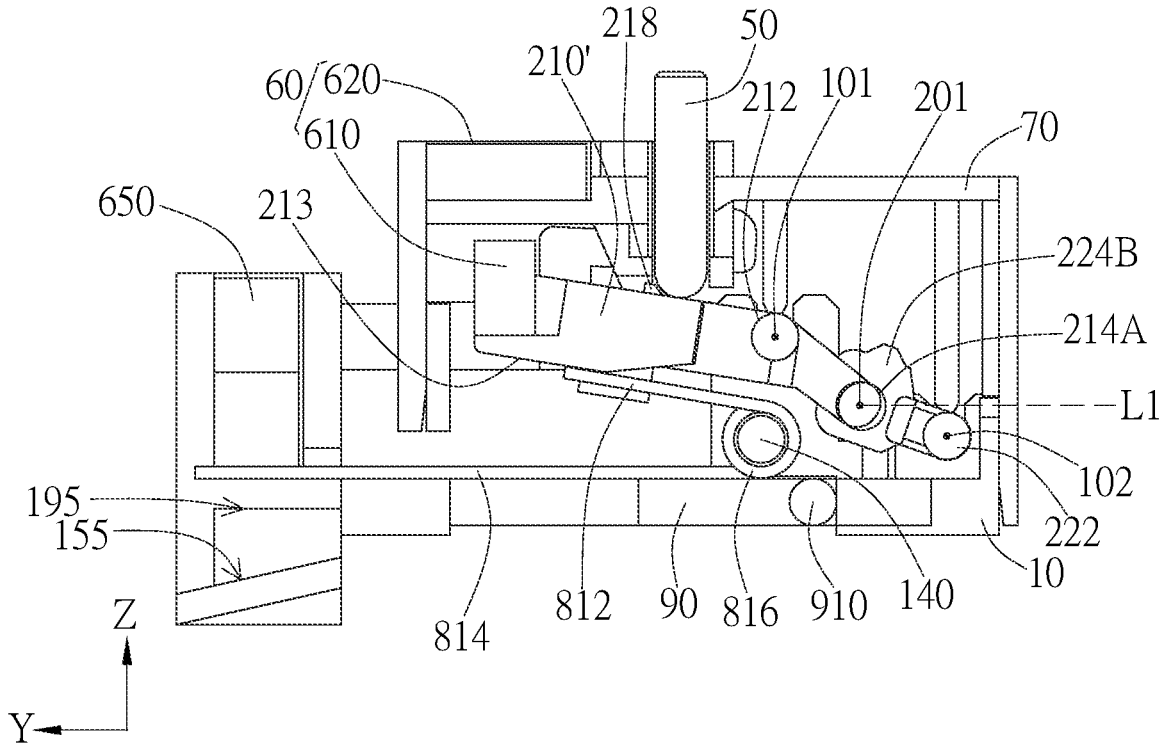
FIG. 23A and FIG. 23B are cross-sectional views showing that the key structure of FIG. 20A is in the non-pressed state and the pressed state, respectively, when the adjusting unit of the key structure is at the first position.
Figure 23B:
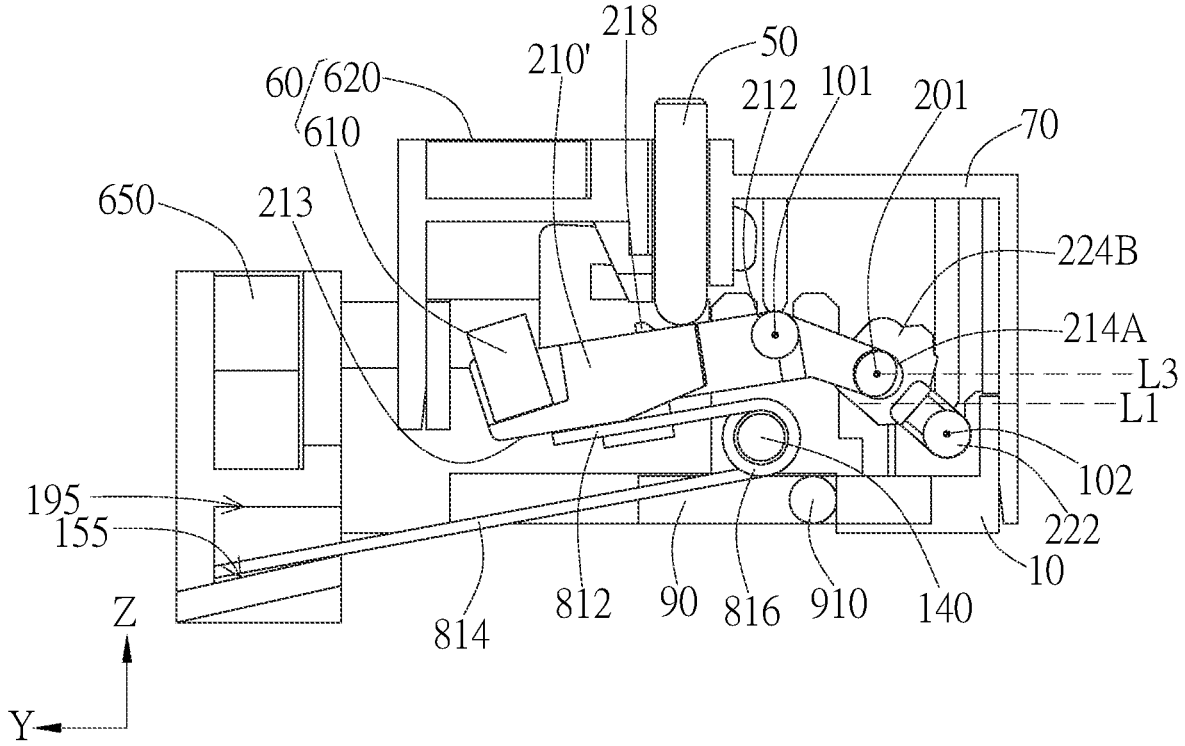
Figure 24A:
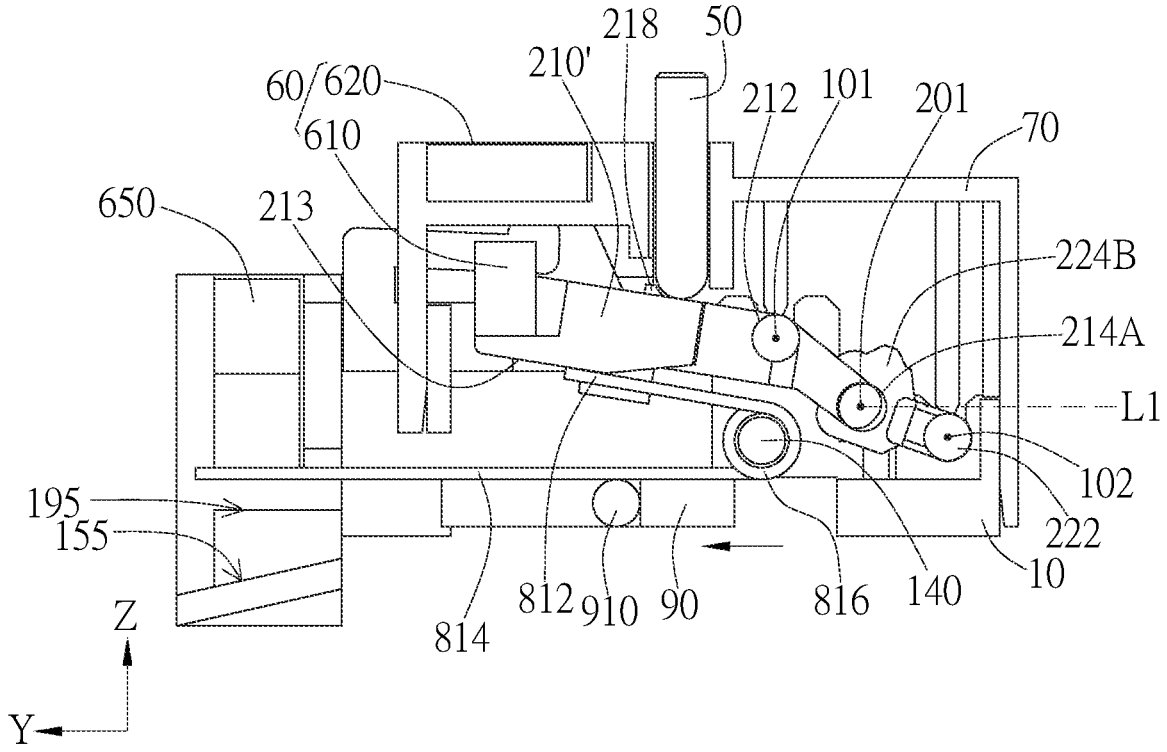
FIG. 24A and FIG. 24B are cross-sectional views showing that the key structure of FIG. 20A is in the non-pressed state and the pressed state, respectively, when the adjusting unit of the key structure is at the second position.
Figure 24B:
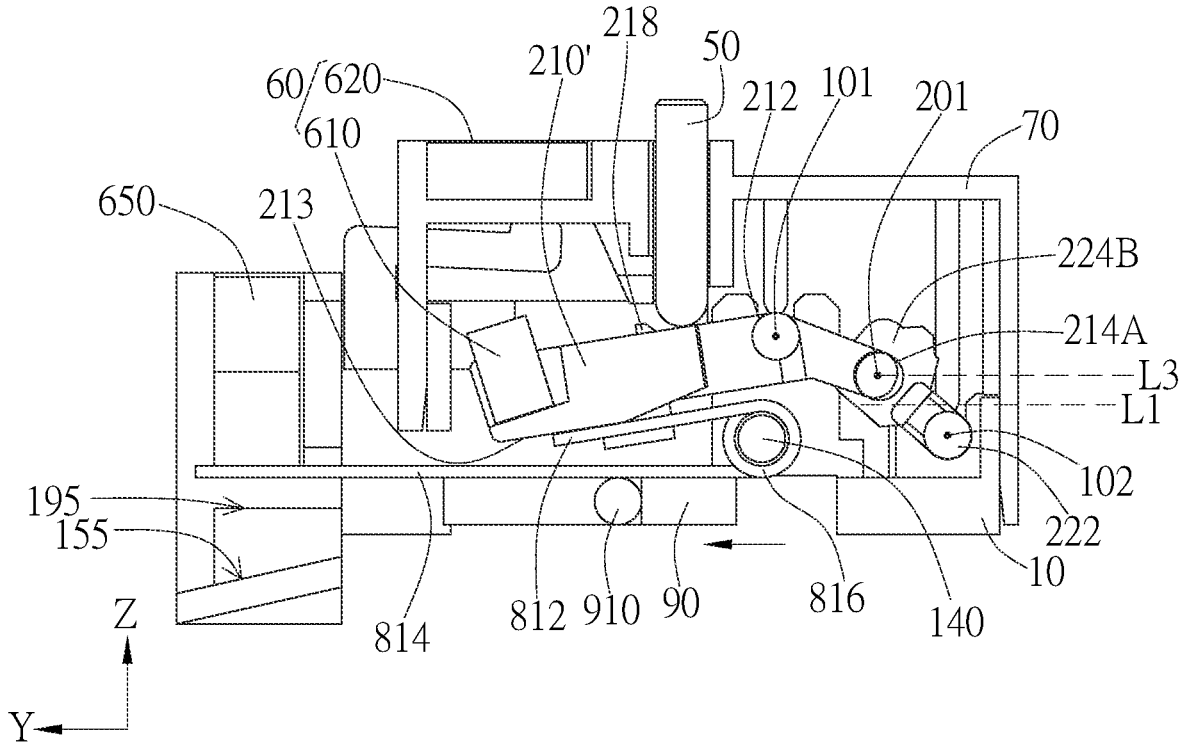

Referring to FIG. 23A to FIG. 24B, the operation of the key structure 1' when the adjusting unit 90 is at the first position or the second position will be illustrated. FIG. 23A and FIG. 23B are cross-sectional views showing that the key structure 1' is in the non-pressed state and the pressed state, respectively, when the adjusting unit 90 is at the first position. FIGS. 24A and 24B are cross-sectional views showing that the key structure 1' is in the non-pressed state and the pressed state, respectively, when the adjusting unit 90 is at the second position.

As shown in FIG. 23A, when the adjusting unit 90 is at the first position, the blocking portion 910 is located at on side of the sound generating member 80 and does not interfere with the sound generating member 80. When the pressing force is not applied to the movable mechanism 20' (e.g. the first linking member 210'), the movable mechanism 20' supports the key structure 1' in the non-pressed state by the magnetic attraction force between the first magnetic member 610 and the second magnetic member 620 of the magnetic unit 60. In other words, when the key structure 1' is in the non-pressed state, the coupling axis 201 of the first linking member 210' and the second linking member 220' formed by coupling the first connecting portion 214A and the second connecting portion 224B is located at the non-pressed position L1. The operation member 50 is positioned by the positioning portion 218 of the first linking member 210', and the sound generating member 80 is positioned by the magnetic attraction force between the magnet 650 and the hitting portion 814. As such, when the pressing force is not applied to the movable mechanism 20', the sound generating member 80 is substantially immovable relative to the base 10.

As shown in FIG. 23B, when the adjusting unit 90 is at the first position, and the pressing force is applied to the movable mechanism 20', the movable mechanism 20' rotates with respect to the base 10 and drives the sound generating member 80 to move, so the hitting portion 814 moves toward the impact surface 155 and hits the impact surface 155 to generate the hitting sound. Specifically, when the pressing force is applied to the first linking member 210' by the operation member 50, the first linking member 210' rotates about the first rotation axis 101 counterclockwise (i.e., along the first direction), and the first magnetic member 610 moves downward with the first linking member 210' away from the second magnetic member 620. Meanwhile, the first connecting portion 214A of the first linking member 210' rotates counterclockwise away from the base 10 (i.e., the coupling axis 201 moves upward to the pressing stop position L3) and drives the second connecting portion 224B of the second linking member 220' to move upward, so the second linking member 220' is driven to rotate about the second rotation axis 102 clockwise (i.e., along the second direction). Moreover, when the movable mechanism 20' rotates with respect to the base 10, the movable mechanism 20' drives the contacting portion 812 to move to rotate the spring body 816, so the hitting portion 814 is driven to move and hit the impact surface 155. Specifically, the first linking member 210' pushes the contacting portion 812 of the sound generating member 80 by the lower surface 213, so the contacting portion 812 moves downward with the first linking member 210' to drive the spring body 816 to rotate counterclockwise, and the hitting portion 814 is driven to move along the channel 195 (or the moving space) to hit the impact surface 155 to generate the hitting sound. As such, when the adjusting unit 90 is at the first position, the key structure 1' can provide the audible operation feedback.

As shown in FIG. 24A, when the adjusting unit 90 moves along the extending direction of the hitting portion 814 (e.g. along the Y-axis direction toward the lefthand side) to the second position, the blocking portion 910 also moves to the lower side of the hitting portion 814 and touches against the lower surface of the hitting portion 814, so as to restrict the movement of the hitting portion 814 toward the impact surface 155. In such a configuration, the sound generating member 80 is positioned not only by the magnetic attraction force between the magnet 650 and the hitting portion 814, but also by the blocking portion 910 abutting (or blocking) the hitting portion 814, so when the pressing force is not applied to the movable mechanism 20', the sound generating member 80 is substantially immovable relative to the base 10.

As shown in FIG. 24B, when the adjusting unit 90 is at the second position, and the pressing force is applied to the movable mechanism 20', the movable mechanism 20' rotates with respect to the base 10, and the adjusting unit 90 restricts movement of the hitting portion 814 relative to the impact surface 155, so the hitting portion 814 cannot move to hit the impact surface 155, and the hitting sound is not generated. Specifically, when the pressing force is applied to the first linking member 210', the first linking member 210' rotates about the first rotation axis 101 counterclockwise (i.e., along the first direction), and the first magnetic member 610 moves downward with the first linking member 210' away from the second magnetic member 620. Meanwhile, the first connecting portion 214A of the first linking member 210' rotates counterclockwise away from the base 10 (i.e., the coupling axis 201 moves upward to the pressing stop position L3) and drives the second connecting portion 224B of the second linking member 220' to move upward, so the second linking member 220' is driven to rotates about the second rotation axis 102 clockwise (i.e., along the second direction). Moreover, when the movable mechanism 20' rotates with respect to the base 10, the movable mechanism 20' drives the contacting portion 812 to move downward. Because the blocking portion 910 of the adjusting unit 90 abouts below the hitting portion 814, the spring body 816 and the hitting portion 814 cannot move substantially, and the positioning portion 312 is elastically deformed with respect to the spring body 816 and the hitting portion 814. In other words, the hitting portion 814 cannot move to hit the impact surface 155, so no hitting sound is generated. As such, when the adjusting unit 90 is at the second position, the key structure 1' can provide the silent (or soundless) operation feedback.

It is noted that though not shown in the drawings, the key structure 1' can utilize a Hall effect switch, which can generate the triggering signal when the pressing force is applied. For example, the Hall sensor can be disposed under the first linking member 210', and the Hall sensor can sense the existence and the intensity of the magnetic field of the first magnetic member 610 to generate the triggering signal. In an embodiment, when the pressing force is not applied (e.g. in the non-pressed state of FIG. 23A, FIG. 24A), the Hall sensor and the first magnetic member 610 is spaced apart by a predetermined distance, so the Hall sensor can output a predetermined voltage (e.g. the first output voltage). When the pressing force is applied, the first magnetic member 610 moves downward with the first linking member 210' to change the distance between the Hall sensor and the first magnetic member 610, so the Hall sensor senses the change of intensity of the magnetic field to output a voltage (e.g. the second output voltage), which is different the predetermined voltage, and the triggering signal can be generated, but not limited thereto. In other embodiments, by modifying the first linking member 210', the first linking member 210' can have the actuating portion 216 as described in the previous embodiments, so the actuating portion 216 moves in response to the pressing force to change the intensity of the optical signal received by the receiver from the emitter to generate the triggering signal, as described above and not elaborate hereinafter.

Figure 25:
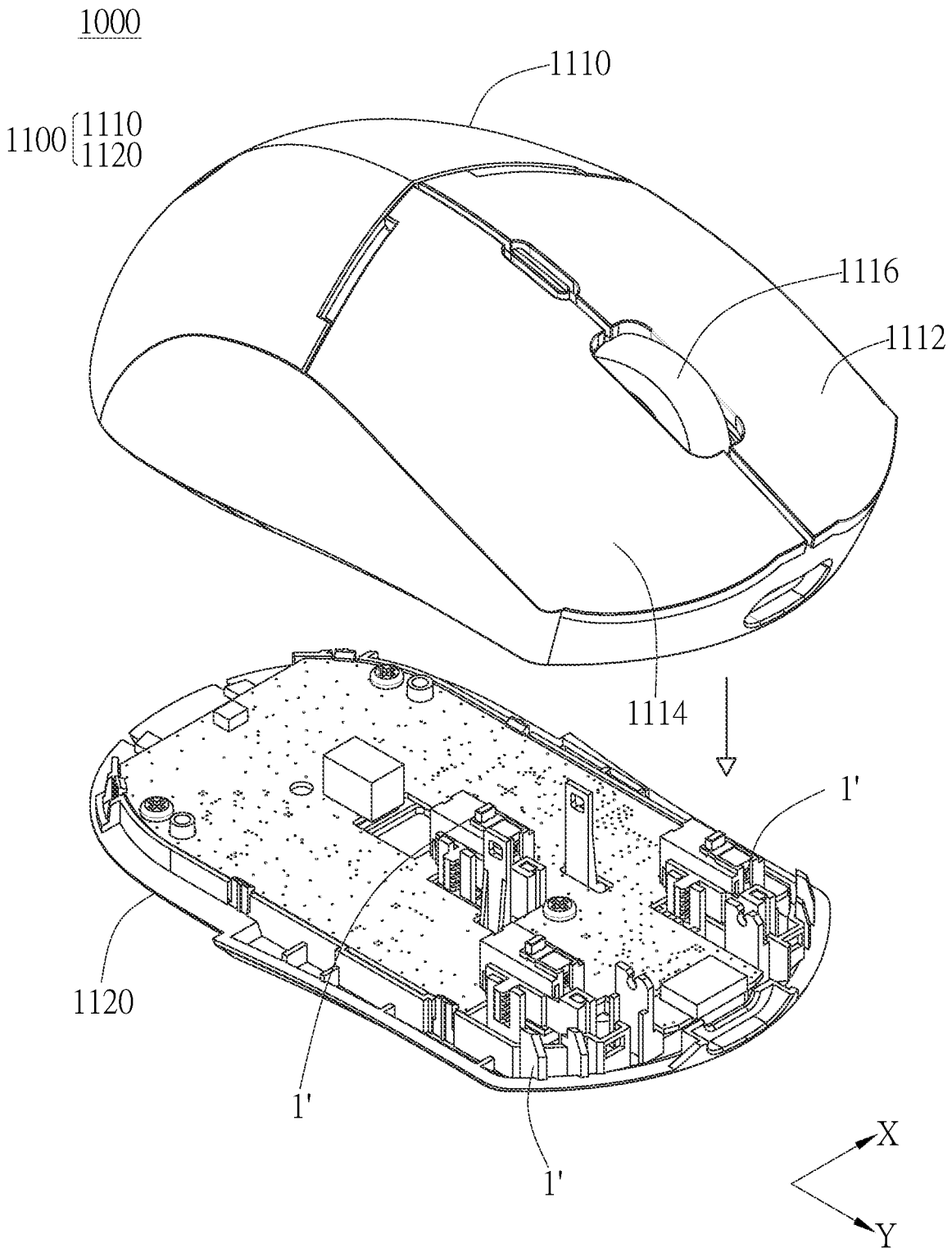
FIG. 25 is a partially exploded view of the input device in an embodiment of the invention.

FIG. 25 is a partially exploded view of the input device 1000 in an embodiment of the invention. As shown in FIG. 25, the input device 1000 includes a housing 1100, a plurality of key structures 1', and a movable frame 1200. The plurality of key structures 1' are disposed in the housing 1100. The movable frame 1200 is movably disposed in the housing 1100. The movable frame 1200 has a plurality of engaging portions 1210 corresponding to the plurality of key structures 1', so the adjusting unit 90 of each of the key structures 1' engages with a corresponding one of the plurality of engaging portions 1210. When the movable frame 1200 moves relative to the housing 1100, the movable frame 1200 drives the adjusting unit 90 of each of the key structures 1' to move, so the plurality of key structures 1' can provide the audible operation feedback or the silent operation feedback.

For example, the input device 1000 can be implemented as a mouse having three key structures 1', but not limited thereto. In other embodiment, the input device 1000 can be any electronic devices as appropriate, and the number and the arrangement of the key structures 1' can be modified according to practical applications. Moreover, the housing 1100 can include an upper casing 1110 and a lower casing 1120. The upper casing 1110 and the lower casing 1120 are preferably detachably combined with each other to accommodate the components of the input device 1000 (e.g. the key structures 1', the movable frame 1200, the circuit board, the positioning unit) therein. The upper casing 1110 preferably has pressable portions corresponding to the key structures 1' for the user to operate. For example, the upper casing 1110 has three pressable portions 1112, 1114, 1116 corresponding to the three key structures 1', respectively. The pressable portion can function as the operation member 50 of FIG. 20B. When the user applies the pressing force to the pressable portion (1112, 1114, or 1116), the corresponding key structure 1' can change from the non-pressed state to the pressed state. The detailed operation of the key structure 1' can be referred to the related descriptions of the previous embodiments and will not elaborate again. Hereinafter, the structure details and operations of how the input device 1000 can change the audible operation or the silent operation of the plurality of key structures 1' by the movable frame 1200 will be illustrated.

Figure 26A:
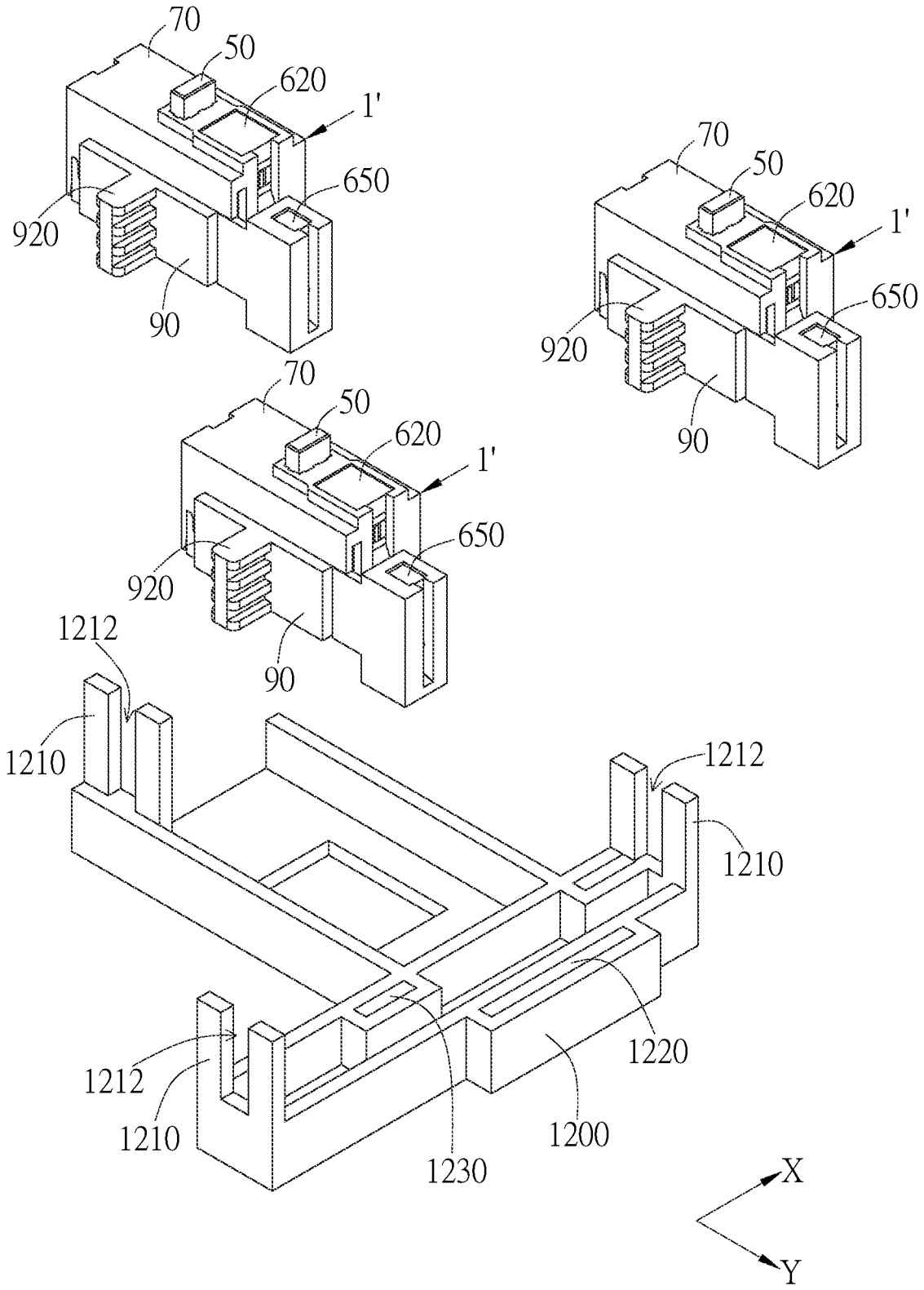
FIG. 26A and FIG. 26B are an exploded view and an assembled view of the movable frame and the plurality of key structures of the input devices of FIG. 25.
Figure 26B:
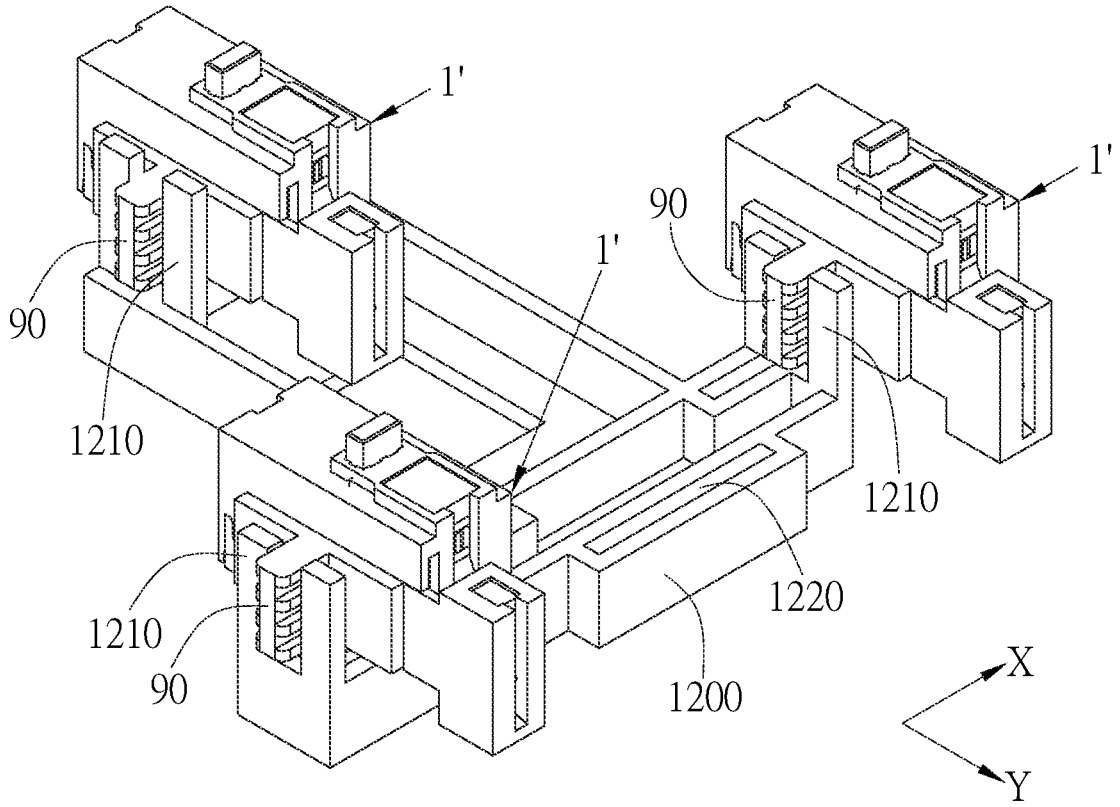
Figure 27:
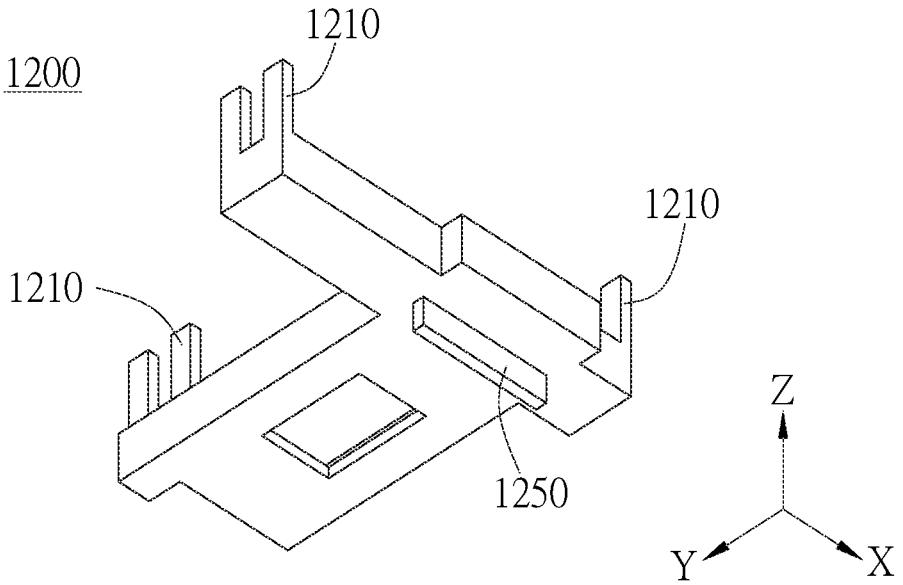
FIG. 27 is a bottom view of the movable frame of the input device.

FIG. 26A and FIG. 26B are an exploded view and an assembled view of the movable frame 1200 and the plurality of key structures 1' of the input device 1000. As shown in FIG. 26A and FIG. 26B, the movable frame 1200 may have a T-shaped structure corresponding to the arrangement of the plurality of key structures 1'. The engaging portion 1210 is preferably an engaging structure having an engaging groove 1212, and the extending direction of the engaging groove 1212 preferably corresponds to the operating portion 920 of the adjusting unit 90 of the corresponding key structure 1'. For example, the engaging groove 1212 extends along the Z direction. When the key structures 1' are disposed corresponding to the movable frame 1200 on the lower casing 1120, the operating portion 920 of the adjusting unit 90 of each of the key structures 1' is inserted into the engaging groove 1212 of the corresponding engaging portion 1210, so the movable frame 1200 and the adjusting units 90 of the plurality of key structures 1' form a linkage connection. Moreover, as shown in FIG. 27, the movable frame 1200 may have an operating part 1250 for the user to operate so as to move the movable frame 1200. For example, the operating part 1250 can be a rib, a bump, or a rod protruding from the lower surface of the movable frame 1200. The housing 1100 (e.g. the lower casing 1120) has a corresponding hole 1122 (shown in FIG. 28A), so the operating part 1250 of the movable frame 1200 can be exposed or protrude from the hole 1122 of the lower casing 1120 for the user to operate to move the movable frame 1200. The movable frame 1200 can have receiving parts 1220 and 1230, which are adapted to accommodate positioning components, such as magnetic members. In this embodiment, the receiving parts 1220 and 1230 can be implemented as slots, and the receiving parts 1220 and 1230 are preferably disposed along the moving direction of the movable frame 1200 (e.g. along the Y-axis direction), so the movable frame 1200 can be selectively positioned at the first position or the second position.

Figure 28B:
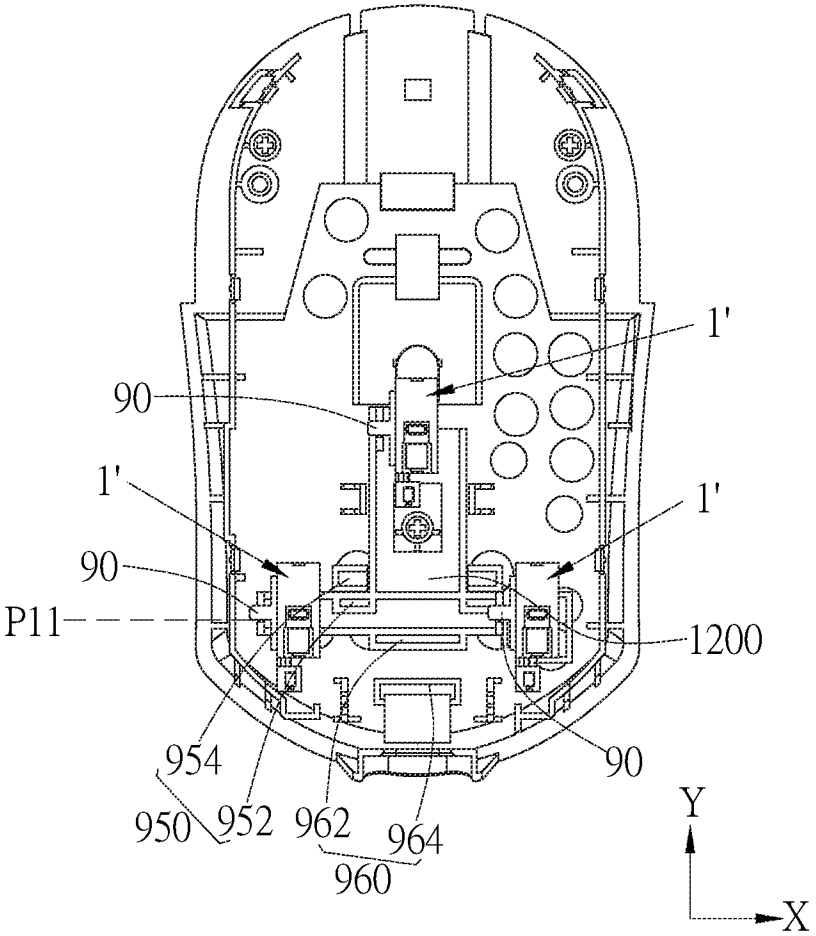
FIG. 28B is a schematic view showing the relative positions of the plurality of key structures and the movable frame of the input device of FIG. 28A.

Specifically, the input device 1000 can further include a first positioning unit 950 and a second positioning unit 960 (shown in FIG. 28B). The movable frame 1200 is positioned by the first positioning unit 950, so the adjusting units 90 are positioned at the first position P11 (shown in FIG. 28B). Alternatively, the movable frame 1200 is positioned by the second positioning unit 960, so the adjusting units 90 are positioned at the second position P22 (shown in FIG. 29B). In an embodiment, each of the first positioning unit 950 and the second positioning unit 960 includes a movable frame magnetic member (952, 962) and a housing magnetic member (954, 964). The movable frame magnetic members 952, 962 and the housing magnetic members 954, 964 are disposed on the movable frame 1200 and the housing 1100 (e.g. the lower casing 1120), respectively. As such, the magnetic attraction force can be generated between the movable frame magnetic member 952 (or 962) and the housing magnetic member 954 (or 964). For example, the movable frame magnetic members 952 and 962 can be disposed in the receiving parts 1230 and 1220 of the movable frame 1200. The movable frame magnetic member 952 (or 962) and the housing magnetic member 954 (or 964) can be implemented as both magnets or a combination of a magnet and a ferromagnetic material, so the magnetic attraction force can be generated between the movable frame magnetic member 952 (or 962) and the housing magnetic member 954 (or 964).

Figure 28A:
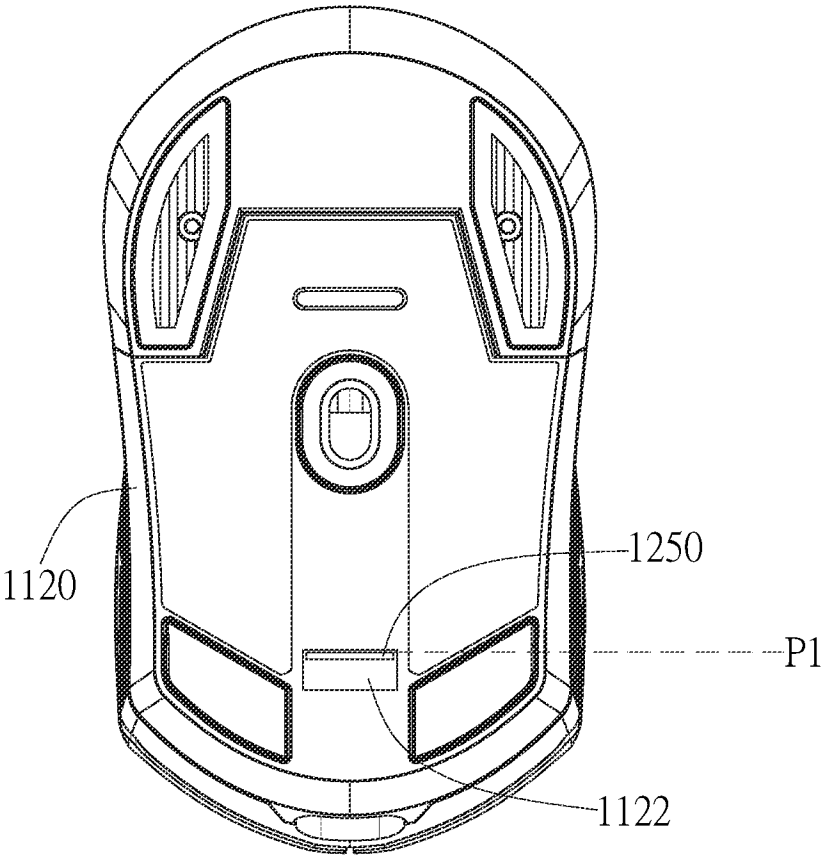
FIG. 28A is a bottom plane view of the input device of FIG. 25 when the movable frame is at the first position.

Referring to FIG. 28A to FIG. 29B, the operation of adjusting the audible or silent operation of the input device 1000 will be illustrated. FIG. 28A is a bottom plane view of the input device 1000 when the movable frame 1200 is at the first position P1, and FIG. 28B is a schematic view showing the relative positions of the key structures 1' and the movable frame 1200 of the input device 1000 of FIG. 28A. As shown in FIG. 28A and FIG. 28B, when the operating part 1250 of the movable frame 1200 is controlled to move upward in the hole 1122 along the Y-axis direction to the first position P1, the engaging portions 1210 of the movable frame 1200 drive the adjusting units 90 of the key structures 1' to move toward the first position P11, i.e., to the position that the blocking portion 910 of the adjusting unit 90 does not interfere with the corresponding sound generating member 80. When the movable frame 1200 moves to the first position P1, the movable frame magnetic member 952 of the first positioning unit 950 moves with the movable frame 1200 closer to the housing magnetic member 954 to generate the magnetic attraction force, so the movable frame 1200 can be positioned at the first position P1 (i.e., the adjusting unit 90 of the key structure 1' is positioned at the first position P11). Meanwhile, the movable frame magnetic member 962 of the second positioning unit 960 moves with the movable frame 1200 away from the housing magnetic member 964. In such a configuration, when the user presses the pressable portion 1112, 1114, or 1116 of the housing 1100, the corresponding key structure 1' can provide the audible operation feedback.

Figure 29B:
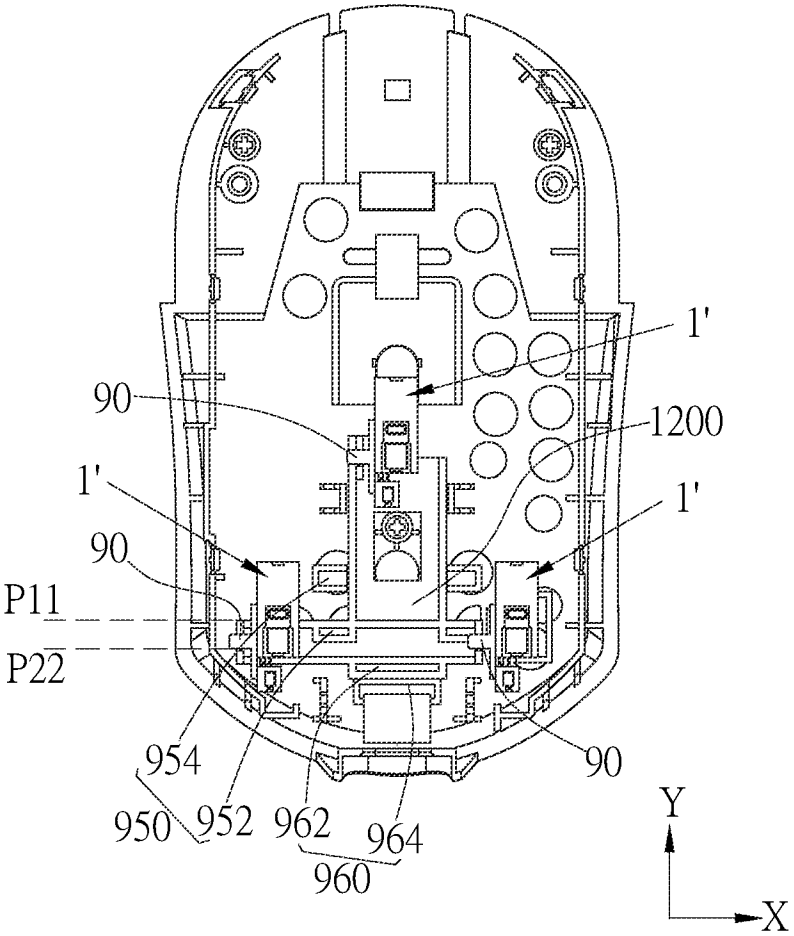
FIG. 29B is a schematic view showing the relative positions of the plurality of key structures and the movable frame of the input device of FIG. 29A.
Figure 29A:
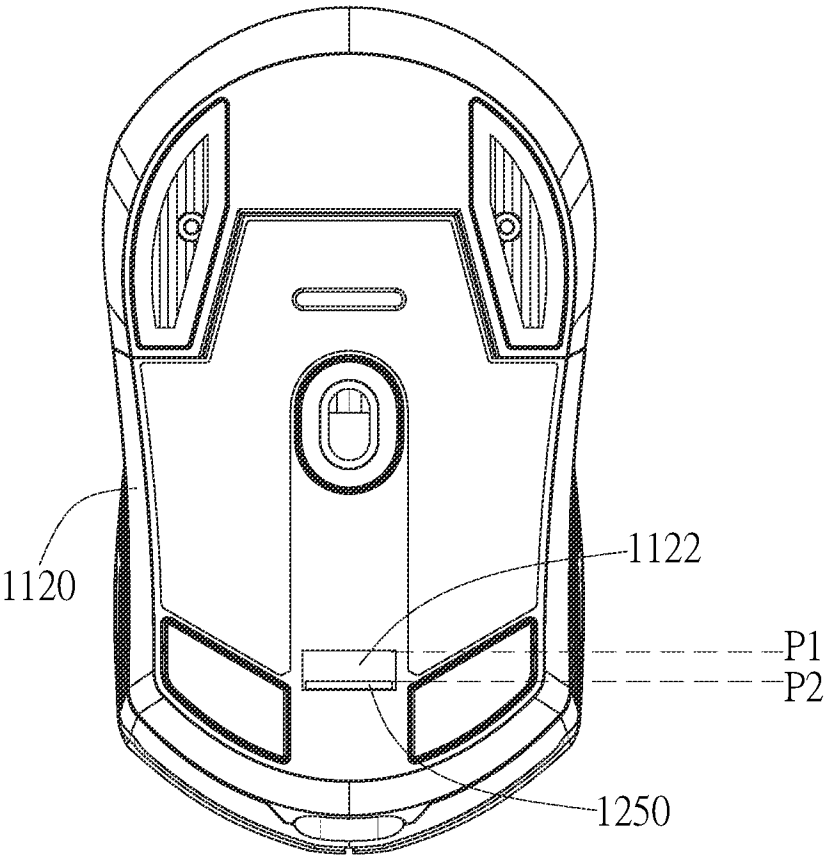
FIG. 29A is a bottom plane view the input device of FIG. 25 when the movable frame is at the second position.

FIG. 29A is a bottom plane view of the input device 1000 when the movable frame 1200 is at the second position P2, and FIG. 29B is a schematic view showing the relative positions of the key structures 1' and the movable frame 1200 of the input device 1000 of FIG. 29A. As shown in FIG. 29A and FIG. 29B, when the operating part 1250 of the movable frame 1200 is controlled to move downward in the hole 1122 along the Y-axis direction to the second position P2, the engaging portions 1210 of the movable frame 1200 drive the adjusting units 90 of the key structures 1' to move toward the second position P22, i.e., to the position that the blocking portion 910 of the adjusting unit 90 interferes with the hitting portion 814 of the corresponding sound generating member 80. When the movable frame 1200 moves to the second position P2, the movable frame magnetic member 962 of the second positioning unit 960 moves with the movable frame 1200 closer to the housing magnetic member 964 to generate the magnetic attraction force, so the movable frame 1200 is positioned at the second position P2 (i.e., the adjusting unit 90 of the key structure 1' is positioned at the second position P22). Meanwhile, the movable frame magnetic member 952 of the first positioning unit 950 moves with the movable frame 1200 away from the housing magnetic member 954. In such a configuration, when the user presses the pressable portion 1112, 1114, or 1116 of the housing 1100, the corresponding key structure 1' can provide the silent operation feedback.

In the above embodiment, the adjusting unit 90 of the key structure 1' is moved along the extending direction of the hitting portion 814 of the sound generating member 80 to the first position P11 or the second position P22. That is, the first position P11 and the second position P22 are disposed along a direction same as the extending direction of the hitting portion 814 (e.g. the Y-axis direction), but not limited thereto. In other embodiments, according to practical applications and space considerations, the adjusting unit 90 can be designed to move toward or away from the extending direction of the hitting portion 814. In other words, the first position and the second position are disposed along a direction different from the extending direction of the hitting portion 814, such as a traverse direction or a vertical direction.

Figure 30A:
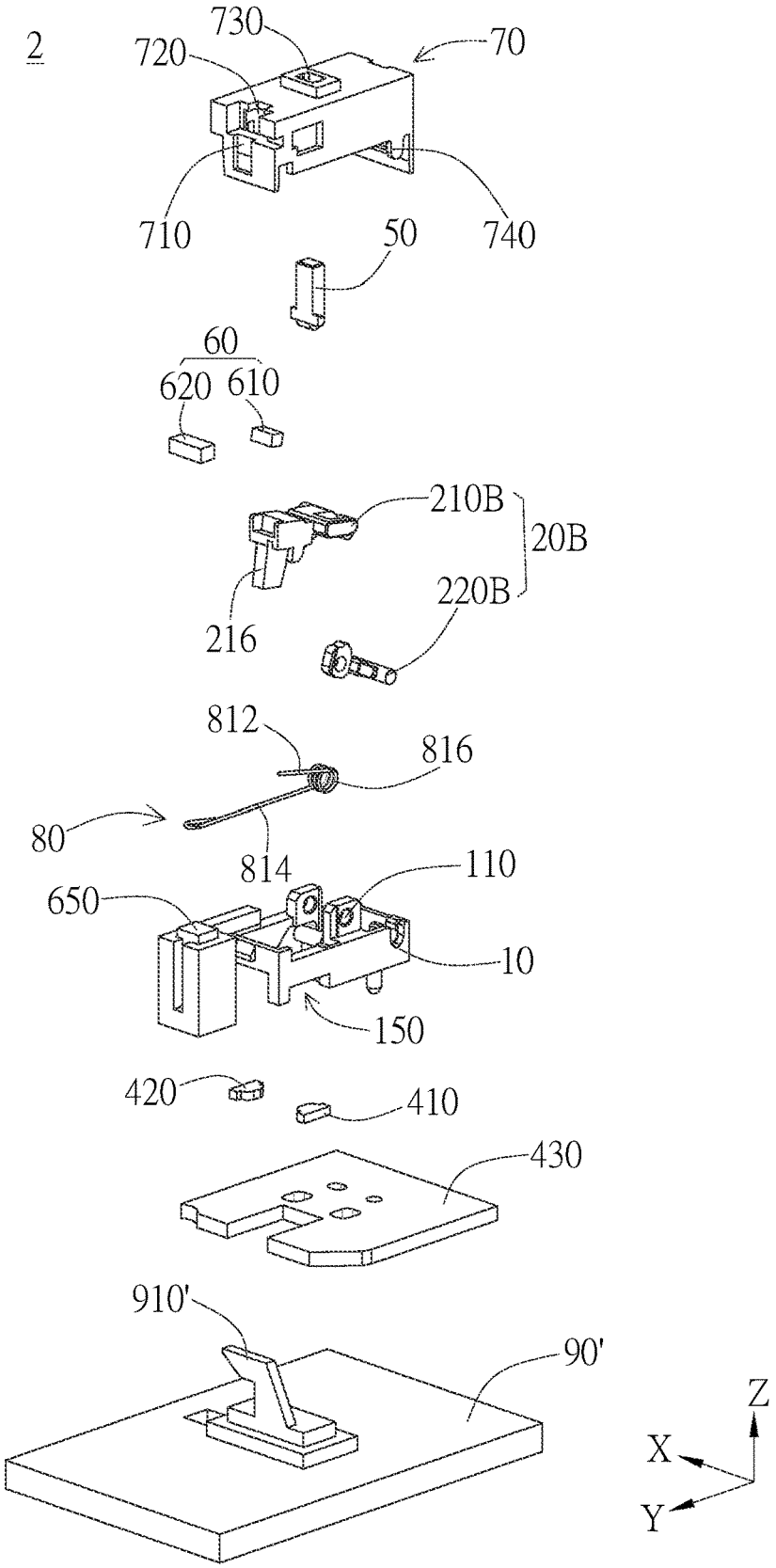
FIG. 30A to FIG. 30C are an exploded view, an assembled view, and a cross-sectional view of the key structure in a ninth embodiment of the invention, respectively, when the adjusting unit of the key structure is at the first position.
Figure 30B:
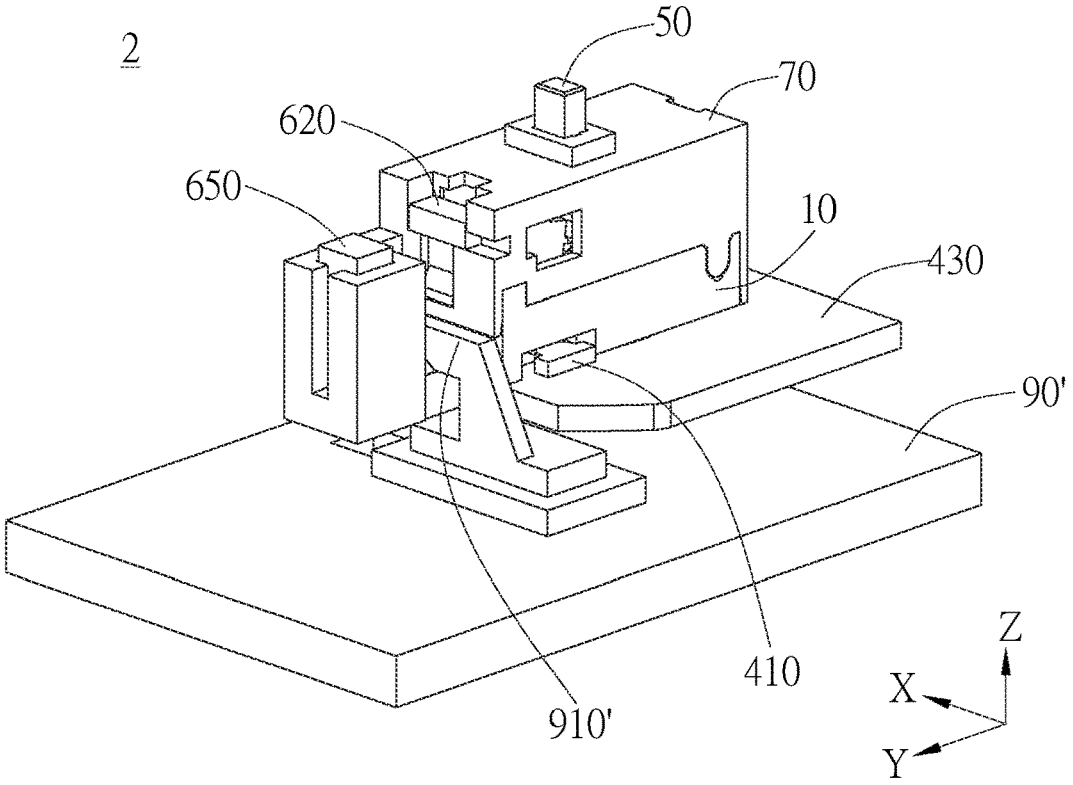
Figure 30C:
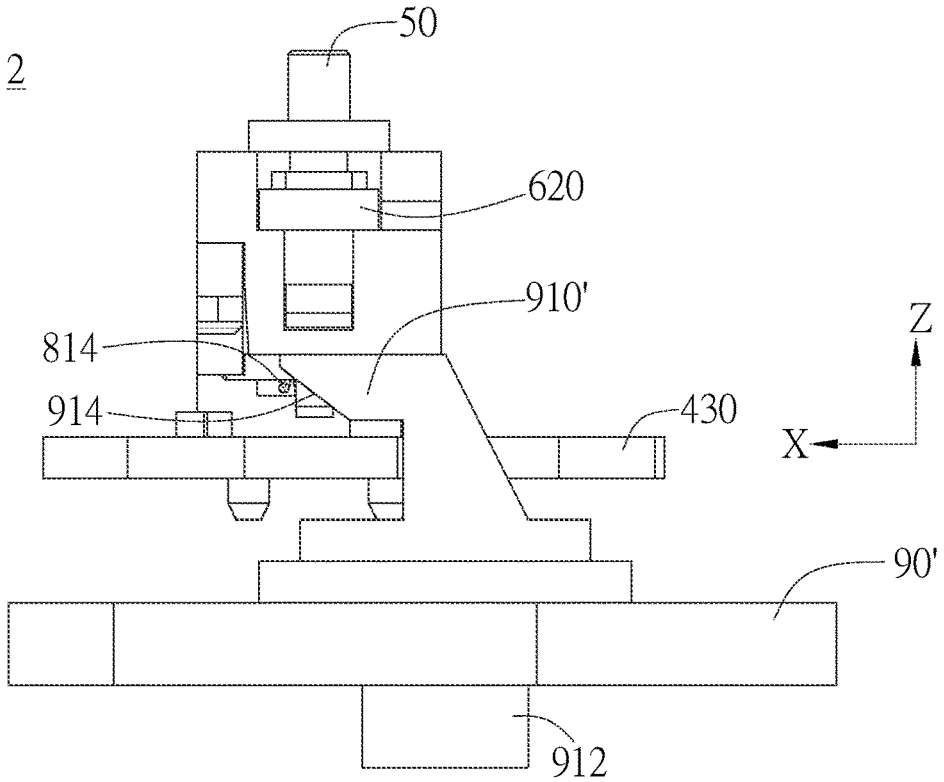

Referring to FIG. 30A to FIG. 30C, FIG. 30A to FIG. 30C are an exploded view, an assembled view, and a cross-sectional view of the key structure 2 in a ninth embodiment of the invention, respectively. In this embodiment, the key structure 2 has a structure similar to the key structure 1'. For example, the movable mechanism of the key structure 2 can be implemented as the linkage mechanism 20B of the key structure 1B of FIG. 6A, and the key structure 2 can utilize the optical switch consisting of the emitter 410, the receiver 420, and the circuit board 430 to provide the triggering signal. Thus, the detailed structure, function, and connection of components of the key structure 2 (e.g. the base 10, the movable mechanism (e.g. the linkage mechanism 20B), the sound generating member 80, the magnetic unit 60) can be referred to the related descriptions of the previous embodiments and will not elaborate again. Hereinafter, the adjusting unit 90' of the key structure 2 will be illustrated.

Figure 31A:
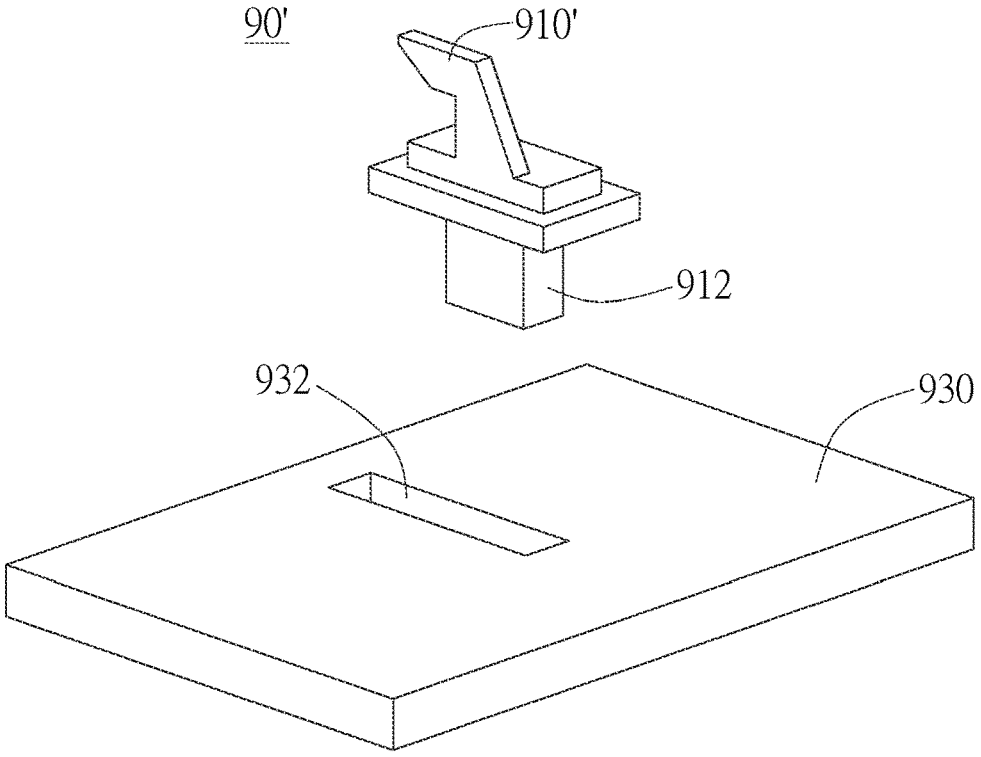
FIG. 31A and FIG. 31B are an exploded view and a bottom view of the adjusting unit of the key structure of FIG. 30A.
Figure 31B:
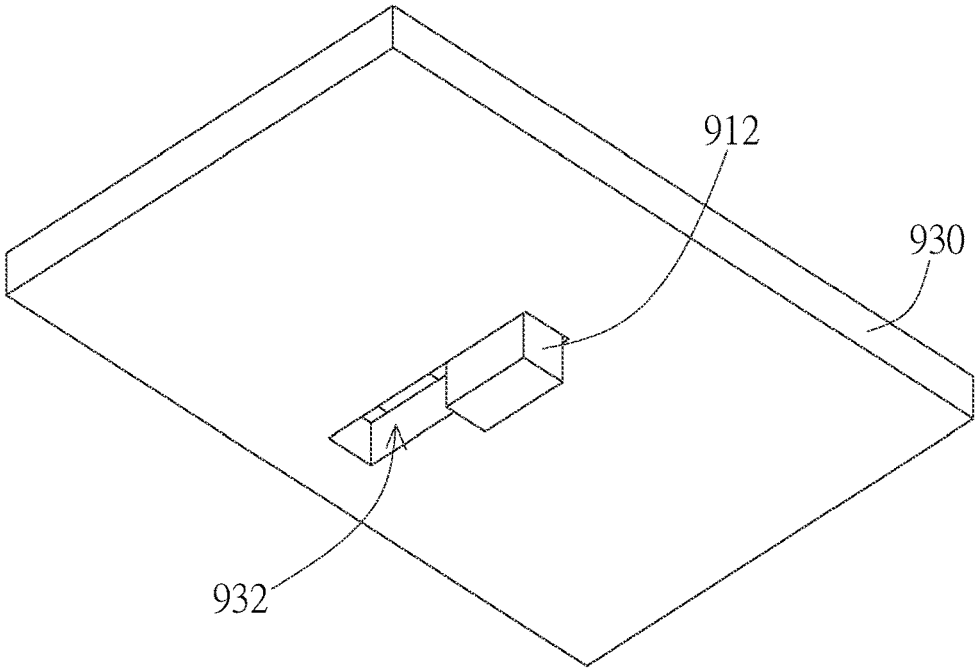

Specifically, the moving direction of the adjusting unit 90' of the key structure 2 (e.g. the X-axis direction) is substantially perpendicular to the extending direction of the hitting portion 814 (e.g. the Y-axis direction). In other words, when the adjusting unit 90' moves close to or away from the extending direction of the hitting portion 814, the blocking portion 910' of the adjusting unit 90' interferes or does not interfere with the hitting portion 814 of the sound generating member 80. Moreover, when the adjusting unit 90' moves to the second position, the blocking portion 910' of the adjusting unit 90' preferably presses the hitting portion 814 of the sound generating member 80 against the impact surface 155 from above to below, so as to restrict the hitting portion 814 to move relative to the impact surface 155. As shown in FIG. 31A and FIG. 31B, in an embodiment, the adjusting unit 90' can further include a support plate 930, and the blocking portion 910' is movably disposed on the support plate 930. For example, the support plate 930 is disposed below the base 10 and the circuit board 430, and the base 10 can be disposed over the circuit board 430. The support plate 930 has a positioning channel 932. The positioning channel 932 extend along the moving direction of the blocking portion 910'. For example, the positioning channel 932 is disposed along the X-axis direction. The blocking portion 910' has a corresponding positioning portion 912, and the positioning portion 912 is movably inserted into the positioning channel 932 and at least partially protrudes out the lower surface of the support plate 930 from the positioning channel 932. As such, when the positioning portion 912 receives a pulling force or a pushing force, the positioning portion 912 can move along the positioning channel 932 to drive the blocking portion 910' to move to the first position not to interfere with the hitting portion 814 (as shown in FIG. 30C) or to the second position to interfere with the hitting portion 814 (as shown in FIG. 33C), but not limited thereto. In another embodiment, the adjusting unit 90' may not have the support plate 930, or the blocking portion 910' can be positioned on the circuit board 430 or any suitable components of the key structure 2, so when the blocking portion 910' receives the pulling or pushing force, the blocking portion 910' can move to the first position or the second position relative to the base 10. In a further embodiment, the blocking portion 910' can be integrated with the support plate 930 as an integral component, so when the support plate 930 moves relative to the base 10, the support plate 930 can drive the blocking portion 910' to move relative to the base 10.

Figure 32A:
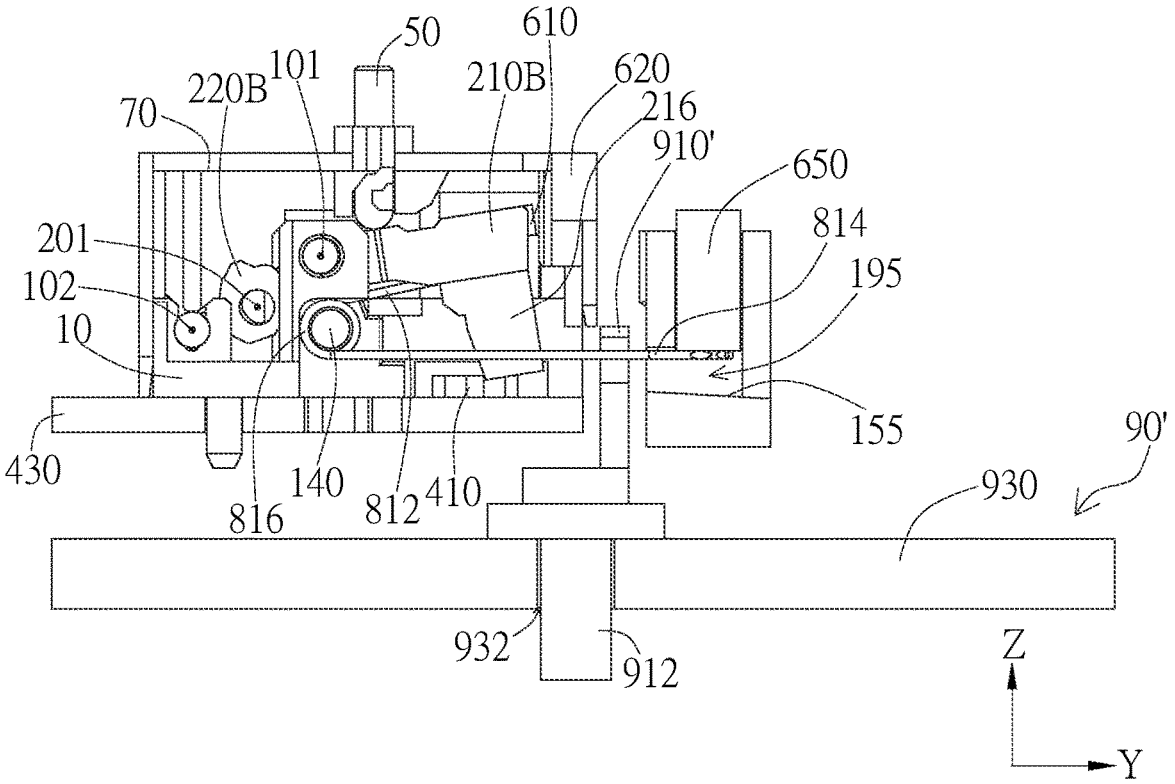
FIG. 32A and FIG. 32B are cross-sectional views showing that the key structure of FIG. 30A is in the non-pressed state and the pressed state, respectively, when the adjusting unit of the key structure is at the first position.
Figure 32B:
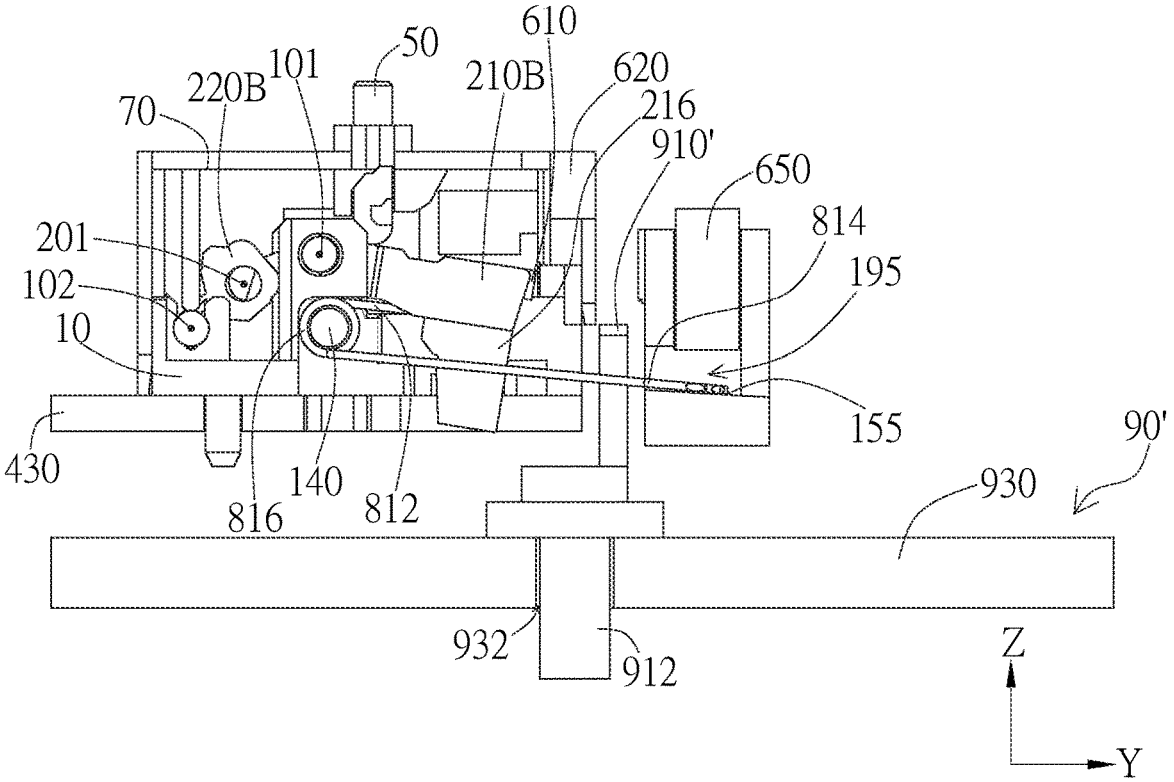

Referring to FIG. 32A and FIG. 32B, the operation of the key structure 2 when the adjusting unit 90' is at the first position will be illustrated. FIGS. 32A and 32B are cross-sectional views showing that the key structure 2 is in the non-pressed state and the pressed state, respectively, when the adjusting unit 90' of the key structure 2 is at the first position. As shown in FIG. 32A, when the adjusting unit 90' is at the first position, the blocking portion 910' is located away from the hitting portion 814 of the sound generating member 80 in the X-axis direction and does not interfere with the hitting portion 814. When the pressing force is not applied to the movable mechanism (e.g. the first linking member 210B of the linkage mechanism 20B), the movable mechanism supports the key structure 2 in the non-pressed state by the magnetic attraction force between the first magnetic member 610 and the second magnetic member 620 of the magnetic unit 60. In other words, when the key structure 2 is in the non-pressed state, the sound generating member 80 is positioned by the magnetic attraction force between the magnet 650 and the hitting portion 814, so when the pressing force is not applied to the movable mechanism, the sound generating member 80 is substantially immovable relative to the base 10. In such a configuration, the moving space is maintained between the impact surface 155 and the hitting portion 814, i.e., the hitting portion 814 and the impact surface 155 are located at two opposite ends of the channel 195, and the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 32B, in the case that the adjusting unit 90' is at the first position, when the pressing force is applied to the movable mechanism, the movable mechanism rotates with respect to the base 10 and drives the sound generating member 80 to move, so the hitting portion 814 moves toward the impact surface 155 and hits the impact surface 155 to generate the hitting sound. Specifically, when the pressing force is applied to the first linking member 210B by the operation member 50, the first linking member 210B rotates about the first rotation axis 101 clockwise (i.e., along the first direction), and the first magnetic member 610 moves downward with the first linking member 210B to be away from the second magnetic member 620. Meanwhile, the first connecting portion of the first linking member 210B also rotates clockwise away from the base 10 (i.e., the coupling axis 201 moves upward) and drives the second connecting portion of the second linking member 220B to move upward, so the second linking member 220B is driven to rotate about the second rotation axis 102 counterclockwise (i.e., along the second direction). Moreover, when the movable mechanism rotates with respect to the base 10, the movable mechanism drives the contacting portion 812 to move and drive the spring body 816 to rotate, so the hitting portion 814 moves to hit the impact surface 155. Specifically, the first linking member 210B pushes the contacting portion 812 of the sound generating member 80, so the contacting portion 812 moves downward with the first linking member 210B to rotate the spring body 816 clockwise, and the hitting portion 814 is driven to rotate clockwise along the channel 195 (or the moving space) to hit the impact surface 155 to generate the hitting sound. As such, when the adjusting unit 90' is at the first position, the key structure 2 can provide the audible operation feedback. Moreover, the actuating portion 216 rotates with the first linking member 210B to a position that the light channel 150 can be shielded, so the intensity of the optical signal received by the receiver 420 from the emitter 410 is smaller (e.g. the amount of light received is less) or substantially equal to zero (i.e., the receiver 420 does not receive the optical signal), and the switch unit is triggered to generate the triggering signal.

Figure 33A:
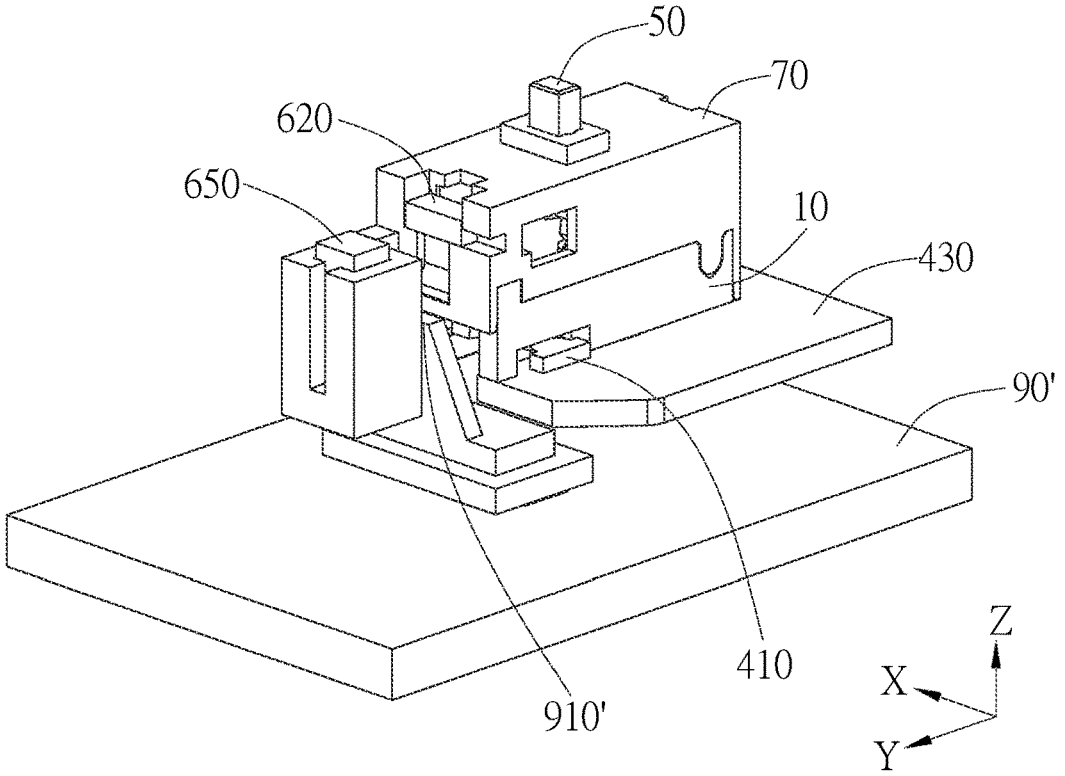
FIG. 33A to FIG. 33C are a three-dimensional view, a bottom view, and a cross-sectional view of the key structure of FIG. 30A, respectively, when the adjusting unit of the key structure is at the second position.
Figure 33B:
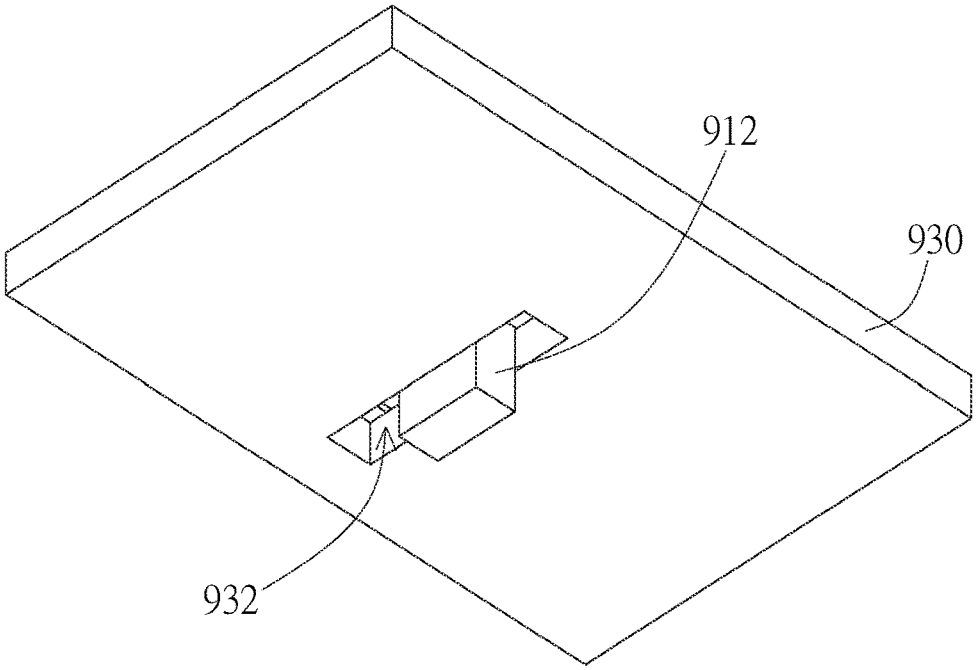
Figure 33C:
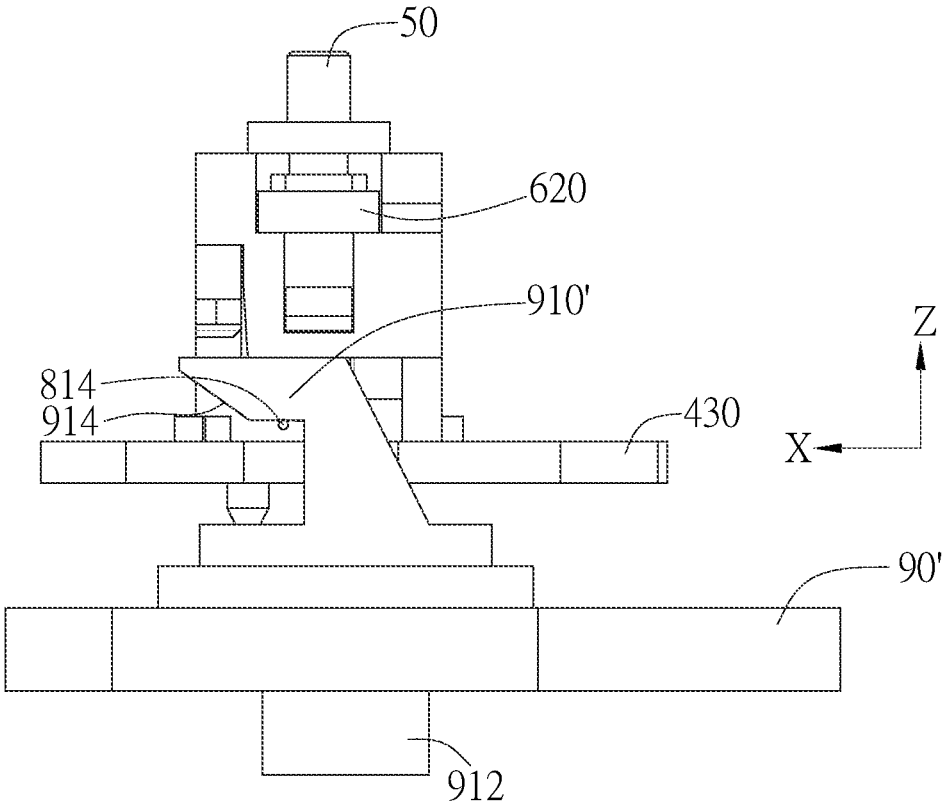

FIG. 33A to FIG. 33C are a three-dimensional view, a bottom view, and a cross-sectional view of the key structure 2, respectively, when the adjusting unit 90' of the key structure 2 is at the second position. As shown in FIG. 33A to FIG. 33C, when the force is applied to the positioning portion 912 of the blocking portion 910', the positioning portion 912 moves along the positioning channel 932 to drive the blocking portion 910' to move along the X-axis direction to interfere with the hitting portion 814. In this embodiment, the end of the blocking portion 910' that corresponds to the hitting portion 814 preferably has an inclined surface. For example, as shown in FIG. 30C, the blocking portion 910' can have an inverted L-shaped structure. The free end of the horizontal section of the inverted L-shaped structure is inclined downward away from the hitting portion 814 to form an inclined surface 914. The upper end of the inclined surface 914 in the Z-axis direction is preferably higher than the hitting portion 814, and the lower end of the inclined surface 914 in the Z-axis direction is lower than the hitting portion 814. Moreover, the height of the hitting portion 814 moving along the inclined surface 914, i.e., the displacement of the hitting portion 814 in the Z-axis direction from the upper end to the lower end of the inclined surface 914, is preferably larger than or equal to the length of the channel 195 in the Z-axis direction. As such, as shown in FIG. 33C, when the blocking portion 910' moves toward the hitting portion 814 to the second position, the hitting portion 814 can slide along the inclined surface 914 to be below the horizontal section, so the blocking portion 910' presses the hitting portion 814 toward the impact surface 155 to restrict the movement of the hitting portion 814 relative to the impact surface 155 (as shown in FIG. 34A).

Figure 34A:
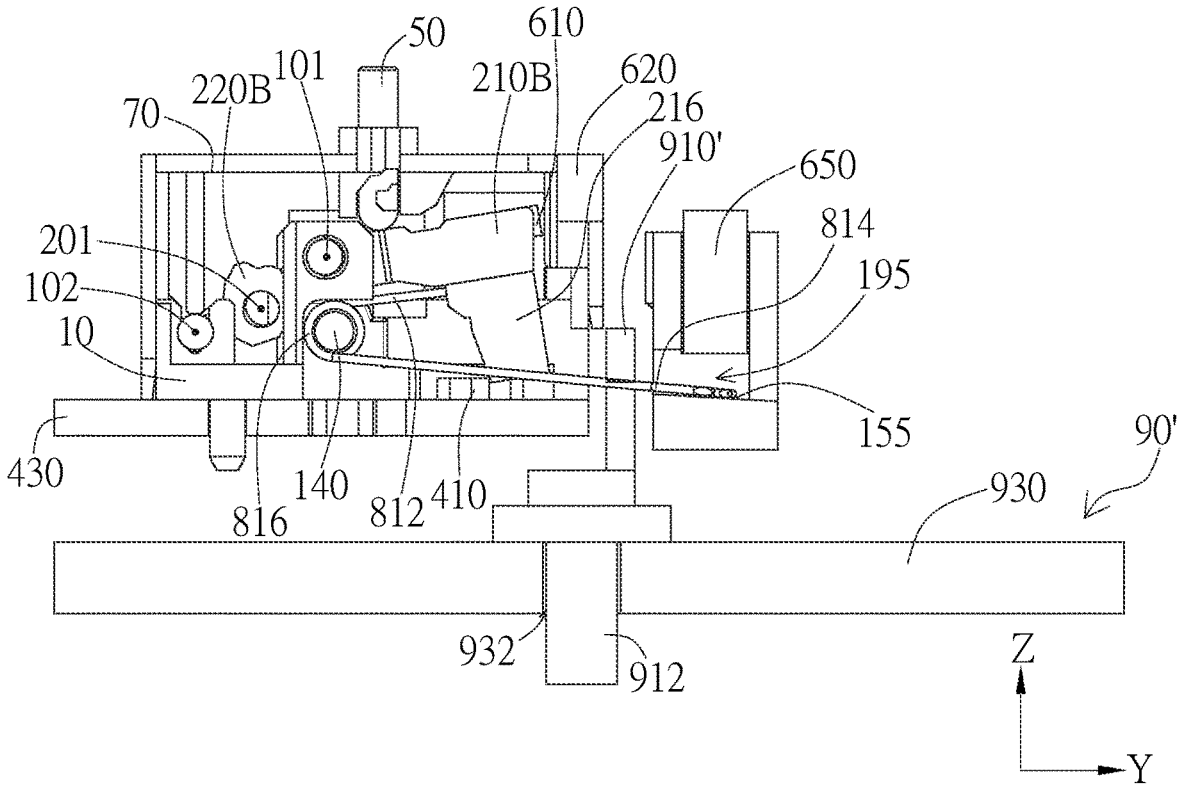
FIG. 34A and FIG. 34B are cross-sectional views showing that the key structure of FIG. 33A is in the non-pressed state and the pressed state, respectively.
Figure 34B:
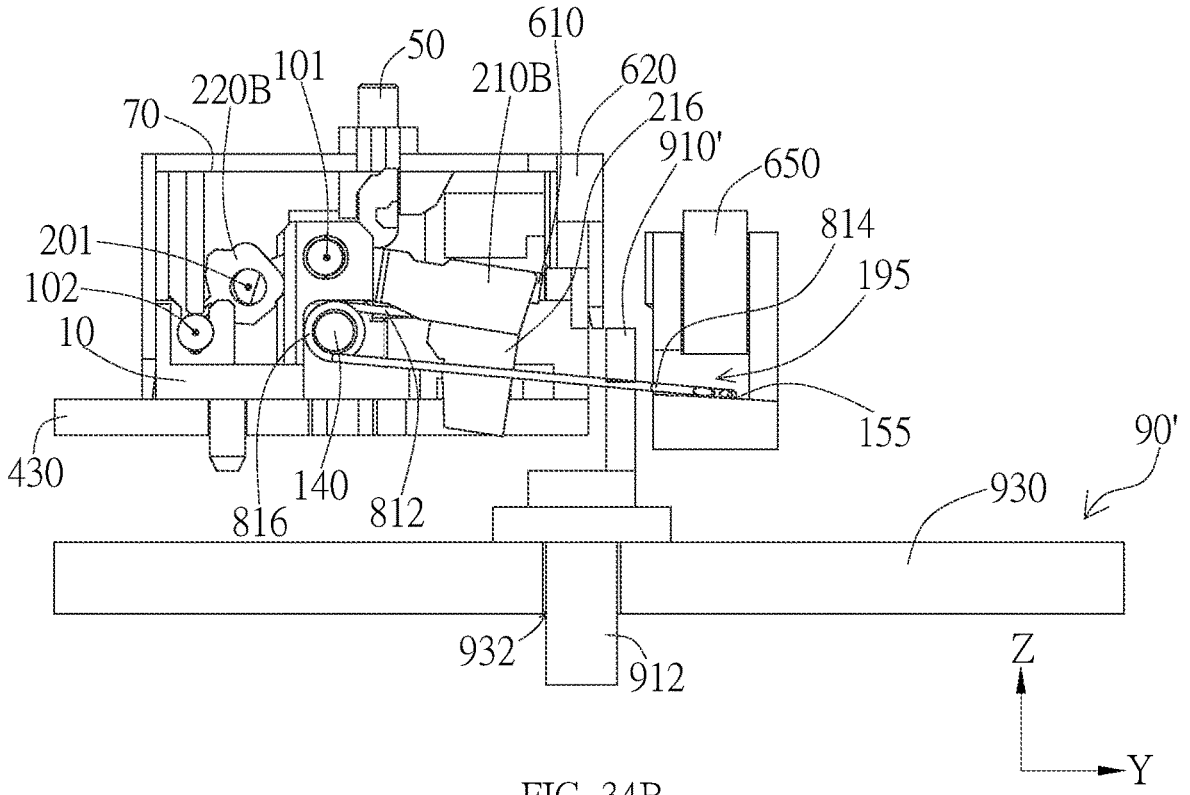

Referring to FIG. 34A and FIG. 34B, the operation of the key structure 2 when the adjusting unit 90' is at the second position will be illustrated. FIG. 34A and FIG. 34B are cross-sectional views showing that the key structure 2 is in the non-pressed state and the pressed state, respectively, when the adjusting unit 90' of the key structure 2 is at the second position. As shown in FIG. 34A, when the adjusting unit 90' moves along the X-axis direction toward the extending direction of the hitting portion 814 (e.g. the Y-axis direction) to the second position, the blocking portion 910' presses the hitting portion 814 against the impact surface 155 to restrict movement of the hitting portion 814 toward the impact surface 155. In other words, when the key structure 2 is in the non-pressed state, the hitting portion 814 is pressed by the blocking portion 910' from above to below, and the hitting portion 814 substantially contacts the impact surface 155 as the hitting portion 814 is pressed by the blocking portion 910'. As such, when the pressing force is not applied to the movable mechanism, the sound generating member 80 is substantially immovable relative to the base 10. In such a configuration, the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 34B, when the pressing force is applied to the first linking member 210B by the operation member 50, the first linking member 210B rotates about the first rotation axis 101 clockwise (i.e., along the first direction), and the first magnetic member 610 moves downward with the first linking member 210B to be away from the second magnetic member 620. Meanwhile, the first connecting portion of the first linking member 210B also rotates clockwise away from the base 10 (i.e., the coupling axis 201 moves upward) and drives the second connecting portion of the second linking member 220B to move upward, so the second linking member 220B is driven to rotate about the second rotation axis 102 counterclockwise (i.e., along the second direction). Moreover, when the movable mechanism rotates with respect to the base 10, the movable mechanism drives the contacting portion 812 to move. Because the blocking portion 910' of the adjusting unit 90' has already pressed the hitting portion 814 against the impact surface 155, so the spring body 816 and the hitting portion 814 are substantially immovable, and the contacting portion 812 is elastically deformed with respect to the spring body 816 and the hitting portion 814. In other words, the hitting portion 814 cannot move downward to hit the impact surface 155, and no hitting sound is generated. Accordingly, when the adjusting unit 90' is at the second position, the key structure 2 can provide the silent (or soundless) operation feedback. In addition, the actuating portion 216 rotates with the first linking member 210B to a position that the light channel 150 can be shielded, so the intensity of the optical signal received by the receiver 420 from the emitter 410 is smaller (e.g. the amount of light received is less) or substantially equal to zero (i.e., the receiver 420 does not receive the optical signal), and the switch unit is triggered to generate the triggering signal.

Figure 35A:
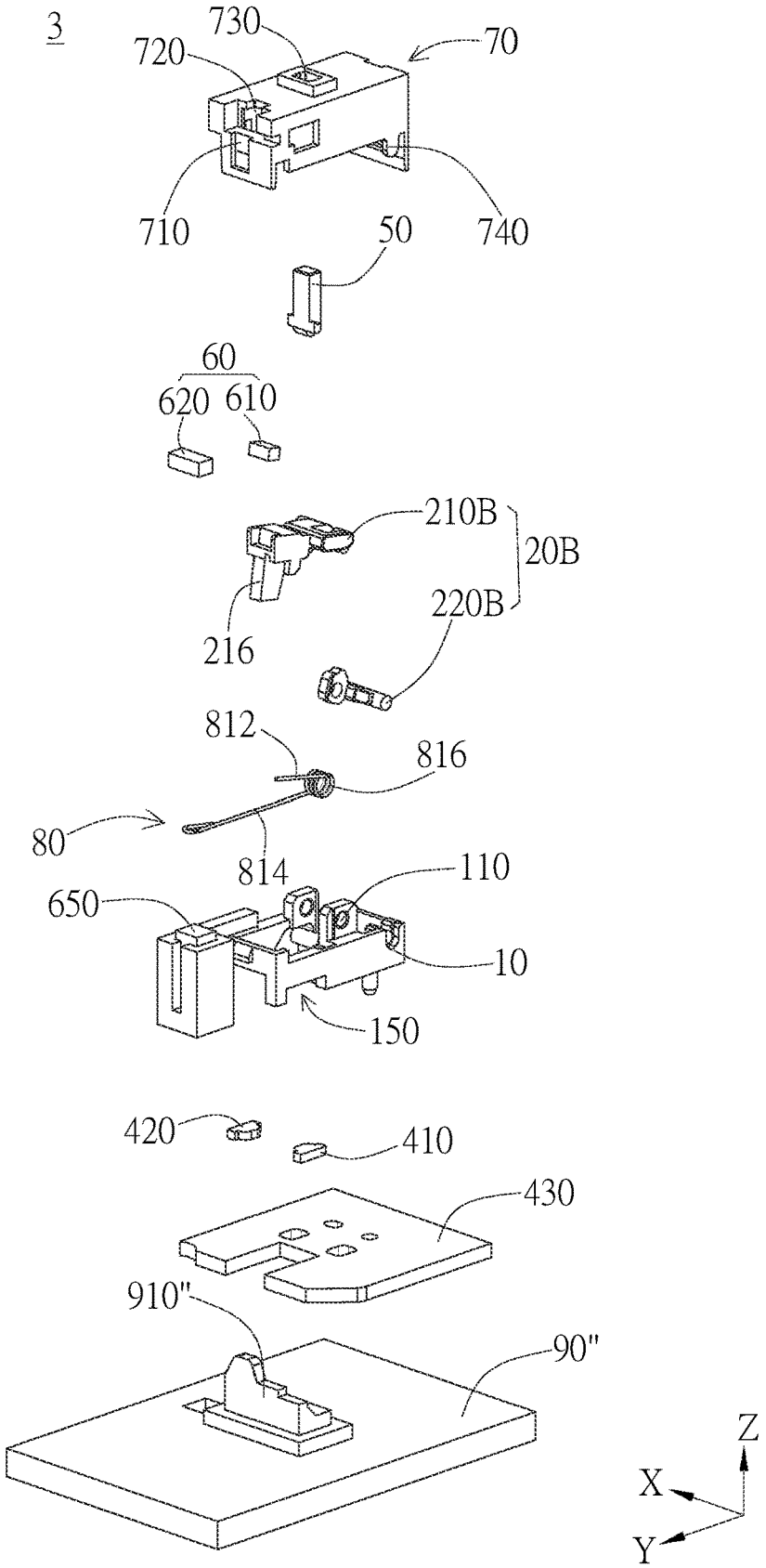
FIG. 35A to FIG. 35C are an exploded view, an assembled view, and a cross-sectional view of the key structure in a tenth embodiment of the invention, respectively, when the adjusting unit of the key structure is at the first position.
Figure 35B:
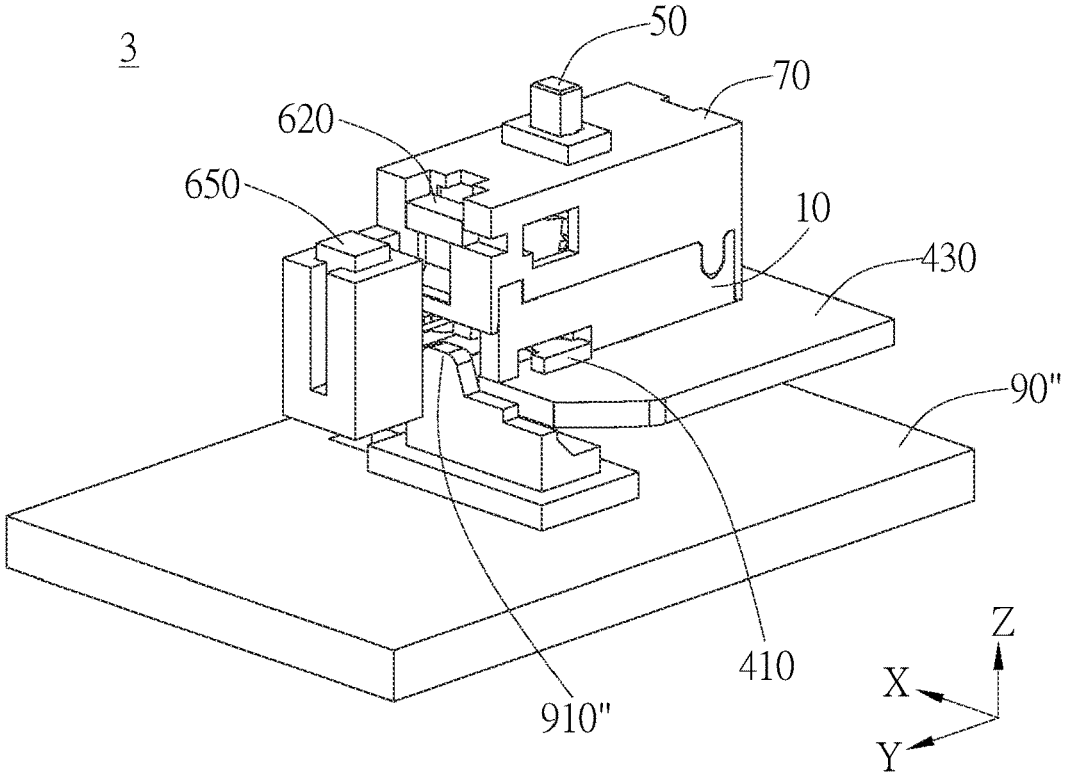
Figure 35C:
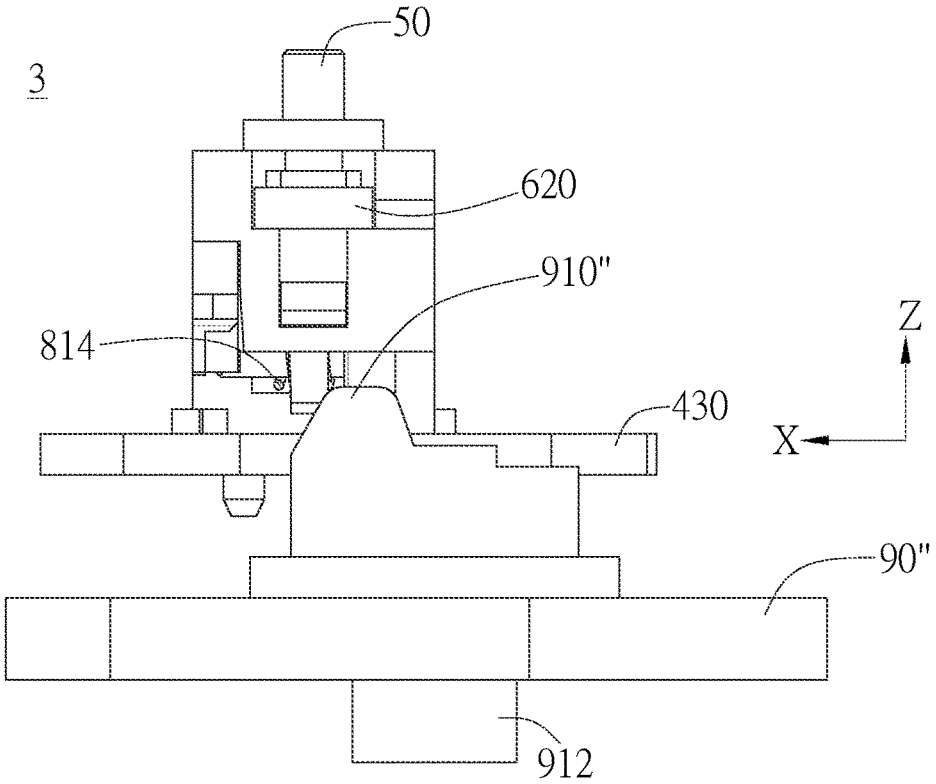

In the embodiment of FIG. 33A, the blocking portion 910' presses the hitting portion 814 from above to below to restrict the movement of the hitting portion 814 relative to the impact surface 155, but not limited thereto. FIG. 35A to FIG. 35C are an exploded view, an assembled view, and a cross-sectional view of the key structure 3 in a tenth embodiment of the invention, respectively, when the adjusting unit 90" of the key structure 3 is at the first position. In this embodiment, the key structure 3 has a structure similar to the key structure 2 and is different in the design of the blocking portion 910" of the adjusting unit 90". Thus, the detailed structure, function, and connection of components of the key structure 3 (e.g. the base 10, the movable mechanism (e.g. the linkage mechanism 20B), the sound generating member 80, the magnetic unit 60) can be referred to the related descriptions of the previous embodiments and will not elaborate again. Hereinafter, the adjusting unit 90" of the key structure 3 will be illustrated.

Figure 36A:
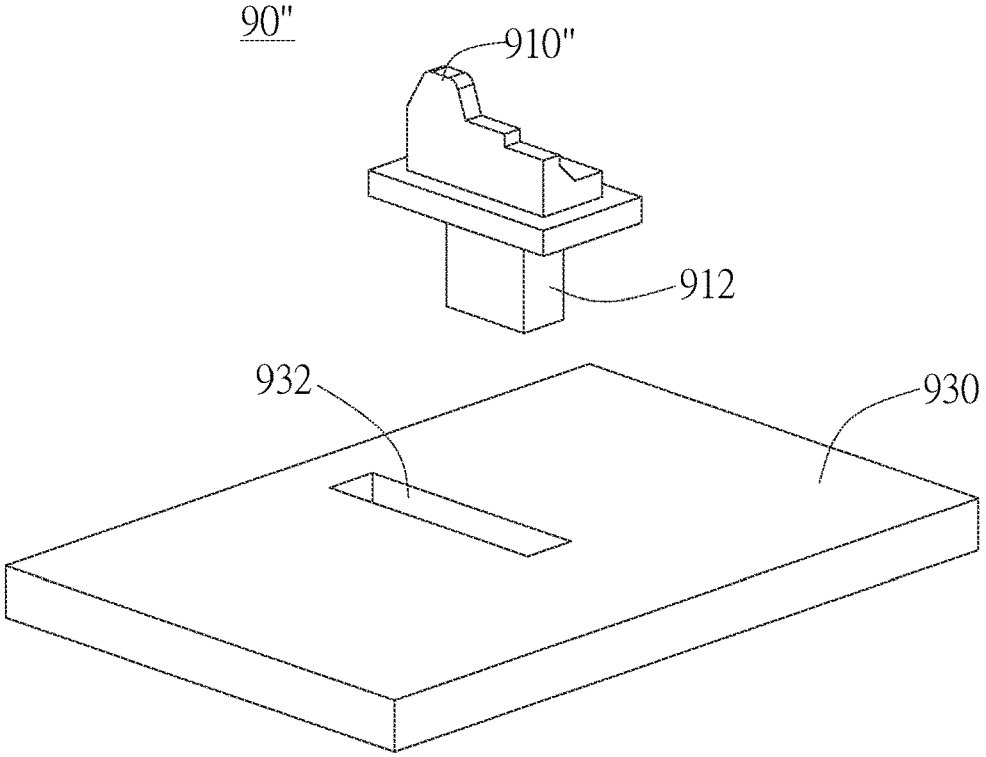
FIG. 36A and FIG. 36B are an exploded view and a bottom view of the adjusting unit of the key structure of FIG. 35A.
Figure 36B:
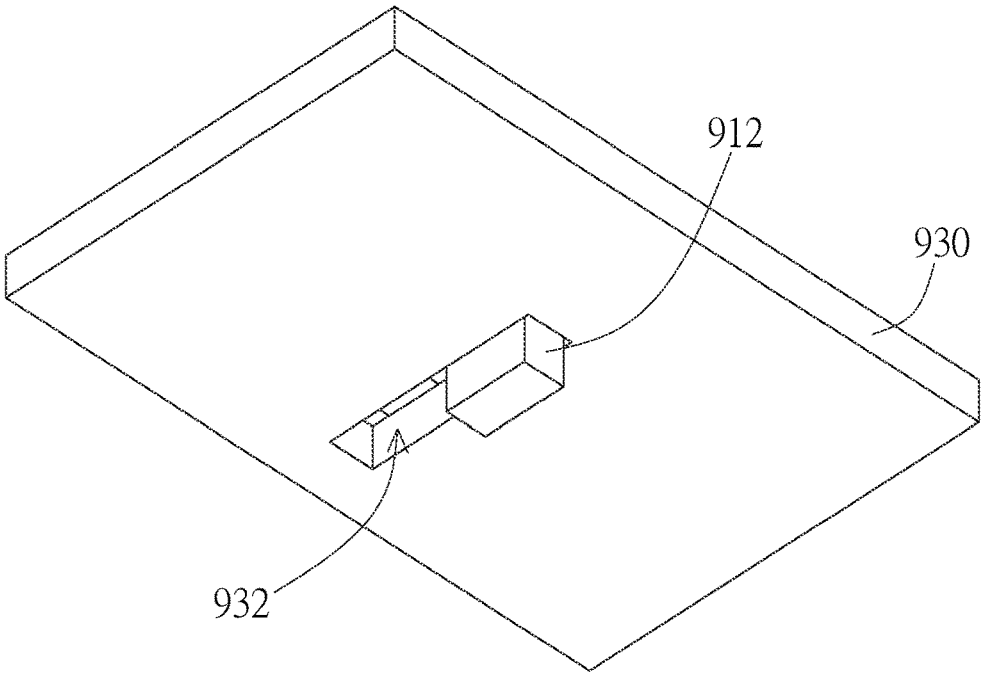

As shown in FIG. 36A and FIG. 36B, the blocking portion 910" of the adjusting unit 90" is movably disposed on the support plate 930. The positioning portion 912 of the blocking portion 910" is movably inserted into the positioning channel 932 of the support plate 930 and at least partially protrudes out the lower surface of the support plate 930 from the positioning channel 932. When the positioning portion 912 receives a pulling force or a pushing force, the positioning portion 912 moves along the positioning channel 932 to drive the blocking portion 910" to move to the first position not to interfere with the hitting portion 814 (as shown in FIG. 35C) or to the second position to interfere with the hitting portion 814 (as shown in FIG. 38C), but not limited thereto. In another embodiment, the adjusting unit 90" may not have the support plate 930. Alternatively, the blocking portion 910" can be integrated with the support plate 930, so when the support plate 930 moves relative to the base 10, the blocking portion 910" can move with the support plate 930 relative to the base 10.

Figure 37A:
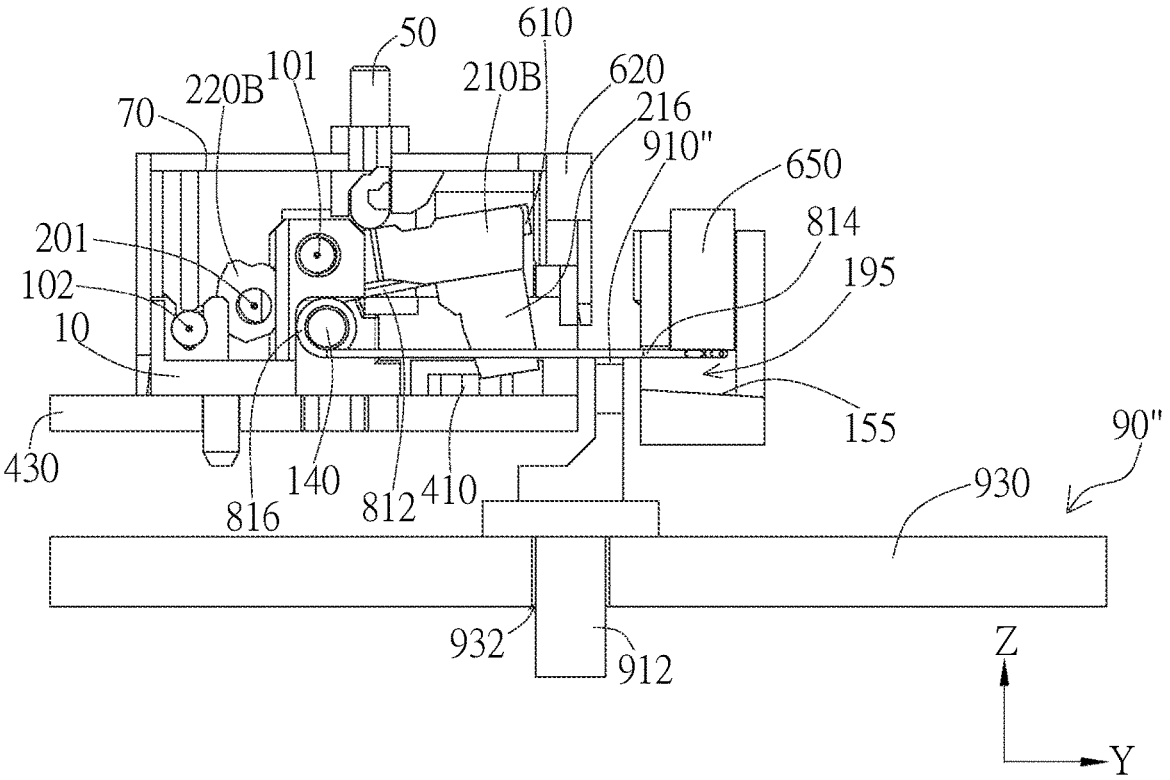
FIG. 37A and FIG. 37B are cross-sectional views showing that the key structure of FIG. 35A is in the non-pressed state and the pressed state, respectively, when the adjusting unit of the key structure is at the first position.
Figure 37B:
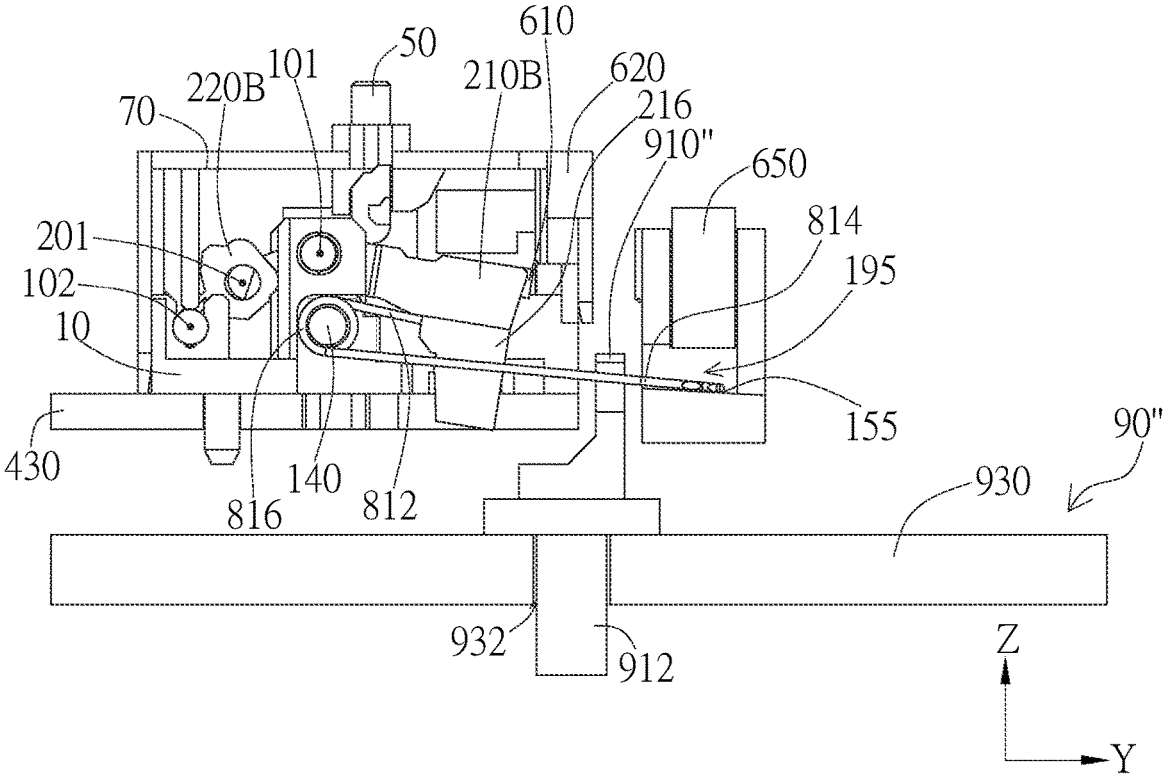

Referring to FIG. 37A and FIG. 37B, the operation of the key structure 3 when the adjusting unit 90" is at the first position will be illustrated. FIG. 37A and FIG. 37B are cross-sectional views showing that the key structure 3 is in the non-pressed state and the pressed state, respectively, when the adjusting unit 90" of the key structure 3 is at the first position. As shown in FIG. 37A and FIG. 37B, when the adjusting unit 90" is at the first position, and the pressing force is applied to the movable mechanism, the movable mechanism rotates with respect to the base 10 and drives the sound generating member 80 to move, so the hitting portion 814 moves toward the impact surface 155 to hit the impact surface 155 to generate the hitting sound. Specifically, when the adjusting unit 90" is at the first position, i.e., the blocking portion 910" is located away from the hitting portion 814 of the sound generating member 80 in the X-axis direction and does not interfere with the hitting portion 814, the pressing operation of the key structure 3 is similar to the key structure 2 of FIG. 32A and FIG. 32B, so can be referred to the related descriptions of the previous embodiments and will not elaborate again.

Figure 38A:
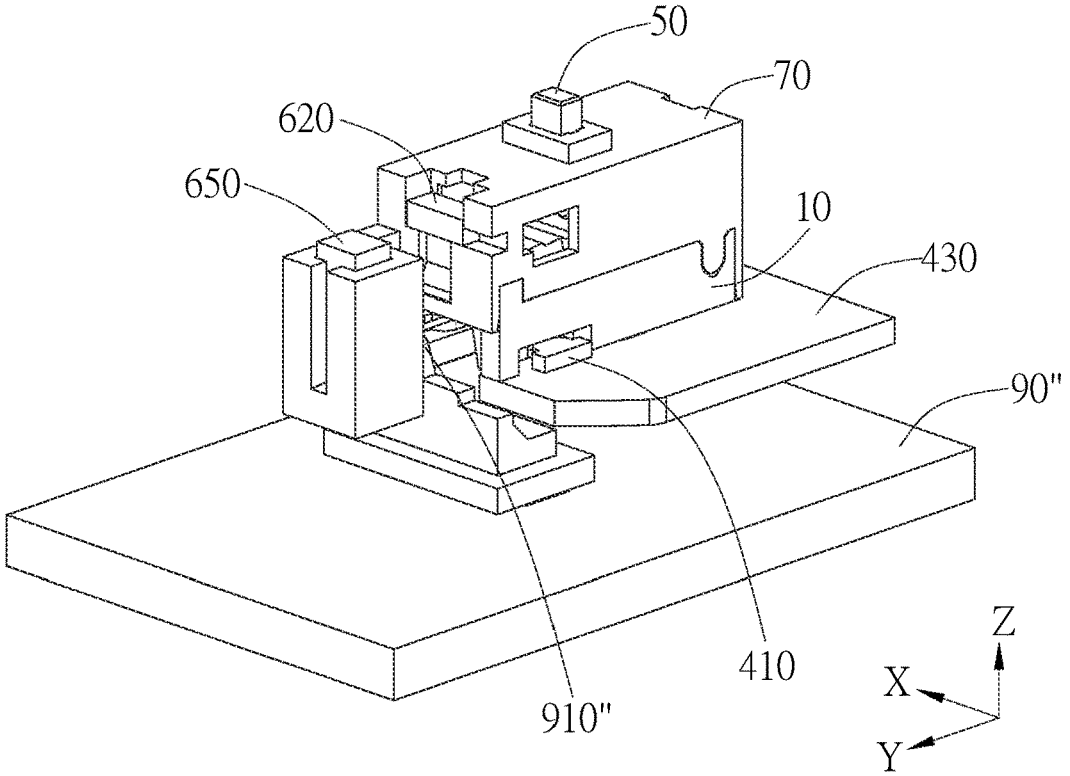
FIG. 38A to FIG. 38C are a three-dimensional view, a bottom view, and a cross-sectional view of the key structure of FIG. 35A, respectively, when the adjusting unit of the key structure is at the second position.
Figure 38B:
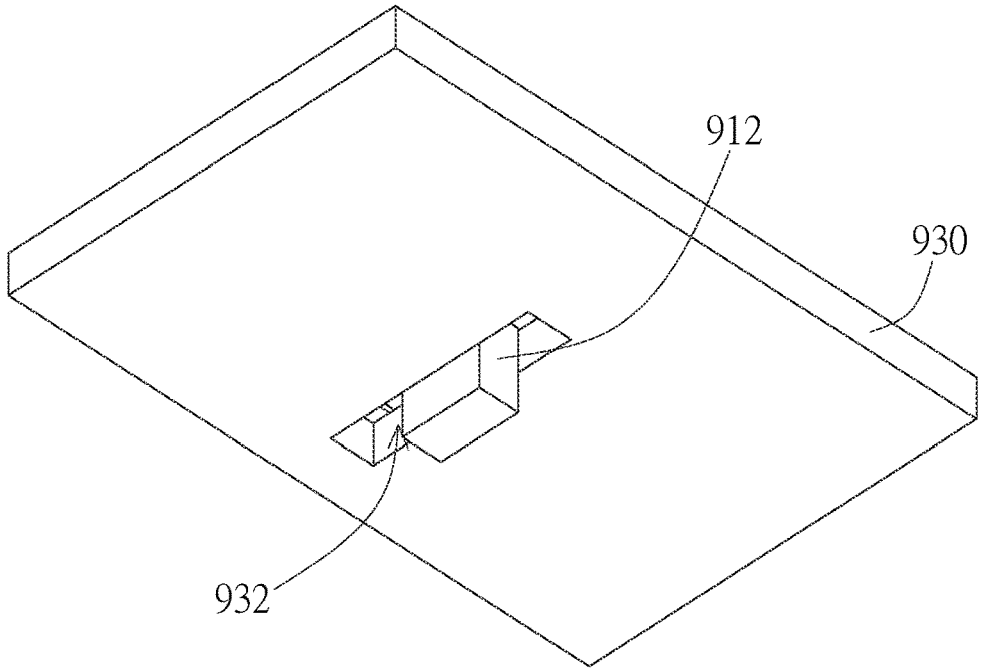
Figure 38C:
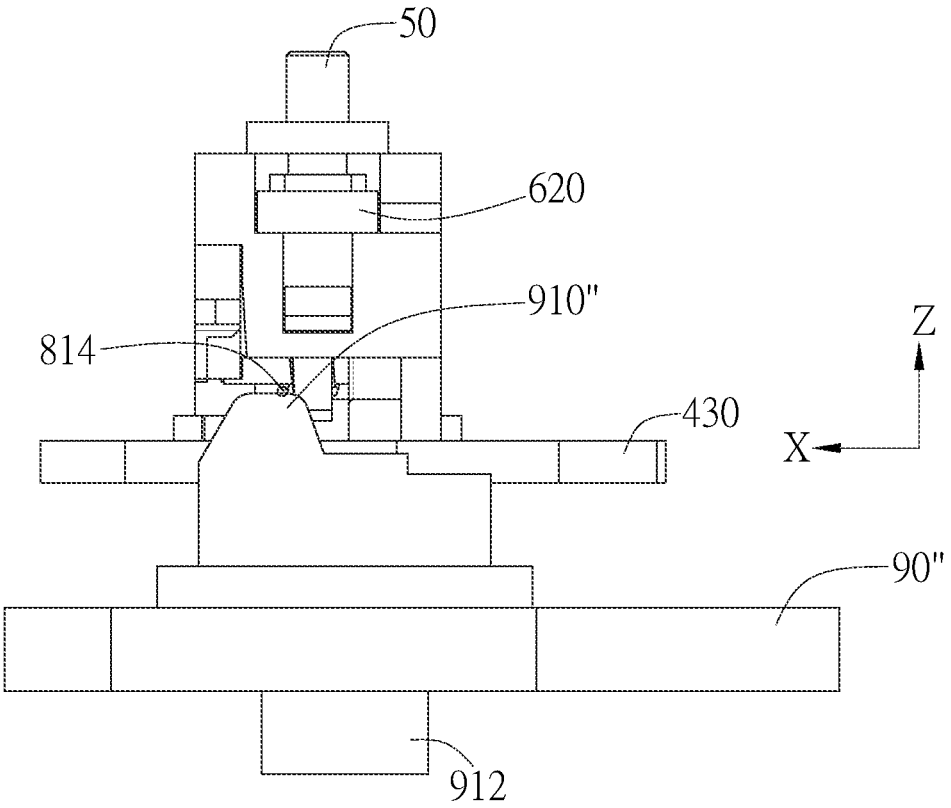

FIG. 38A to FIG. 38C are a three-dimensional view, a bottom view, and a cross-sectional view of the key structure 3, respectively, when the adjusting unit 90" of the key structure 3 is at the second position. As shown in FIG. 38A to FIG. 38C, when the force is applied to the positioning portion 912 of the blocking portion 910", the positioning portion 912 moves along the positioning channel 932 and drives the blocking portion 910" to move to interfere with the hitting portion 814. In this embodiment, the free end of the blocking portion 910" that corresponds to the hitting portion 814 preferably has an inclined surface. For example, the top portion of the blocking portion 910" can have a trapezoid-like structure. The sidewall of the blocking portion 910" facing the hitting portion 814 is preferably inclined upward away from the hitting portion 814 to form an inclined surface. The top surface of the blocking portion 910" is preferably a flat surface, and the height of the top surface of the blocking portion 910" (i.e., the height of the top surface in the Z-axis direction) is substantially equal to or slightly larger than the bottom of the hitting portion 814. As such, when the blocking portion 910" moves along the X-axis direction toward the hitting portion 814 to the second position, the hitting portion 814 can slide along the inclined surface to the top surface, so the blocking portion 910" abuts below the hitting portion 814 from below to above to restrict the movement of the hitting portion 814 relative to the impact surface 155.

Figure 39A:
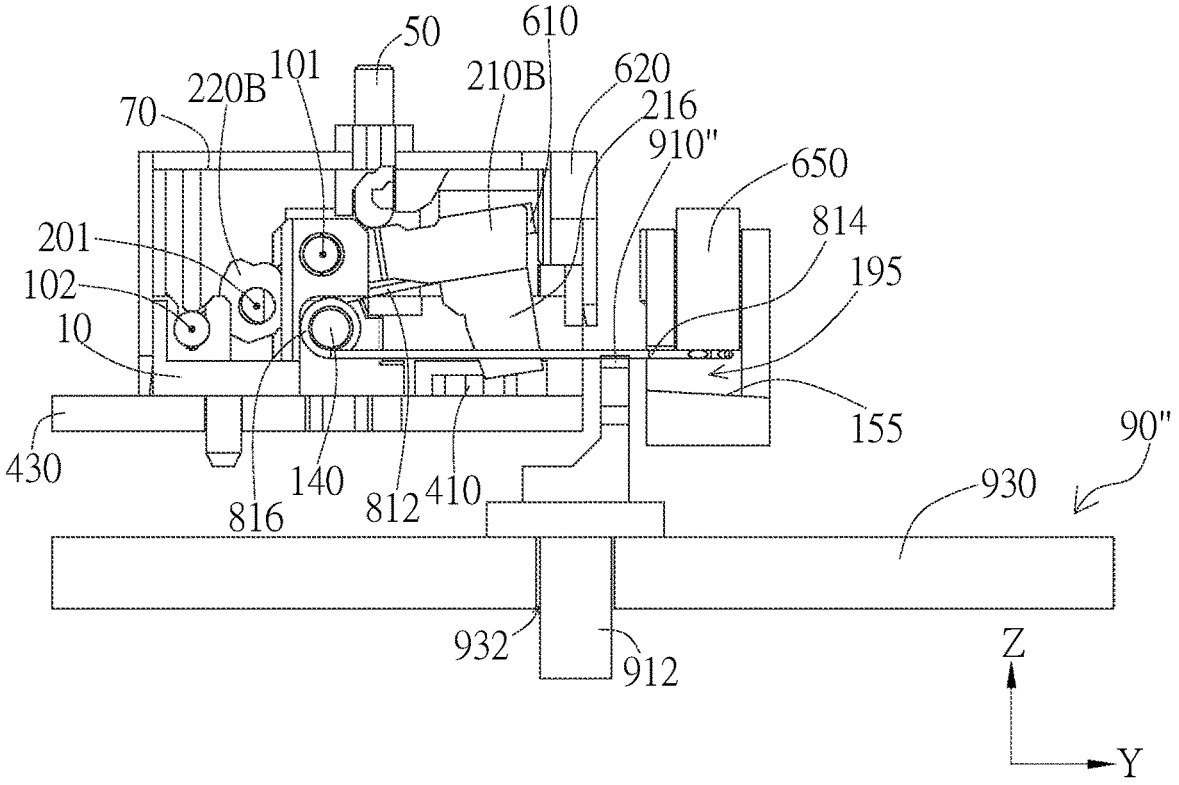
FIG. 39A and FIG. 39B are cross-sectional views showing that the key structure of FIG. 38A is in the non-pressed state and the pressed state, respectively.
Figure 39B:
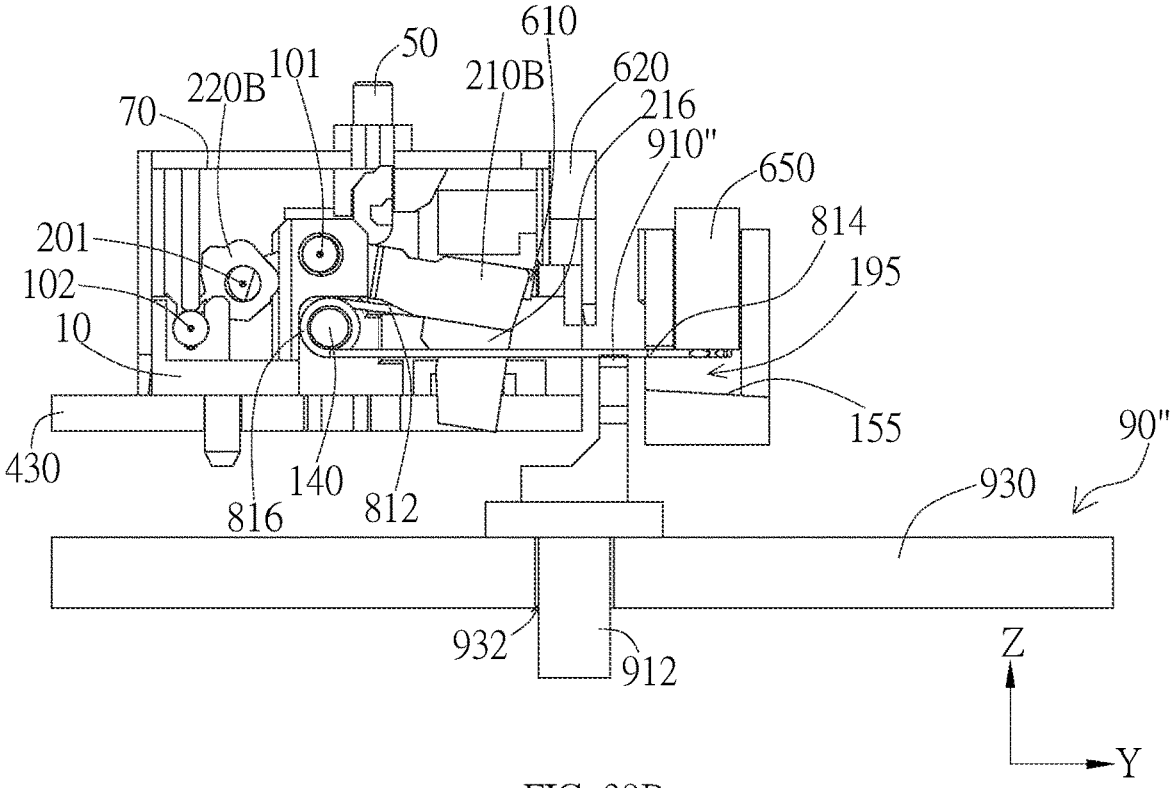

Referring to FIG. 39A to FIG. 39B, the operation of the key structure 3 when the adjusting unit 90" is at the second position will be illustrated. FIGS. 39A and 39B are cross-sectional views showing that the key structure 3 in the non-pressed state and the pressed state, respectively, when the adjusting unit 90" of the key structure 3 is at the second position. As shown in FIG. 39A, when the adjusting unit 90" moves along the X-axis direction toward the extending direction of the hitting portion 814 (e.g. the Y-axis direction) to the second position, the blocking portion 910" pushes the hitting portion 814 toward the magnet 650 from below to above to restrict the hitting portion 814 to move downward toward the impact surface 155. In such a configuration, the sound generating member 80 is positioned not only by the magnetic attraction force between the magnet 650 and the hitting portion 814, but also by the blocking portion 910" abutting below the hitting portion 814. Accordingly, when the pressing force is not applied to the movable mechanism, the sound generating member 80 is substantially immovable relative to the base 10. In such a configuration, the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 39B, when the pressing force is applied to the first linking member 210B by the operation member 50, the first linking member 210B rotates about the first rotation axis 101 clockwise (i.e., along the first direction), and the first magnetic member 610 moves downward with the first linking member 210B to be away from the second magnetic member 620. Meanwhile, the first connecting portion of the first linking member 210B also rotates clockwise away from the base 10 (i.e., the coupling axis 201 moves upward) and drives the second connecting portion of the second linking member 220B to move upward, so the second linking member 220B is driven to rotate about the second rotation axis 102 counterclockwise (i.e., along the second direction). Moreover, when the movable mechanism rotates with respect to the base 10, the movable mechanism drives the contacting portion 812 to move downward. Because the blocking portion 910" of the adjusting unit 90" abuts below the hitting portion 814, so the spring body 816 and the hitting portion 814 are substantially immovable, and the contacting portion 812 is elastically deformed with respect to the spring body 816 and the hitting portion 814. In other words, the hitting portion 814 cannot move downward to hit the impact surface 155, and no hitting sound is generated. Accordingly, when the adjusting unit 90" is at the second position, the key structure 3 can provide the silent (or soundless) operation feedback. In addition, the actuating portion 216 rotates with the first linking member 210B to a position that the light channel 150 can be shielded, so the intensity of the optical signal received by the receiver 420 from the emitter 410 is smaller (e.g. the amount of light received is less) or substantially equal to zero (i.e., the receiver 420 does not receive the optical signal), and the switch unit is triggered to generate the triggering signal.

Figure 20A:
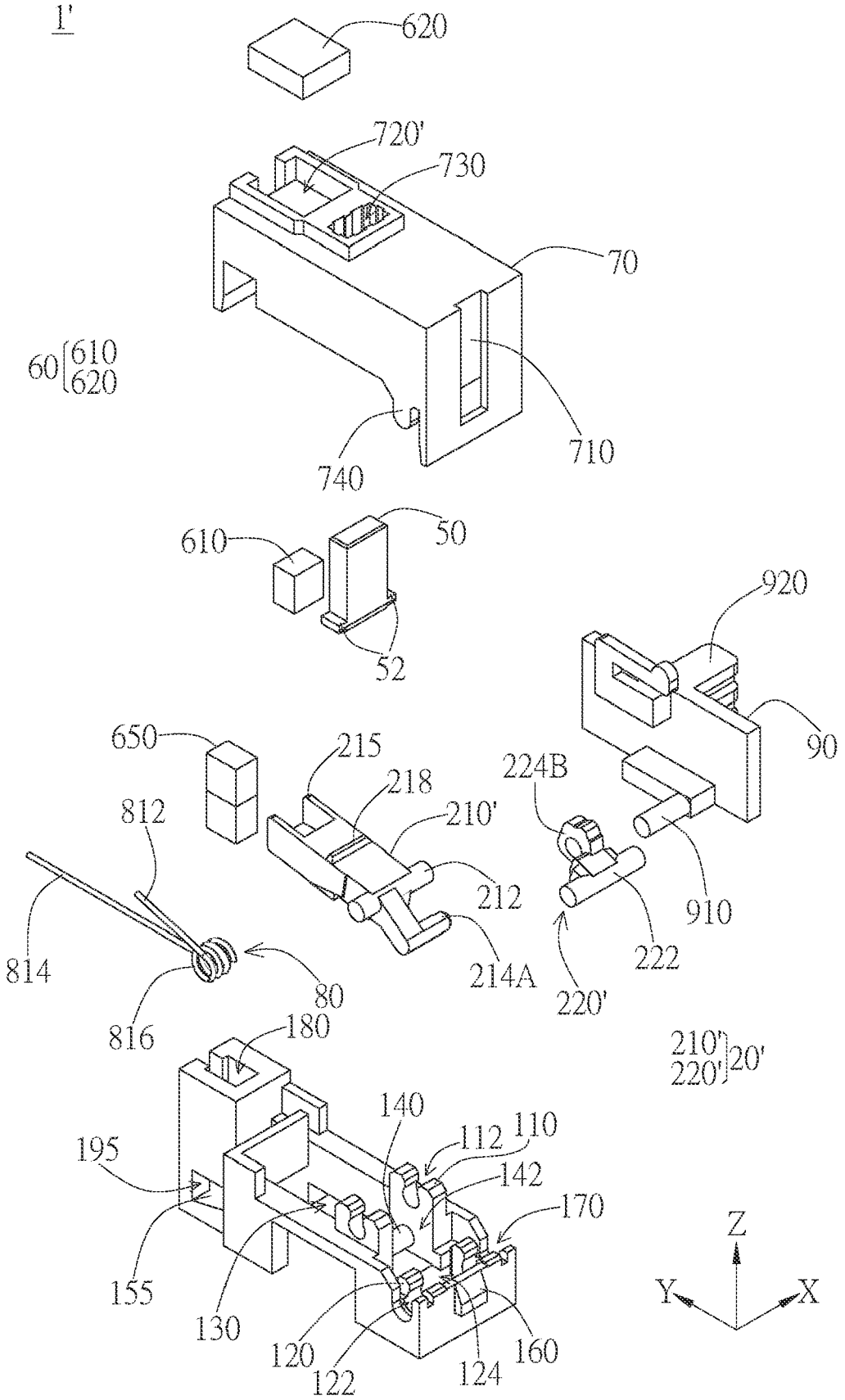
FIG. 20A and FIG. 20B are an exploded view and an assembled view of the key structure in an eighth embodiment of the invention, respectively.
Figure 20B:
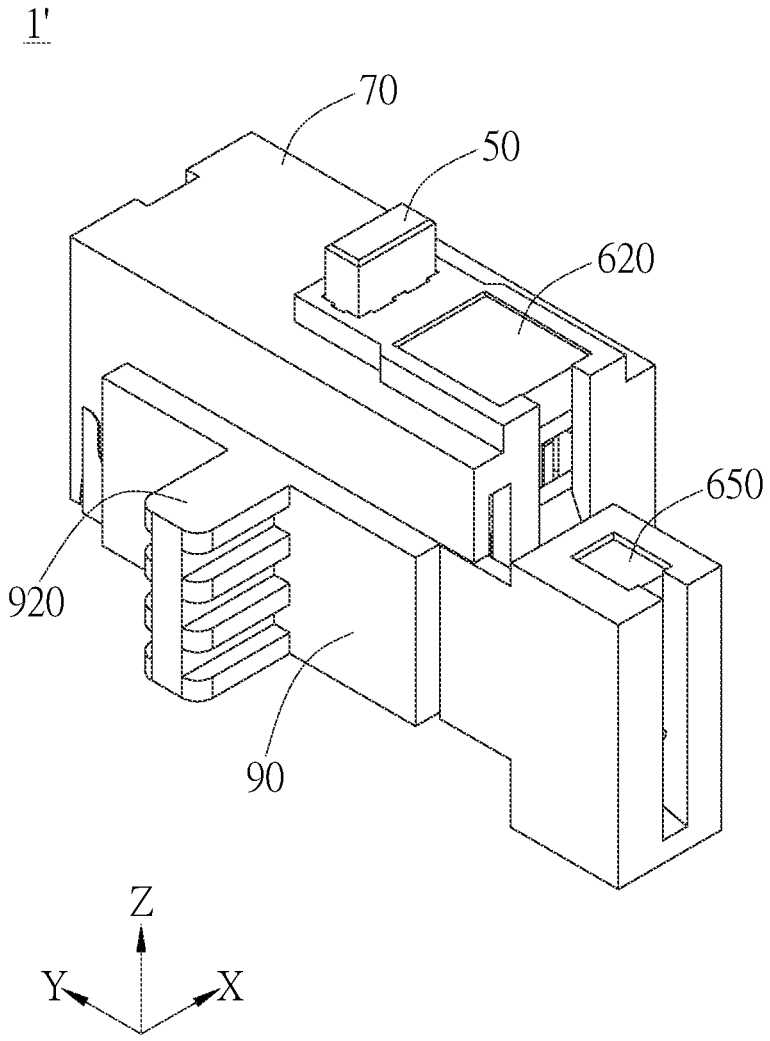
Figure 21A:
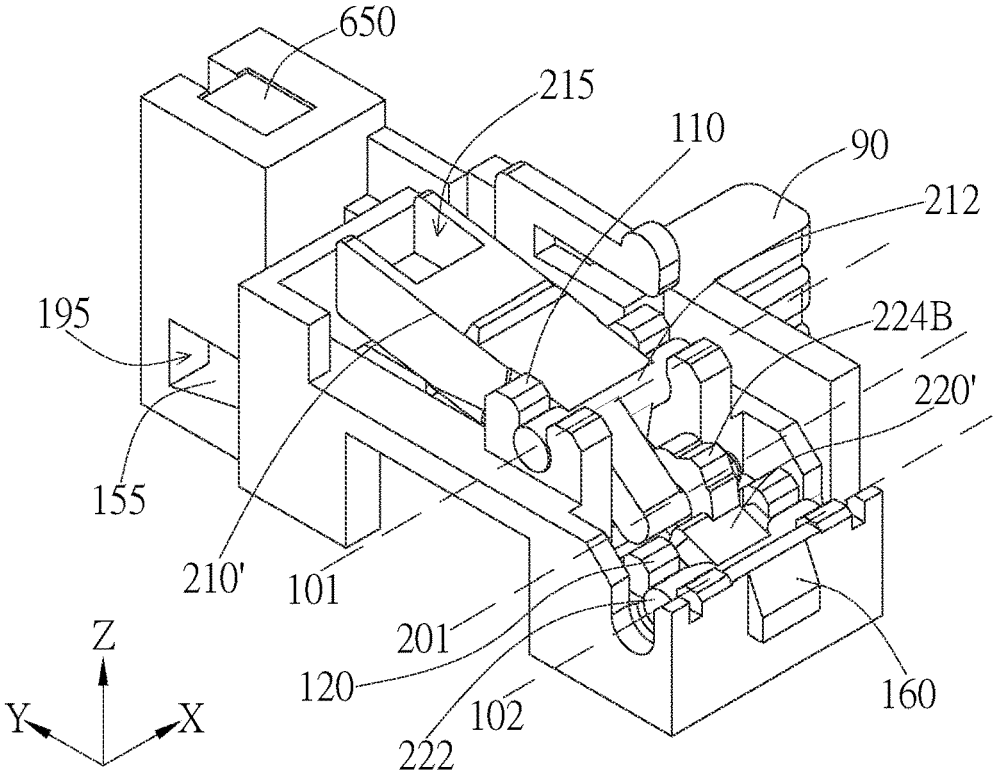
FIG. 21A and FIG. 21B are assembled views of the key structure (without the cover) of FIG. 20A from different viewing angles.
Figure 21B:
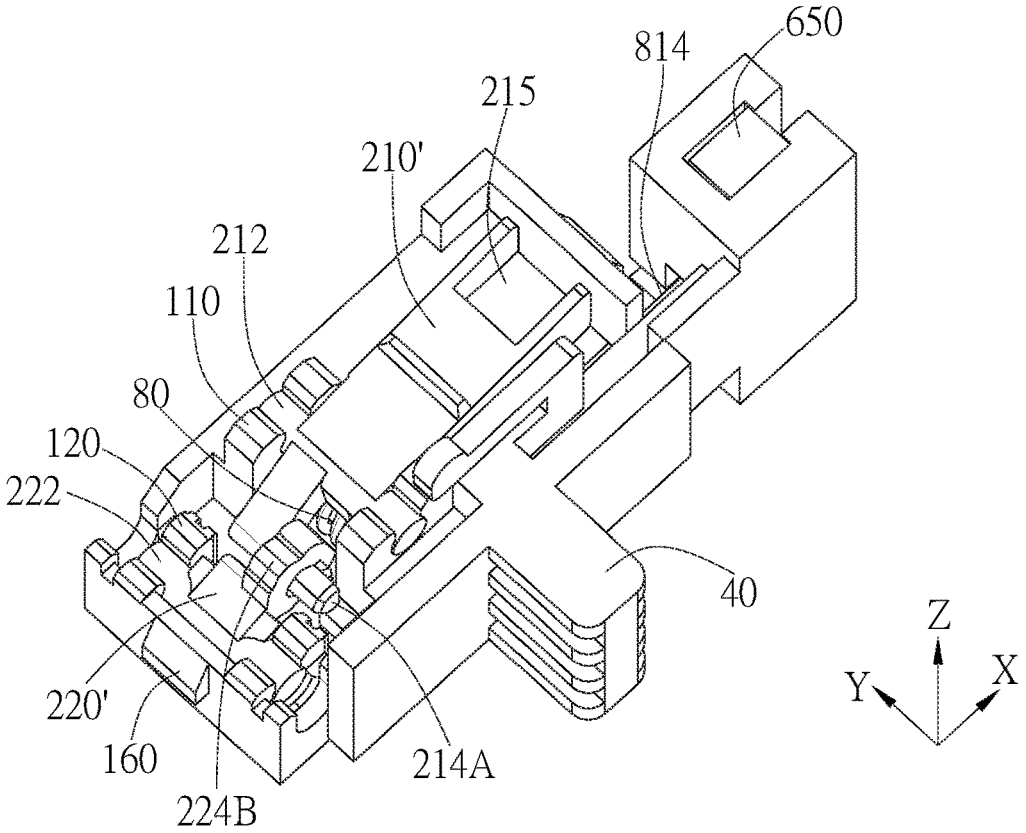
Figure 40A:
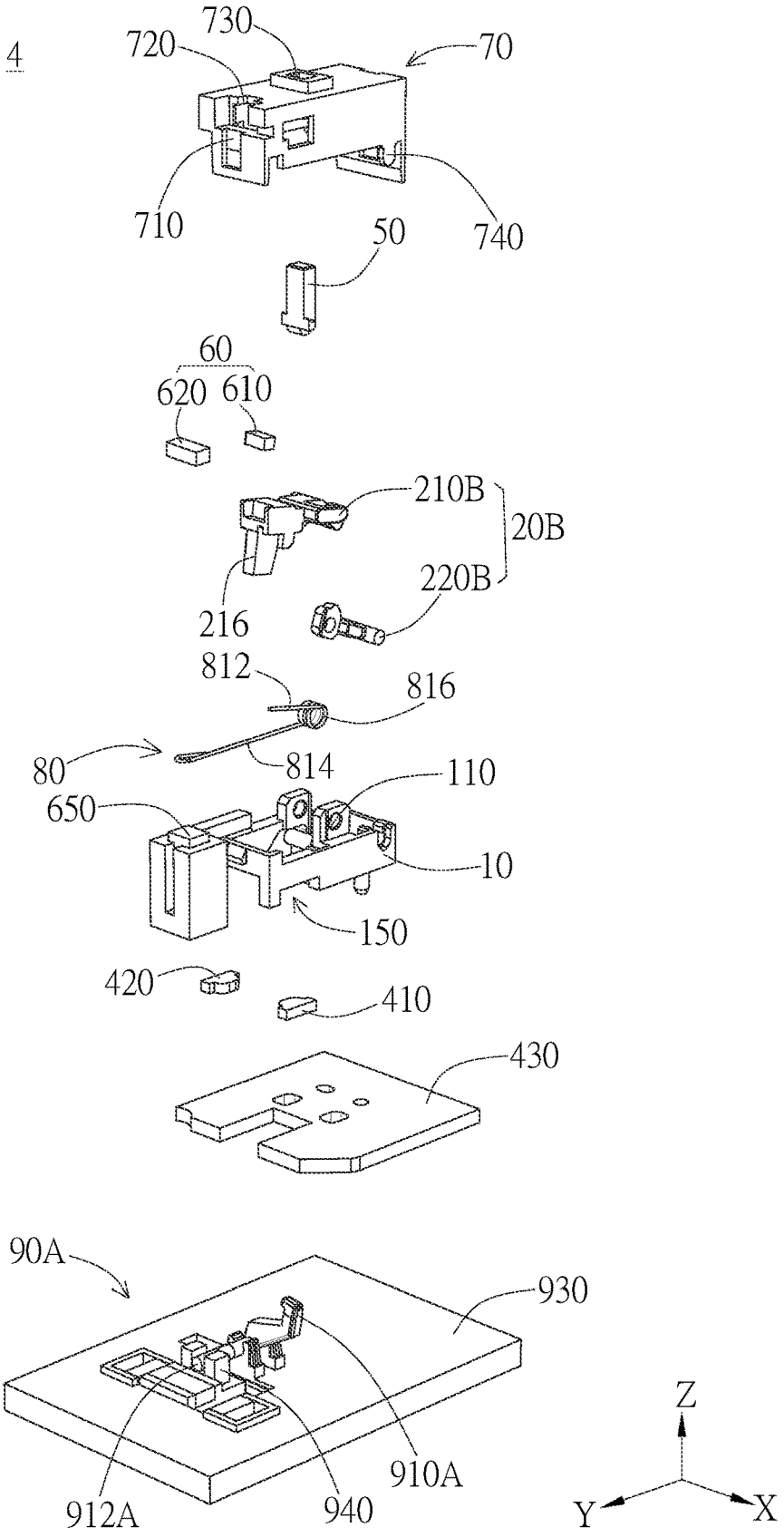
FIG. 40A to FIG. 40C are an exploded view, an assembled view, and a side view of the key structure in an eleventh embodiment of the invention, respectively, when the adjusting unit of the key structure is at the first position.
Figure 40B:
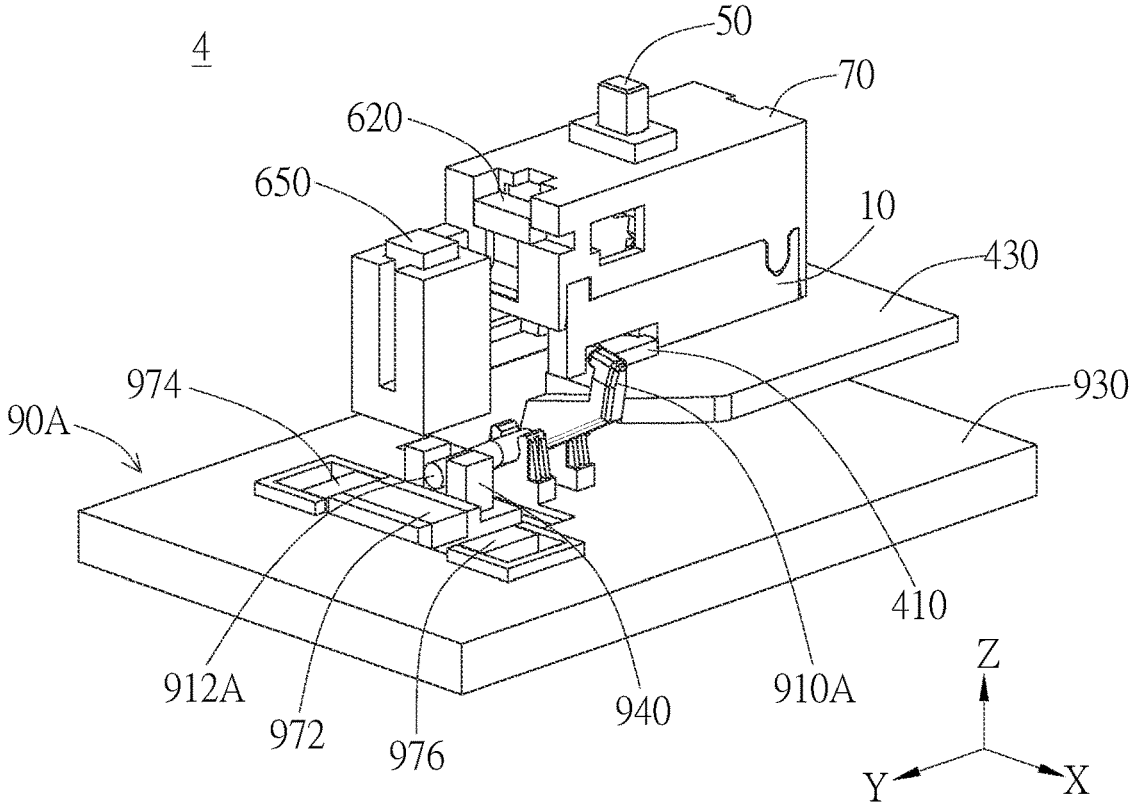
Figure 40C:
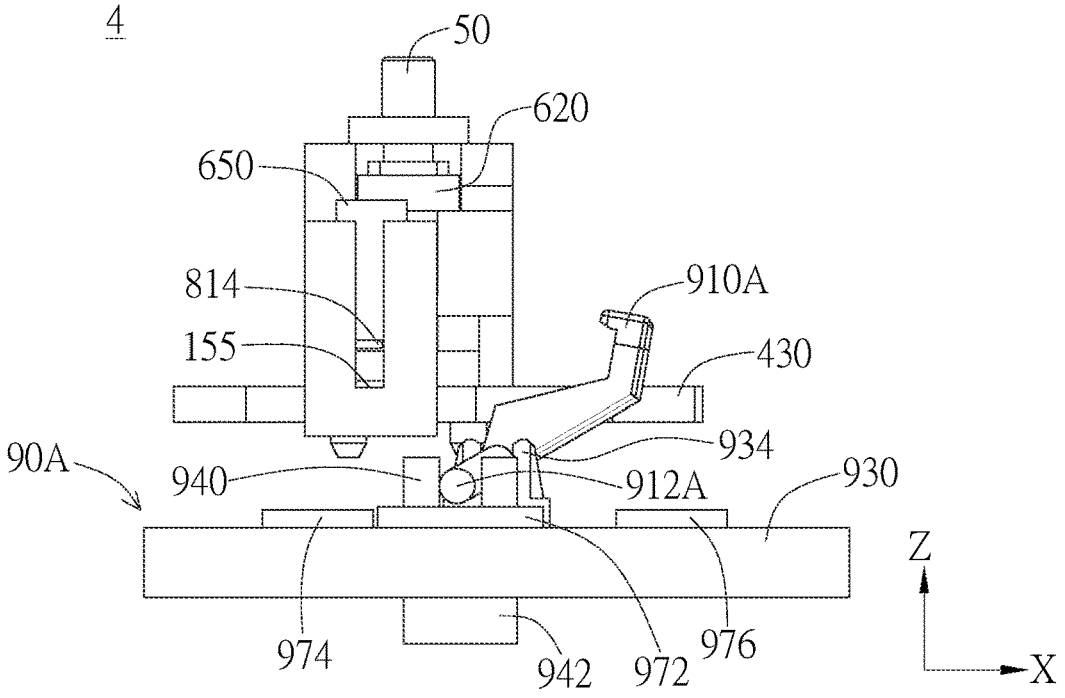

In the embodiments of FIG. 20A, FIG. 30A, and FIG. 35A, the adjusting units 90, 90', 90" are linearly moved to drive the blocking portion 910, 910', 910" to linearly move to the first position or the second position, but not limited thereto. FIG. 40A to FIG. 40C are an exploded view, an assembled view, and a cross-sectional view of the key structure 4 in an eleventh embodiment of the invention, respectively, when the adjusting unit 90A of the key structure 4 is at the first position. In this embodiment, the key structure 4 has a structure similar to the key structure 2, 3 and is different in the design of the adjusting unit 90A. Thus, the detailed structure, function, and connection of components of the key structure 4 (e.g. the base 10, the movable mechanism (e.g. the linkage mechanism 20B), the sound generating member 80, the magnetic unit 60) can be referred to the related descriptions of the previous embodiments and will not elaborate again. Hereinafter, the adjusting unit 90A of the key structure 4 will be illustrated.

Referring to FIG. 40A to FIG. 40C and FIG. 41A to FIG. 41C, in an embodiment, the adjusting unit 90A can include a support plate 930, a movable portion 940, and a blocking portion 910A. The support plate 930 is disposed below the base 10, and the circuit board 430 can be disposed between the support plate 930 and the base 10. The movable portion 940 is supported by the support plate 930 to be movable relative to the base 10. The blocking portion 910A is rotatably positioned on the support plate 930 and couples the movable portion 940. When the movable portion 940 moves relative to the base 10, the movable portion 940 drives the blocking portion 910A to rotate, so the blocking portion 910A can or cannot interfere with the hitting portion 814.

Figure 41A:
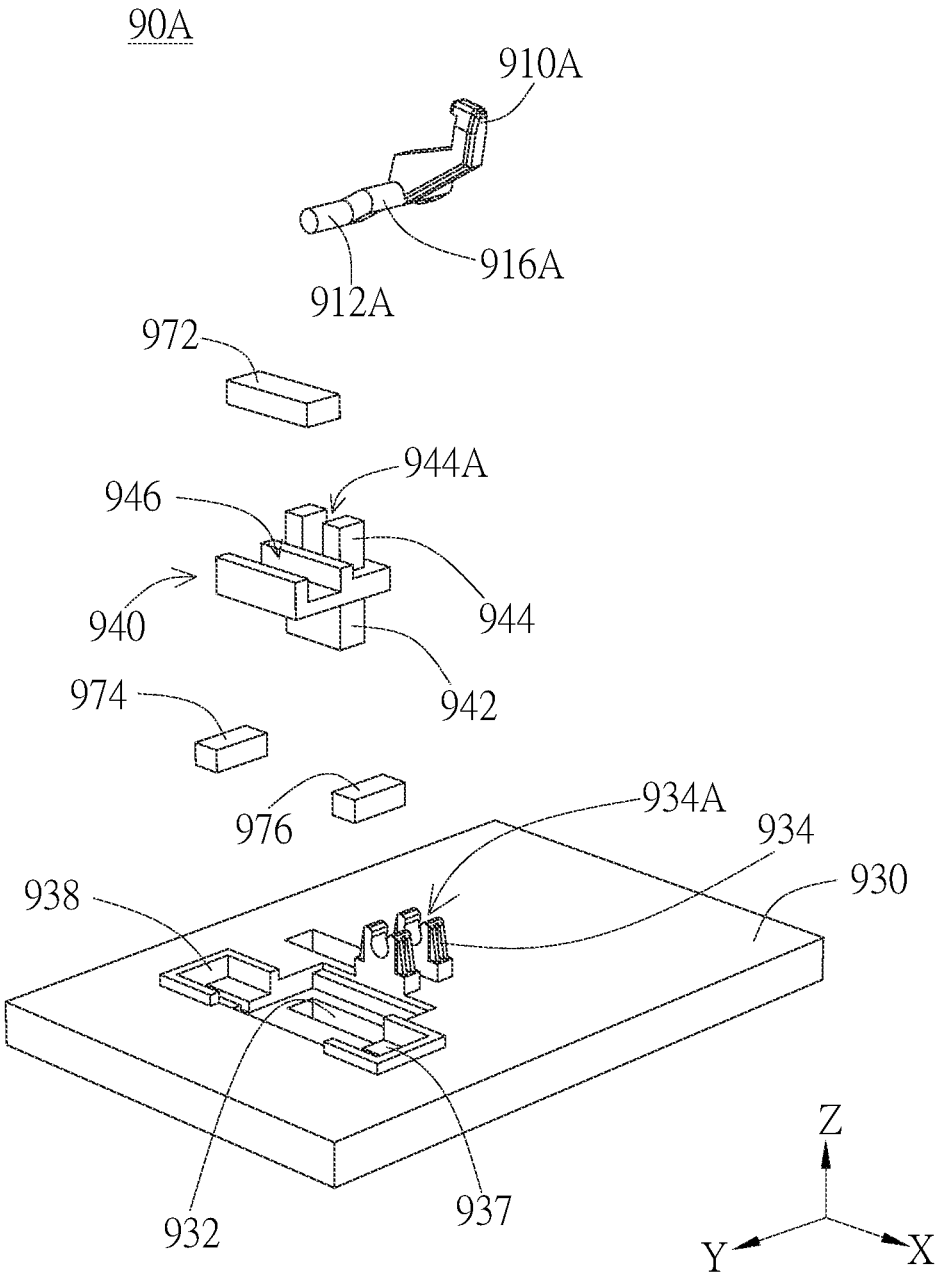
FIG. 41A to FIG. 41C are an exploded view, an assembled view and a bottom view of the adjusting unit of the key structure of FIG. 40A, respectively.
Figure 41B:
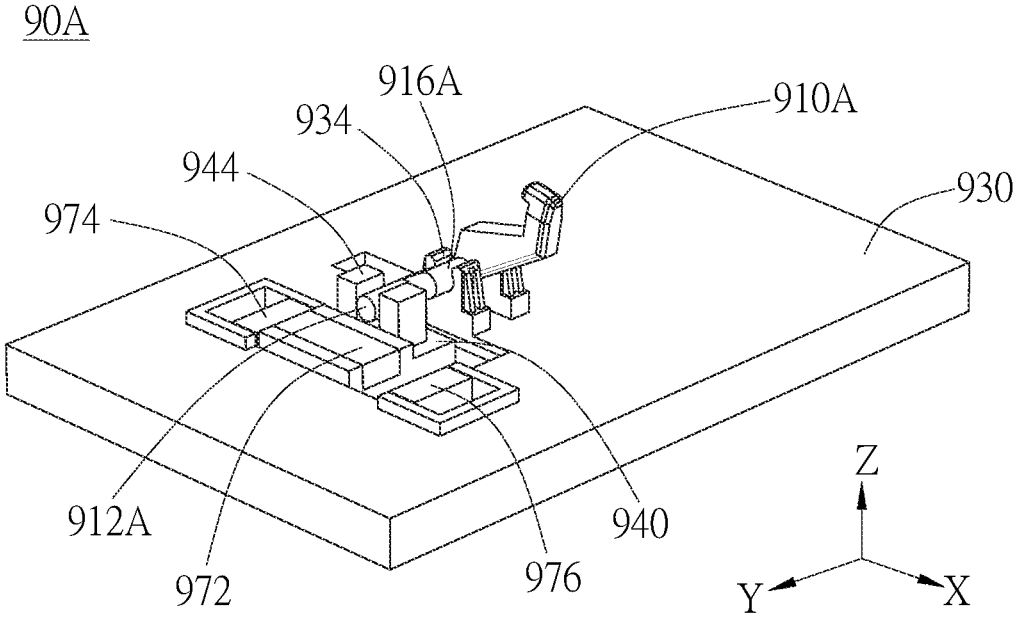
Figure 41C:
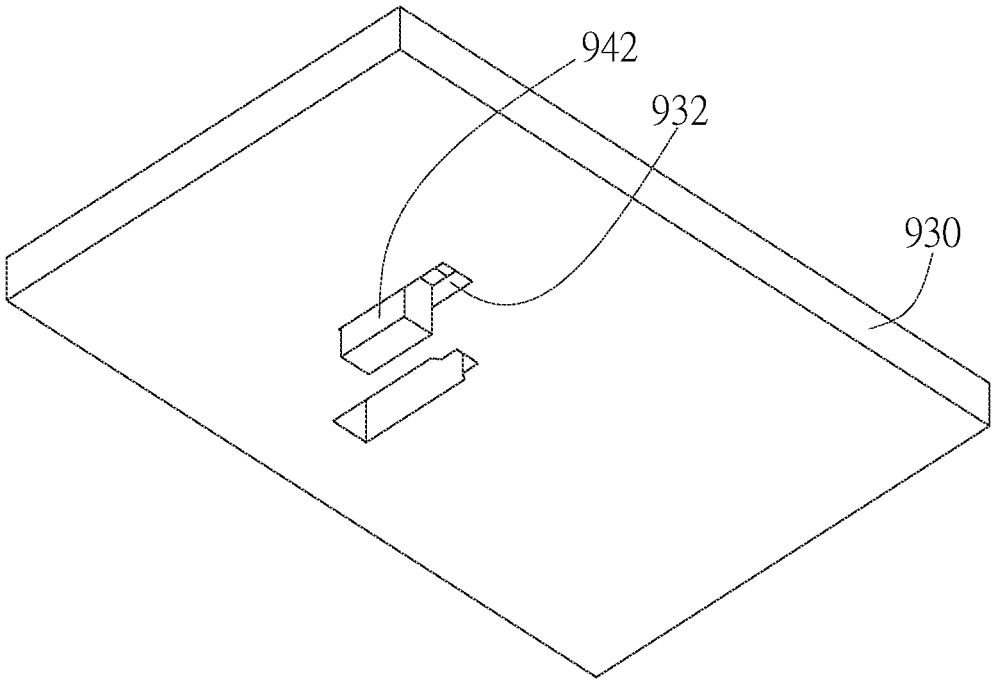

Specifically, as shown in FIG. 41A to FIG. 41C, the support plate 930 has a positioning channel 932 and a coupling portion 934. The positioning channel 932 extends along the moving direction of the movable portion 940 (such as disposed along the X-axis direction), and the movable portion 940 is allowed to move in the positioning channel 932. The coupling portion 934 is disposed at one side of the positioning channel 932 and adapted to rotatably couple the blocking portion 910A. For example, the coupling portion 934 can be a coupling structure having a pivotal hole 934A, so the rotation axis formed by coupling the blocking portion 910A and the coupling portion 934 is preferably perpendicular to the moving direction of the movable portion 940. The movable portion 940 has a positioning part 942 and an engaging part 944. The positioning part 942 and the engaging part 944 are disposed at two opposite ends of the movable portion 940 (e.g. lower end and upper end), respectively. The positioning part 942 can be movably inserted into the positioning channel 932 and at partially extends out the lower surface of the support plate 930 from the positioning channel 932, so the movable portion 940 is movably positioned on the support plate 930. The engaging part 944 protrudes above the upper surface of the support plate 930 and preferably is an engaging structure having an engaging groove 944A.

The blocking portion 910A has a connecting part 912A and a pivot part 916A. The connecting part 912A is positioned on the engaging part 944 of the movable portion 940. For example, the connecting part 912A is inserted into the engaging groove 944A of the engaging part 944, so the blocking portion 910A and the movable portion 940 can form a linkage mechanism. The pivot part 916A and the coupling portion 934 of the support plate 930 are rotatably coupled with each other, so when the movable portion 940 moves, the blocking portion 910A can be driven to rotate with respect to the support plate 930. In an embodiment, the connecting part 912A can be implemented as a circular rod, and the connecting part 912A is preferably inserted into the engaging groove 944A of the engaging part 944 of the movable portion 940 along a direction perpendicular to the moving direction of the movable portion 940 (e.g. along the Y-axis direction), but not limited thereto. According to practical applications, the blocking portion 910A and the movable portion 940 can be rotatably connected by any suitable coupling manners, such as engaging, screwing, and not limited to the embodiments. The pivot part 916A can be implemented as a pivot. In the extending direction of the blocking portion 910A, the connecting part 912A is closer to the outer side of the blocking portion 910A than the pivot part 916A is. When the blocking portion 910A is rotatably connected to the support plate 930 by coupling the pivot part 916A and the pivotal hole 934A, the connecting part 912A is closer to the support plate 930 than the pivot part 916A is. In other words, the connecting part 912A, the pivot part 916A, and the part of the blocking portion 910A adapted to interfere with the hitting portion 814 (such as an interfering part) are sequentially disposed along the extending direction of the blocking portion 910A. Moreover, the extending direction or the axial direction of the pivot part 916A (e.g. the Y-axis direction) is preferably perpendicular to the moving direction of the movable portion 940 (e.g. the X-axis direction), and in the axial direction of the pivot part 916A, the connecting part 912A is preferably disposed on one side of the pivot part 916A, such as the outer side.

The adjusting unit 90A can further include a positioning unit, and the movable portion 940 is positioned at the first position or the second position by the positioning unit. Specifically, the positioning unit can include a movable portion magnetic member 972 and support plate magnetic members 974, 976. The movable portion magnetic member 972 and the support plate magnetic members 974, 976 are disposed on the movable portion 940 and the support plate 930, respectively. The magnetic attraction force can be generated between the movable portion magnetic member 972 and the support plate magnetic member 974 or 976. For example, the movable portion 940 can further have an accommodating part 946A, which is adapted to accommodate the movable portion magnetic member 972. The support plate 930 can further have receiving parts 938, 937, which are adapted to receive the support plate magnetic members 974, 976, respectively. The support plate magnetic members 974 and 976 are disposed along the moving direction of the movable portion 940 (e.g. the X-axis direction). For example, the accommodating part 946A (or the receiving parts 938, 937) can be a recess or a surface space of the movable portion 940 (or the support plate 930). In an embodiment, the movable portion magnetic member 972 and the support plate magnetic member 974 (or 976) can be implemented as both magnets or a combination of a magnet and a ferromagnetic material, so the magnetic attraction force can be generated between the movable portion magnetic member 972 and the support plate magnetic member 974 (or 976). Moreover, in this embodiment, one movable portion magnetic member 972 and two support plate magnetic members 974 and 976 are illustrated to generate the magnetic attraction force, but not limited thereto. In other embodiments, two movable portion magnetic members 972 and two support plate magnetic members 974 and 976 can be used to generate the magnetic attraction force, respectively. As shown in FIG. 40C, when the movable portion 940 is at the first position with respect to the base 10, the movable portion magnetic member 972 is close to the support plate magnetic member 974 and away from the support plate magnetic member 976, so the movable portion 940 is positioned at the first position by the magnetic attraction force between the movable portion magnetic member 972 and the support plate magnetic member 974, and the blocking portion 910A is also positioned at a position not interfering with the hitting portion 814.

Figure 42A:
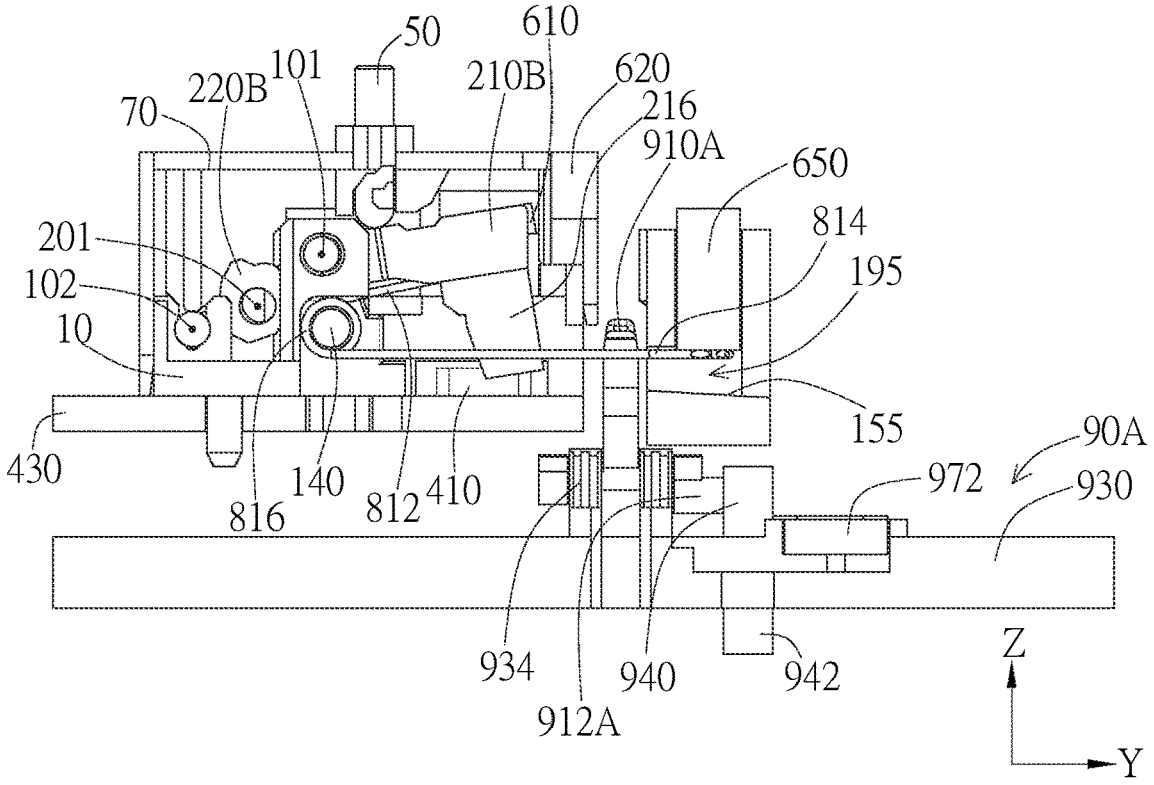
FIG. 42A and FIG. 42B are cross-sectional views showing that the key structure of FIG. 40A is in the non-pressed state and the pressed state, respectively, when the adjusting unit of the key structure is at the first position.
Figure 42B:
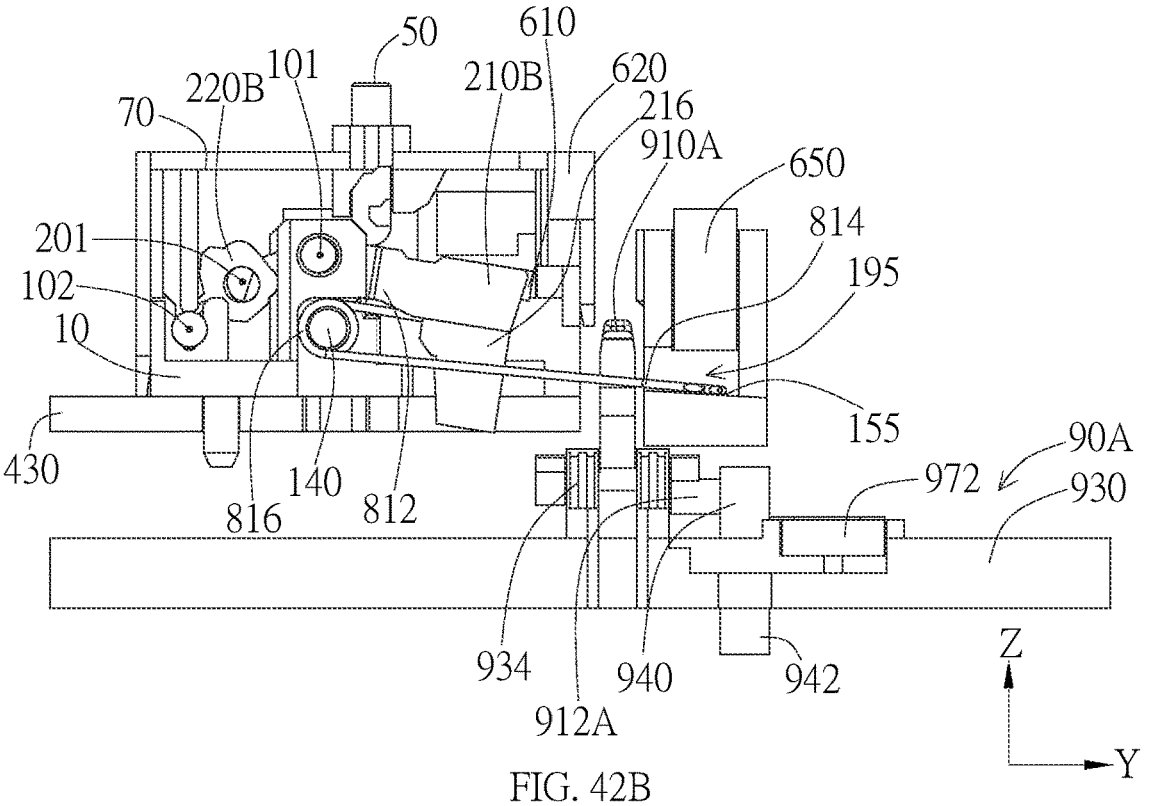

Referring to FIG. 42A and FIG. 42B, the operation of the key structure 4 when the adjusting unit 90A is at the first position will be illustrated. FIG. 42A and FIG. 42B are cross-sectional views showing that the key structure 4 is in the non-pressed state and the pressed state, respectively, when the adjusting unit 90A is at the first position. As shown in FIG. 42A and FIG. 42B, when the adjusting unit 90A is at the first position (i.e., the blocking portion 910A does not interfere with the hitting portion 814), and the pressing force is applied to the movable mechanism, the movable mechanism rotates with respect to the base 10 and drives the sound generating member 80 to move, so the hitting portion 814 moves toward the impact surface 155 and hits the impact surface 155 to generate the hitting sound. Specifically, when the movable portion 940 of the adjusting unit 90A is at the first position, the blocking portion 910A is away from the hitting portion 814 of the sound generating member 80 in the X-axis direction and does not interfere with the hitting portion 814. The pressing operation of the key structure 4 in such a configuration is similar to that of the key structure 2 of FIG. 32A and FIG. 32B, so can be referred to the above related descriptions and will not elaborate again.

Figure 43A:
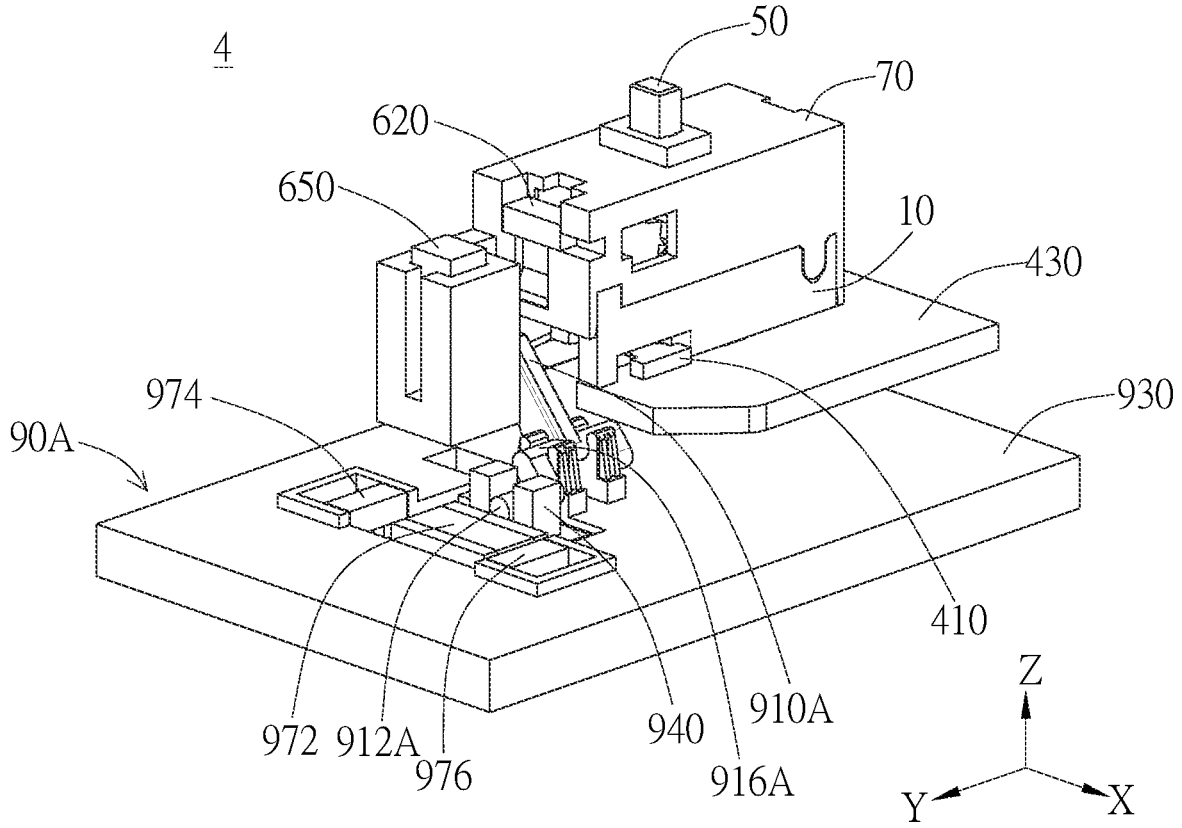
FIG. 43A to FIG. 43C are a three-dimensional view, a side view, and a bottom view of the key structure of FIG. 40A, respectively, when the adjusting unit of the key structure is at the second position.
Figure 43B:
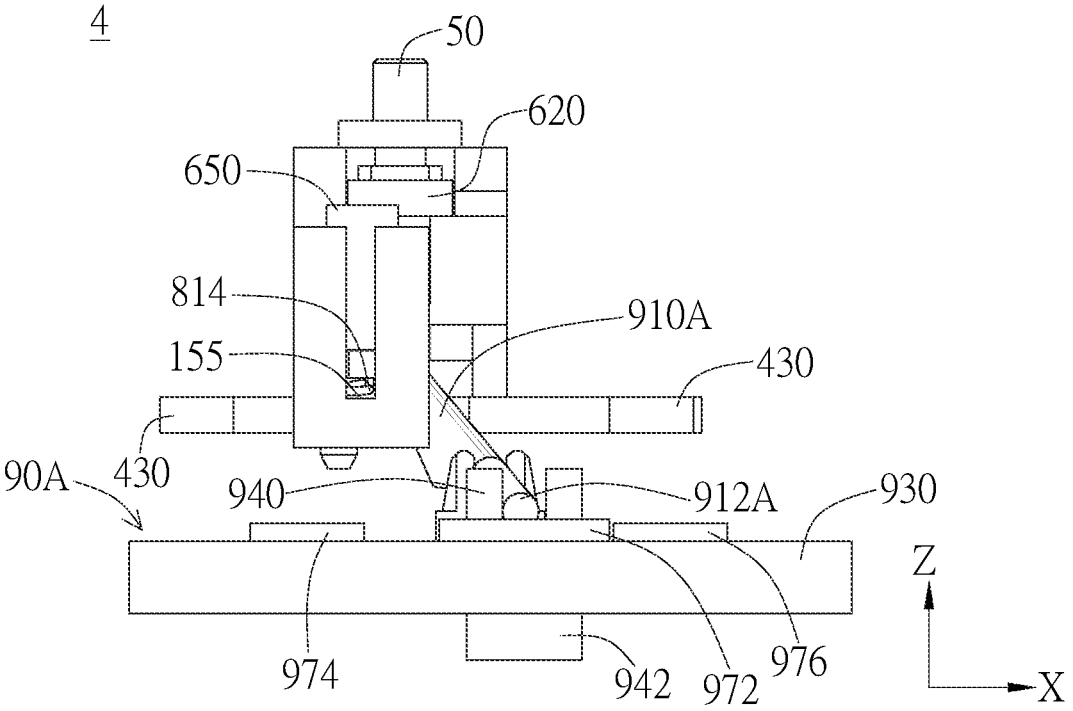
Figure 43C:
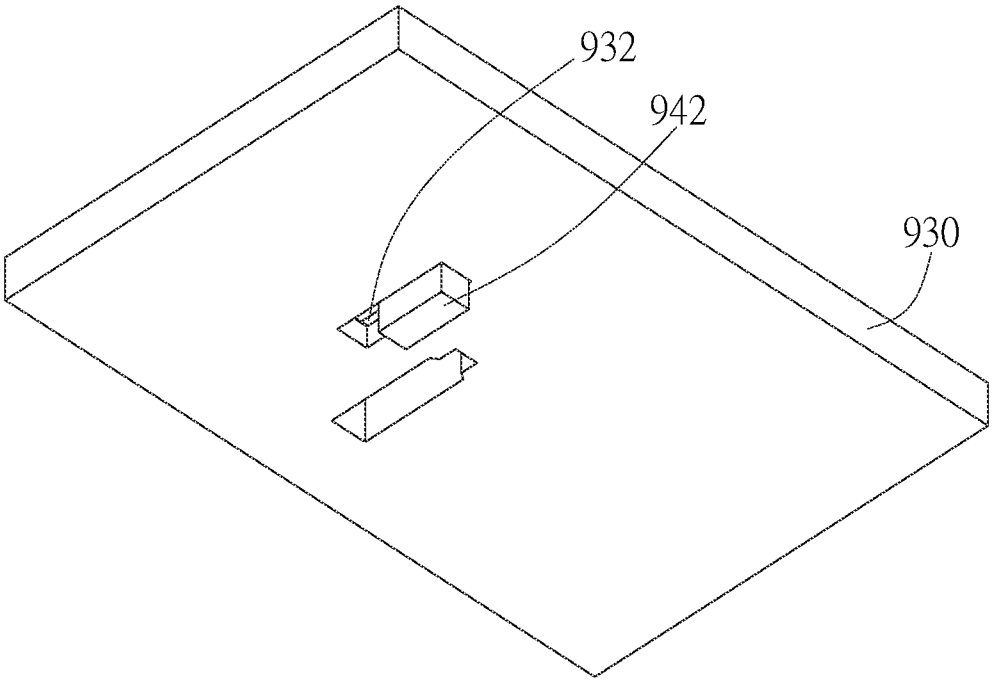

FIG. 43A to FIG. 43C are a three-dimensional view, a side view, and a bottom view of the key structure 4, respectively, when the adjusting unit 90A of the key structure 4 is at the second position. As shown in FIG. 43A to FIG. 43C, when the movable portion 940 moves relative to the base 10 to the second position, the movable portion 940 drives the blocking portion 910A to rotate and interfere with the hitting portion 814 to restrict movement of the hitting portion 814 relative to the impact surface 155. Moreover, when the movable portion 940 moves relative to the base 10 to the second position, the movable portion 940 drives the movable portion magnetic member 972 to move close to the support plate magnetic member 976 and away from the support plate magnetic member 974, so the movable portion 940 is positioned at the second position by the magnetic attraction force between the movable portion magnetic member 972 and the support plate magnetic member 976, and the blocking portion 910A is positioned at a positioned interfering with the hitting portion 814. Specifically, when a pulling or pushing force is applied to the positioning part 942 of the movable portion 940, the movable portion 940 moves along the positioning channel 932 (e.g. toward the righthand side and away from the base 10) and drives the connecting part 912A of the blocking portion 910A to move to the righthand side, so the blocking portion 910A rotates about the pivot part 916A counterclockwise with respect to the support plate 930 toward the hitting portion 814. Consequently, the blocking portion 910A interferes with the hitting portion 814. In this embodiment, when the movable portion 940 is at the second position, the blocking portion 910A preferably presses the hitting portion 814 toward the impact surface 155, so the hitting portion 814 can contact the impact surface 155. In other words, when the movable portion 940 of the adjusting unit 90A moves to the second position, the movable portion 940 drives the blocking portion 910A to rotate, so the blocking portion 910A presses the hitting portion 814 of the sound generating member 80 against the impact surface 155 from above to below to restrict the hitting portion 814 to move relative to the impact surface 155.

Figure 44A:
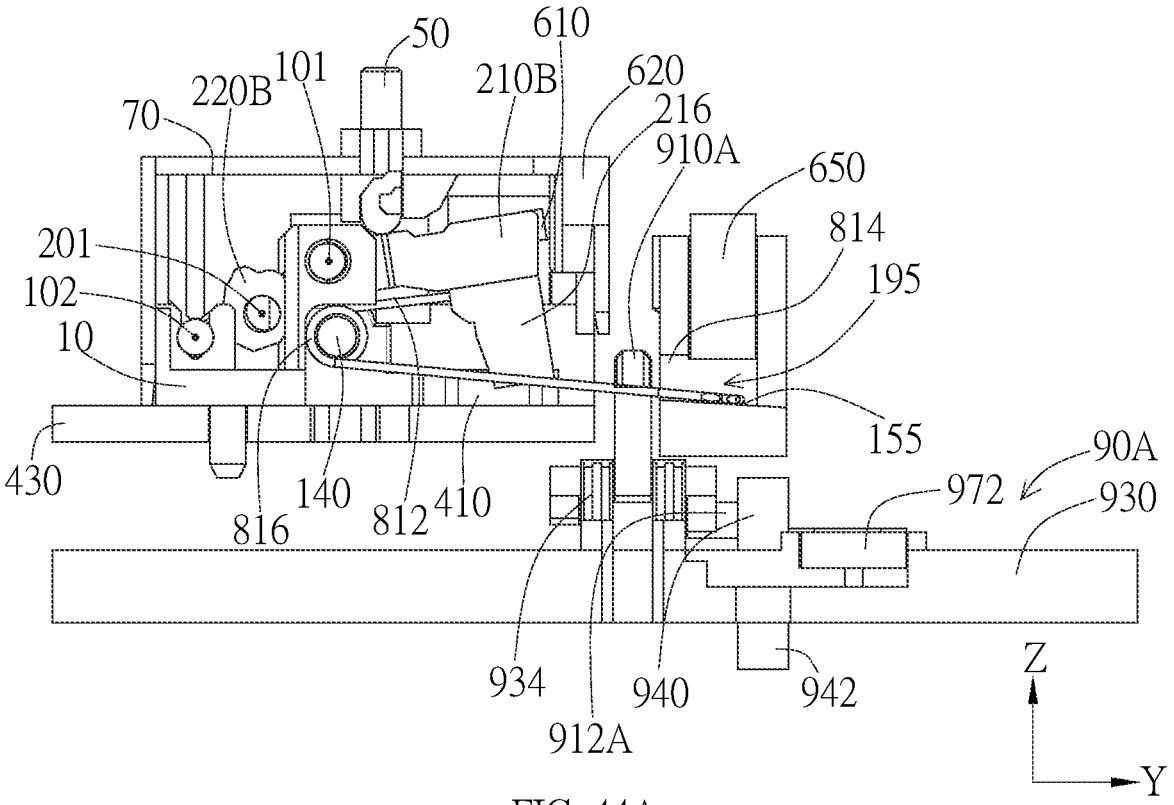
FIG. 44A and FIG. 44B are cross-sectional views showing that the key structure of FIG. 43A is in the non-pressed state and the pressed state, respectively.
Figure 44B:
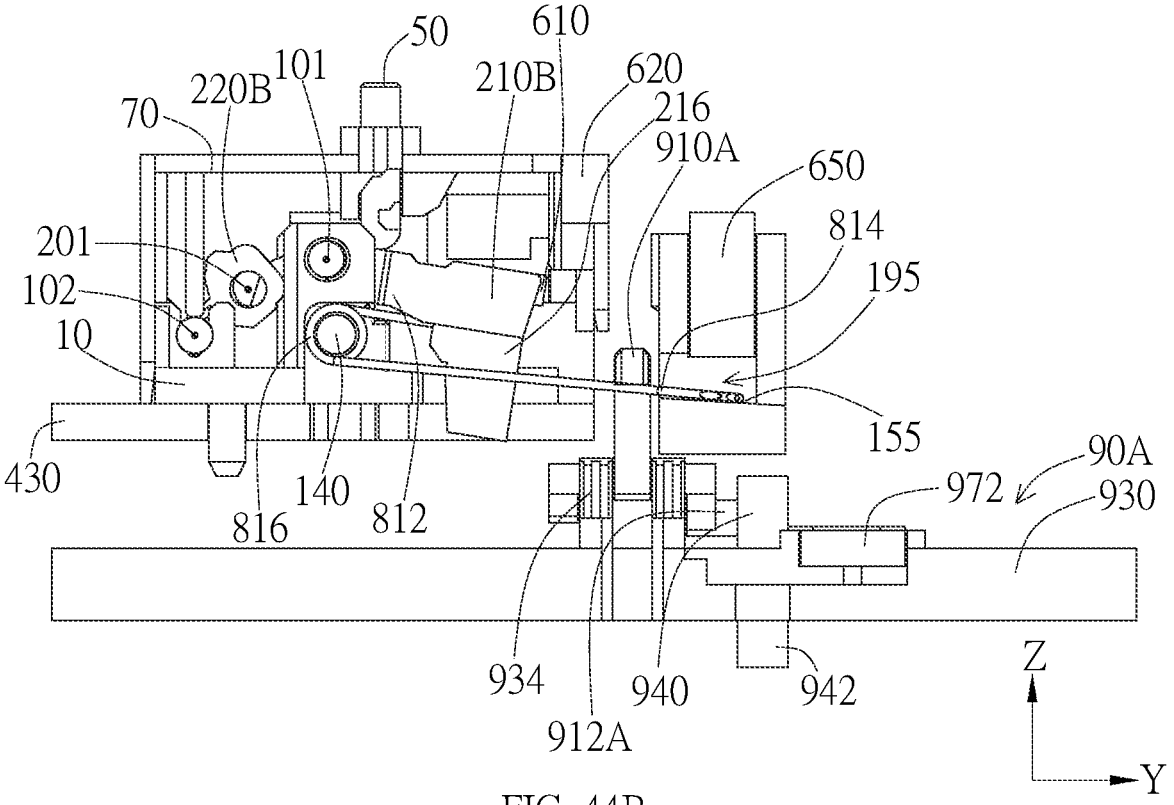

Referring to FIG. 44A to FIG. 44B, the operation of the key structure 4 when the adjusting unit 90A is at the second position will be illustrated. FIG. 44A and FIG. 44B are cross-sectional views showing that the key structure 4 is in the non-pressed state and the pressed state, respectively, when the adjusting unit 90A is at the second position. As shown in FIG. 44A, when the adjusting unit 90A is at the second position, the blocking portion 910A presses the hitting portion 814 against the impact surface 155 to restrict movement of the hitting portion 814 toward the impact surface 155. In other words, when the key structure 4 is in the non-pressed state, the hitting portion 814 is pressed by the blocking portion 910A from above to below. The hitting portion 814 is pressed by the blocking portion 910A in a manner that the hitting portion 814 of the sound generating member 80 substantially contacts the impact surface 155, so when the pressing force is not applied to the movable mechanism, the sound generating member 80 is substantially immovable relative to the base 10. In such a configuration, the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 44B, when the pressing force is applied to the first linking member 210B by the operation member 50, the first linking member 210B rotates about the first rotation axis 101 clockwise (i.e., along the first direction), and the first magnetic member 610 moves with the first linking member 210B downward to be away from the second magnetic member 620. Meanwhile, the first connecting portion of the first linking member 210B also rotates clockwise away from the base 10 (i.e., the coupling axis 201 moves upward), and the second connecting portion of the second linking member 220B moves upward, so the second linking member 220B is driven to rotate about the second rotation axis 102 counterclockwise (i.e., along the second direction). Moreover, when the movable mechanism rotates with respect to the base 10, the movable mechanism (e.g. the first linking member 210B) drives the contacting portion 812 to move. Because the blocking portion 910A of the adjusting unit 90A presses the hitting portion 814 against the impact surface 155, the spring body 816 and the hitting portion 814 are substantially immovable, and the contacting portion 812 is elastically deformed with respect to the spring body 816 and the hitting portion 814. That is, the hitting portion 814 cannot move to hit the impact surface 155, and no hitting sound is generated. Accordingly, when the adjusting unit 90A is at the second position, the key structure 4 can provide the silent (or soundless) operation feedback. In addition, the actuating portion 216 rotates with the first linking member 210B to a position that the light channel 150 can be shielded, so the intensity of the optical signal received by the receiver 420 from the emitter 410 is smaller (e.g. the amount of light received is less) or substantially equal to zero (i.e., the receiver 420 does not receive the optical signal), and the switch unit is triggered to generate the triggering signal.

Figure 45A:
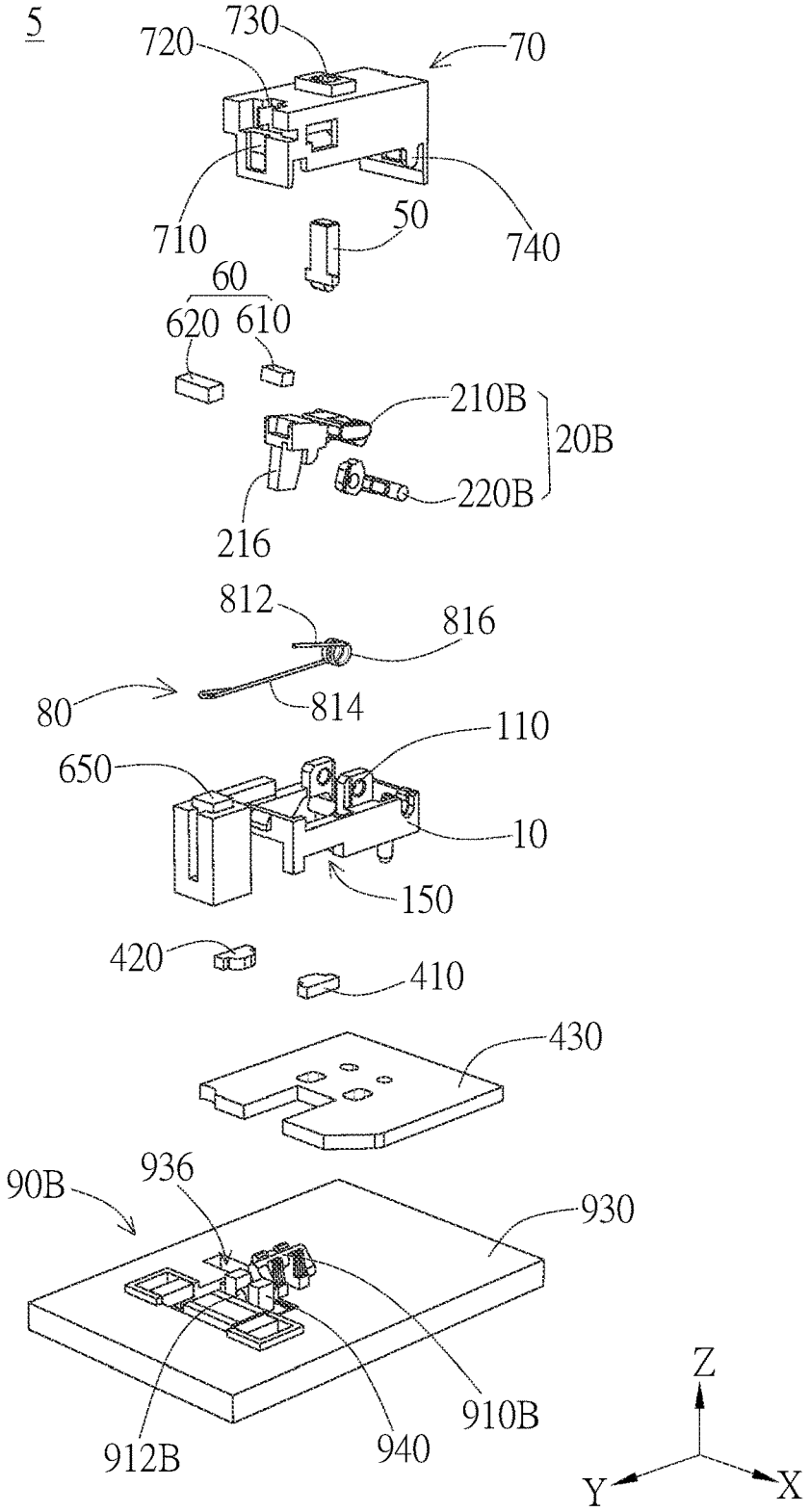
FIG. 45A to FIG. 45C are an exploded view, an assembled view, and a side view of the key structure in a twelfth embodiment of the invention, respectively, when the adjusting unit of the key structure is at the first position.
Figure 45B:
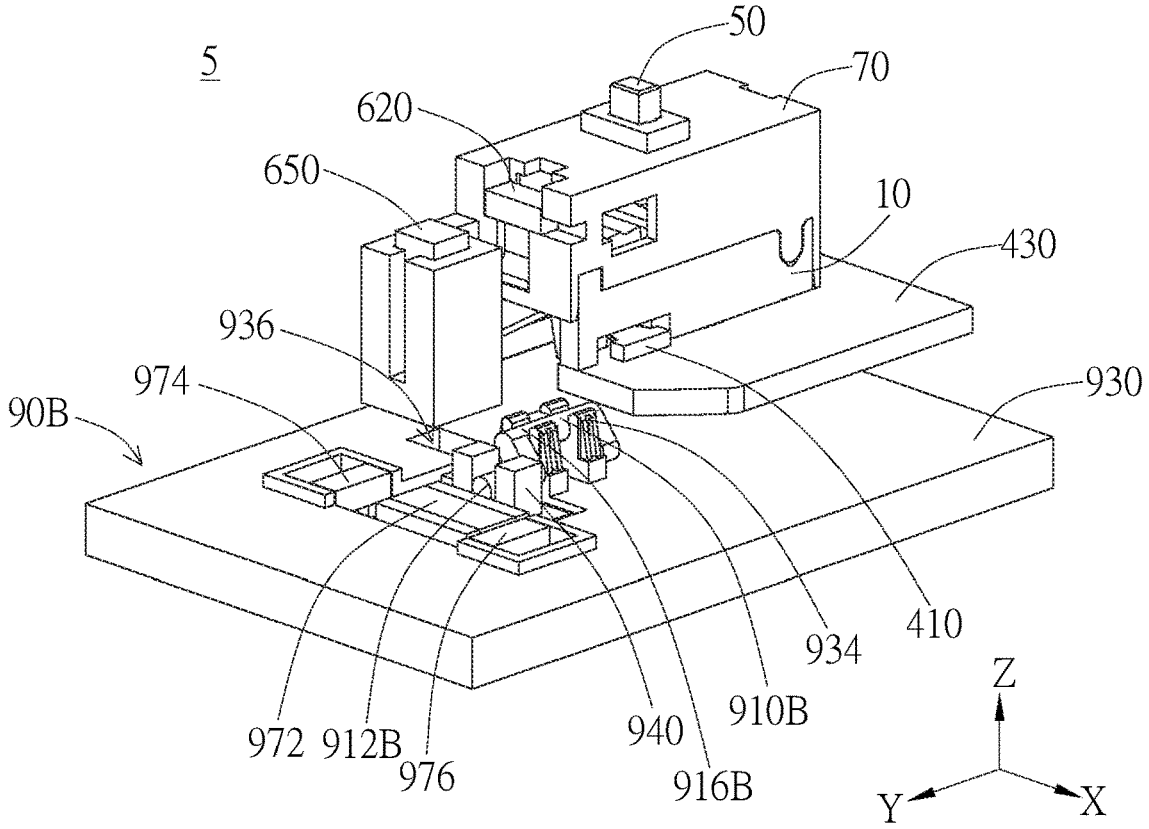
Figure 45C:
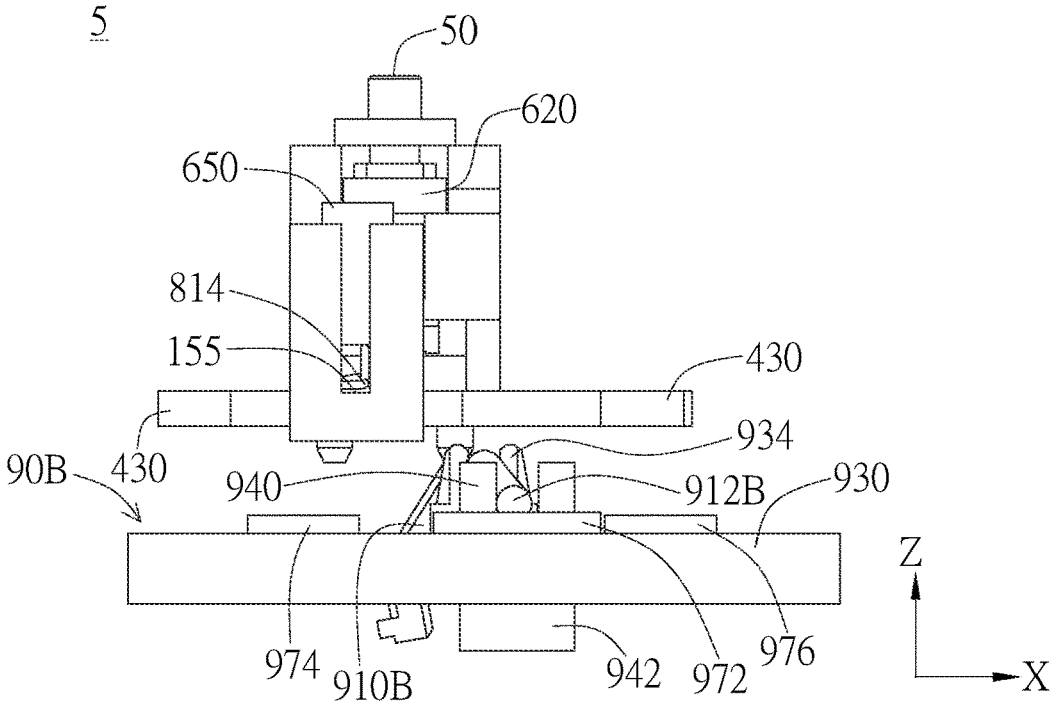
Figure 46A:
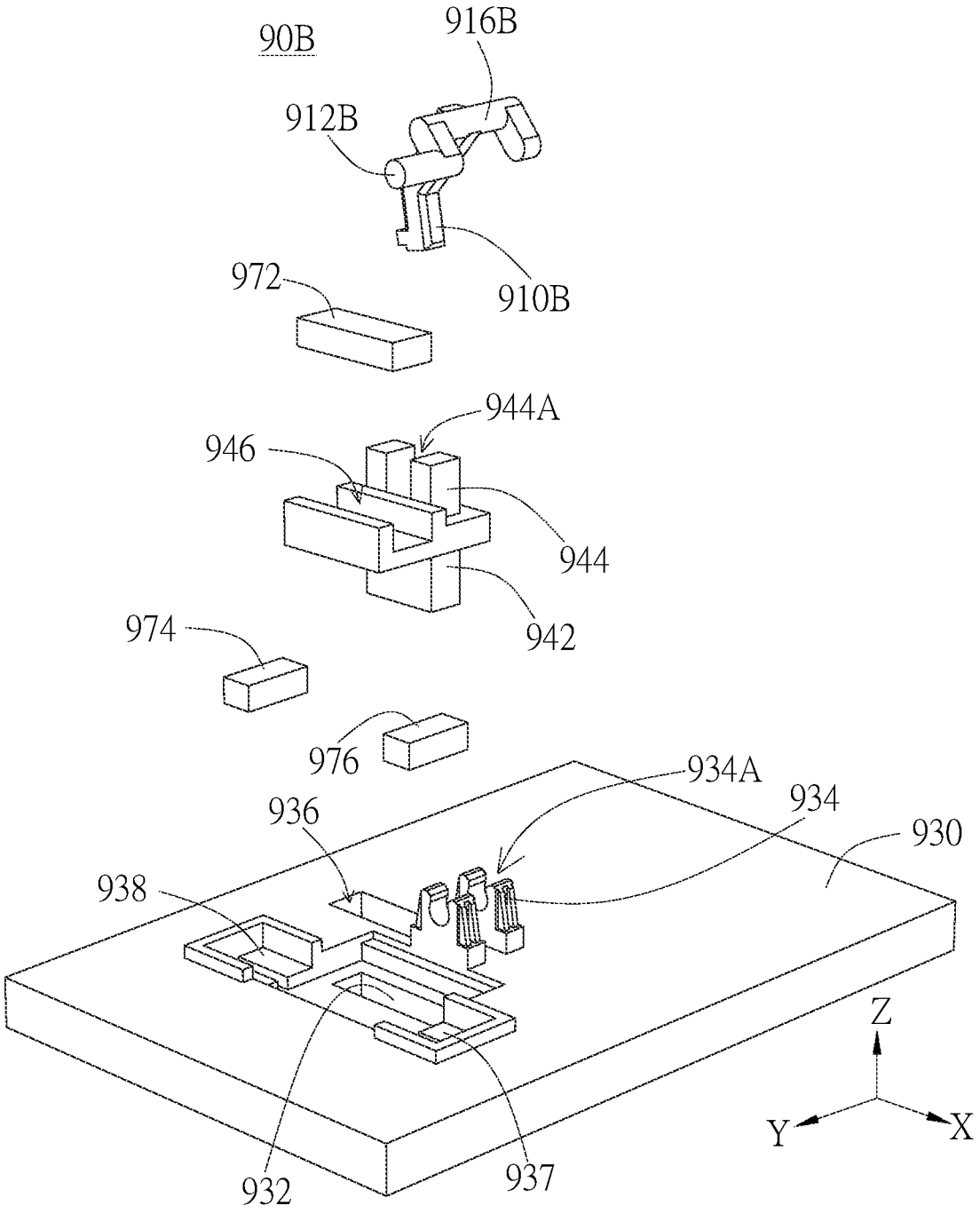
FIG. 46A to FIG. 46C are an exploded view, an assembled view, and a bottom view of the adjusting unit of the key structure of FIG. 45A, respectively.
Figure 46B:
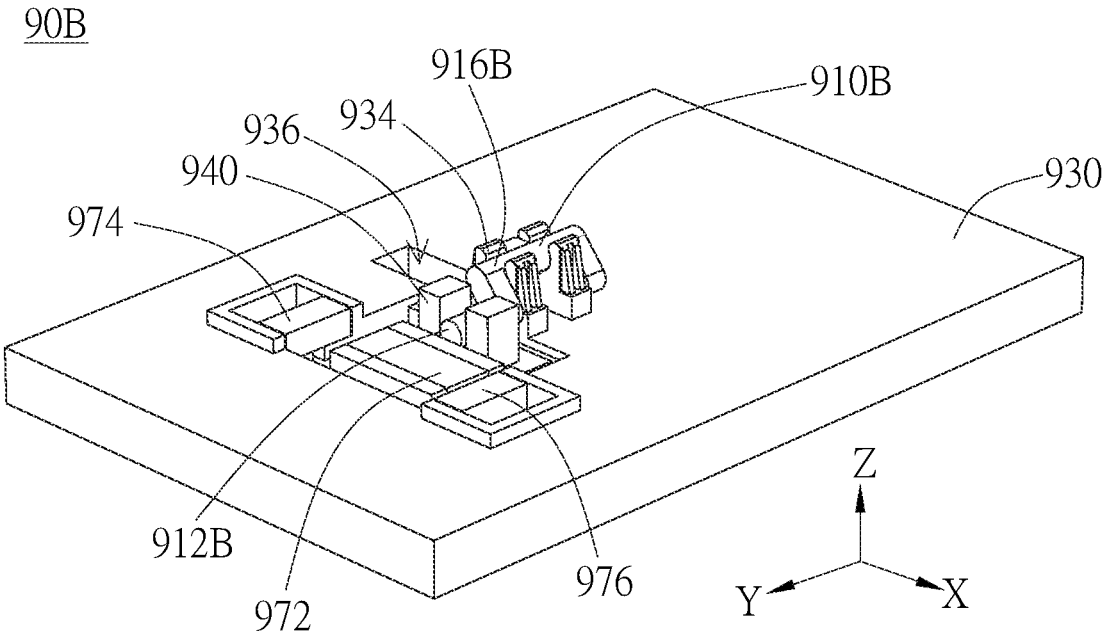
Figure 46C:
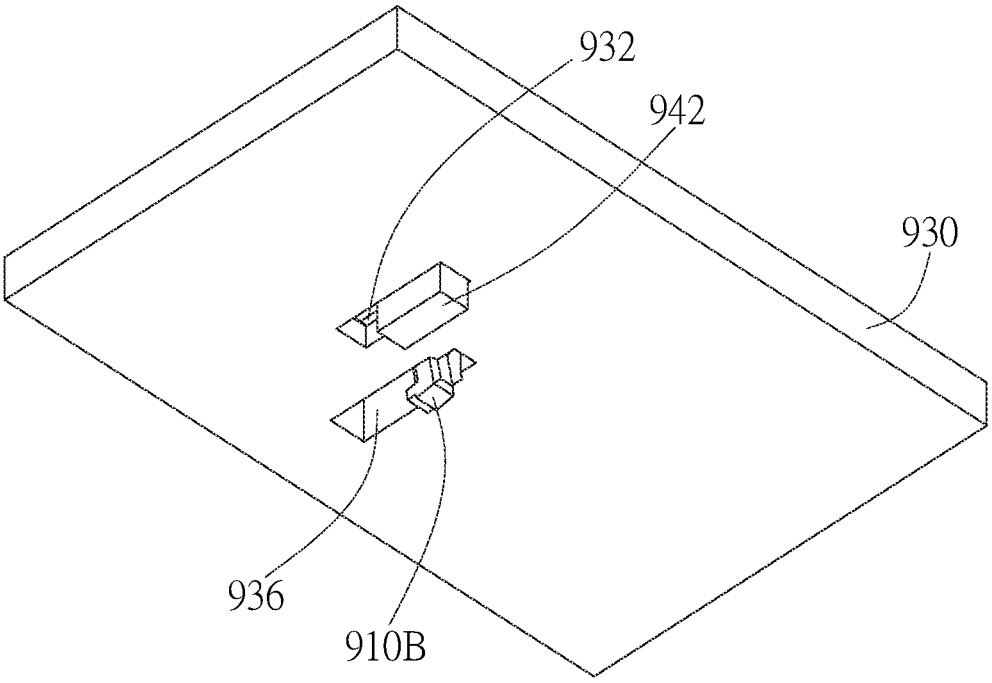

FIG. 45A to FIG. 45C are an exploded view, an assembled view, and a side view of the key structure 5 in a twelfth embodiment of the invention, respectively, when the adjusting unit 90B of the key structure 5 is at the first position. In this embodiment, the key structure 5 has a structure similar to the key structure 4 and is different in the design of the blocking portion 910B of the adjusting unit 90B and the linkage design with the movable portion 940. Thus, the detailed structure, function, and connection of components of the key structure 5 (e.g. the base 10, the movable mechanism (e.g. the linkage mechanism 20B), the sound generating member 80, the magnetic unit 60) can be referred to the related descriptions of the previous embodiments and will not elaborate again. Hereinafter, the blocking portion 910B of the key structure 5 and its linkage with the movable portion 940 will be illustrated.

As shown in FIG. 45A to FIG. 45C and FIG. 46A to FIG. 46C, the adjusting unit 90B can include a support plate 930, a movable portion 940, and a blocking portion 910B. The support plate 930 is disposed below the base 10, and the circuit board 430 can be disposed between the support plate 930 and the base 10. The movable portion 940 is supported by the support plate 930 to be movable relative to the base 10. The blocking portion 910B is rotatably positioned on the support plate 930 and couples the movable portion 940. When the movable portion 940 moves relative to the base 10, the movable portion 940 drives the blocking portion 910B to rotate, so the blocking portion 910B can or cannot interfere with the hitting portion 814. In this embodiment, the support plate 930 can further have a through hole 936, and the through hole 936 can be disposed along the moving direction of the blocking portion 910B. When the movable portion 940 moves to drive the blocking portion 910B to rotate, the blocking portion 910B can at least partially extend into the through hole 936 to increase the moving space of the blocking portion 910B. As shown in FIG. 45C, when the movable portion 940 is at the first position with respect to the base 10, the blocking portion 910B does not interfere with the hitting portion 814, and the blocking portion 910B partially extends into the through hole 936. Moreover, the movable portion magnetic member 972 is close to the support plate magnetic member 976 and away from the support plate magnetic member 974, so the movable portion 940 is positioned at the first position by the magnetic attraction force between the movable portion magnetic member 972 and the support plate magnetic member 976, and the blocking portion 910B is positioned at a position not interfering with the hitting portion 814.

Figure 47A:
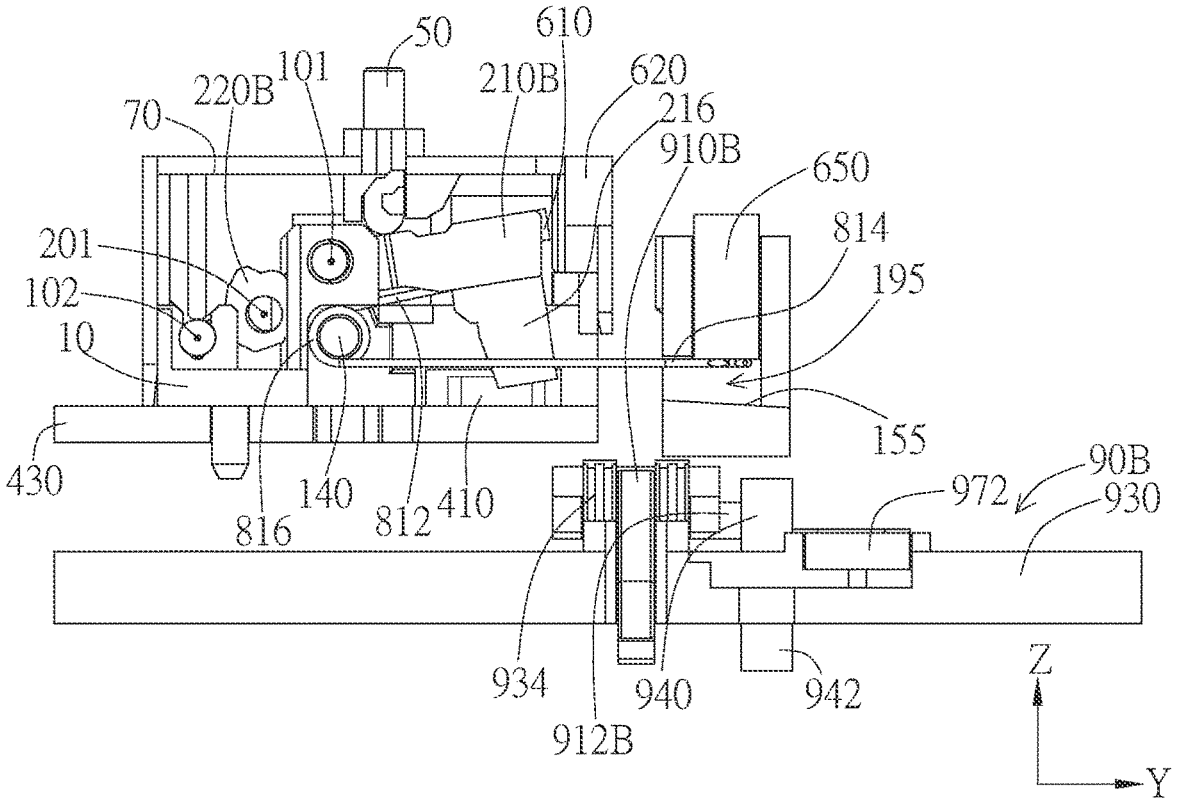
FIG. 47A and FIG. 47B are cross-sectional views showing that the key structure of FIG. 45A is in the non-pressed state and the pressed state, respectively, when the adjusting unit of the key structure is at the first position.
Figure 47B:
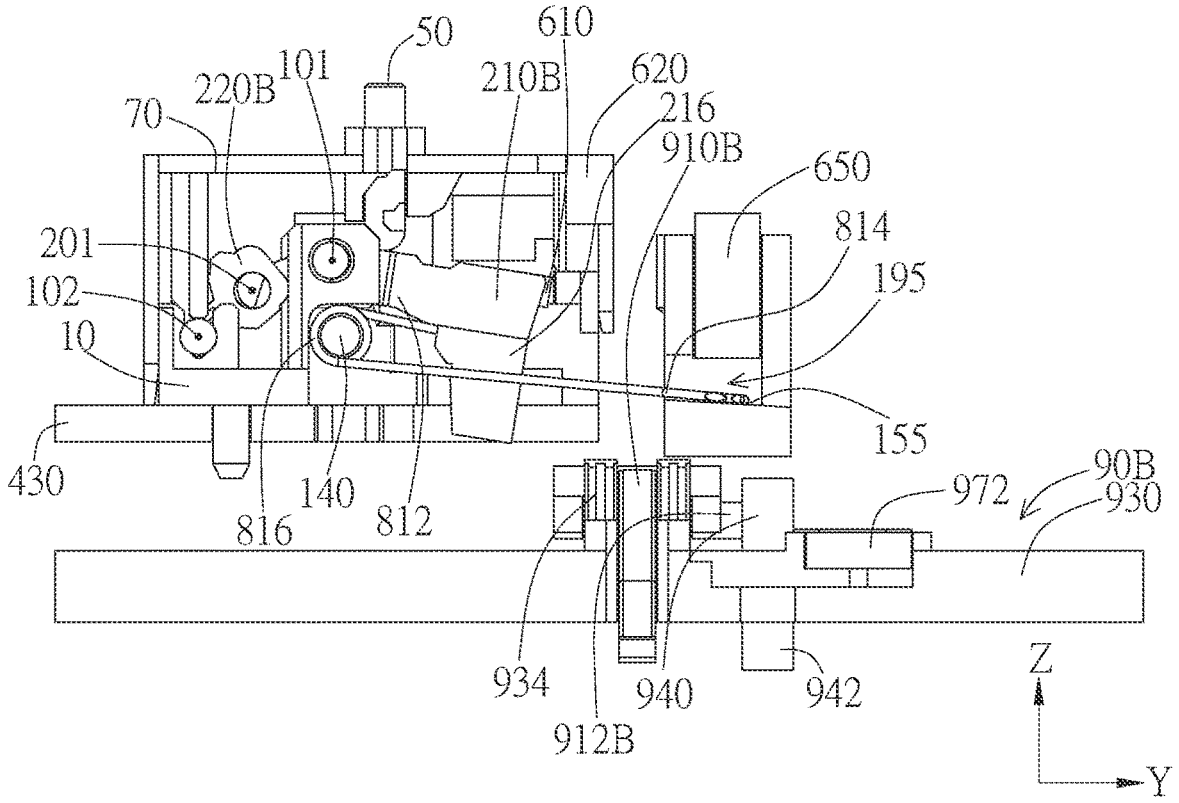

Referring to FIG. 47A and FIG. 47B, the operation of the key structure 5 when the adjusting unit 90B is at the first position will be illustrated. FIGS. 47A and 47B are cross-sectional views showing that the key structure 5 is in the non-pressed state and the pressed state, respectively, when the adjusting unit 90B of the key structure 5 is at the first position. As shown in FIG. 47A and FIG. 47B, when the adjusting unit 90B is at the first position (i.e., the blocking portion 910B does not interfere with the hitting portion 814), and the pressing force is applied to the movable mechanism, the movable mechanism rotates with respect to the base 10 and drives the sound generating member 80 to move, so the hitting portion 814 moves toward the impact surface 155 to hit the impact surface 155 to generate the hitting sound. Specifically, when the movable portion 940 of the adjusting unit 90B is at the first position, the blocking portion 910B is located away from the hitting portion 814 of the sound generating member 80 in the X-axis direction and does not interfere with the hitting portion 814. The pressing operation of the key structure 5 in such a configuration is similar to that of the key structure 2 of FIG. 32A and FIG. 32B, so can be referred to the above related descriptions and will not elaborate again.

Figure 48A:
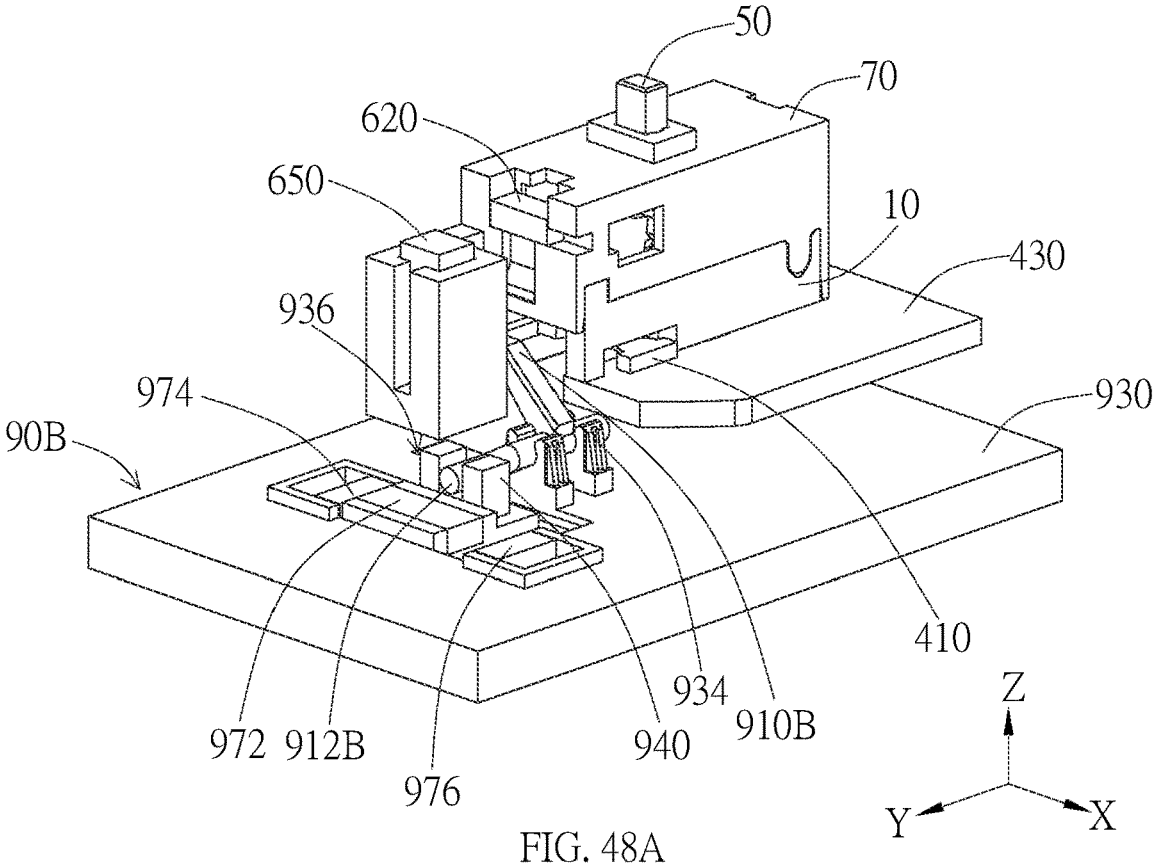
FIG. 48A and FIG. 48B are an assembled view and a side view of the key structure of FIG. 45A, respectively, when the adjusting unit of the key structure is at the second position.
Figure 48B:
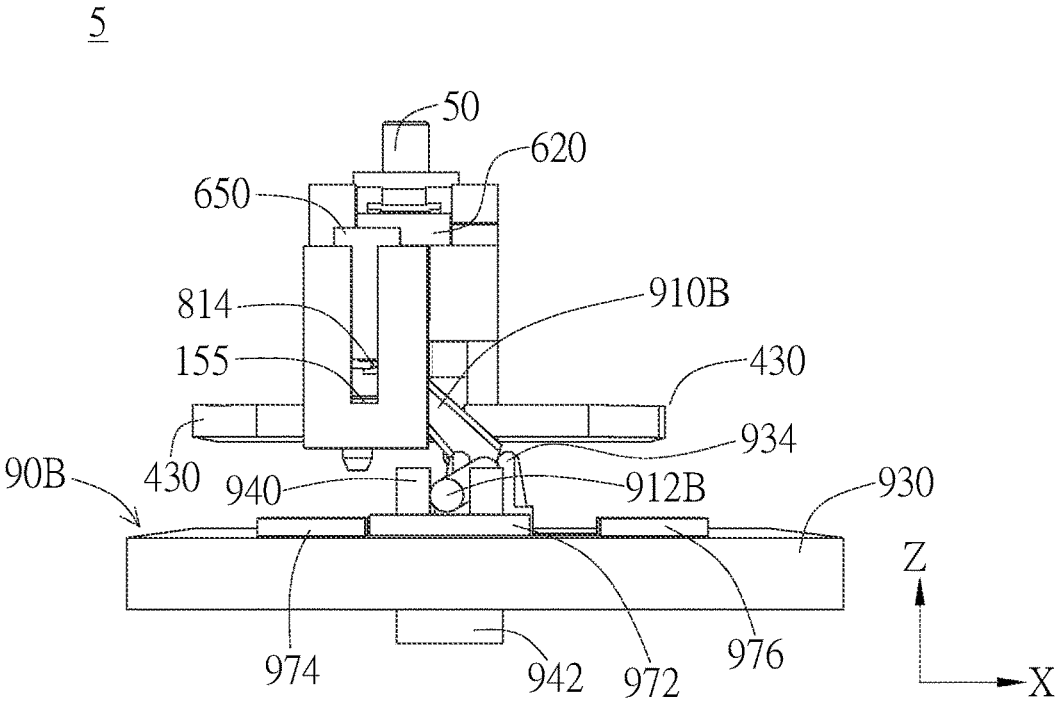
Figure 49A:
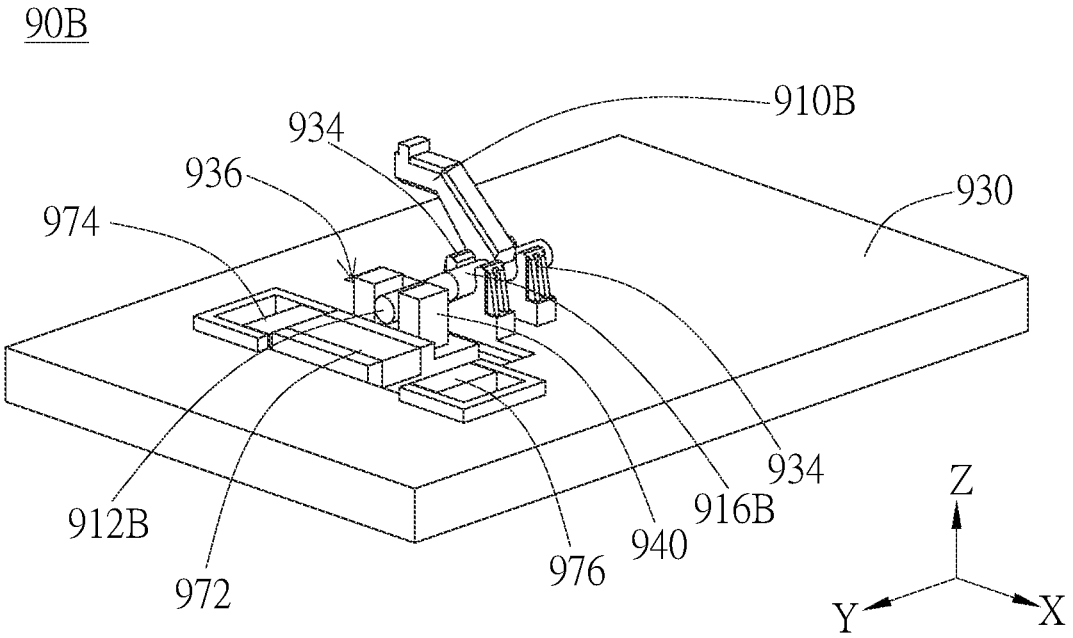
FIG. 49A and FIG. 49B are a three-dimensional view and a bottom view of the adjusting unit of FIG. 48A at the second position, respectively.
Figure 49B:
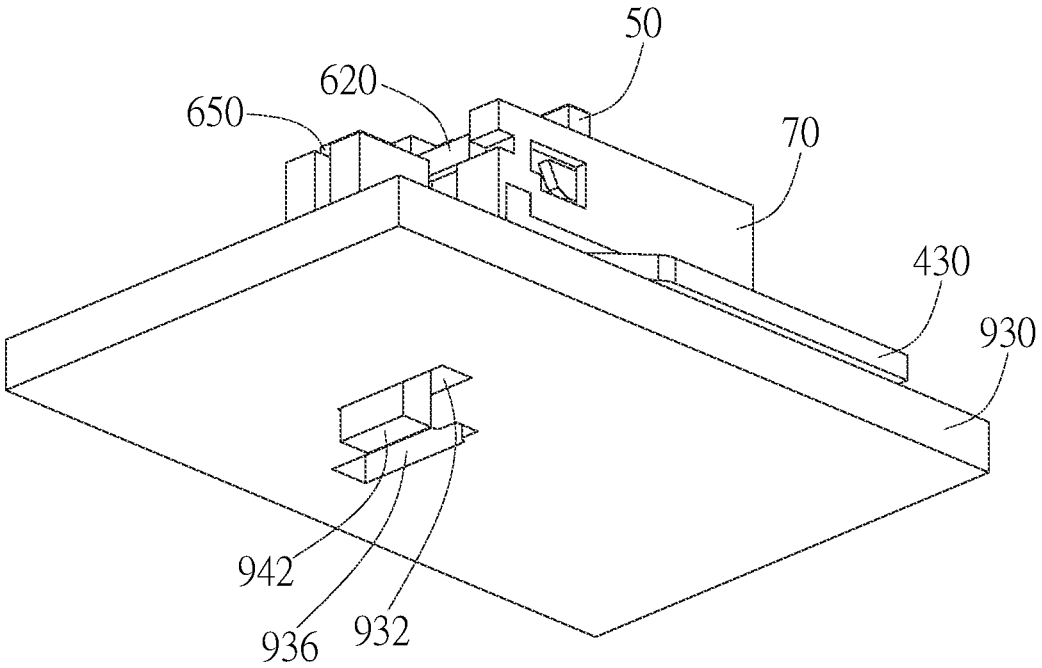

FIG. 48A and FIG. 48B are an assembled view and a side view of the key structure 5, respectively, when the adjusting unit 90B of the key structure 5 is at the second position. FIG. 49A and FIG. 49B are a three-dimensional view and a bottom view of the adjusting unit 90B at the second position, respectively. As shown in FIG. 48A, FIG. 48B, FIG. 49A, and FIG. 49B, when the movable portion 940 moves relative to the base 10 to the second position, the movable portion 940 drives the blocking portion 910B to rotate and interfere with the hitting portion 814 to restrict movement of the hitting portion 814 relative to the impact surface 155. When the movable portion 940 moves relative to the base 10 to the second position, the movable portion 940 drives the movable portion magnetic member 972 to move close to the support plate magnetic member 974 and away from the support plate magnetic member 976, so the movable portion 940 is positioned at the second position by the magnetic attraction force between the movable portion magnetic member 972 and the support plate magnetic member 974, and the blocking portion 910B is positioned at a position interfering with the hitting portion 814. Specifically, when a pulling or pushing force is applied to the positioning part 942 of the movable portion 940, the movable portion 940 moves along the positioning channel 932 (e.g. toward the lefthand side and close to the base 10) and drives the connecting part 912B of the blocking portion 910B to move to the lefthand side, so the blocking portion 910B rotates about the pivot part 916B clockwise with respect to the support plate 930 toward the hitting portion 814. Consequently, the blocking portion 910B interferes with the hitting portion 814. In this embodiment, when the movable portion 940 is at the second position, the blocking portion 910B preferably abuts below the hitting portion 814, so the hitting portion 814 cannot move relative to the impact surface 155. In other words, when the movable portion 940 of the adjusting unit 90B moves to the second position, the movable portion 940 drives the blocking portion 910B to rotate from below the support plate 930 out of the through hole 936 to above the support plate 930, so the blocking portion 910B abuts below the hitting portion 814 of the sound generating member 80 from below to above to restrict the hitting portion 814 to move relative to the impact surface 155.

Figure 50A:
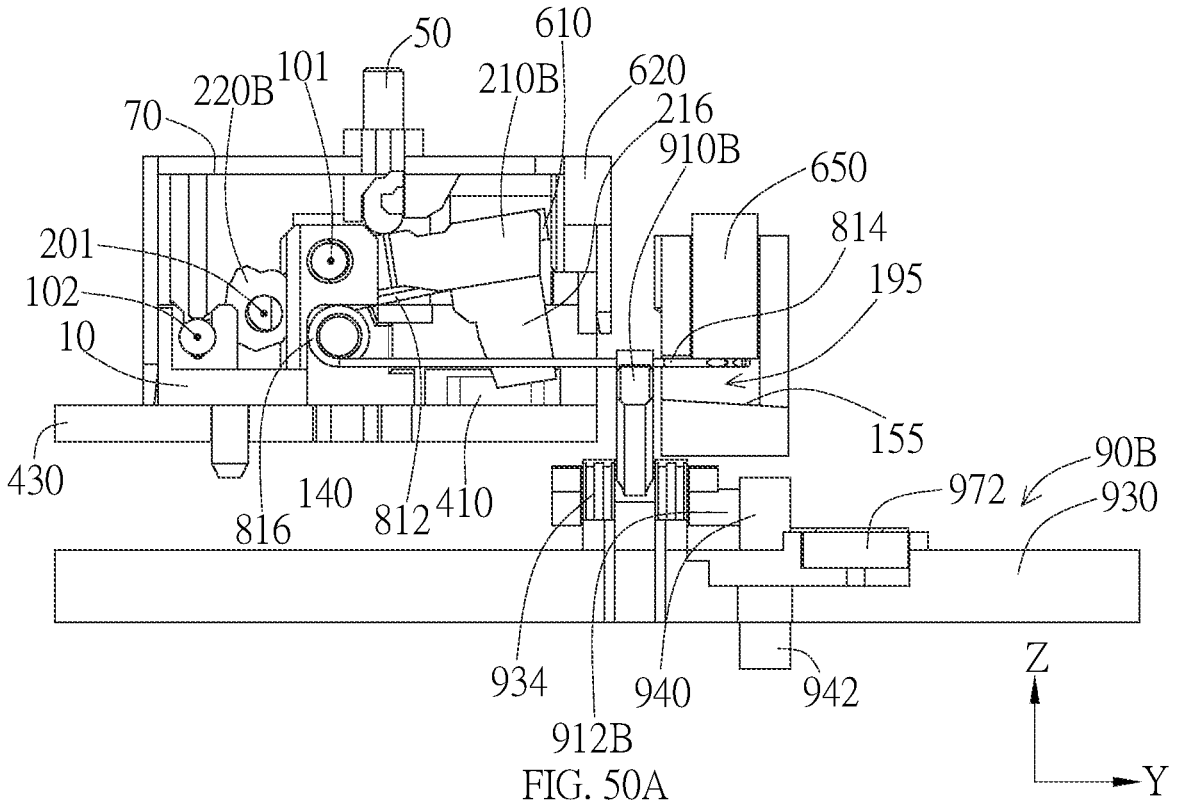
FIG. 50A and FIG. 50B are cross-sectional views showing that the key structure of FIG. 48A is in the non-pressed state and the pressed state, respectively.
Figure 50B:
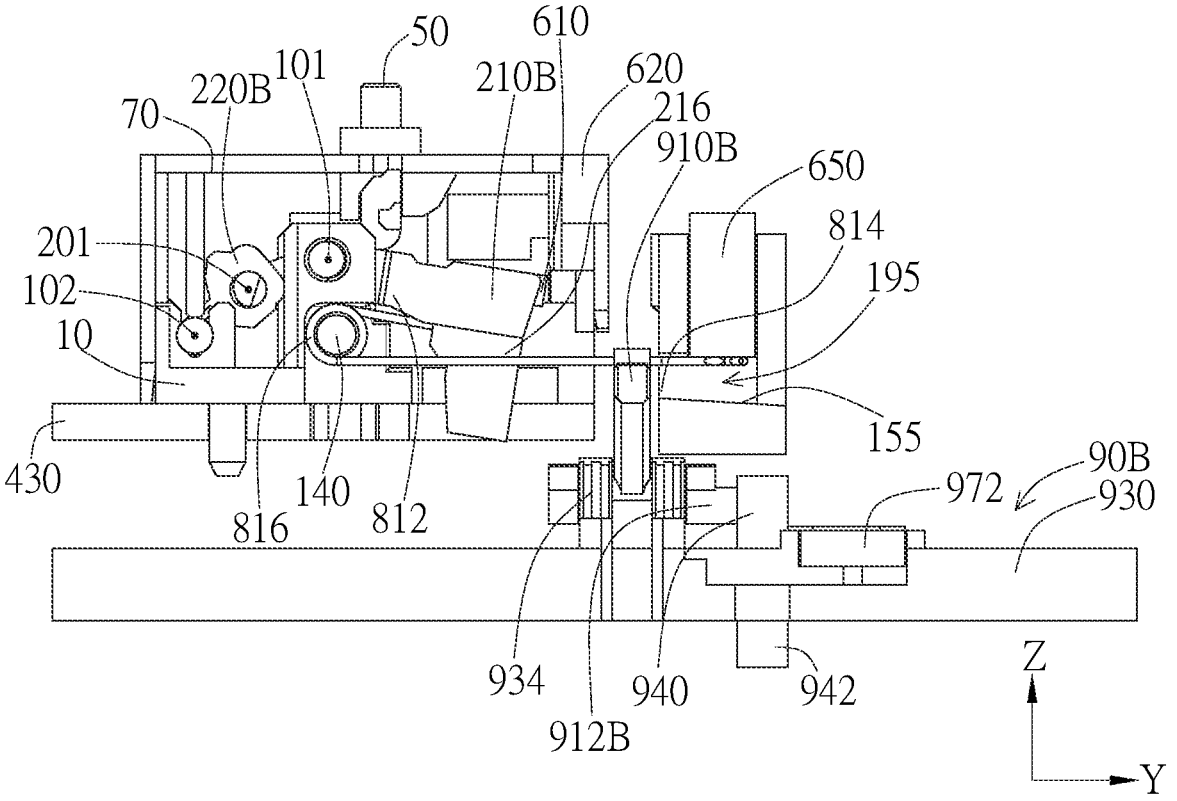

Referring to FIG. 50A and FIG. 50B, the operation of the key structure 5 when the adjusting unit 90B is at the second position will be illustrated. FIGS. 50A and 50B are cross-sectional views showing that the key structure 5 is in the non-pressed state and the pressed state, respectively, when the adjusting unit 90B of the key structure 5 is at the second position. As shown in FIG. 50A, when the adjusting unit 90B is at the second position, the blocking portion 910B abuts below the hitting portion 814 to restrict the hitting portion 814 to move downward toward the impact surface 155. In other words, when the key structure 5 is in the non-pressed state, the hitting portion 814 is blocked by the blocking portion 910B from below to above. The blocking portion 910B abuts below the hitting portion 814 in a manner that when the pressing force is not applied to the movable mechanism, the sound generating member 80 is substantially immovable relative to the base 10. In such a configuration, the actuating portion 216 of the first linking member 210B does not shield or partially shields the light channel 150, so the intensity of the optical signal received by the receiver 420 from the emitter 410 is stronger (i.e., the amount of light received is larger).

As shown in FIG. 50B, when the pressing force is applied to the first linking member 210B by the operation member 50, the first linking member 210B rotates about the first rotation axis 101 clockwise (i.e., along the first direction), and the first magnetic member 610 moves with the first linking member 210B downward to be away from the second magnetic member 620. Meanwhile, the first connecting portion of the first linking member 210B also rotates clockwise away from the base 10 (i.e., the coupling axis 201 moves upward), and the second connecting portion of the second linking member 220B moves upward, so the second linking member 220B is driven to rotate about the second rotation axis 102 counterclockwise (i.e., along the second direction). Moreover, when the movable mechanism rotates with respect to the base 10, the movable mechanism drives the contacting portion 812 to move. Because the blocking portion 910B of the adjusting unit 90B abuts below the hitting portion 814, the spring body 816 and the hitting portion 814 are substantially immovable, and the contacting portion 812 is elastically deformed with respect to the spring body 816 and the hitting portion 814. That is, the hitting portion 814 cannot move downward to hit the impact surface 155, and no hitting sound is generated. Accordingly, when the adjusting unit 90B is at the second position, the key structure 5 can provide the silent (or soundless) operation feedback. In addition, the actuating portion 216 rotates with the first linking member 210B to a position that the light channel 150 can be shielded, so the intensity of the optical signal received by the receiver 420 from the emitter 410 is smaller (e.g. the amount of light received is less) or substantially equal to zero (i.e., the receiver 420 does not receive the optical signal), and the switch unit is triggered to generate the triggering signal.

Figure 51A:
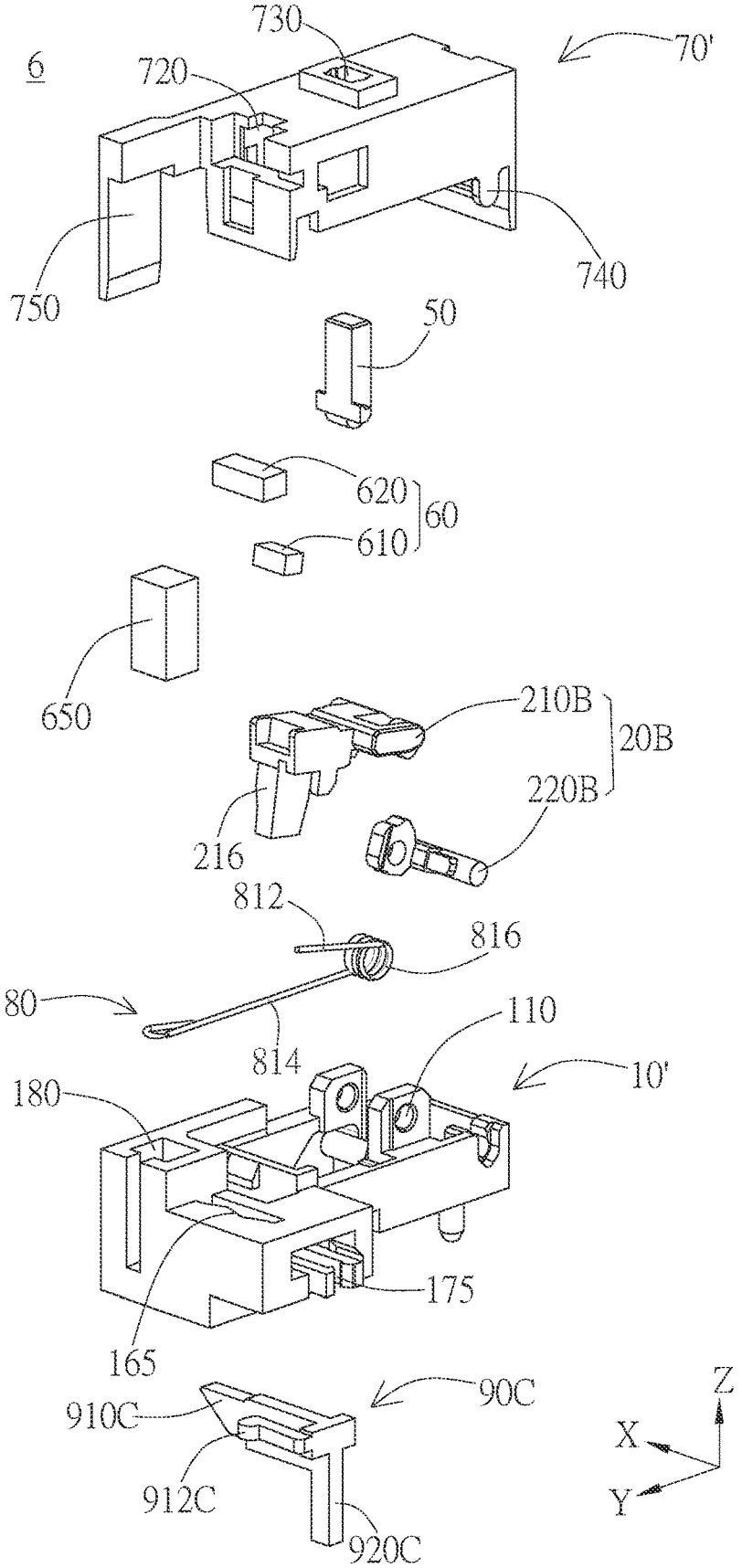
FIG. 51A to FIG. 51C are an exploded view, an assembled view, and a cross-sectional view of the key structure in a thirteenth embodiment of the invention, respectively, when the adjusting unit of the key structure is at the first position.
Figure 51B:
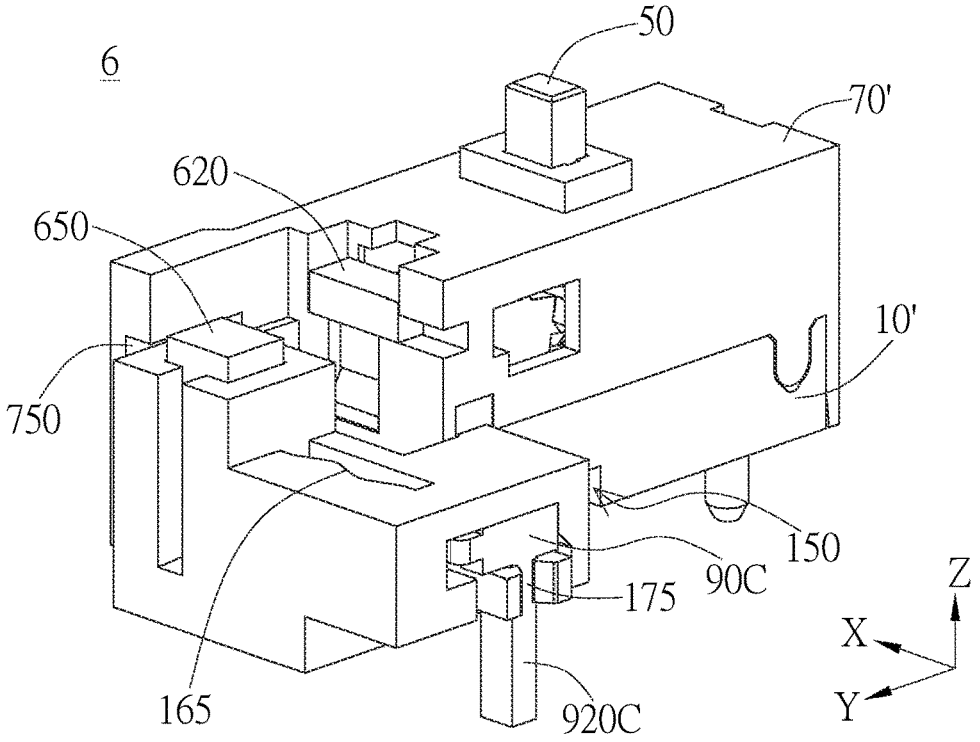
Figure 51C:
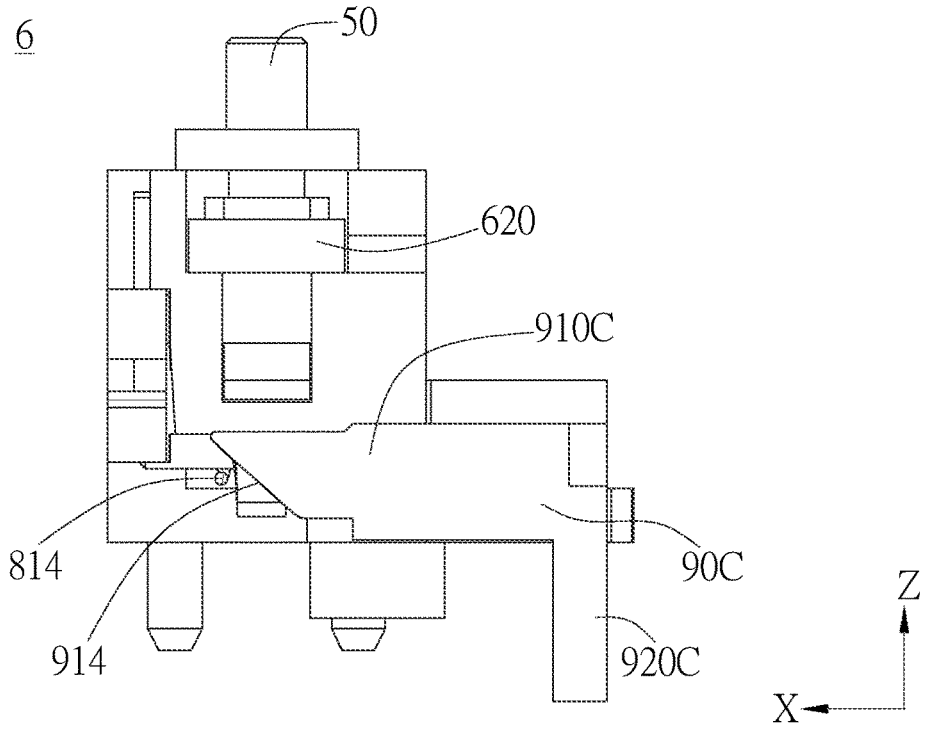

In the previous embodiments, the adjusting unit 90, 90', 90", 90A, or 90B is disposed corresponding to the base 10 (or the cover 70), but not limited thereto. In other embodiments, the adjusting unit can be designed to be movably positioned on the base or the cover to reduce the number of components and to increase the assembling efficient. FIG. 51A to FIG. 51C are an exploded view, an assembled view, and a cross-sectional view of the key structure 6 in a thirteenth embodiment of the invention, respectively, when the adjusting unit 90C of the key structure 6 is at the first position. In this embodiment, the key structure 6 has a structure similar to the key structure 2 and is different in the design of the adjusting unit 90C and the positioning design (e.g. positioned on the base 10'). Thus, the detailed structure, function, and connection of components of the key structure 6 (e.g. the base 10', the cover 70', the movable mechanism (e.g. the linkage mechanism 20B), the sound generating member 80, the magnetic unit 60) can be referred to the related descriptions of the previous embodiments and will not elaborate again. Hereinafter, the adjusting unit 90C of the key structure 6 and the modification of the base 10' corresponding to the adjusting unit 90C will be illustrated.

Figure 52A:
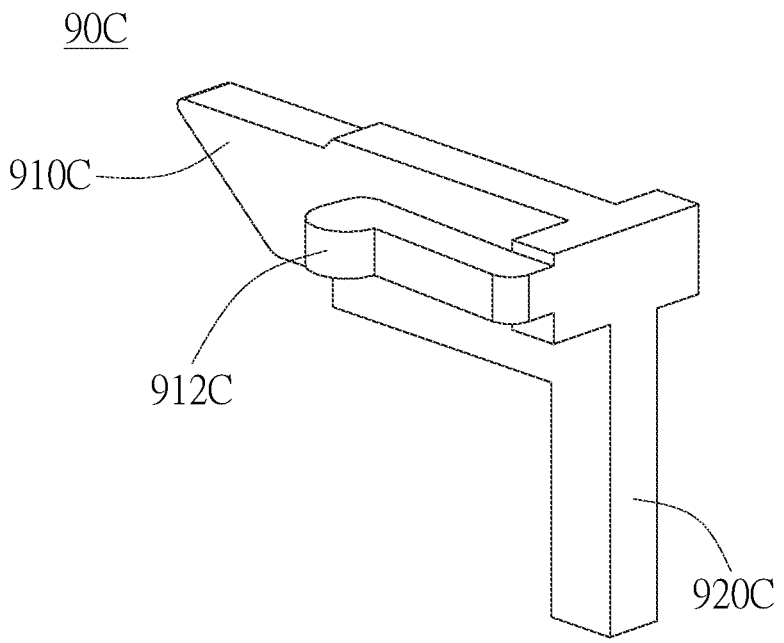
FIG. 52A and FIG. 52B are schematic views of the adjusting unit of the key structure of FIG. 51A from different viewing angles.
Figure 52B:
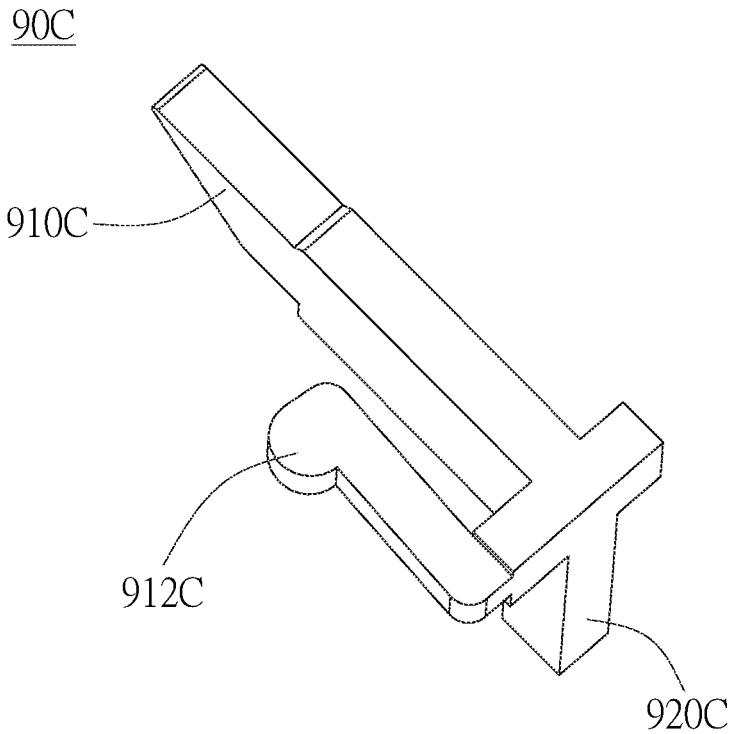

As shown in FIG. 52A and FIG. 52B, in this embodiment, the adjusting unit 90C can be formed as an integral single component and have a blocking portion 910C, a positioning portion 912C, and an operating portion 920C. The adjusting unit 90C interferes with the sound generating member 80 by means of the blocking portion 910C and is positioned at the first position or the second position by means of the positioning portion 912C. The operating portion 920C can receive a pulling force or a pushing force to be moved between the first position and the second position. Specifically, the blocking portion 910C preferably extends along the moving direction of the adjusting unit 90C (e.g. the X-axis direction). The operating portion 920C is connected to the blocking portion 910C and preferably extends along the Y-axis direction. The positioning portion 912C is disposed at the lateral side of the blocking portion 910C and is movable relative to the blocking portion 910C. For example, the blocking portion 910C, the operating portion 920C, and the positioning portion 912C are connected with each other by one end of each. As such, the free end of the blocking portion 910C is adapted to interfere with the hitting portion 814 of the sound generating member 80, and the free end of the operating portion 920C is adapted to receive the pulling for pushing force to move the adjusting unit 90C. The positioning portion 912C extends toward the same direction as the blocking portion 910C and has a gap from the blocking portion 910C, so the free end of the positioning portion 912C can elastically deform or laterally move relative to the blocking portion 910C (e.g. in the Y-axis direction). In this embodiment, the free end of the blocking portion 910C preferably inclinedly extends downward away from the hitting portion 814 to form an inclined surface. In other words, the blocking portion 910C can have a design similar to the inclined surface 914 of the blocking portion 910'. Moreover, the free end of the positioning portion 912C preferably have a rounded head (or a rounded bump) to facilitate the positioning (described later).

Referring to FIG. 51A to FIG. 51C and FIG. 53A and FIG. 53B, FIG. 53A and FIG. 53B are a top view and a bottom view the key structure 6 of FIG. 51A, respectively, when the adjusting unit 90C is at the first position. Corresponding to the adjusting unit 90C, the base 10' which constitutes a part of the housing of the key structure 6 is modified. In this embodiment, the base 10' further has a support portion 175, which is adapted to support the adjusting unit 90C. Specifically, the support portion 175 can be an extension portion of the base 10' that extends along the X-axis direction corresponding to the hitting portion 814. The support portion 175 can be formed with a tunnel for allowing the blocking portion 910C of the adjusting unit 90C to move therein, so the blocking portion 910C can move relative to the hitting portion 814 in the tunnel. The base 10' can further have a positioning channel 165, and the positioning channel 165 preferably communicates with the tunnel of the support portion 175. When the adjusting unit 90C is positioned on the base 10', the blocking portion 910C is inserted into the tunnel of the support portion 175. The operating portion 920C protrudes downward from the support portion 175, and the positioning portion 912C is located in the positioning channel 165. In this embodiment, the support portion 175 of the base 10' is illustrated as a block structure having the hollow tunnel formed therein, but not limited thereto. In other embodiments, the support portion 175 can have a platform-shaped structure, and the tunnel can be an opened channel or groove.

Figure 53A:
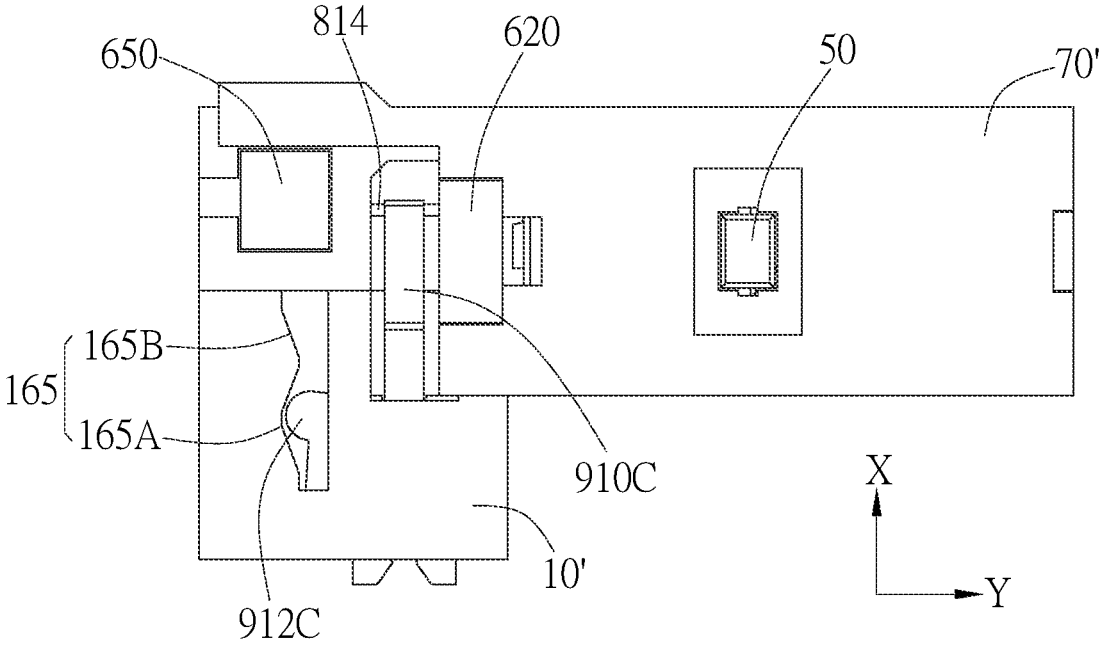
FIG. 53A and FIG. 53B are a top view and a bottom view of the key structure of FIG. 51A, respectively, when the adjusting unit at the first position.
Figure 53B:
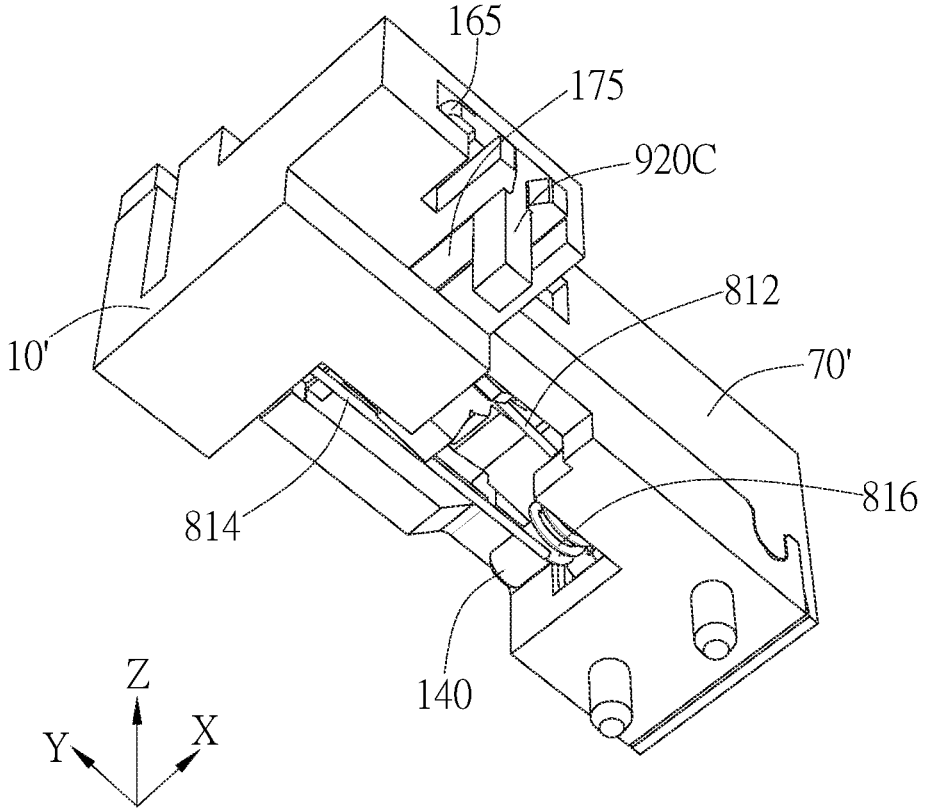

As shown in FIG. 53A, the positioning channel 165 can include a first groove portion 165A and a second groove portion 165B. The first groove portion 165A communicates with the second groove portion 165B. The location of the first groove portion 165A corresponds to the first position of the adjusting unit 90C relative to the hitting portion 814, and the location of the second groove portion 165B corresponds to the second position of the adjusting unit 90C relative to the hitting portion 814. In other words, when the positioning portion 912C of the adjusting unit 90C is positioned in the first groove portion 165A, the adjusting unit 90C is at the first position relative to the hitting portion 814 and does not interfere with the hitting portion 814. When the positioning portion 912C of the adjusting unit 90C is positioned in the second groove portion 165B, the adjusting unit 90C is at the second position relative to the hitting portion 814 and interferes with the hitting portion 814. In this embodiment, a portion of the positioning channel 165 where the first groove portion 165A and the second groove portion 165B are communicated (or the neck portion) has a smaller width to restrict movement of the positioning portion 912C between the first groove portion 165A and the second groove portion 165B. For example, the width of the first groove portion 165A and the width of the second groove portion 165B preferably correspond to the width of the rounded head of the positioning portion 912C. When no force is applied to move the adjusting unit 90C, the positioning portion 912C cannot move through the neck portion so to be positioned in the first groove portion 165A or the second groove portion 165B. When the force is applied to move the adjusting unit 90C, the rounded head of the positioning portion 912C is pressed at the neck portion, so the positioning portion 912C deforms (or shifts) toward the blocking portion 910C to pass through the neck portion to be positioned in the second groove portion 165B or the first groove portion 165A.

As shown in FIG. 51A and FIG. 51B, in order to enhance the positioning and coupling of the base 10' and the cover 70', the cover 70' can further have an extension portion 750. The extension portion 750 extends corresponding to the base 10' from one side of the cover 70'. When the cover 70' is combined with the base 10', the base 10' can abut against the extension portion 750 of the cover 70'. In this embodiment, the extension portion 750 is preferably disposed along the Y-axis direction to restrict movement of the base 10' in the X-axis direction. Moreover, the extension portion 750 may have a recess, so when the cover 70' is combined with the base 10', not only the movement of the base 10' in the X-axis direction but also the movement of the base 10' in the Z-axis direction is restricted, but not limited thereto.

Figure 54A:
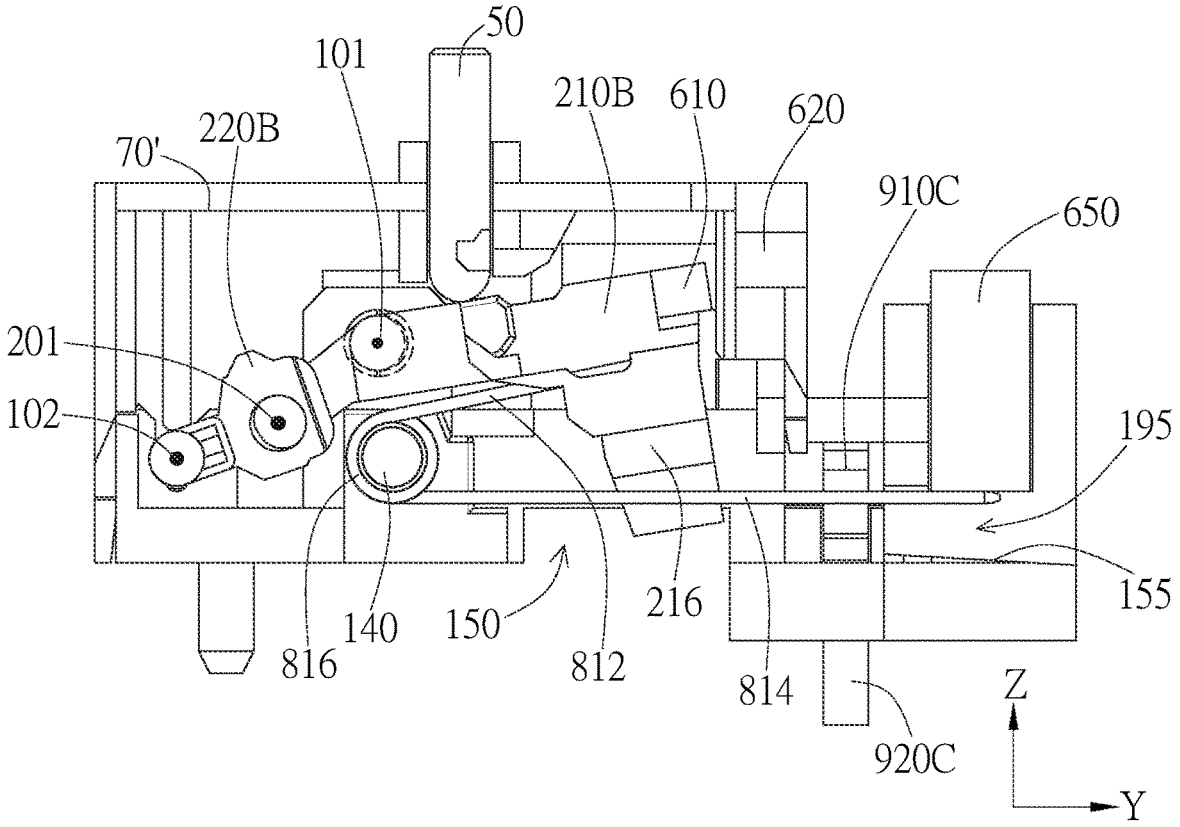
FIG. 54A and FIG. 54B are cross-sectional views showing that the key structure of FIG. 51A is in the non-pressed state and the pressed state, respectively, when the adjusting unit of the key structure is at the first position.
Figure 54B:
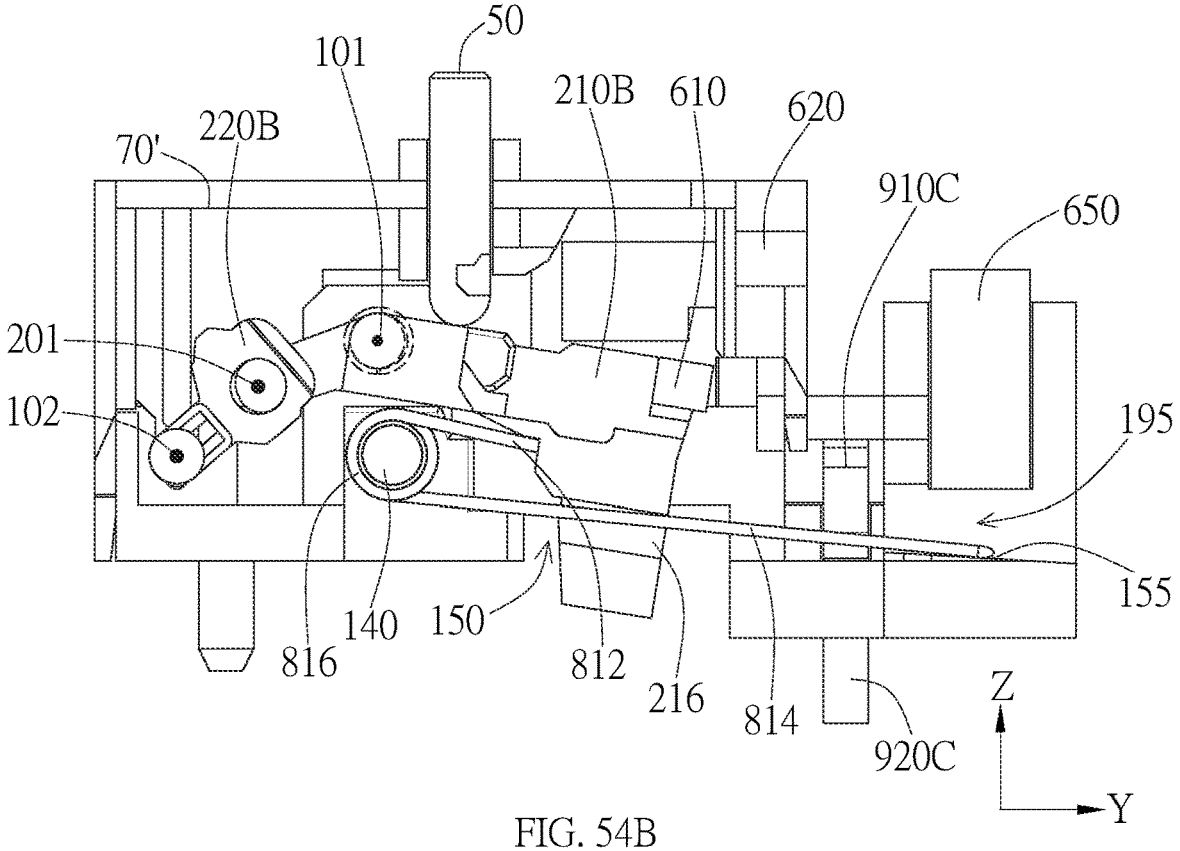
Figure 55A:
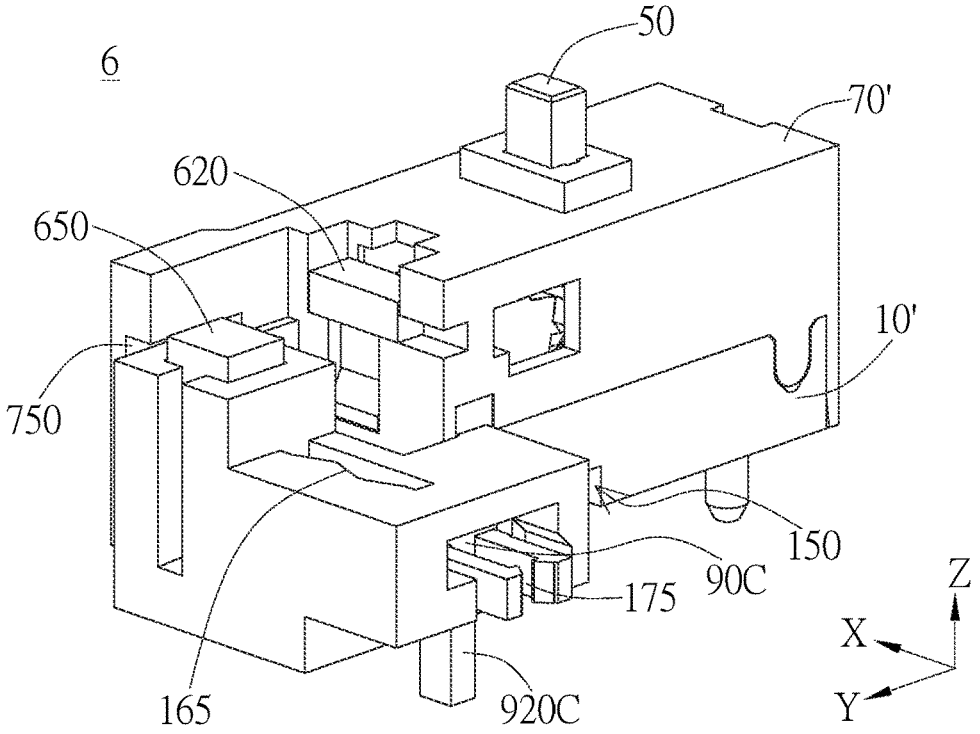
FIG. 55A to FIG. 55D are an assembled view, a cross-sectional view, a top view, and a bottom view of the key structure of FIG. 51A, respectively, when the adjusting unit of the key structure is at the second position.
Figure 55B:
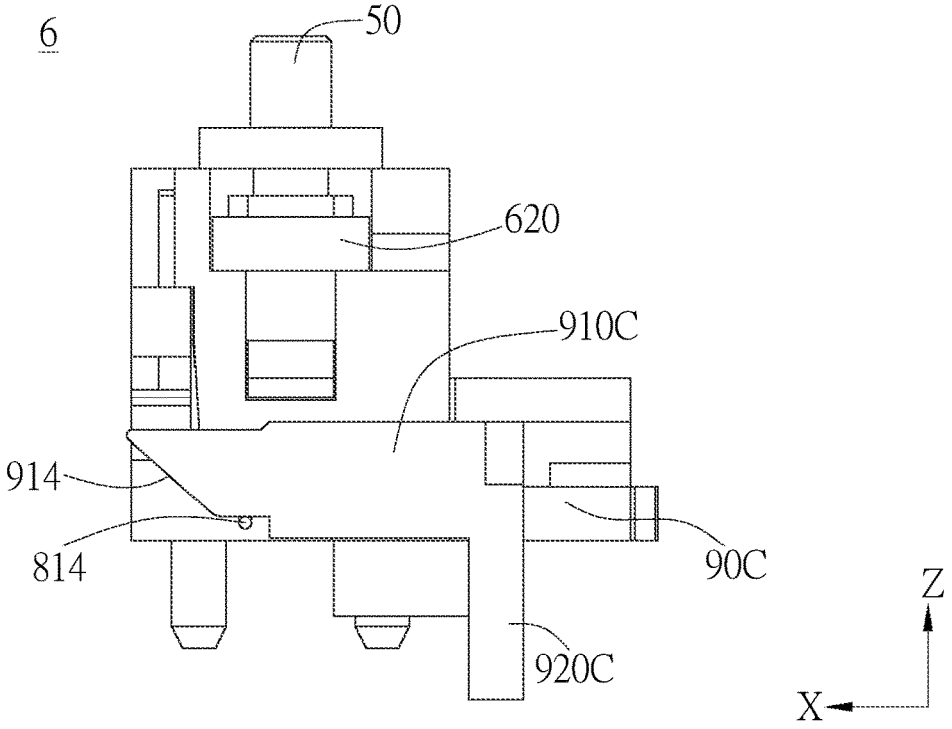
Figure 55C:
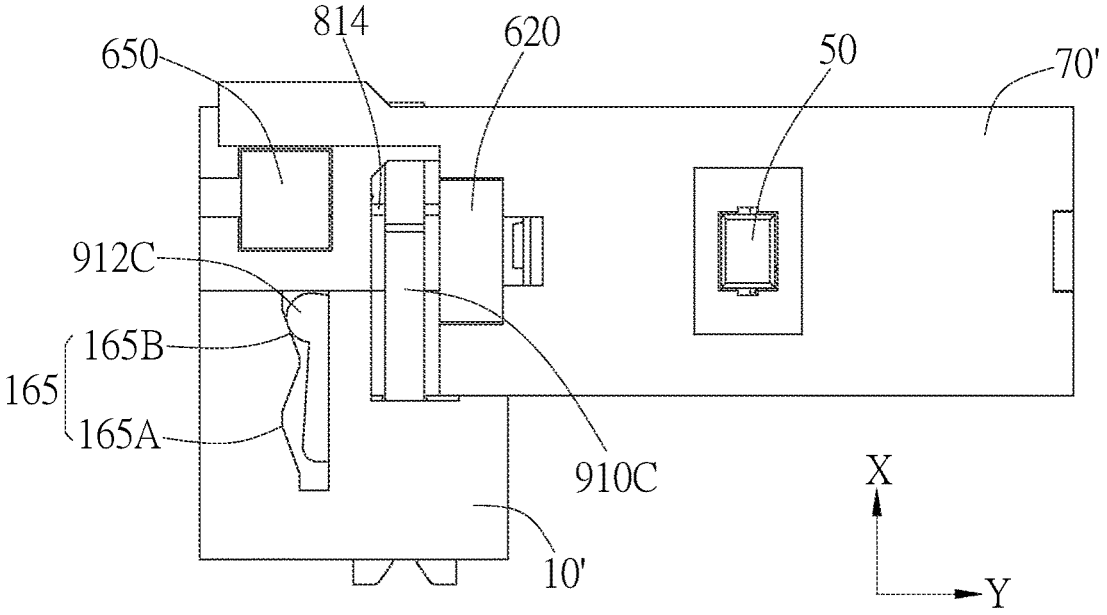
Figure 55D:
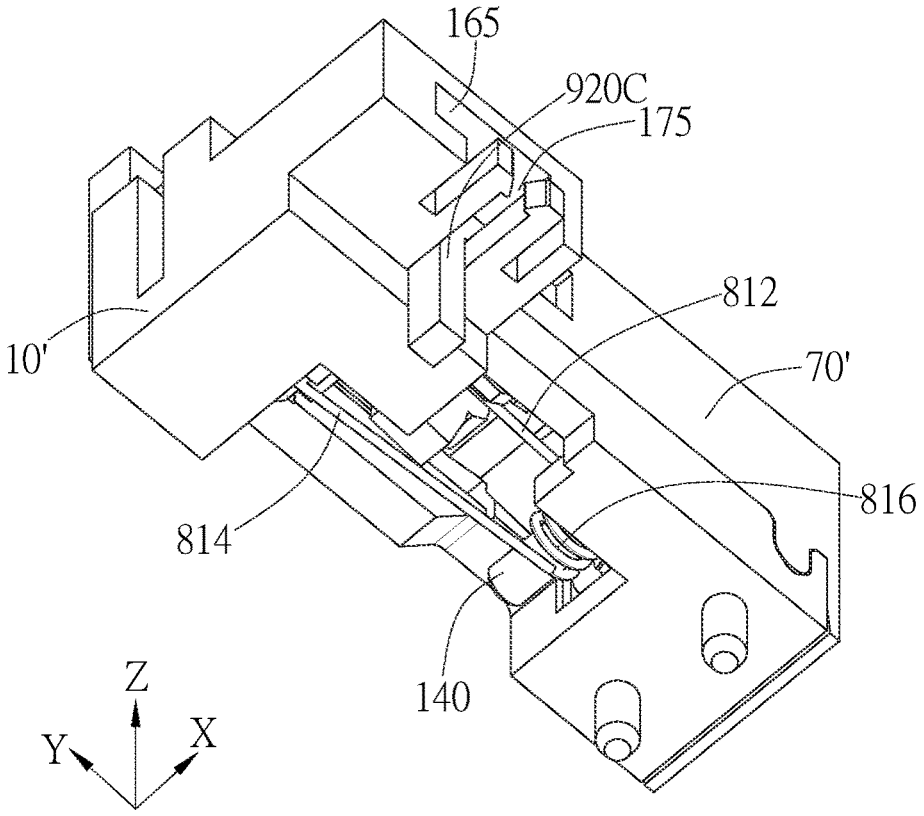

Referring to FIG. 54A and FIG. 54B, the operation of the key structure 6 when the adjusting unit 90C is at the first position will be illustrated. FIG. 54A and FIG. 54B are cross-sectional views showing that the key structure 6 is in the non-pressed state and the pressed state, respectively, when the adjusting unit 90C of the key structure 6 is at the first position. As shown in FIG. 54A and FIG. 54B, when the adjusting unit 90C is at the first position (i.e., the blocking portion 910C does not interfere with the hitting portion 814), and the pressing force is applied to the movable mechanism, the movable mechanism rotates with respect to the base 10' and drives the sound generating member 80 to move, so the hitting portion 814 moves toward the impact surface 155 to hit the impact surface 155 to generate the hitting sound. Specifically, when the positioning portion 912C of the adjusting unit 90C is positioned in the first groove portion 165A, the blocking portion 910C is located away from the hitting portion 814 of the sound generating member 80 in the X-axis direction and does not interfere with the hitting portion 814. The pressing operation of the key structure 6 in such a configuration is similar to that of the key structure 2 of FIG. 32A and FIG. 32B, so can be referred to the above related descriptions and will not elaborate again.

FIG. 55A to FIG. 55D are respectively an assembled view, a cross-sectional view, a top view, and a bottom view of the key structure 6, respectively, when the adjusting unit 90C of the key structure 6 is at the second position. As shown in FIG. 55A to FIG. 55D, when a pulling force or pushing force is applied to the operating portion 920C of the adjusting unit 90C to move the adjusting unit 90C to the second position (i.e., the adjusting unit 90C moves toward the hitting portion 814), the positioning portion 912C moves along the positioning channel 165 to be pressed by the neck portion of the positioning channel 165 and to elastically deform toward the blocking portion 910C, so as to pass through the neck portion of the positioning channel 165 to be positioned in the second groove portion 165B. Meanwhile, the blocking portion 910C also moves toward the hitting portion 814 to the second position, and the hitting portion 814 can slide along the inclined surface of the blocking portion 910C to be located below the blocking portion 910C. As such, the blocking portion 910C can press the hitting portion 814 against the impact surface 155 to restrict the movement of the hitting portion 814 relative to the impact surface 155 (as shown in FIG. 56A).

Figure 56A:
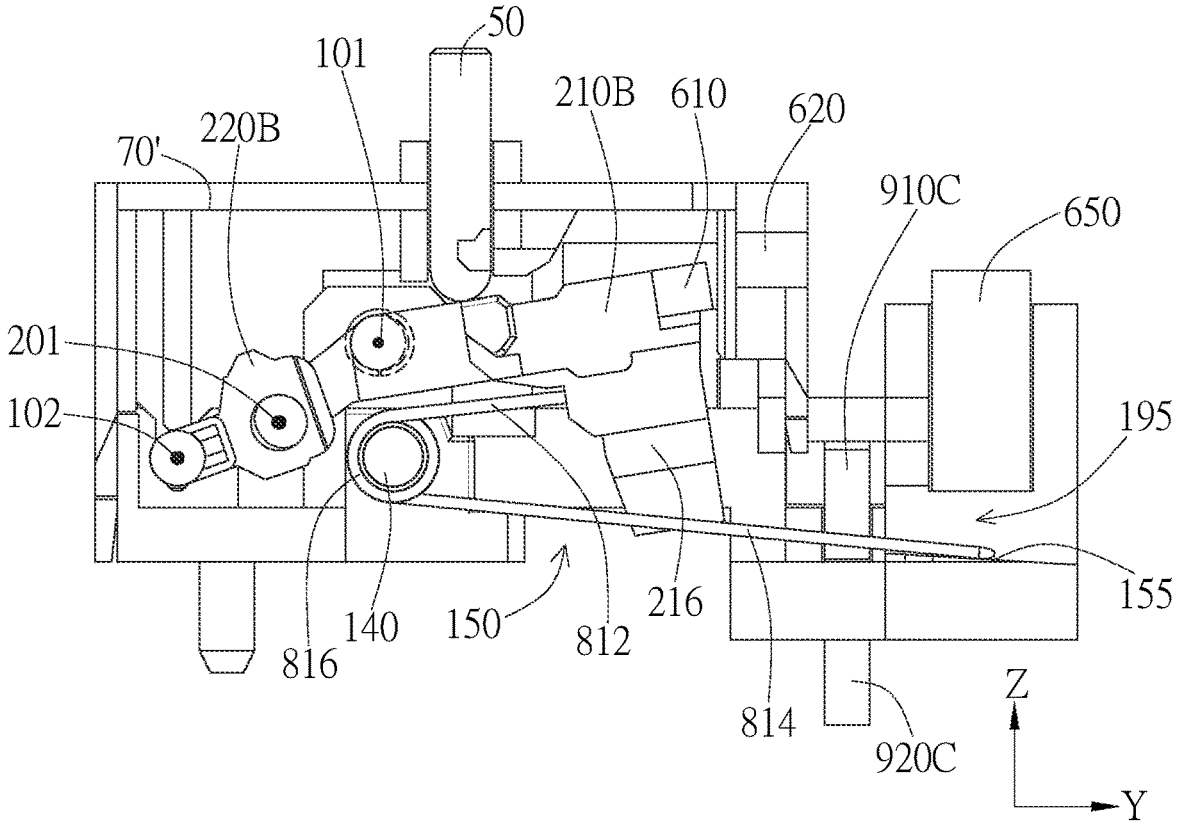
FIG. 56A and FIG. 56B are cross-sectional views showing that the key structure of FIG. 55A is in the non-pressed state and the pressed state, respectively.
Figure 56B:
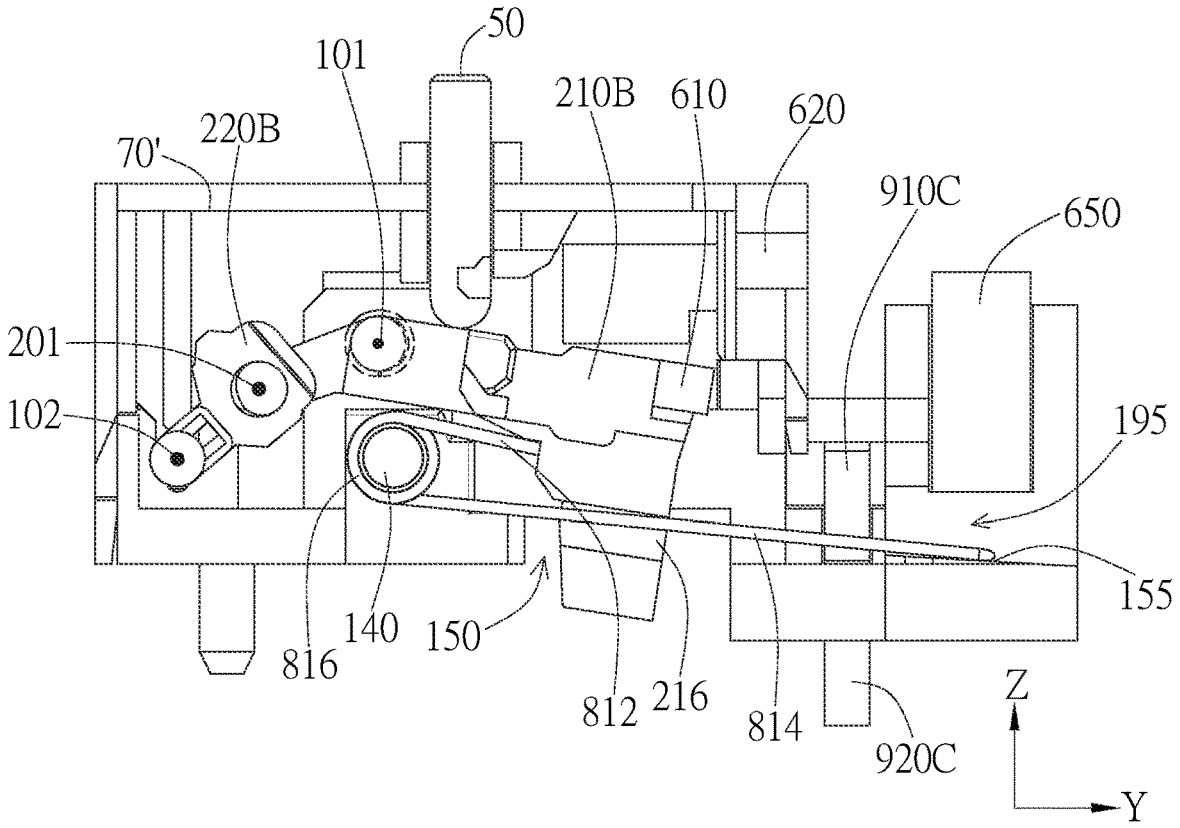

Referring to FIG. 56A and FIG. 56B, the operation of the key structure 6 when the adjusting unit 90C is at the second position will be illustrated. FIG. 56A and FIG. 56B are cross-sectional views showing that the key structure 6 is in the non-pressed state and the pressed state, respectively, when the adjusting unit 90C of the key structure 6 is at the second position. As shown in FIG. 56A, when the adjusting unit 90C is at the second position, the blocking portion 910C presses the hitting portion 814 against the impact surface 155 to restrict the movement of the hitting portion 814 toward the impact surface 155. In other words, when the key structure 6 is in the non-pressed state, the hitting portion 814 is pressed by the blocking portion 910C from above to below. The blocking portion 910C presses the hitting portion 814 in a manner that the hitting portion 814 of the sound generating member 80 substantially contacts the impact surface 155. When the pressing force is not applied to the movable mechanism, the sound generating member 80 is substantially immovable relative to the base 10'. In such a configuration, the actuating portion 216 of the first linking member 210B does not shield or partially shields the light channel 150. It is noted that although the receiver and the emitter are not shown in this embodiment, the associated operation can be referred to the related descriptions in the previous embodiments.

As shown in FIG. 56B, when the pressing force is applied to the first linking member 210B by the operation member 50, the first linking member 210B rotates about the first rotation axis 101 clockwise (i.e., along the first direction), and the first magnetic member 610 moves with the first linking member 210B downward to be away from the second magnetic member 620. Meanwhile, the first connecting portion of the first linking member 210B also rotates clockwise away from the base 10' (i.e., the coupling axis 201 moves upward), and the second connecting portion of the second linking member 220B moves upward, so the second linking member 220B is driven to rotate about the second rotation axis 102 counterclockwise (i.e., along the second direction). Moreover, when the movable mechanism rotates with respect to the base 10', the movable mechanism (e.g. the first linking member 210B) drives the contacting portion 812 to move. Because the blocking portion 910C of the adjusting unit 90C presses the hitting portion 814 against the impact surface 155, the spring body 816 and the hitting portion 814 are substantially immovable, and the contacting portion 812 is elastically deformed with respect to the spring body 816 and the hitting portion 814. That is, the hitting portion 814 cannot move to hit the impact surface 155, and no hitting sound is generated. Accordingly, when the adjusting unit 90C is at the second position, the key structure 6 can provide the silent (or soundless) operation feedback. In addition, the actuating portion 216 rotates with the first linking member 210B to a position that the light channel 150 can be shielded.

It is noted that in the above embodiment, the adjusting unit 90C is positioned on the base 10', but not limited thereto. In other embodiments, by modifying the design of the cover, the adjusting unit 90C can be positioned on the cover to reduce the number of components of the key structure and to simplify the assembling process. Moreover, in the embodiment of FIG. 51A, the blocking portion 910C of the adjusting unit 90C presses the hitting portion 814 against the impact surface 155 from above to below, but not limited thereto. In other embodiments, by modifying the blocking portion of the adjusting unit 90C to have a structure similar to the blocking portion 910" of FIG. 36A, the blocking portion of the adjusting unit 90C can abut below the hitting portion 814 from below to above to restrict the hitting portion 814 to move downward toward the impact surface 155.

Moreover, by modifying the movable frame 1200, the key structure 2, 3, 4, 5, or 6 can be applied to the input device 1000 of FIG. 25. For example, the engaging portions 1210 of the movable frame 1200 can be designed to couple the positioning portion 912 of the blocking portion 910', 910" of the adjusting unit 910', 910", to couple the positioning part 942 of the movable portion 940 of the adjusting unit 910A, 9106, or to couple the operating portion 920C of the adjusting unit 90C. As such, the movable frame 1200 can drive the adjusting units of the plurality of key structures (e.g. 2, 3, 4, 5, 6) to move, so the plurality of key structures can provide the audible operation feedback or the silent (soundless) operation feedback, not elaborate again.

Although the preferred embodiments of the invention have been described herein, the above description is merely illustrative. The preferred embodiments disclosed will not limit the scope of the invention. Further modification of the invention herein disclosed will occur to those skilled in the respective arts and all such modifications are deemed to be within the scope of the invention as defined by the appended claims.

What is claimed is:

1. A key structure, comprising:

a base;

a movable mechanism movably positioned on the base;

a sound generating member positioned on the base, the sound generating member having a hitting portion extending corresponding to an impact surface; and an adjusting unit movable relative to the base to be at a first position or a second position, wherein when the adjusting unit is at the first position, and a pressing force is applied to the movable mechanism, the movable mechanism moves relative to the base and drives the sound generating member to move, so the hitting portion moves to hit the impact surface to generate a hitting sound; when the adjusting unit is at the second position, and the pressing force is applied to the movable mechanism, the adjusting unit restricts movement of the hitting portion, so the hitting portion cannot move to hit the impact surface.

2. The key structure of claim 1, wherein the movable mechanism is a linkage mechanism comprising a plurality of linking members movably coupled with each other; at least one of the plurality of linking members is rotatably positioned on the base; when the pressing force is applied to the movable mechanism, the plurality of linking members move associated with each other to restrict a moving range of the plurality of linking members relative to the base.

3. The key structure of claim 1, wherein the sound generating member comprises a torsion spring having a spring body, a contacting portion, and the hitting portion; the spring body is positioned on the base; the contacting portion and the hitting portion extend from two opposite ends of the spring body, and the contacting portion is adapted to touch against the movable mechanism.

4. The key structure of claim 3, wherein when the adjusting unit is at the first position, and the movable mechanism moves relative to the base, the movable mechanism drives the contacting portion to move to rotate the spring body, so the hitting portion is driven to hit the impact surface.

5. The key structure of claim 3, wherein when the adjusting unit is at the second position, and the movable mechanism moves relative to the base, the movable mechanism drives the contacting portion to move, and the spring body and the hitting portion are substantially immovable.

6. The key structure of claim 1, further comprising a magnet disposed corresponding to the hitting portion, wherein when the adjusting unit is at the first position, and the pressing force is not applied to the movable mechanism, a magnetic attraction force is generated between the magnet and the hitting portion to maintain a moving space between the hitting portion and the impact surface.

7. The key structure of claim 6, wherein the impact surface is an extension surface of the base; the magnet is disposed on the base; the base has a channel located between the magnet and the extension surface to serve as the moving space; the hitting portion is allowed to move along the channel to hit the impact surface.

8. The key structure of claim 1, further comprising a magnetic unit, wherein the magnetic unit comprises a first magnetic member disposed on the movable mechanism and a second magnetic member disposed corresponding to the first magnetic member to generate a magnetic attraction force; when the pressing force is applied to the movable mechanism, the movable mechanism drives the first magnetic member away from the second magnetic member; when the pressing force is released, the magnetic attraction force enables the movable mechanism to move with the first magnetic member toward the second magnetic member to a position before the pressing force is applied.

9. The key structure of claim 1, wherein the adjusting unit comprises a blocking portion; when the adjusting unit is at the first position, the blocking portion does not interfere with the sound generating member; when the adjusting unit is at the second position, the blocking portion interferes with the sound generating member to restrict the hitting portion to move relative to the impact surface.

10. The key structure of claim 9, wherein when the adjusting unit is at the second position, the blocking portion abuts below the hitting portion to restrict the hitting portion to move relative to the impact surface.

11. The key structure of claim 9, wherein when the adjusting unit is at the second position, the blocking portion presses the hitting portion against the impact surface, so the hitting portion contacts the impact surface.

12. The key structure of claim 11, wherein the adjusting unit is movably positioned on the base to be at the first position or the second position relative to the hitting portion.

13. The key structure of claim 1, wherein the adjusting unit comprises a support plate disposed below the base, a movable portion supported by the support plate to be movable relative to the base, and a blocking portion rotatably positioned on the support plate and coupling the movable portion; when the movable portion moves relative to the base, the movable portion drives the blocking portion to rotate, so the blocking portion interferes or does not interfere with the hitting portion.

14. The key structure of claim 13, wherein when the movable portion moves relative to the base to be at the first position, the blocking portion does not interfere with the hitting portion; when the movable portion moves relative to the base to be at the second position, the movable portion drives the blocking portion to rotate and interfere with the hitting portion to restrict the hitting portion to move relative to the impact surface.

15. The key structure of claim 14, wherein when the movable portion moves relative to the base to be at the second position, the blocking portion abuts below the hitting portion to restrict the hitting portion to move relative to the impact surface.

16. The key structure of claim 14, wherein when the movable portion moves relative to the base to be at the second position, the blocking portion presses the hitting portion against the impact surface, so the hitting portion contacts the impact surface.

17. The key structure of claim 13, wherein the adjusting unit further comprises a positioning unit; the movable portion is positioned at the first position or the second position by the positioning unit.

18. The key structure of claim 17, wherein the positioning unit comprises a movable portion magnetic member disposed on the movable portion and a support plate magnetic member disposed on the support plate; a magnetic attraction force is generated between the movable portion magnetic member and the support plate magnetic member.

19. An input device, comprising:

a housing;

a plurality of key structures of claim 1 disposed in the housing; and a movable frame movably disposed in the housing, the movable frame having a plurality of engaging portions corresponding to the plurality of key structures, so the adjusting unit of each of the plurality of key structures engaging with a corresponding one of the plurality of engaging portions, wherein when the movable frame moves relative to the housing, the movable frame drives the adjusting unit of each of the plurality of key structures to move, so the plurality of key structures provide an audible operation feedback or a silent operation feedback.

20. The input device of claim 19, further comprising a first positioning unit and a second positioning unit, wherein the movable frame is positioned by the first positioning unit or the second positioning unit to position each of the adjusting units at the first position or the second position; each of the first positioning unit and the second positioning unit comprises a movable frame magnetic member disposed on the movable frame and a housing magnetic member disposed on the housing; a magnetic attraction force is generated between the movable frame magnetic member and the housing magnetic member.

* * * * *